US012594470B2

(12) United States Patent
Halberg et al.

(10) Patent No.: US 12,594,470 B2
(45) Date of Patent: Apr. 7, 2026

(54) IRONS WITH OPTIMIZED FACE

(71) Applicant: Taylor Made Golf Company, Inc., Carlsbad, CA (US)

(72) Inventors: Connor Mark Halberg, San Clemente, CA (US); Scott Taylor, Bonita, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 1052 days.

(21) Appl. No.: 17/566,131

(22) Filed: Dec. 30, 2021

(65) Prior Publication Data

US 2022/0118326 A1 Apr. 21, 2022

Related U.S. Application Data

(63) Continuation-in-part of application No. 17/368,520, filed on Jul. 6, 2021, now Pat. No. 11,458,374, which (Continued)

(51) Int. Cl.

| | |
|---|---|
| ***A63B 53/04*** | (2015.01) |
| ***A63B 53/00*** | (2015.01) |
| ***A63B 60/00*** | (2015.01) |
| ***A63B 60/02*** | (2015.01) |
| ***A63B 60/50*** | (2015.01) |

(Continued)

(52) U.S. Cl.

CPC ..... *A63B 53/0475* (2013.01); *A63B 53/005* (2020.08); *A63B 53/0412* (2020.08); *A63B 53/042* (2020.08); *A63B 53/0433* (2020.08); *A63B 53/0445* (2020.08); *A63B 53/0458* (2020.08); *A63B 60/002* (2020.08); *A63B 60/02* (2015.10); *A63B 60/50* (2015.10);

(Continued)

(58) Field of Classification Search

CPC ..... A63B 53/0458; A63B 53/047; A63B 53/0475; A63B 2053/0479

See application file for complete search history.

(56) References Cited

U.S. PATENT DOCUMENTS 5,344,140 A * 9/1994 Anderson ..... A63B 60/00 473/342
5,423,535 A * 6/1995 Shaw ..... A63B 60/00 473/291

(Continued)

FOREIGN PATENT DOCUMENTS

JP 5638074 B2 * 12/2014 ..... A63B 53/0466

*Primary Examiner* — Alvin A Hunter

(74) *Attorney, Agent, or Firm* — Klarquist Sparkman, LLP

(57) ABSTRACT

Iron-type golf club heads can have a high-COR face portion with an optimized face thickness profile that maximizes selected performance characteristics, such as ball speed, ball spin or ball trajectory angle, while maintaining certain required constraint properties, such as keeping stresses low for durability. Such face portions can have certain regions that are significantly stiffer than other regions of the face portion. For example, a low region of the face portion can be significantly stiffer than a high region of the face, or one quadrant of the face can be significantly stiffer than other quadrants of the face. Disclosed face thickness profiles can feature irregularly shaped contours that maximize the distribution of material in the face for optimal performance characteristics within defined constraints.

25 Claims, 72 Drawing Sheets

Related U.S. Application Data is a continuation-in-part of application No. 17/330,033, filed on May 25, 2021, now Pat. No. 11,413,510, which is a continuation-in-part of application No. 17/132,541, filed on Dec. 23, 2020, now Pat. No. 11,400,351, which is a continuation-in-part of application No. 16/870,714, filed on May 8, 2020, now Pat. No. 11,406,882.

(60) Provisional application No. 62/954,211, filed on Dec. 27, 2019, provisional application No. 62/846,492, filed on May 10, 2019.

(51) Int. Cl.
*A63B 60/52* (2015.01)
*A63B 60/54* (2015.01)

(52) U.S. Cl.
CPC ..... *A63B 60/52* (2015.10); *A63B 60/54* (2015.10); *A63B 2053/0479* (2013.01); *A63B 2209/02* (2013.01)

(56) References Cited

U.S. PATENT DOCUMENTS 5,423,546 A * 6/1995 Manning ..... A63B 53/04 473/331
5,472,203 A * 12/1995 Schmidt ..... A63B 53/04 473/350
5,669,824 A * 9/1997 Aizawa ..... A63B 60/00 473/291
5,830,084 A * 11/1998 Kosmatka ..... A63B 60/00 473/324
5,873,795 A * 2/1999 Wozny ..... A63B 53/04 473/346
5,971,868 A * 10/1999 Kosmatka ..... A63B 69/3635 473/324
6,045,456 A * 4/2000 Best ..... A63B 60/00 473/332
6,428,425 B1 * 8/2002 Naruo ..... A63B 60/00 473/332
6,435,981 B2 * 8/2002 Naruo ..... A63B 53/047 473/345
6,695,712 B1 * 2/2004 Iwata ..... A63B 53/047 473/345
6,899,638 B2 * 5/2005 Iwata ..... A63B 53/0466 473/349
6,997,820 B2 2/2006 Willett et al.
7,018,303 B2 * 3/2006 Yamamoto ..... A63B 60/52 473/329
7,223,179 B2 * 5/2007 Tsunoda ..... A63B 53/047 473/324
7,575,524 B2 * 8/2009 Willett ..... A63B 53/047 473/345
7,575,525 B2 * 8/2009 Matsunaga ..... A63B 53/047 473/345
7,749,102 B2 * 7/2010 Nakamura ..... A63B 53/047 473/349
8,353,785 B2 * 1/2013 Ines ..... A63B 60/00 473/342
8,512,164 B2 * 8/2013 Ines ..... B23P 15/00 473/342
8,517,863 B2 * 8/2013 Wahl ..... A63B 60/00 473/346
9,533,202 B2 * 1/2017 Blevins ..... G06F 16/51
9,597,562 B2 * 3/2017 Dipert ..... A63B 53/0475
9,975,018 B2 * 5/2018 Dipert ..... A63B 60/00
10,155,143 B2 * 12/2018 Wahl ..... A63B 53/0475
10,245,484 B2 * 4/2019 Dipert ..... A63B 60/00
10,646,757 B2 * 5/2020 Dipert ..... A63B 53/047
11,020,639 B2 * 6/2021 Golden ..... A63B 53/047
11,202,946 B2 * 12/2021 Golden ..... A63B 53/0454
11,305,165 B2 * 4/2022 Dipert ..... A63B 53/0475
11,433,284 B2 * 9/2022 Gonzalez ..... A63B 53/06
11,745,065 B2 * 9/2023 Dipert ..... A63B 53/047 473/345
12,145,038 B2 * 11/2024 Golden ..... A63B 53/047
12,220,623 B2 * 2/2025 Martens ..... A63B 53/0475
12,226,679 B2 * 2/2025 Martens ..... A63B 53/0454
2001/0051548 A1 * 12/2001 Iwata ..... A63B 53/04 473/329
2003/0176232 A1 * 9/2003 Hasebe ..... A63B 60/00 473/291
2005/0009631 A1 * 1/2005 Krumme ..... A63B 53/047 473/342
2008/0139334 A1 * 6/2008 Willett ..... A63B 53/0466 473/329
2008/0153626 A1 * 6/2008 Matsunaga ..... A63B 53/0466 473/350
2009/0264218 A1 * 10/2009 Willett ..... A63B 53/047 473/342
2010/0273570 A1 * 10/2010 Ines ..... A63B 53/047 473/349
2012/0100931 A1 * 4/2012 Wahl ..... A63B 60/00 473/345
2014/0228149 A1 * 8/2014 Cole ..... A63B 53/0466 473/332
2015/0024869 A1 * 1/2015 Kitagawa ..... A63B 53/047 473/331
2017/0080310 A1 * 3/2017 Blevins ..... A63B 53/047
2020/0129824 A1 * 4/2020 Blevins ..... G06F 16/51
2022/0118326 A1 * 4/2022 Halberg ..... A63B 60/52
2024/0416188 A1 * 12/2024 Takehara ..... A63B 60/00

* cited by examiner

IRONS WITH OPTIMIZED FACE

CROSS-REFERENCE TO RELATED APPLICATIONS

This application is a continuation-in-part of U.S. patent application Ser. No. 17/368,520 filed Jul. 6, 2021, which is a continuation-in-part of U.S. patent application Ser. No. 17/330,033, filed May 25, 2021, which is a continuation-in-part of U.S. patent application Ser. No. 17/132,541, filed Dec. 23, 2020, which claims priority to U.S. Provisional Patent Application No. 62/954,211, filed Dec. 27, 2019 and is a continuation-in-part of U.S. patent application Ser. No. 16/870,714, filed May 8, 2020, which claims the benefit of U.S. Provisional Patent Application No. 62/846,492, filed May 10, 2019, and U.S. Provisional Patent Application No. 62/954,211, filed Dec. 27, 2019, all of which are herein incorporated by reference in their entirety.

FIELD

The present disclosure relates to golf club heads. More specifically, the present disclosure relates to golf club heads for iron type golf clubs.

BACKGROUND

Iron-type golf club heads often include large cavities in their rear surfaces (i.e., "cavity-back"). Typically, the position and overall size and shape of a cavity are selected to remove mass from that portion of the club head and/or to adjust the center of gravity or other properties of the club head. Manufacturers of cavity-back golf clubs often place a badge or another insert in the cavity for decorative purposes and/or for indicating the manufacturer name, logo, trademark, or the like. The badge or insert may be used to achieve a performance benefit, such as for sound and vibration damping.

Alternatively or additionally, manufacturers of cavity-back golf clubs often place acoustic or vibration dampers in the cavity to provide sound and vibration damping. The badge, damper, and/or other insert may contribute to a "feel" of the golf club. Although the "feel" of the golf club results from a combination of various factors (e.g., club head weight, weight distribution, aerodynamics of the club head, weight and flexibility of the shaft, etc.), it has been found that a significant factor that affects the perceived "feel" of a golf club to a user is the sound and vibrations produced when the golf club head strikes a ball. For example, if a club head makes a strange or unpleasant sound at impact, or a sound that is too loud, such sounds can translate to an unpleasant "feel" in the golfer's mind. Likewise, if the club head has a high frequency vibration at impact, such vibrations can also translate to an unpleasant 'feel' in the golfer's mind.

However, stiff badges, dampers, and/or other inserts adversely impact the performance of other characteristics of the club head, such as by reducing the coefficient of restitution (COR) and characteristic time (CT) of the club head, as well as by adding weight to the golf club head and by increasing the height of the center of gravity (CG) of the club face.

SUMMARY

The present disclosure describes iron type golf club heads typically comprising a head body and a striking plate. The head body includes a heel portion, a toe portion, a topline portion, a sole portion, and a hosel configured to attach the club head to a shaft. In some embodiments, the head body defines a front opening configured to receive the striking plate at a front rim formed around a periphery of the front opening. In other embodiments, the striking plate is formed integrally (such as by casting) with the head body.

In some embodiments, the iron type golf club heads include a localized stiffened region that is located on the striking face of the golf club head. In some embodiments, the localized stiffened region has a size, shape, stiffness profile, location, position, and/or other properties that alter the launch conditions of golf balls struck by the club head. For example, in some embodiments, golf ball launch conditions are altered in a way that wholly or partially compensates for, overcomes, or prevents the occurrence of an unwanted deviation from a desired trajectory of golf ball shots struck by the golf club head.

Some disclosed club heads have a high-COR face portion with an optimized face thickness profile that maximizes selected performance characteristics, such as ball speed, ball spin or ball trajectory angle, while maintaining certain required constraint properties, such as keeping stresses low for durability. Such face portions can have certain regions that are significantly stiffer than other regions of the face portion. For example, a low region of the face portion can be significantly stiffer than a high region of the face, or one quadrant of the face can be significantly stiffer than other quadrants of the face. Disclosed face thickness profiles can feature irregularly shaped contours that maximize the distribution of material in the face for optimal performance characteristics within defined constraints.

For example, in some embodiments, the face portion has a COR area of the face portion that is from 50 $mm^2$ to 300 $mm^2$ and where locations on the ball-striking surface have a COR of at least 0.790, and a ratio of average $Et^3$ for a high-toe quadrant, a high-heel quadrant, and/or a low-heel quadrant of the face portion divided by an average $Et^3$ for a low-toe quadrant of the face portion can be between 0.15 and 0.75. In some embodiments, a ratio of average $Et^3$ for a high region of the face portion divided by an average $Et^3$ for a low region of the face portion is between 0.15 and 0.75, where the high region comprises the high-toe quadrant of the face portion combined with a high-heel quadrant of the face portion, and the low region comprises the low-toe quadrant of the face portion combined with a low-heel quadrant of the face portion.

In some embodiments, an absolute value of a thickness difference between a first point located in the low-toe quadrant of the face portion and a second point located in the high-heel quadrant can be between 0.65 mm and 2.3 mm, and a distance between the first point and the second point can be at least 1.5*Zup (e.g., where Zup is 10-20 mm).

The foregoing and other objects, features, and advantages of the disclosed technology will become more apparent from the following detailed description, which proceeds with reference to the accompanying figures.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

One or more of the present embodiments provide for a damper spanning substantially the full length of the striking face from heel-to-toe of a golf club head. In embodiments where a solid full-length damper would negatively impact performance of the golf club head, one or more cutouts and/or other relief is provided in the damper to reduce the surface area of the damper that contacts the rear surface of the striking face. By reducing the surface area that the damper contacts the rear surface of the striking face, the full length improves the sound and feel of the golf club head at impact and only minimally reduces performance of the golf club head. For example, by providing one or more cutouts and/or other relief, the damper spans most of the striking face from heel-to-toe while maintaining face flexibility, thus a characteristic time (CT) and a coefficient of restitution (COR) of the striking face may be maintained.

Club Head Structure

The following describes exemplary embodiments of golf club heads in the context of an iron-type golf club, but the principles, methods and designs described may be applicable in whole or in part to utility golf clubs (also known as hybrid golf clubs), metal-wood-type golf clubs, driver-type golf clubs, putter-type golf clubs, and other golf clubs.

Figure 1:
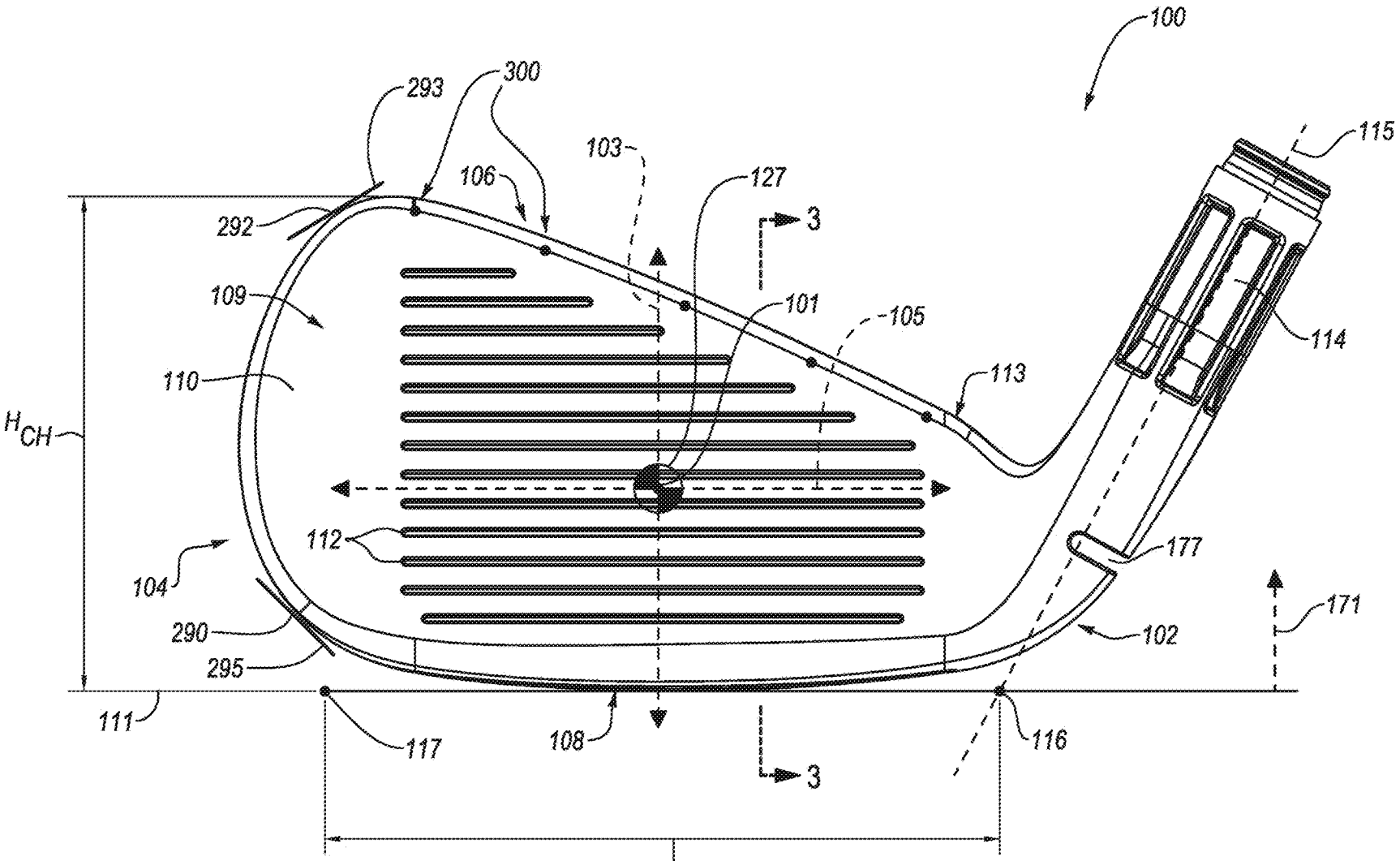
FIG. 1 is a front elevation view of a golf club head, according to one or more examples of the present disclosure.

FIG. 1 illustrates one embodiment of an iron-type golf club head 100 including a body 113 having a heel portion 102, a toe portion 104, a sole portion 108, a topline portion 106, and a hosel 114. The golf club head 100 is shown in FIG. 1 in a normal address position with the sole portion 108 resting upon a ground plane 111, which is assumed to be perfectly flat. As used herein, "normal address position" means the position of the golf club head 100 when a vector normal to a geometric center of a strike face 110 of the golf club head 100 lies substantially in a first vertical plane (i.e., a plane perpendicular to the ground plane 111), a centerline axis 115 of the hosel 114 lies substantially in a second vertical plane, and the first vertical plane and the second vertical plane substantially perpendicularly intersect. The geometric center of the strike face 110 is determined using the procedures described in the USGA "Procedure for Measuring the Flexibility of a Golf Club head," Revision 2.0, Mar. 25, 2005. The strike face 110 is the front surface of a strike plate 109 of the golf club head 100. The strike face 110 has a rear surface 131, opposite the strike face 110 (see, e.g., FIG. 3). In some embodiments, the strike plate has a thickness that is less than 2.0 mm, such as between 1.0 mm and 1.75 mm. Additionally or alternatively, the strike plate may have an average thickness less than or equal to 2 mm, such as an average thickness between 1.0 mm and 2.0 mm, such as an average thickness between 1.25 mm and 1.75 mm. In some embodiments, the strike plate has a thickness that varies. In some embodiments, the strike plate has a thinned region coinciding and surrounding the center of the face such that the center face region of the strike plate is the thinnest region of the strike plate. In other embodiments, the strike plate has a thickened region coinciding and surrounding the center of the face such that the center face region of the strike plate is the thickest region of the strike plate.

As shown in FIG. 1, a lower tangent point 290 on the outer surface of the golf club head 100, of a line 295 forming a 45° angle relative to the ground plane 111, defines a demarcation boundary between the sole portion 108 and the toe portion 104. Similarly, an upper tangent point 292 on the outer surface of the golf club head 100 of a line 293 forming a 45° angle relative to the ground plane 111 defines a demarcation boundary between the topline portion 106 and the toe portion 104. In other words, the portion of the golf club head 100 that is above and to the left (as viewed in FIG. 1) of the lower tangent point 290 and below and to the left (as viewed in FIG. 1) of the upper tangent point 292 is the toe portion 104.

The strike face 110 includes grooves 112 designed to impact and affect spin characteristics of a golf ball struck by the golf club head 100. In some embodiments, the toe portion 104 may be defined to be any portion of the golf club head 100 that is toeward of the grooves 112. In some embodiments, the body 113 and the strike plate 109 of the golf club head 100 can be a single unitary cast piece, while in other embodiments, the strike plate 109 can be formed separately and be adhesively or mechanically attached to the body 113 of the golf club head 100.

Figure 2:
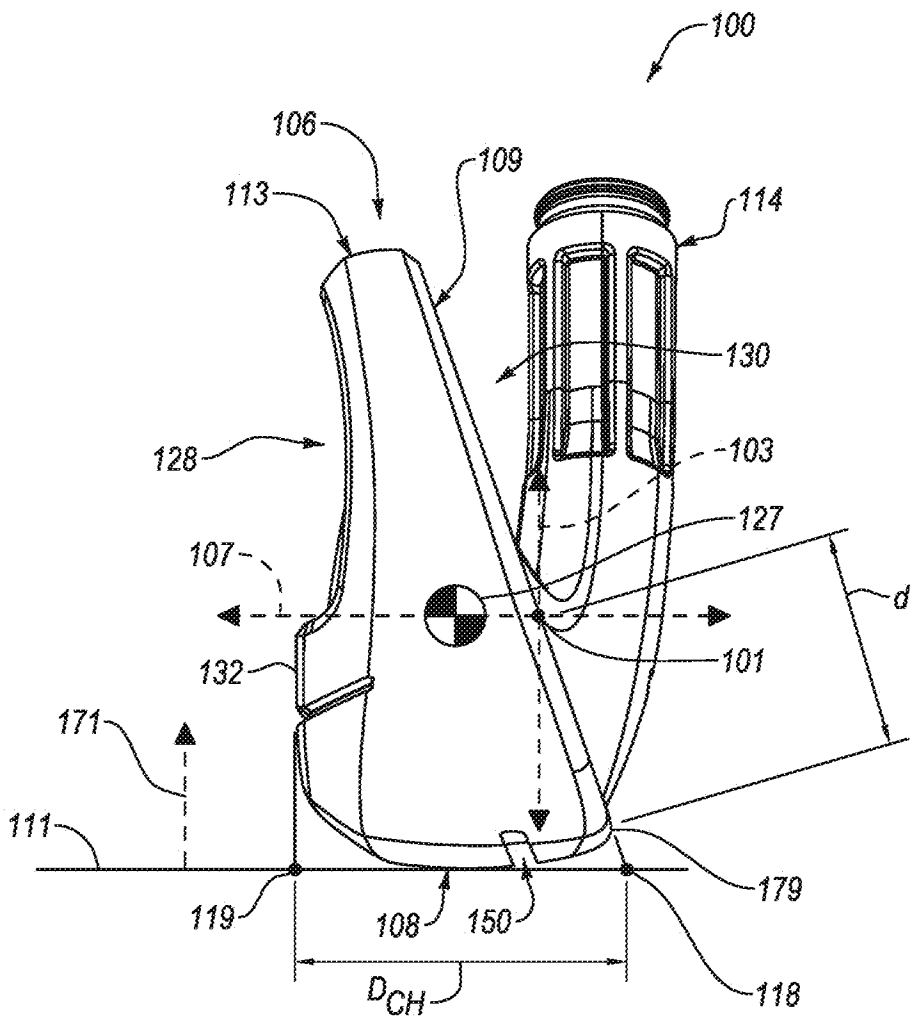
FIG. 2 is a side elevation view of the golf club head of FIG. 1, according to one or more examples of the present disclosure.

FIGS. 1 and 2 show an ideal strike location 101 on the strike face 110 and respective coordinate system with the ideal strike location 101 at the origin. As used herein, the ideal strike location 101 is located on the strike face 110 and coincides with the location of the CG 127 of the golf club head 100 along an x-axis 105 and is offset from a leading edge 179 of the golf club head 100 (defined as the midpoint of a radius connecting the sole portion 108 and the strike face 110) by a distance d, which is 16.5 mm in some implementations, along the strike face 110, as shown in FIG. 2. The x-axis 105, a y-axis 107, and a z-axis 103 intersect at the ideal strike location 101, which defines the origin of the orthogonal axes. With the golf club head 100 in the normal address position, the x-axis 105 is parallel to the ground plane 111 and is oriented perpendicular to a normal plane extending from the strike face 110 at the ideal strike location 101. The y-axis 107 is also parallel to the ground plane 11 and is perpendicular to the x-axis 105. The z-axis 103 is oriented perpendicular to the ground plane 11, and thus is perpendicular to the x-axis 105 and the y-axis 107. In addition, a z-up axis 171 can be defined as an axis perpendicular to the ground plane 111 and having an origin at the ground plane 111.

In certain embodiments, a desirable CG-y location is between about 0.25 mm to about 20 mm along the y-axis 107 toward the rear portion of the club head. Additionally, according to some embodiments, a desirable CG-z location is between about 12 mm to about 25 mm along the z-up axis 171.

Figure 3:
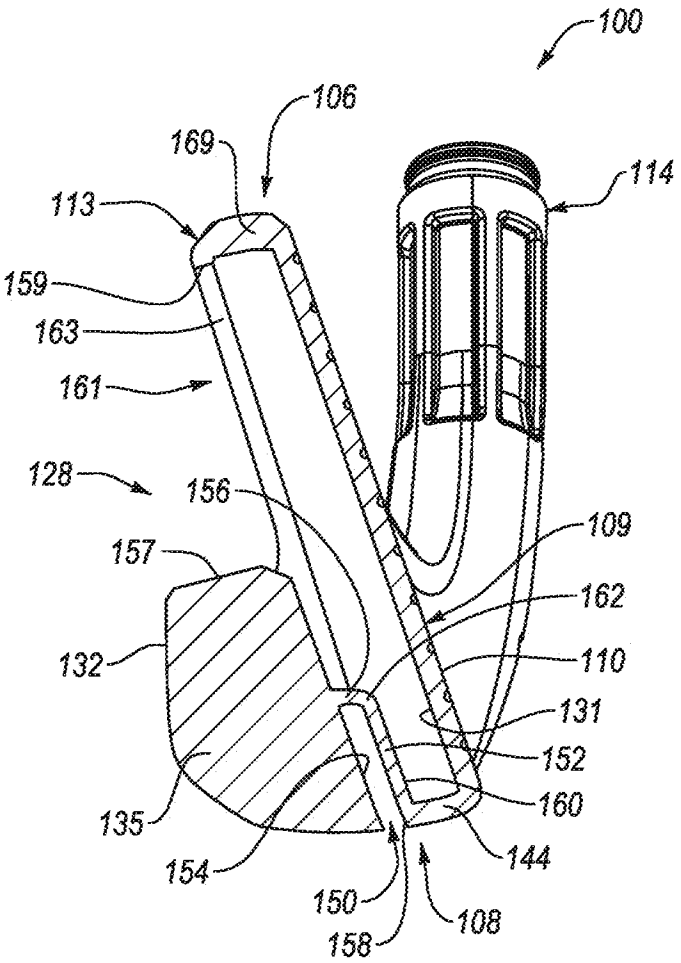
FIG. 3 is a cross-sectional side elevation view of the golf club head of FIG. 1, taken along the line 3-3 of FIG. 1, according to one or more examples of the present disclosure.
Figure 4:
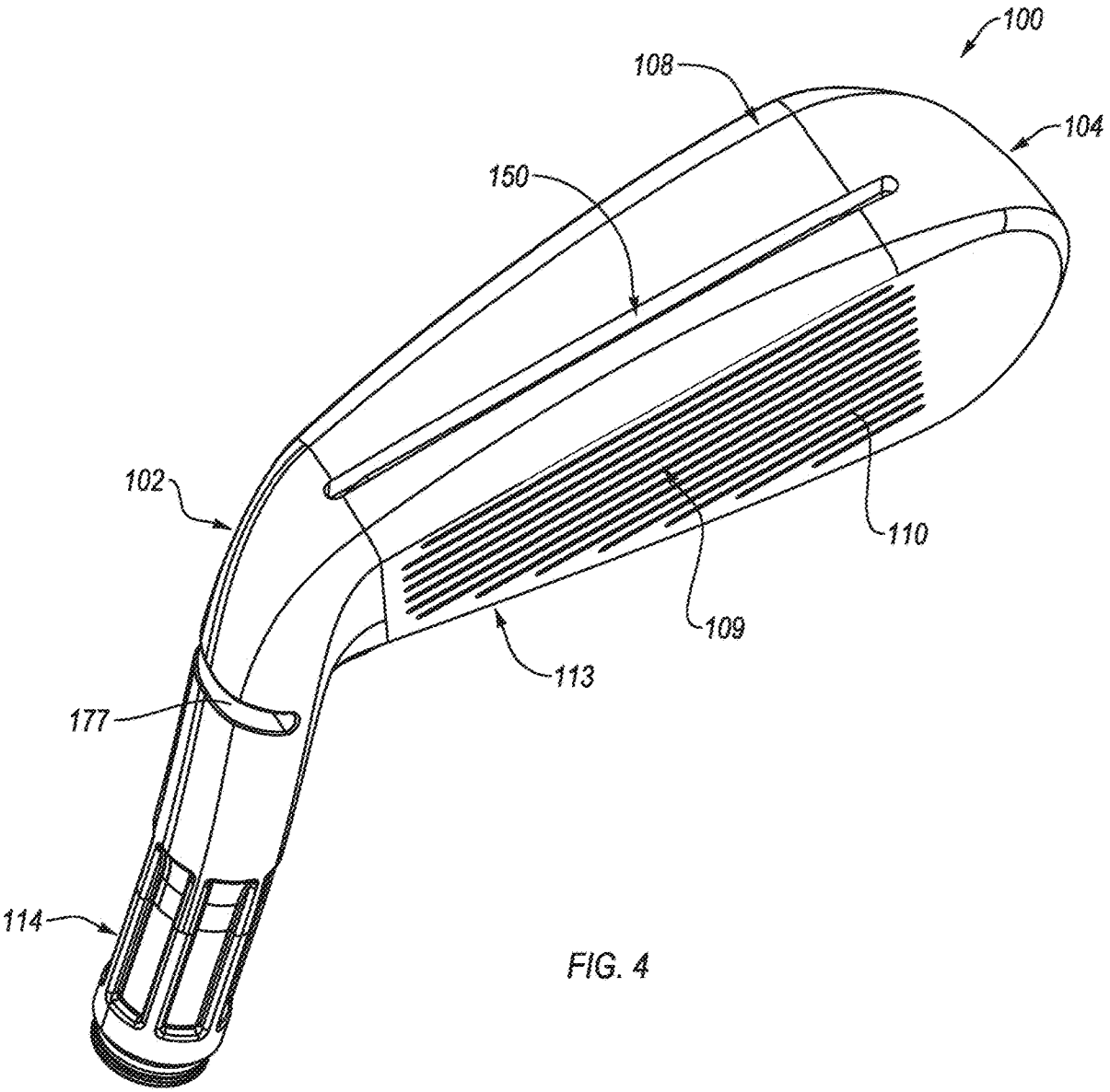
FIG. 4 is a perspective view of the golf club head of FIG. 1, from a bottom of the golf club head, according to one or more examples of the present disclosure.
Figure 5:
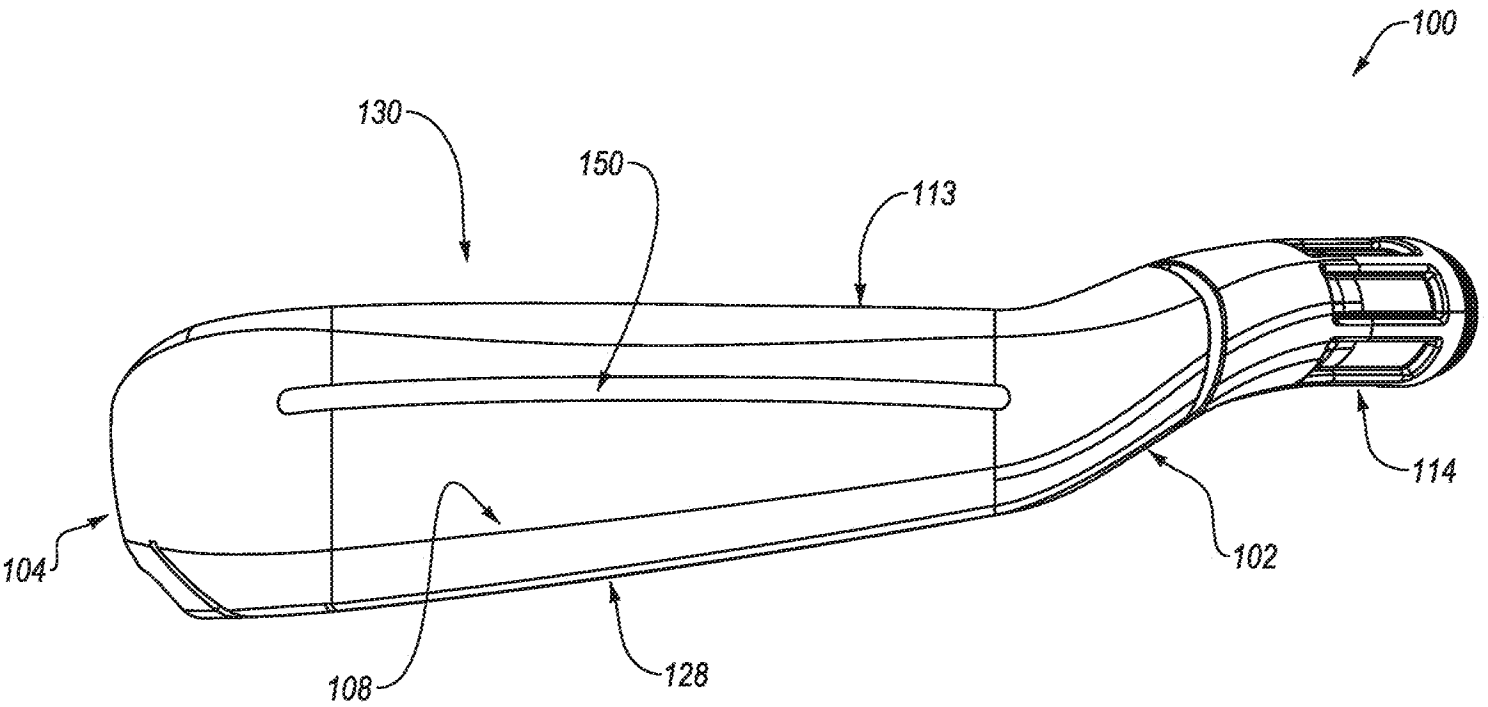
FIG. 5 is a bottom plan view of the golf club head of FIG. 1, according to one or more examples of the present disclosure.

The golf club head 100 may be of solid construction (also referred to as "blades" and/or "muscle backs"), hollow, cavity back, or other construction. However, in the illustrated embodiments, the golf club head 100 is depicted as having a cavity-back construction because the golf club head 100 includes an open cavity 161 behind the strike plate 109 (see, e.g., FIG. 3). FIG. 3 shows a cross-sectional side view, along the cross-section lines 3-3 of FIG. 1, of the golf club head 100.

In the embodiment shown in FIGS. 1-3, the grooves 112 are located on the strike face 110 such that they are centered along the X-axis 105 about the ideal strike location 101 (such that the ideal strike location 101 is located within the strike face 110 on an imaginary line that is both perpendicular to and that passes through the midpoint of the longest score-line groove 112). In other embodiments (not shown in the drawings), the grooves 112 may be shifted along the X-axis 105 to the toe side or the heel side relative to the ideal striking location 101, the grooves 112 may be aligned along an axis that is not parallel to the ground plane 111, the grooves 112 may have discontinuities along their lengths, or the strike face 110 may not have grooves 112. Still other shapes, alignments, and/or orientations of grooves 112 on the strike face 110 are also possible.

In reference to FIG. 1, the golf club head 100 has a sole length $L_B$ (i.e., length of the sole) and a club head height $H_{CH}$ (i.e., height of the golf club head 100). The sole length $L_B$ is defined as the distance between two points 116, 117 projected onto the ground plane 111. The heel side point 116 is defined as the intersection of a projection of the hosel axis 115 onto the ground plane 111. The toe side point 117 is defined as the intersection point of the vertical projection of the lower tangent point (described above) onto the ground plane 111. Accordingly, the distance between the heel side point 116 and the toe side point 117 is the sole length $L_B$ of the golf club head 100. The club head height $H_{CH}$ is defined as the distance between the ground plane 111 and the uppermost point of the club head in a direction parallel to the z-up axis 171.

Referring to FIG. 2, the golf club head 100 includes a club head front-to-back depth $D_{CH}$ defined as the distance between two points 118, 119 projected onto the ground plane 111. A forward end point 118 is defined as the intersection of the projection of the leading edge 143 onto the ground plane 111 in a direction parallel to the z-up axis 171. A rearward end point 119 is defined as the intersection of the projection of the rearward-most point of the club head onto the ground plane 111 in a direction parallel to the z-up axis 171. Accordingly, the distance between the forward end point 118 and rearward end point 119 of the golf club head 100 is the depth $D_{CH}$ of the golf club head 100.

Referring to FIGS. 3 and 6-9, the body 113 of the golf club head 100 further includes a sole bar 135 that defines a rearward portion of the sole portion 108 of the body 113. The sole bar 135 has a relatively large thickness in relation to the strike plate 109 and other portions of the golf club head 100. Accordingly, the sole bar 135 accounts for a significant portion of the mass of the golf club head 100 and effectively shifts the CG of the golf club head 100 relatively lower and rearward. As particularly shown in FIG. 3, the sole portion 108 of the body 113 includes a forward portion 189 with a thickness less than that of the sole bar 135. The forward portion 189 is located between the sole bar 135 and the strike face 110. As described more fully below, the body 113 includes a channel 150 formed in the sole portion 108 between the sole bar 135 and the strike face 110 to effectively separate the sole bar 135 from the strike face 110. The channel 150 is located closer to the forward end point 118 than the rearward end point 119.

In certain embodiments of the golf club head 100, such as those where the strike plate 109 is separately formed and attached to the body 113, the strike plate 109 can be formed of forged maraging steel, maraging stainless steel, or precipitation-hardened (PH) stainless steel. In general, maraging steels have high strength, toughness, and malleability. Being low in carbon, maraging steels derive their strength from precipitation of inter-metallic substances other than carbon. The principle alloying element is nickel (e.g., 15% to nearly 30%). Other alloying elements producing intermetallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the strike plate 109. In other embodiments, the strike plate 109 is a precipitation hardened stainless steel such as 17-4, 15-5, or 17-7. After forming the strike plate 109 and the body 113 of the golf club head 100, the contact surfaces of the strike plate 109 and the body 113 can be finish-machined to ensure a good interface contact surface is provided prior to welding. In some embodiments, the contact surfaces are planar for ease of finish machining and engagement.

The strike plate 109 can be forged by hot press forging using any of the described materials in a progressive series of dies. After forging, the strike plate 109 is subjected to heat-treatment. For example, 17-4 PH stainless steel forgings are heat treated by 1040° C. for 90 minutes and then solution quenched. In another example, C455 or C450 stainless steel forgings are solution heat-treated at 830° C. for 90 minutes and then quenched.

In some embodiments, the body 113 of the golf club head 100 is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In still other embodiments, the body 113 and/or the strike plate 109 of the golf club head 100 are made from fiber-reinforced polymeric composite materials and are not required to be homogeneous. Examples of composite materials and golf club components comprising composite materials are described in U.S. Patent Application Publication No. 2011/0275451, published Nov. 10, 2011, which is incorporated herein by reference in its entirety.

The body 113 of the golf club head 100 can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

In some embodiments, the golf club head 100 includes a flexible boundary structure ("FBS") at one or more locations on the golf club head 100. Generally, the FBS feature is any structure that enhances the capability of an adjacent or related portion of the golf club head 100 to flex or deflect and to thereby provide a desired improvement in the performance of the golf club head 100. The FBS feature may include, in several embodiments, at least one slot, at least one channel, at least one gap, at least one thinned or weakened region, and/or at least one of any of various other structures. For example, in several embodiments, the FBS feature of the golf club head 100 is located proximate the strike face 109 of the golf club head 100 in order to enhance the deflection of the strike face 109 upon impact with a golf ball during a golf swing. The enhanced deflection of the strike face 109 may result, for example, in an increase or in a desired decrease in the coefficient of restitution ("COR") of the golf club head 100. When the FBS feature directly affects the COR of the golf club head 100, the FBS may also be termed a COR feature. In other embodiments, the increased perimeter flexibility of the strike face 109 may cause the strike face 109 to deflect in a different location and/or different manner in comparison to the deflection that occurs upon striking a golf ball in the absence of the channel, slot, or other flexible boundary structure.

In the illustrated embodiment of the golf club head 100, the FBS feature is a channel 150 that is located on the sole portion 108 of the golf club head 100. As indicated above, the FBS feature may comprise a slot, a channel, a gap, a thinned or weakened region, or other structure. For clarity, however, the descriptions herein will be limited to embodiments containing a channel, such as the channel 150, with it being understood that other FBS features may be used to achieve the benefits described herein.

Referring to FIG. 3, the channel 150 is formed into the sole portion 108 and extends generally parallel to and spaced rearwardly from the strike face 110. Moreover, the channel 150 is defined by a forward wall 152, a rearward wall 154, and an upper wall 156. The rearward wall 154 is a forward portion of the sole bar 135. The channel 150 includes an opening 158 defined on the sole portion 108 of the golf club head 100. The forward wall 152 further defines, in part, a first hinge region 160 located at the transition from the forward portion of the sole 108 to the forward wall 152, and a second hinge region 162 located at a transition from an upper region of the forward wall 152 to the sole bar 135. The first hinge region 160 and the second hinge region 162 are portions of the golf club head 100 that contribute to the increased deflection of the strike face 110 of the golf club head 100 due to the presence of the channel 150. In particular, the shape, size, and orientation of the first hinge region 160 and the second hinge region 162 are designed to allow these regions of the golf club head 100 to flex under the load of a golf ball impact. The flexing of the first hinge region 160 and second hinge region 162, in turn, creates additional deflection of the strike face 110.

The hosel 114 of the golf club head 100 can have any of various configurations, such as shown and described in U.S. Pat. No. 9,731,176. For example, the hosel 114 may be configured to reduce the mass of the hosel 114 and/or facilitate adjustability between a shaft and the golf club head 100. For example, the hosel 114 may include a notch 177 that facilitates flex between the hosel 114 and the body 113 of the golf club head 100.

Figure 9:
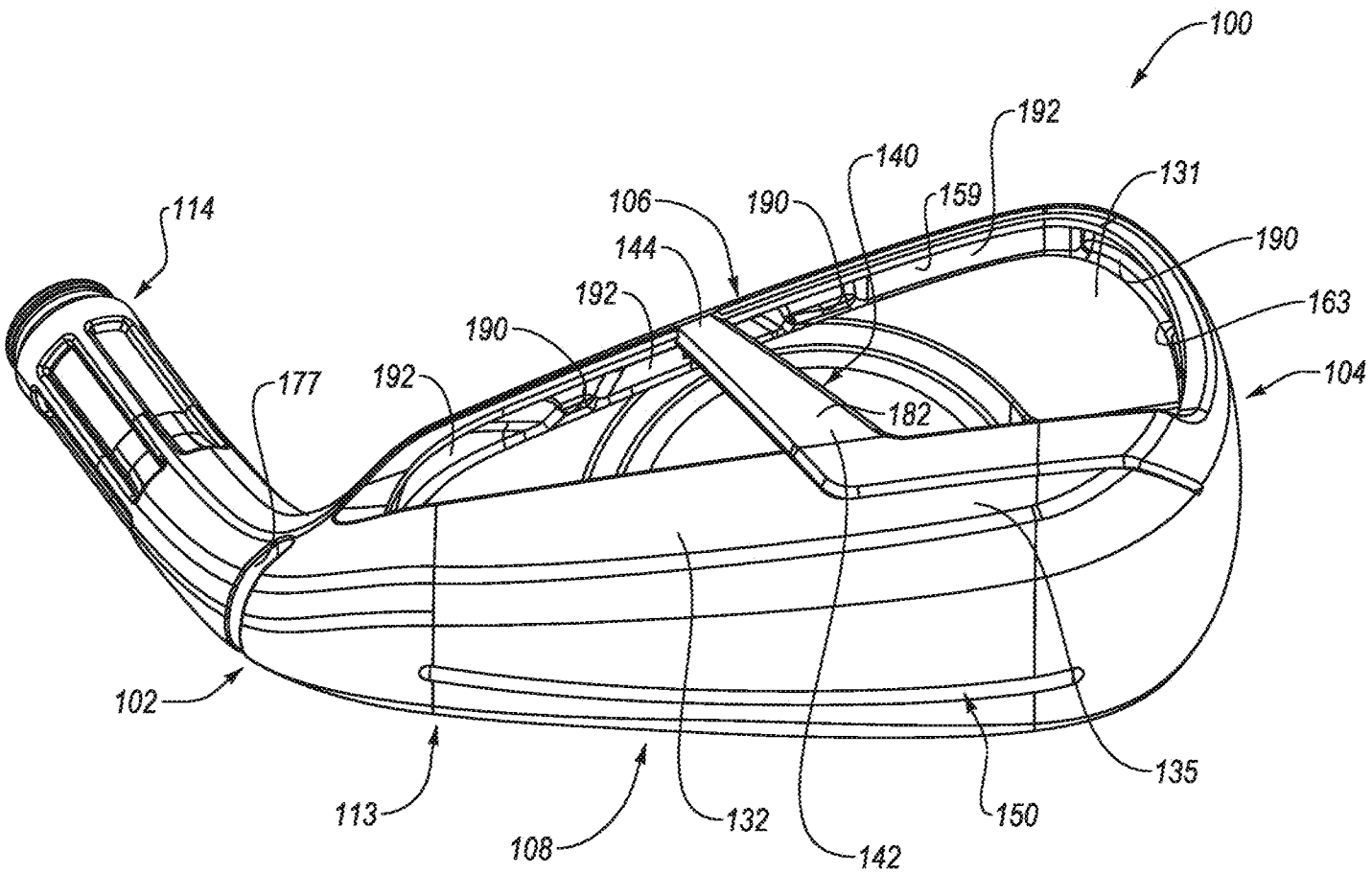
FIG. 9 is a perspective view of the golf club head of FIG. 1, from a bottom-rear of the golf club head, according to one or more examples of the present disclosure.

The topline portion 106 of the golf club head 100 can have any of various configurations, such as shown and described in U.S. Pat. No. 9,731,176. For example, the topline portion 106 of the golf club head 100 may include weight reducing features to achieve a lighter weight topline. According to one embodiment shown in FIG. 9, the weight reducing features of the topline portion 106 of the golf club head 100 include a variable thickness of the top wall 169 defining the topline portion 106. More specifically, in a direction lengthwise along the topline portion 106, the thickness of the top wall 169 alternates between thicker and thinner so as to define pockets 190 between ribs 192 or pads. The pockets 190 are those portions of the top wall 169 having a thickness less than that of the portions of the top wall 169 defining the ribs 192. The pockets 190 help to reduce mass in the topline portion 106, while the ribs 192 promote strength and rigidity of the topline portion 106 and provide a location where a bridge bar 140 can be fixed to the topline portion 106 as is explained in more detail below. As shown in FIG. 9, the alternating wall thickness of the top wall 169 can extend into the toe wall forming the toe portion 104. In the illustrated embodiment, the top wall 169 includes two pockets 190 and three ribs 192. However, in other embodiments, the top wall 169 can include more or less that two pockets 190 and three ribs 192.

Referring to FIGS. 6-9, the back portion 128 of the golf club head 100 includes a bridge bar 140 that extends uprightly from the sole bar 135 to the topline portion 106. As defined herein, uprightly can be vertically or at some angle greater than zero relative to horizontal. The bridge bar 140 structurally interconnects the sole bar 135 directly with the topline portion 106 without being interconnected directly with the strike plate 109. In other words, the bridge bar 140 is directly coupled to a top surface 157 of the sole bar 135, at a top end 144 of the bridge bar 140, and a bottom surface 159 of the topline portion 106, at a bottom end 142 of the bridge bar 140. However, the bridge bar 140 is not directly coupled to the strike plate 109. In fact, an unoccupied gap or space is present between the bridge bar 140 and the rear surface 131 of the strike plate 109. The bridge bar 140 can be made of the same above-identified materials as the body 113 of the golf club head 100. Alternatively, the bridge bar 140 can be made of a material that is different than that of the rest of the body 113. However, the material of the bridge bar 140 is substantially rigid so that the portions of the golf club head 100 coupled to the bridge bar 140 are rigidly coupled. The bridge bar 140 is non-movably or rigidly fixed to the sole bar 135 and the topline portion 106. In one embodiment, the bridge bar 140 is co-formed (e.g., via a casting technique) with the topline portion 106 and the sole bar 135 so as to form a one-piece, unitary, seamless, and monolithic, construction with the topline portion 106 and the sole bar 135. However, according to another embodiment, the bridge bar 140 is formed separately from the topline portion 106 and the sole bar 135 and attached to the topline portion 106 and the bridge bar 140 using any of various attachment techniques, such as welding, bonding, fastening, and the like. In some implementations, when attached to or formed with the topline portion 106 and the sole bar 135, the bridge bar 140 is not under compression or tension.

The bridge bar 140 spans the cavity 161, and more specifically, spans an opening 163 to the cavity 161 of the golf club head 100. The opening 163 is at the back portion 128 of the golf club head 100 and has a length $L_O$ extending between the toe portion 104 and the heel portion 102. The bridge bar 140 also has a length $L_{BB}$ and a width $W_{BB}$ transverse to the length $L_{BB}$. The length $L_{BB}$ of the bridge bar 140 is the maximum distance between the bottom end 142 of the bridge bar 140 and the top end 144 of the bridge bar 140. The length $L_{BB}$ of the bridge bar 140 is less than the length $L_O$. The width $W_{BB}$ of the bridge bar 140 is the minimum distance from a given point on one elongated side of the bridge bar 140 to the opposite elongated side of the bridge bar 140 in a direction substantially parallel with the x-axis 105 (e.g., heel-to-toe direction). The width $W_{BB}$ of the bridge bar 140 is less than the length $L_O$ of the opening 163. In one implementation, the width $W_{BB}$ of the bridge bar 140 is less than 20% of the length $L_O$. According to another implementation, the width $W_{BB}$ of the bridge bar 140 is less than 10% or 5% of the length $L_O$. The width $W_{BB}$ of the bridge bar 140 can be greater at the bottom end 142 than at the top end 144 to promote a lower Z-up. Alternatively, the width $W_{BB}$ of the bridge bar 140 can be greater at the top end 144 than at the bottom end 142 to promote a higher Z-up. In yet other implementations, the width $W_{BB}$ of the bridge bar 140 is constant from the top end 144 to the bottom end 142. In some implementations, the length $L_{BB}$ of the bridge bar 140 is 2-times, 3-times, or 4-times the width $W_{BB}$ of the bridge bar 140.

Figure 6:
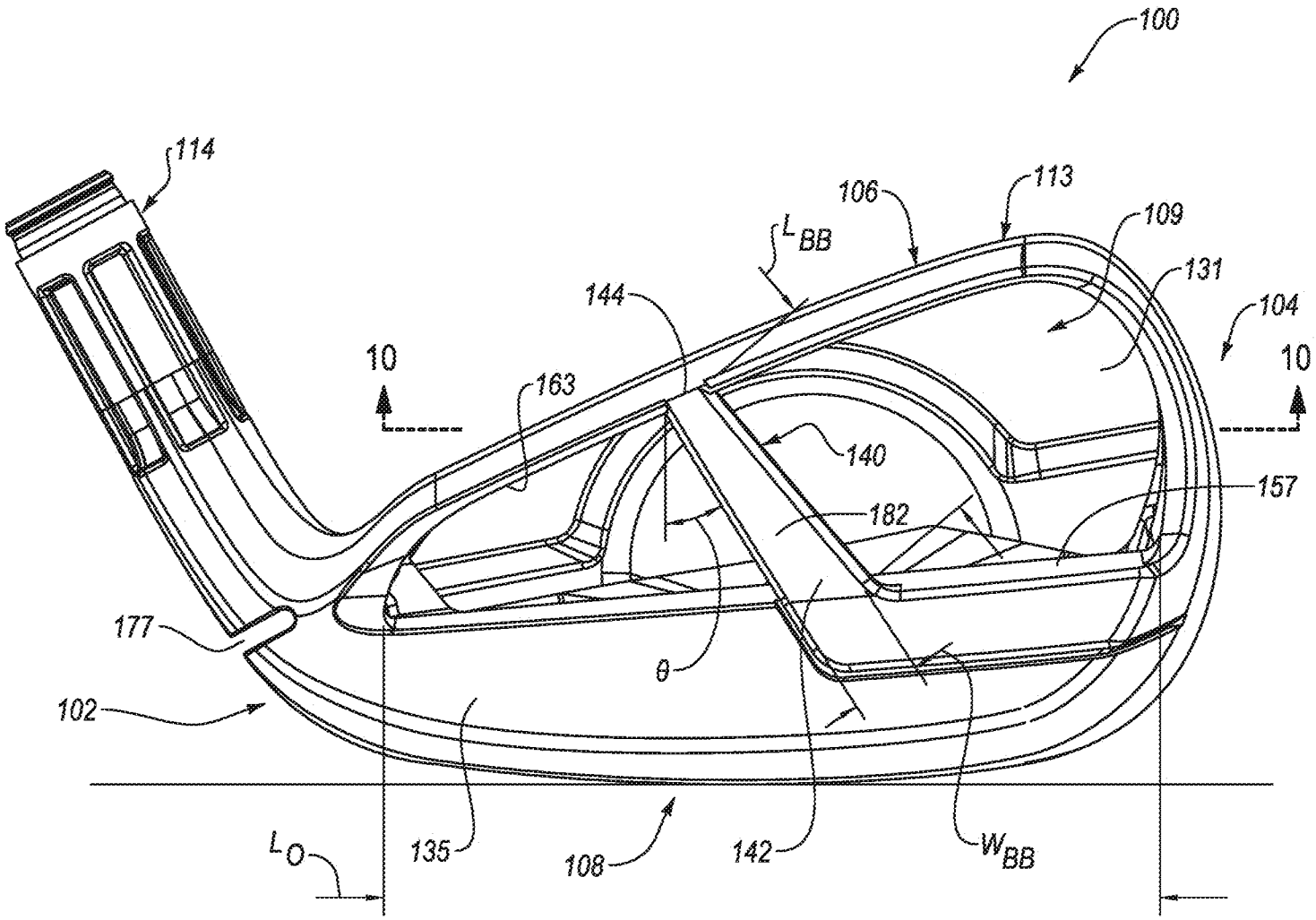
FIG. 6 is a back elevation view of the golf club head of FIG. 1, according to one or more examples of the present disclosure.
Figure 7:
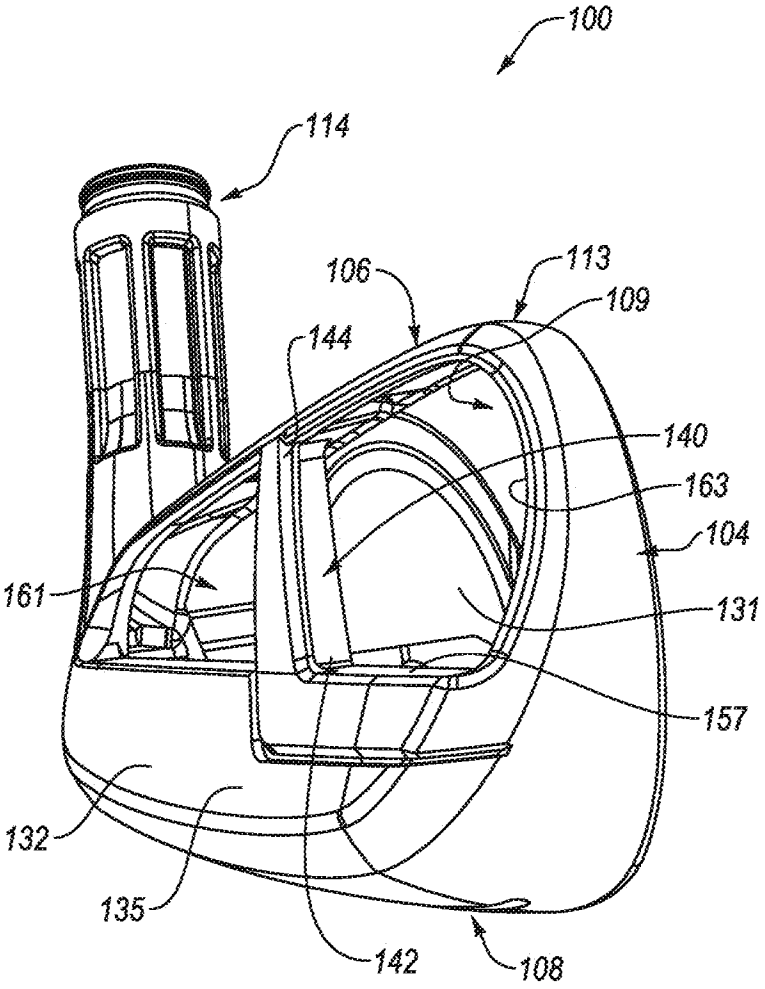
FIG. 7 is a perspective view of the golf club head of FIG. 1, from a rear-toe of the golf club head, according to one or more examples of the present disclosure.
Figure 8:
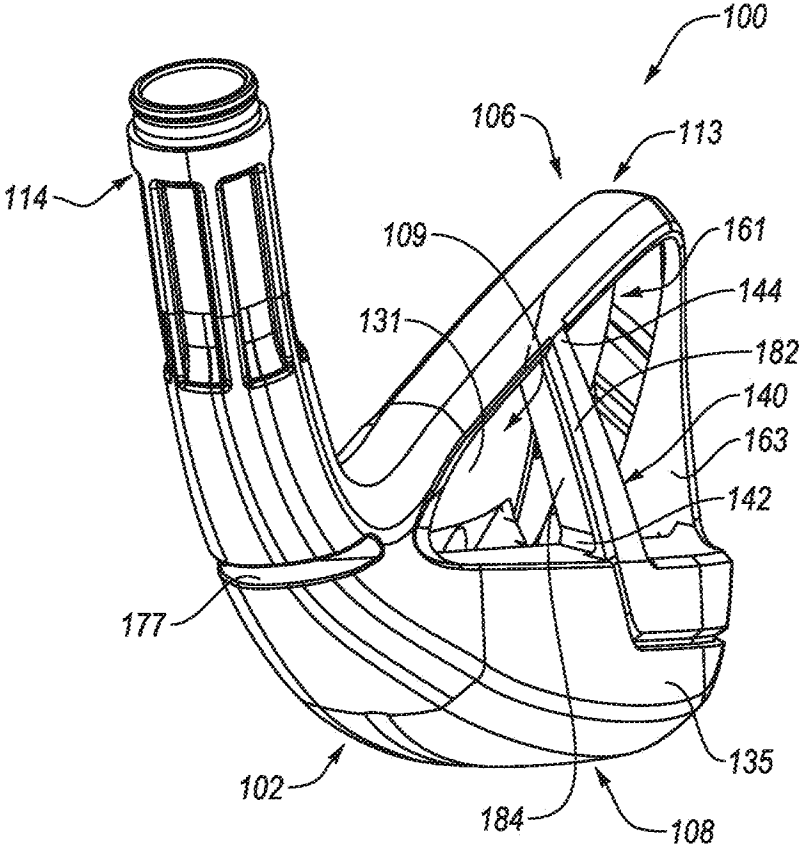
FIG. 8 is a perspective view of the golf club head of FIG. 1, from a rear-heel of the golf club head, according to one or more examples of the present disclosure.

Referring to FIG. 6, an areal mass of the rear portion 128 of the golf club head 100 between the topline portion 106, the sole portion 108, the toe portion 104, and the heel portion 102 is between 0.0005 g/mm$^2$ and 0.00925 g/mm$^2$, such as, for example, about 0.0037 g/mm$^2$. Generally, the areal mass of the rear portion 128 is the mass per unit area of the area defined by the opening 163 to the cavity 161. In some implementations, the area of the opening 163 is about 1,600 mm$^2$.

In some embodiments, the golf club head may include a topline portion weight reduction zone that includes weight reducing features that yield a mass per unit length within the topline portion weight reduction zone of between about 0.09 g/mm to about 0.40 g/mm, such as between about 0.09 g/mm to about 0.35 g/mm, such as between about 0.09 g/mm to about 0.30 g/mm, such as between about 0.09 g/mm to about 0.25 g/mm, such as between about 0.09 g/mm to about 0.20 g/mm, or such as between about 0.09 g/mm to about 0.17 g/mm. In some embodiments, the topline portion weight reduction zone yields a mass per unit length within the weight reduction zone less than about 0.25 g/mm, such as less than about 0.20 g/mm, such as less than about 0.17 g/mm, such as less than about 0.15 g/mm, or such as less than about 0.10 g/mm. The golf club head has a topline portion made from a metallic material having a density between about 7,700 kg/m$^3$ and about 8,100 kg/m$^3$, e.g. steel. If a different density material is selected for the topline construction that could either increase or decrease the mass per unit length values. The weight reducing features may be applied over a topline length of at least 10 mm, such as at least 20 mm, such as at least 30 mm, such as at least 40 mm, such as at least 45 mm, such as at least 50 mm, such as at least 55 mm, or such as at least 60 mm.

Additional and different golf club head features may be included in one or more embodiments. For example, additional golf club head features are described in U.S. Pat. Nos. 10,406,410, 10,155,143, 9,731,176, 9,597,562, 9,044,653, 8,932,150, 8,535,177, and 8,088,025, which are incorporated by reference herein in their entireties. Additional and different golf club head features are also described in U.S. Patent Application Publication No. 2018/0117425, published May 3, 2018, which is incorporated by reference herein in its entirety. Additional and different golf club head features are also described in U.S. Patent Publication No. 2019/0381370, published Dec. 19, 2019, which is incorporated by reference herein in its entirety.

Coefficient of Restitution and Characteristic Time

As used herein, the terms "coefficient of restitution," "COR," "relative coefficient of restitution," "relative COR," "characteristic time," and "CT" are defined according to the following. The coefficient of restitution (COR) of an iron club head is measured according to procedures described by the USGA Rules of Golf as specified in the "Interim Procedure for Measuring the Coefficient of Restitution of an Iron Club head Relative to a Baseline Plate," Revision 1.2, Nov. 30, 2005 (hereinafter "the USGA COR Procedure"). Specifically, a COR value for a baseline calibration plate is first determined, then a COR value for an iron club head is determined using golf balls from the same dozen(s) used in the baseline plate calibration. The measured calibration plate COR value is then subtracted from the measured iron club head COR to obtain the "relative COR" of the iron club head.

To illustrate by way of an example: following the USGA COR Procedure, a given set of golf balls may produce a measured COR value for a baseline calibration plate of 0.845. Using the same set of golf balls, an iron club head may produce a measured COR value of 0.825. In this example, the relative COR for the iron club head is 0.825−0.845=−0.020. This iron club head has a COR that is 0.020 lower than the COR of the baseline calibration plate, or a relative COR of −0.020.

The characteristic time (CT) is the contact time between a metal mass attached to a pendulum that strikes the face center of the golf club head at a low speed under conditions prescribed by the USGA club conformance standards.

Damper and Badge Structures

As manufacturers of iron-type golf club heads design cavity-back club heads for a high moment of inertia (MOI), low center of gravity (CG), and other characteristics, acoustic and vibration dampers may be provided to counteract unpleasant sounds and vibration frequencies produced by features of the club heads, such as resulting from thin toplines, thin striking faces, and other club head characteristics. Heel-to-toe badges and/or dampers may be provided such that unpleasant sounds and vibration frequencies are dampened, while maintaining acceptable COR and CT values for the striking face. Heel-to-toe badges and/or dampers may also be provided with relief cutouts (also referred to as channels and grooves, such as to provide projection or ribs on the damper) to maintain COR and CT values of the striking face, improve COR and CT values for off-center strikes, and to provide for a larger "sweet-spot" on the striking face.

Figure 10:
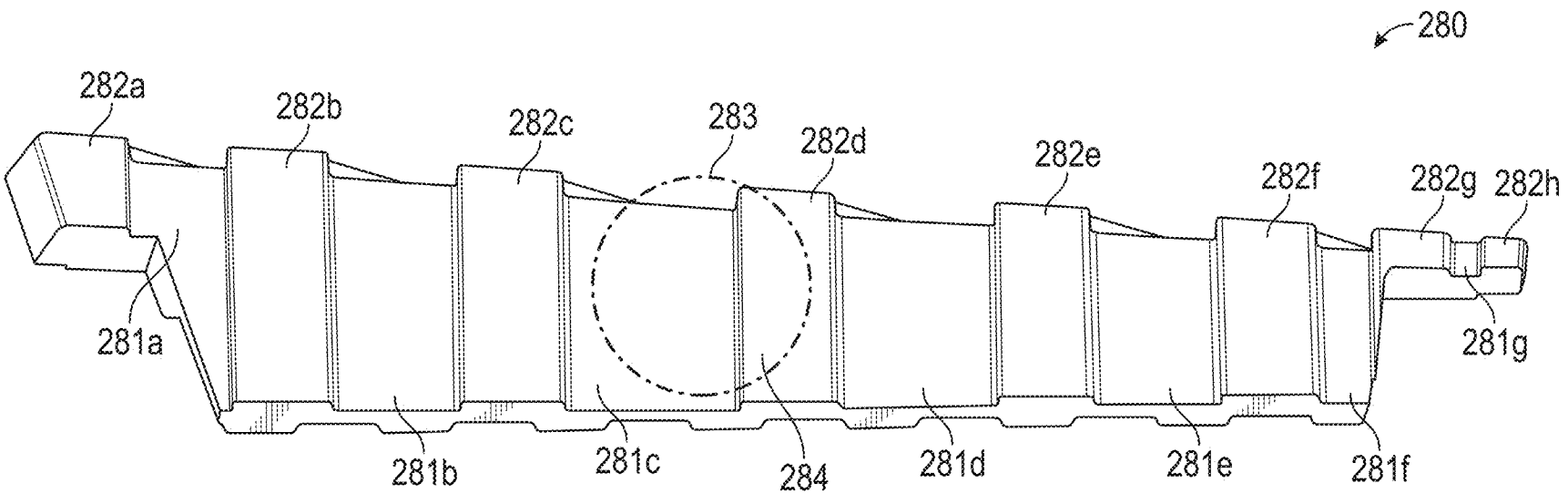
FIG. 10 is a front elevation view of a golf club head damper, according to one or more examples of the present disclosure.

FIG. 10 illustrates one embodiment of a damper 280 of an iron-type golf club head. The damper 280 includes one or more relief cutouts 281*a*-281*g* on front surface 284 that reduce the surface area of the damper 280 that contacts a rear surface of the striking face. Any number of relief cutouts may be provided. The damper 280 includes one or more projections 282*a*-282*h* on front surface 284 that contact the rear surface of the striking face. Any number of projections may be provided. The number of projections may correspond with the number of relief cutouts. For example, as depicted in FIG. 10, damper 280 has one more projection than relief cutout, such that the damper 280 contacts the rear surface of the striking face on both sides of each relief cutout. In another embodiment, the damper 280 may have fewer projections than relief cutouts. In yet another embodiment, the damper 280 may have an equal number of projections and relief cutouts.

In one or more embodiments, the width and shape of each of the relief cutouts 281*a*-281*g* and each of the projections 282*a*-282*h* may differ in order to provide different damping characteristics of the damper 280 (e.g., sound and feel) and different performance characteristics at different locations across the striking face (e.g., CT and COR). For example, wide relief cutouts may be provided in the damper 280 near the ideal strike location (e.g., location 101 in FIG. 1) to retain more COR while still benefitting sound and feel across the striking face. In another example, narrow relief cutouts may be provided in the damper 280 at the ideal strike location to provide for better sound and feel at the expense of reduced performance characteristics. In yet another example, uniform cutouts may be provided in the damper 280 to provide for a balance between sound and feel with performance characteristics.

In one or more embodiments, the relief cutout widths may provide for zones of contact by the projections of the damper. For example, in a damper with wider projections near the ideal strike location of the striking face, the damper will provide for better damping near the ideal strike location and will maintain a greater percentage of COR and CT near the heel and toe locations of the striking face. By maintaining a greater percentage of COR and CT near the heel and toe locations of the striking face, a perceived "sweet spot" of the striking face can be enlarged, providing for more consistent COR and CT across the striking face, resulting in consistent ball speeds resulting from impact across the striking face.

To provide for adequate sound and vibration damping, and to meet other club head specifications, the amount of surface area that the damper contacts the striking face determines the level of damping provided by the damper and impacts the performance specifications of the club head. For example, the damper need not be compressed to provide for damping. For example, the damper may move with the striking face, while still providing for sound and vibration damping. However, in some embodiments, the damper is compressed by the striking face. For example, a striking face may flex up to about 1.5 mm. In embodiments where the damper 280 is compressed, the damper may be compressed up to about 0.3 mm, up to about 0.6 mm, up to about 1.0 mm, up to about 1.5 mm, or up to another distance.

The damper 280 can be described by a projection ratio of the surface area of the projections contacting the striking face to a surface area of a projected area of the entire damper 280 (i.e., a combined surface area of the projections and the relief cutouts). In one or more embodiments, the projection ratio is no more than about 25%, between about 25% and 50%, or another percentage. In some embodiments, the surface area of the entire damper 280 is more than about 2 times the surface area of the projections, such as about 2.3 times (i.e., 542 $mm^2$/235 $mm^2$), about 2.2 times (i.e., 712 $mm^2$/325 $mm^2$), or about 1.8 times (i.e., 722 $mm^2$/396 $mm^2$). Dampers with other ratios may be provided. For example, a numerically higher projection ratio (e.g., about 50%) may provide for increased vibration and sound damping at the expense of performance characteristics. Likewise, a numerically lower projection ratio (e.g., about 25%) may provide for increased performance characteristics at the expense of vibration and sound damping.

As depicted in FIG. 10, the damper 280 may include alternating projections 282*a*-282*h* and relief cutouts 281*a*-281*g*. The alternating projections 282*a*-282*h* and relief cutouts 281*a*-281*g* reduces the surface area of the projected surface of the damper 280 from contacting a rear surface of the striking face. By providing the relief cutouts 281*a*-281*g* in the damper 280, flexibility of the striking face can be maintained when compared to a solid damper (i.e., a damper without relief). In one embodiment, when compared to a solid damper that reduces COR of a striking face by about 5 points, a damper with relief cutouts may reduce COR of the striking face by only about 2.5 points. In another embodiment, when compared to a solid damper, a damper with relief cutouts may reduce COR of the striking face by 4 points less than the solid damper.

The damper 280 may be provided in any shape suitable to fit within the cavity and provide for vibration and sound damping. In one or more embodiments, the damper 280 may be provided with a tapered profile that reaches a peak height adjacent to a toeside of the damper. For example, the damper 280 may have a length of about 75 mm measured from the heel portion to the toe portion, a toeside height of about 16 mm, and heelside height of about 10 mm. In another example, the toeside height is no less than twice the heelside height. Other measurements may be provided, such as a length of greater than 40 mm measured from the heel portion to the toe portion, greater than 50 mm measured from the heel portion to the toe portion, greater than 60 mm measured from the heel portion to the toe portion, greater than 70 mm measured from the heel portion to the toe portion, or another length.

In one or more embodiments, the golf club head may include striking face of a golf club head may include localized stiffened regions, variable thickness regions, or inverted cone technology (ICT) regions located on the striking face at a location that surrounds or that is adjacent to the ideal striking location of the striking face. In these embodiments, additional features may be provided by the damper 280 to accommodate for the localized stiffened regions, variable thickness regions, or ICT regions. For example, the damper 280 may include a cutout 283 provided to receive and/or contact a portion of the striking face corresponding to a localized stiffened region, a variable thickness region, or an ICT region. As such, the cutout 283 is provided to match a shape of the region, such as a circular region, an elliptical region, or another shape of the region. In one example, the cutout 283 receives, but does not contact, at least a portion of the of a rear surface of the localized stiffened region, variable thickness region, or ICT region. In another example, the cutout 283 receives and is in contact with at least a portion of the rear surface of the localized stiffened region, variable thickness region, or ICT region. In this example, the damper contacts less than about 50% of the rear surface area, less than about 40%, or another portion of the rear surface area.

In one or more embodiments, the damper 280 is provided in lieu of localized stiffened regions, variable thickness regions, or ICT regions located on the striking face. For example, the damper 280 may be provided with characteristics that stiffen a localized region of the striking face more than surrounding regions of the striking face, such as to increase the durability of the club head striking face, to increase the area of the striking face that produces high CT and/or COR, or a combination of these reasons. To stiffen a localized region of the striking face, relief cutouts may be provided adjacent to the localized region, resulting in a stiffened local region and one or more flexible adjacent regions. Additional and different relief cutouts may be provided to effectuate localized stiffened regions of the striking face using the damper 280.

Figure 11:
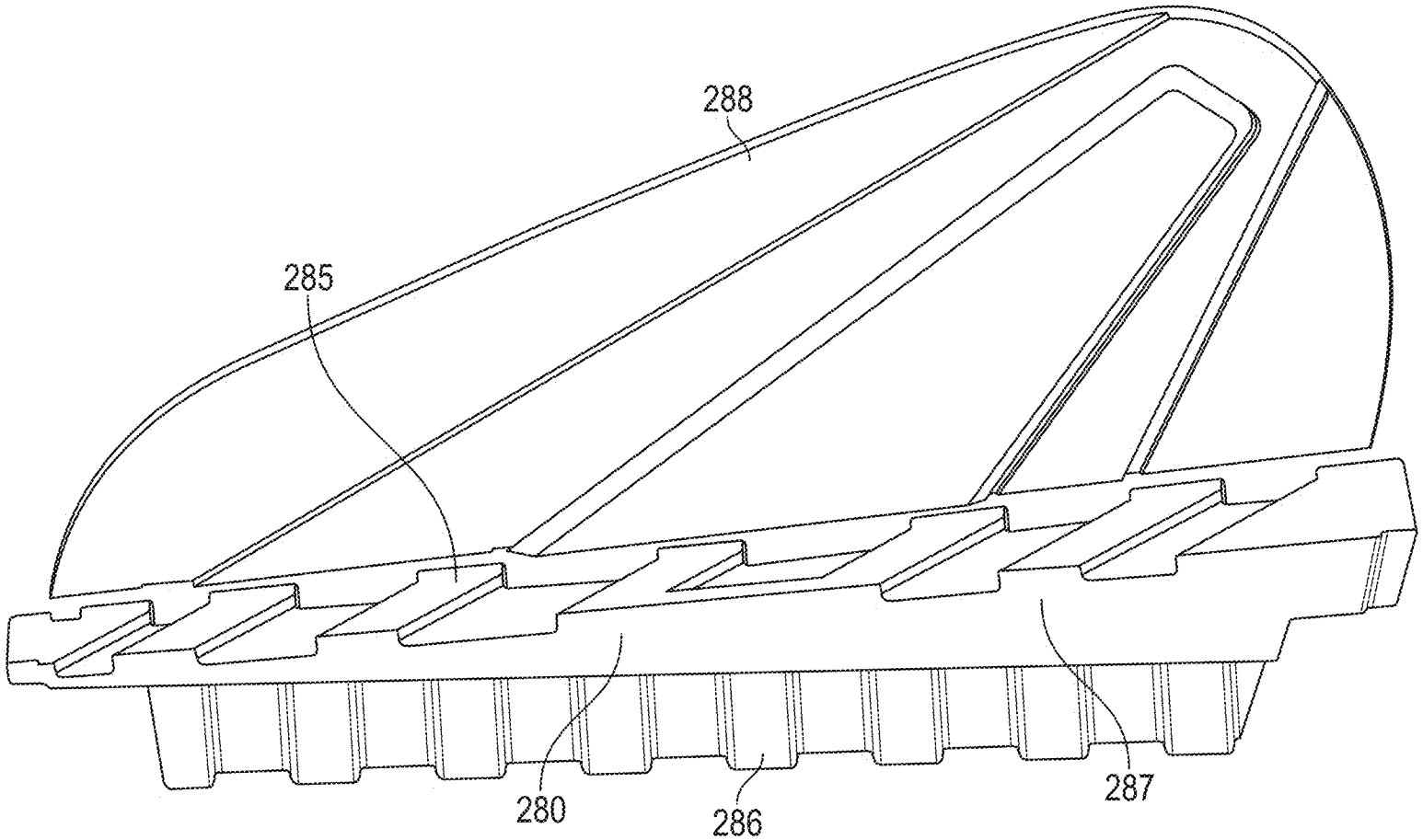
FIG. 11 is a back perspective view of a golf club head badge and the damper of FIG. 10, according to one or more examples of the present disclosure.

In one or more embodiments, additional relief cutouts may be provided on any surface of the damper 280, such as a top surface 285, an intermediate surface 286, a rear surface 287, or another surface, such as depicted in FIG. 11. For example, the additional relief cutouts may be provided for weight savings, water drainage from the cavity, ease of damper installation, aesthetic characteristics, and to provide other performance benefits.

In one or more embodiments, relief cutouts on the front surface 284 and/or the intermediate surface 286 of the damper 280 provide for a volume and mass savings compared to a damper without relief cutouts. In one example, a damper without relief cutouts is 7589 $mm^3$ with a mass of 9.9 g. Providing relief cutouts on the front surface 284 reduces the volume of the damper to 7278 $mm^3$ and reduces the mass to 9.5 g, providing a 4.1% mass savings. Providing relief cutouts on the front surface 284 and the intermediate surface 286 reduces the volume of the damper to 6628 $mm^3$ and reduces the mass to 8.6 g, providing a 12.7% mass savings. In another example, another damper without relief cutouts is 5976 $mm^3$ with a mass of 7.8 g. Providing relief cutouts on the front surface 284 reduces the volume of the damper to 5608 $mm^3$ and reduces the mass to 7.3 g, providing a 6.1% mass savings. Providing relief cutouts on the front surface 284 and the intermediate surface 286 reduces the volume of the damper to 4847 $mm^3$ and reduces the mass to 6.3 g, providing a 18.7% mass savings.

Figure 12:
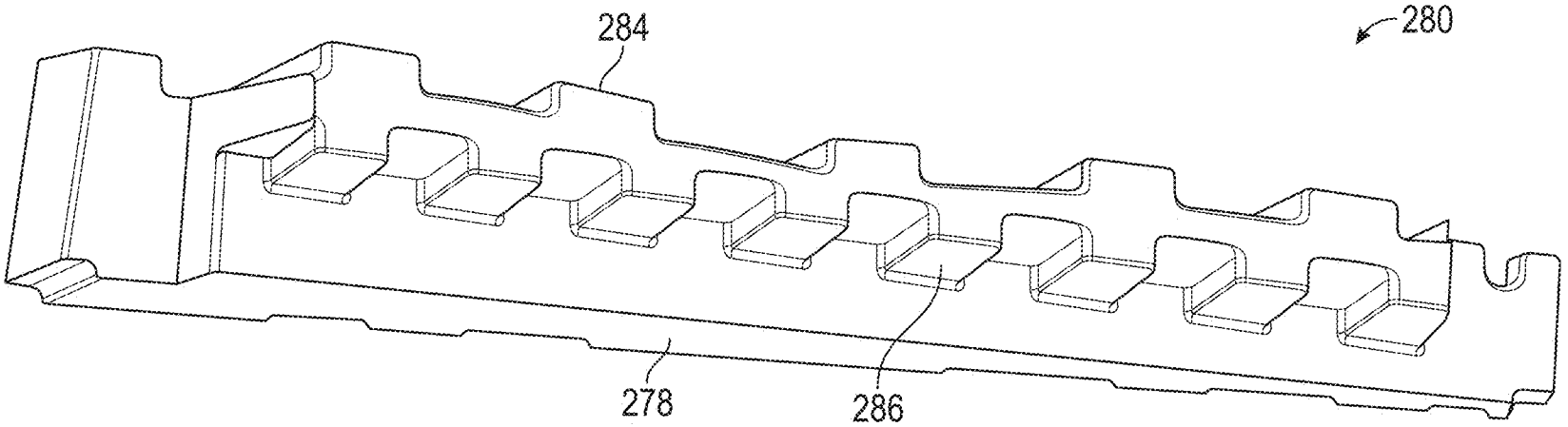
FIG. 12 is a bottom perspective view of the golf club head badge and damper of FIG. 11, according to one or more examples of the present disclosure.

FIGS. 11-12 illustrate additional views of one embodiment of a damper 280 of an iron-type golf club head. The damper 280 includes a top surface 285, an intermediate rear surface 286, and a rear surface 287. Additional and different surfaces may be provided.

In one or more embodiments, relief cutouts are provided in the top surface 285 of the damper 280. For example, one or more relief cutouts 281*a*-281*g* on front surface 284 (depicted in FIG. 10) may extend to the top surface 285. The relief cutouts provided in the top surface 285 may allow for water trapped in front of the damper 280 to drain from the cavity. The relief cutouts provided in the top surface 285 may also provide for aesthetic benefits, such as allowing the damper to be more pleasing to the golfer and to blend into the feature lines of the golf club head. The relief cutouts provided in the top surface 285 may also provide for weight savings and may add to the flexibility of the damper for ease of installation into the cavity. Any number of relief cutouts may be provided in the top surface 285.

In one or more embodiments, relief cutouts are also provided in the intermediate rear surface 286 of the damper 280. The relief cutouts provided in the intermediate rear surface 286 may also provide for weight savings and may add to the flexibility of the damper for ease of installation into the cavity. Any number of relief cutouts may be provided in the intermediate rear surface 285. Projections may also be provided in the intermediate rear surface 286 for contact with a rear portion and/or a sole bar of the club head. In an example, uniform projections and uniform relief cutouts are provided in the intermediate rear surface 286. In this example, the intermediate rear surface 286 includes the same number of projections as the front surface 284. In another example, the intermediate rear surface 286 includes more projections than the front surface 284. In another example, the intermediate rear surface 286 includes fewer projections than the front surface 284.

FIG. 11 also illustrates one embodiment of a badge 288 of an iron-type golf club head. The badge 288 may be positioned above the damper 280 within the cavity of the club head. For example, the badge 288 may be adhesively secured or otherwise mechanically attached or connected to the rear surface of the striking face. The badge 288 may be provided in any shape. For example, the badge 288 may be provided in a tapered shape, with a peak height adjacent to the toeside of the badge. The badge 288 may provide additional vibration and sound damping, as well as serve aesthetic purposes within the cavity. In one or more embodiments, the damper 280 extends a greater distance from heel to toe than the badge 288.

In some embodiments, the damper 280 is provided with a pattern or other relief on the front surface 284 that reduces the surface area of the damper 280 that contacts a rear surface of the striking face. Any type of relief may be provided that reduces the surface area of the front surface of the damper that contacts the rear surface of the striking face. For example, the damper 280 may be provided with a honeycomb pattern, a cross-cut pattern, a nubbin pattern, pattern, another pattern, or a pattern inversion. The pattern and/or other relief may be symmetrical across the front surface of the damper, or the pattern may vary across the front surface. The pattern and/or other relief provides that less than 100% of the front surface of the damper contact the rear surface of the striking face, such as 20% to 80% of the projected area of the front surface of the damper contacting the rear surface of the striking face.

Additional and different golf club badge and/or damper features may be included in one or more embodiments. For example, additional golf club badge and/or damper features are described in U.S. Pat. Nos. 10,427,018, 9,937,395, and 8,920,261, which are incorporated by reference herein in their entireties.

Damper Materials

A variety of materials and manufacturing processes may be used in providing the damper 280. In one or more embodiments, the damper 280 is a combination of Santoprene and Hybrar. For example, using different ratios of Santoprene to Hybrar, the durometer of the damper 280 may be manipulated to provide for different damping characteristics, such as interference, dampening, and stiffening properties. In one embodiment, a ratio of about 85% Santoprene to about 15% Hybrar is used. In another embodiment, a ratio of at least about 80% Santoprene to about 10% Hybrar is used. Other ratios may be used.

Examples of materials that may be suitable for use as a damper structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd.

In some embodiments, the filler material may have a modulus of elasticity ranging from about 0.001 GPa to about 25 GPa, and a durometer ranging from about 5 to about 95 on a Shore D scale. In other examples, gels or liquids can be used, and softer materials which are better characterized on a Shore A or other scale can be used. The Shore D hardness on a polymer is measured in accordance with the ASTM (American Society for Testing and Materials) test D2240.

In some embodiments, the damper material may have a density of about 0.95 g/cc to about 1.75 g/cc, or about 1 g/cc. The damper material may have a hardness of about 10 to about 70 shore A hardness. In certain embodiments, a shore A hardness of about 40 or less is preferred. In certain embodiments, a shore D hardness of up to about 40 or less is preferred.

In some embodiments, the damper material may have a density between about 0.16 g/cc and about 0.19 g/cc or between about 0.03 g/cc and about 0.19 g/cc. In certain embodiments, the density of the damper material is in the range of about 0.03 g/cc to about 0.2 g/cc, or about 0.04-0.10 g/cc. The density of the damper material may impact the COR, durability, strength, and damping characteristics of the club head. In general, a lower density material will have less of an impact on the COR of a club head. The damper material may have a hardness range of about 15-85 Shore OO hardness or about 80 Shore OO hardness or less.

In one or more embodiments, the damper 280 may be provided with different durometers across a length of the damper 280. For example, the damper 280 may be co-molded using different materials with different durometers, masses, densities, colors, and/or other material properties. In one embodiment, the damper 280 may be provided with a softer durometer adjacent to the ideal striking location of the striking face than adjacent to the heel and toe portions. In another embodiment, the damper 280 may be provided with a harder durometer adjacent to the ideal striking location of the striking face than adjacent to the heel and toe portions. In these examples, the different material properties used to co-mold the damper 280 may provide for better performance and appearance.

Additional and different damper materials and manufacturing processes can be used in one or more embodiments. For example, additional damper materials and manufacturing processes are described in U.S. Pat. Nos. 10,427,018, 9,937,395, 9,044,653, 8,920,261, and 8,088,025, which are incorporated by reference herein in their entireties. For example, the damper 280 may be manufactured at least in part of rubber, silicone, elastomer, another relatively low modulus material, metal, another material, or any combination thereof.

Club Head and Damper Interaction

Figure 13:
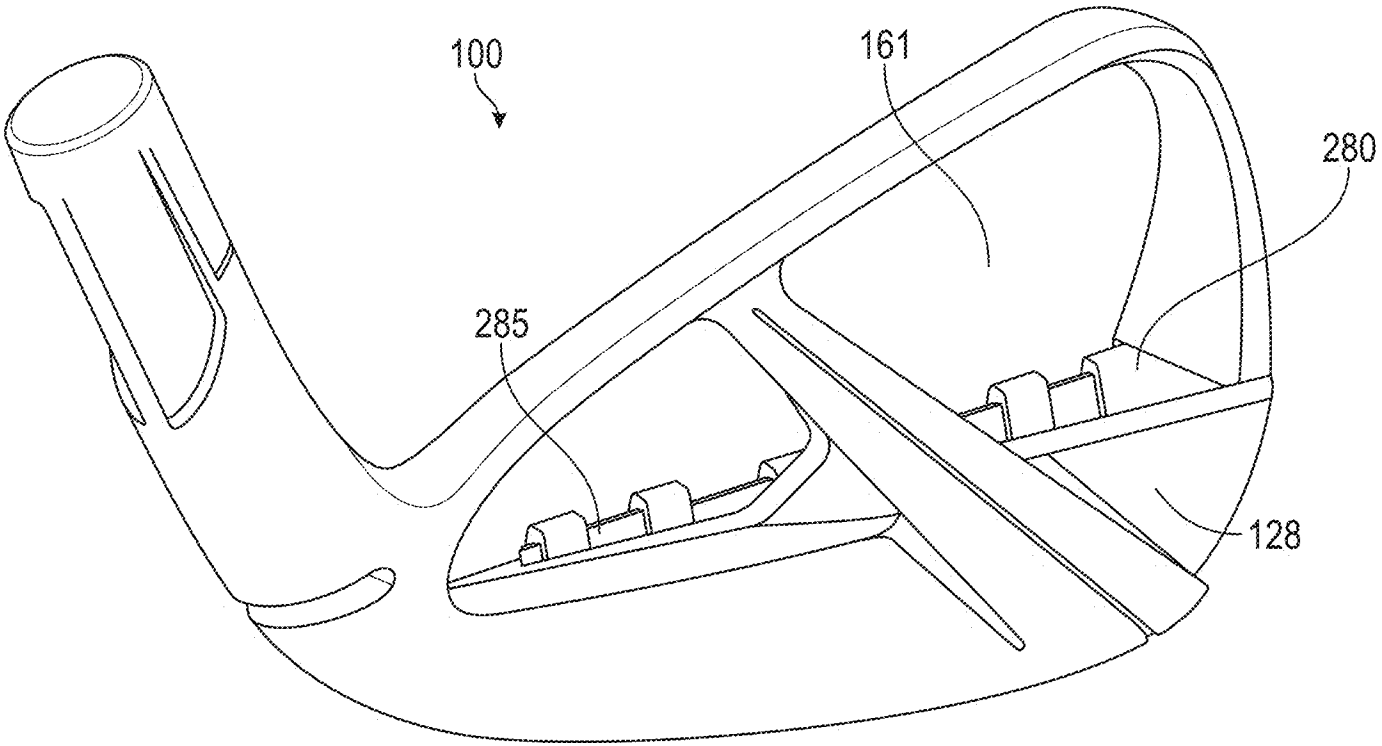
FIG. 13 is a back perspective view of a golf club head, according to one or more examples of the present disclosure.

FIG. 13 illustrates one embodiment of the damper 280 positioned within the cavity 161 of a golf club head 100. For example, the damper 280 is inserted from a toeside of the club head 100 into the cavity 161. Likewise, a badge 288 (not depicted) may also be inserted from the toeside of the golf club head and affixed within the cavity 161. In one or more embodiments, the damper 280 is positioned low in the cavity 161 below an upper edge of the rear portion 128 (i.e., below the cavity opening line). For example, the damper 280 is positioned about 1 mm below an upper edge of the upper edge of the rear portion 128. The damper may also be positioned below the badge 288.

As discussed above, in one or more embodiments, the damper 280 may include relief cutouts on one or more surfaces of the damper 280 which allow water to drain out of the cavity 161 from below and around the damper 280. For example, if the club head 100 is submerged in a water bucket, such as for cleaning, the relief cutouts allow water to drain from the cavity 161. In testing embodiments of the damper 280, a club head 100 without the relief cutouts retained 1.2 g of water. In contrast, a club head 100 with the relief cutouts retained only 0.3 g of water.

Figure 14:
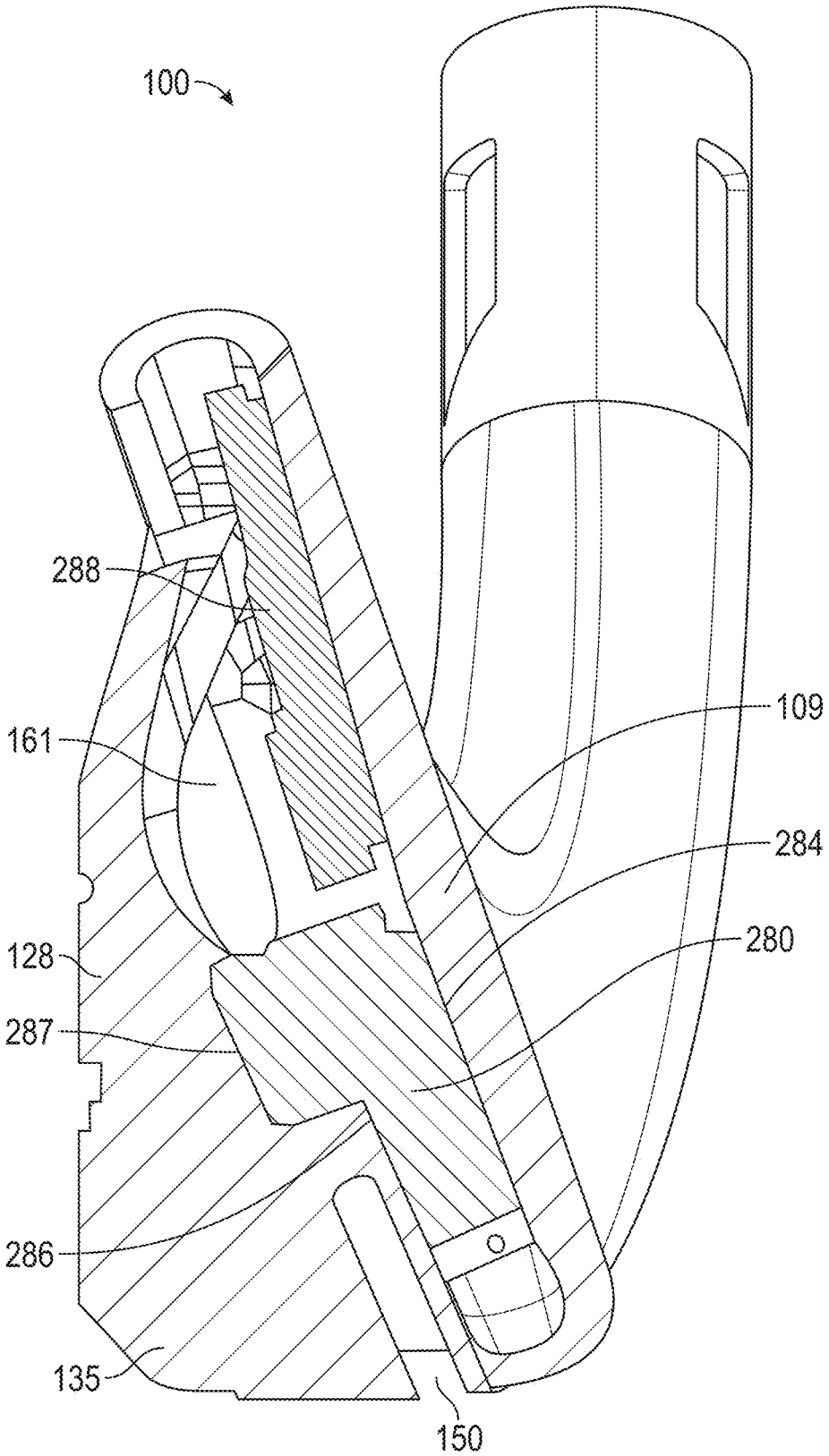
FIG. 14 is a cross-sectional side view of a golf club head, according to one or more examples of the present disclosure.

FIG. 14 illustrates a cross-section view of one embodiment of the damper 280 positioned within the cavity 161 of a golf club head 100. The front surface 284 of the damper 280 contacts a rear surface of the striking face 109. The intermediate surface 286 and the rear surface 287 of the damper 280 each contact the rear portion 128 and/or the sole bar 135. As depicted in FIG. 14, the damper 280 contacts the striking face 109, the rear portion 128 and/or the sole bar 135 at varying heights within the cavity 161. Further, channel 150 may be rearward intermediate surface 286.

In one or more embodiments, a badge 288 may also be positioned within the cavity 161. As depicted in FIG. 14, the badge 288 is positioned above the damper 280 and separated from the damper 280. For example, the damper 280 and the badge 288 may be separated by about 1 mm or another distance. In another embodiment, the badge 288 is positioned above of and in contact with the damper 280. In this embodiment, the badge 288 may lock the damper in place within the cavity 161. The badge 288 may be an ABS plastic or another material, secured within the cavity to the rear surface of the striking face 109 by an adhesive or tape. In one example, the badge is secured by tape with a thickness of about 1.1 mm, providing additional vibration and sound damping of the striking face 109. In some embodiments, the damper 280 extends rearward of the badge 288.

Figure 15:
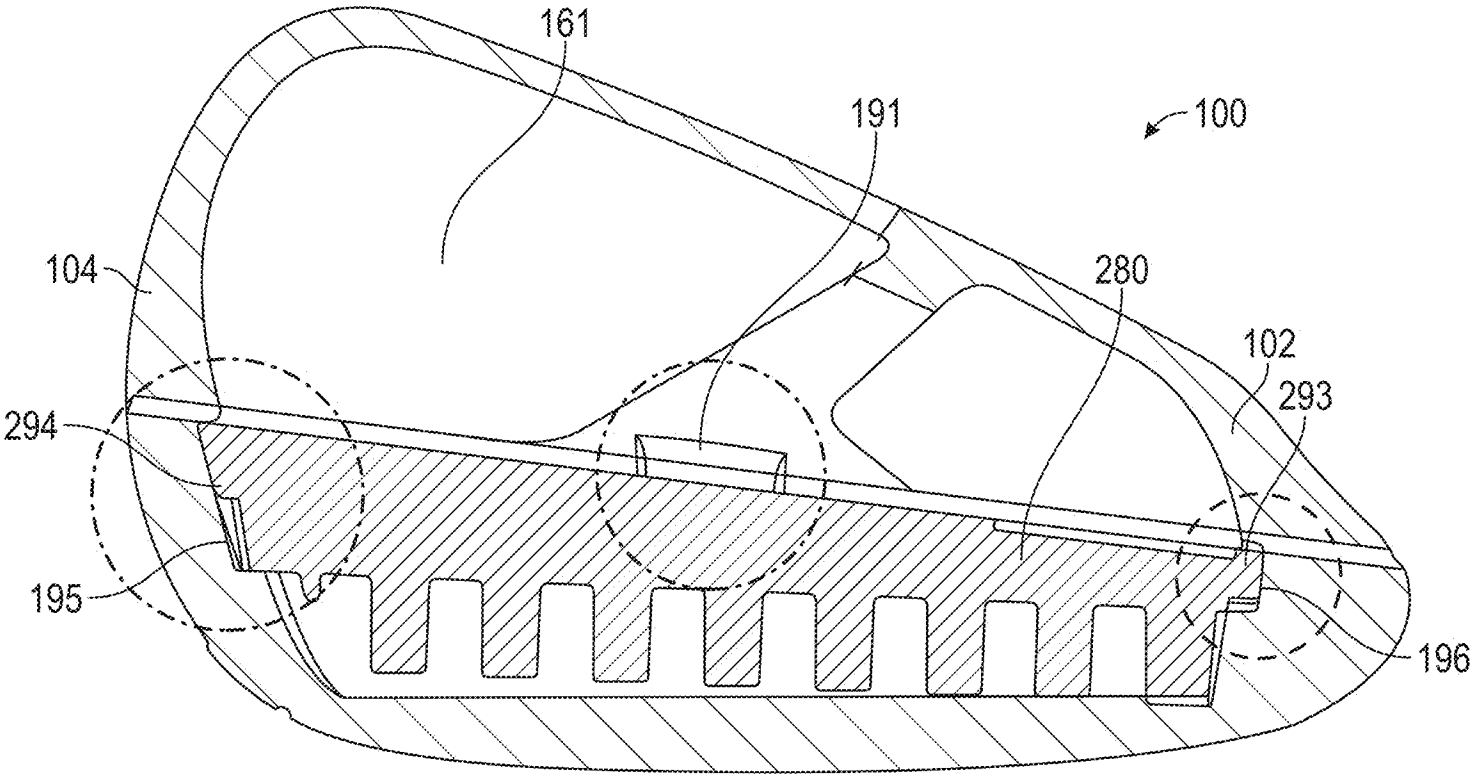
FIG. 15 is a cross-sectional back view of a golf club head, according to one or more examples of the present disclosure.

FIG. 15 illustrates another cross-section view of one embodiment of the damper 280 positioned within the cavity 161 of a golf club head 100. The heel portion 102 of the club head 100 includes a negative heel tab 196 for receiving the heel tab 293 of the damper 280. The toe portion 104 of the club head 100 includes a negative toe tab 195 for receiving the toe tab 294 of the damper 280. During installation, the damper 280 may be inserted into the cavity 161 and locked into place using the toe tab 294 and the heel tab 293. The club head 100 may also include a center tab 191 for further securing the damper 280 within the cavity 161.

As depicted in FIG. 15, a portion of the negative toe tab 195 overlaps a portion of the damper 280 when the damper 280 is positioned within the cavity 161. Likewise, a portion of the negative heel tab 196 overlaps a portion of the damper 280 when the damper 280 is positioned within the cavity 161. In one or more embodiments, the top edge of each of the negative toe tab 195, the center tab 191, and the negative heel tab 196 are substantially colinear.

In one or more embodiments, the damper 280 may be positioned in contact with a "donut" (not depicted in FIG. 15) of the striking face 109. For example, the damper 280 may be positioned in contact with a lower portion of the "donut," such as below the peak of the "donut." In some embodiments, the "donut" further secures the damper within the cavity 161.

In one or more embodiments, the damper 280 may be positioned in the cavity 161 and secured with an interference fit between the damper 280 and the body 113. For example, the damper 280 may be under compression when it is positioned win the cavity 161, such as at least 0.2 mm of compression, 0.4 mm of compression, 0.6 mm of compression, or another length of compression. In an embodiment, the front surface 284 of the damper 280 is compressed by at least 0.2 mm by the striking face 109 and the rear surface 287 is compressed by at least 0.2 mm by the rear portion 128. In another embodiment, the damper 280 is preloaded by about 0.6 mm by the damper 280 contacting the body 113.

Figure 16:
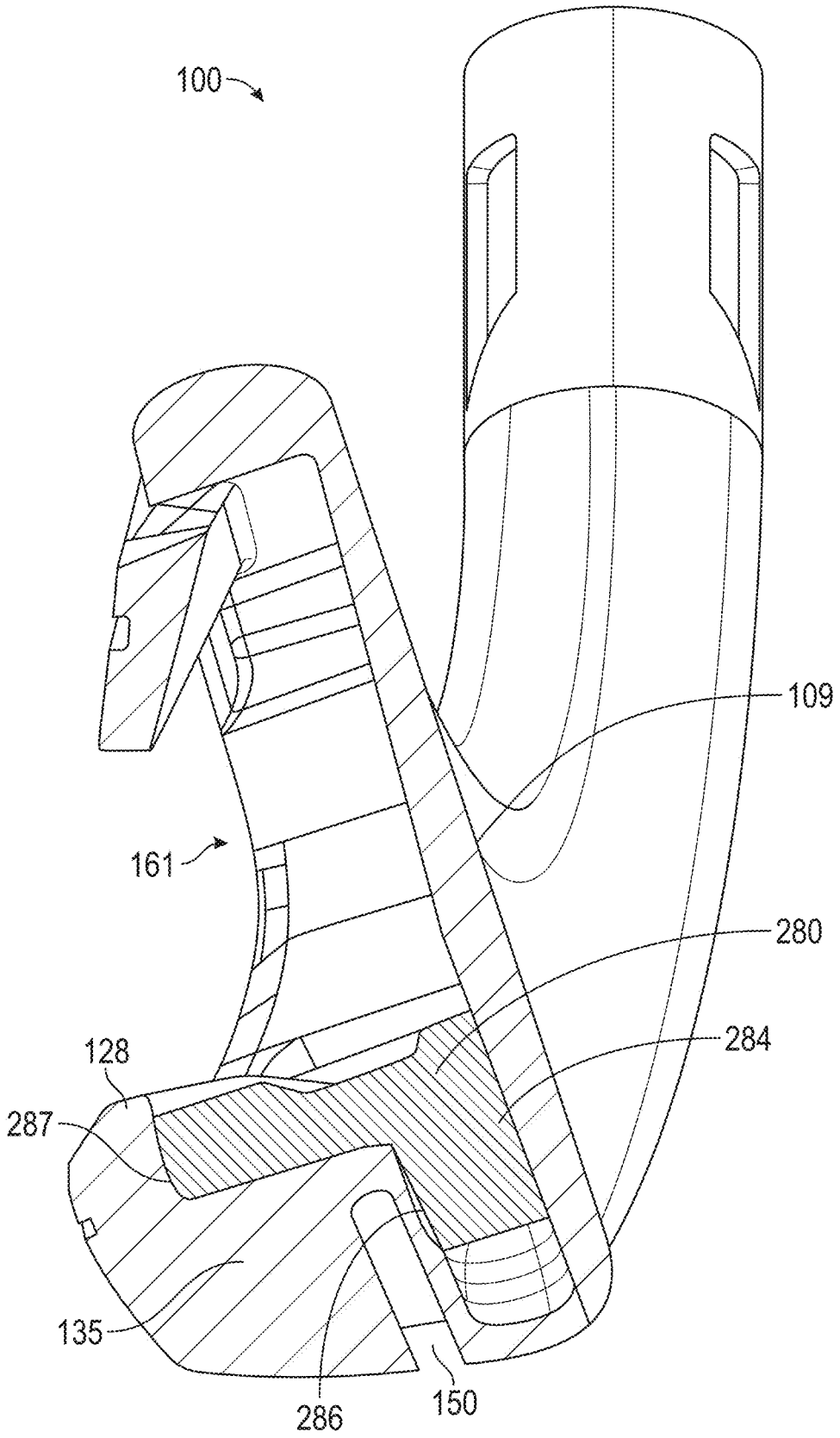
FIG. 16 is a cross-sectional side view of a golf club head, according to one or more examples of the present disclosure.

FIG. 16 illustrates a cross-section view of another embodiment of the damper 280 positioned within the cavity 161 of a golf club head 100. The front surface 284 of the damper 280 contacts a rear surface of the striking face 109. The intermediate surface 286 and the rear surface 287 of the damper 280 each contact the rear portion 128 and/or the sole bar 135. As depicted in FIG. 16, the damper 280 contacts the striking face 109, the rear portion 128 and/or the sole bar 135 at varying heights within the cavity 161. Further, channel 150 may be rearward intermediate surface 286.

Figure 17:
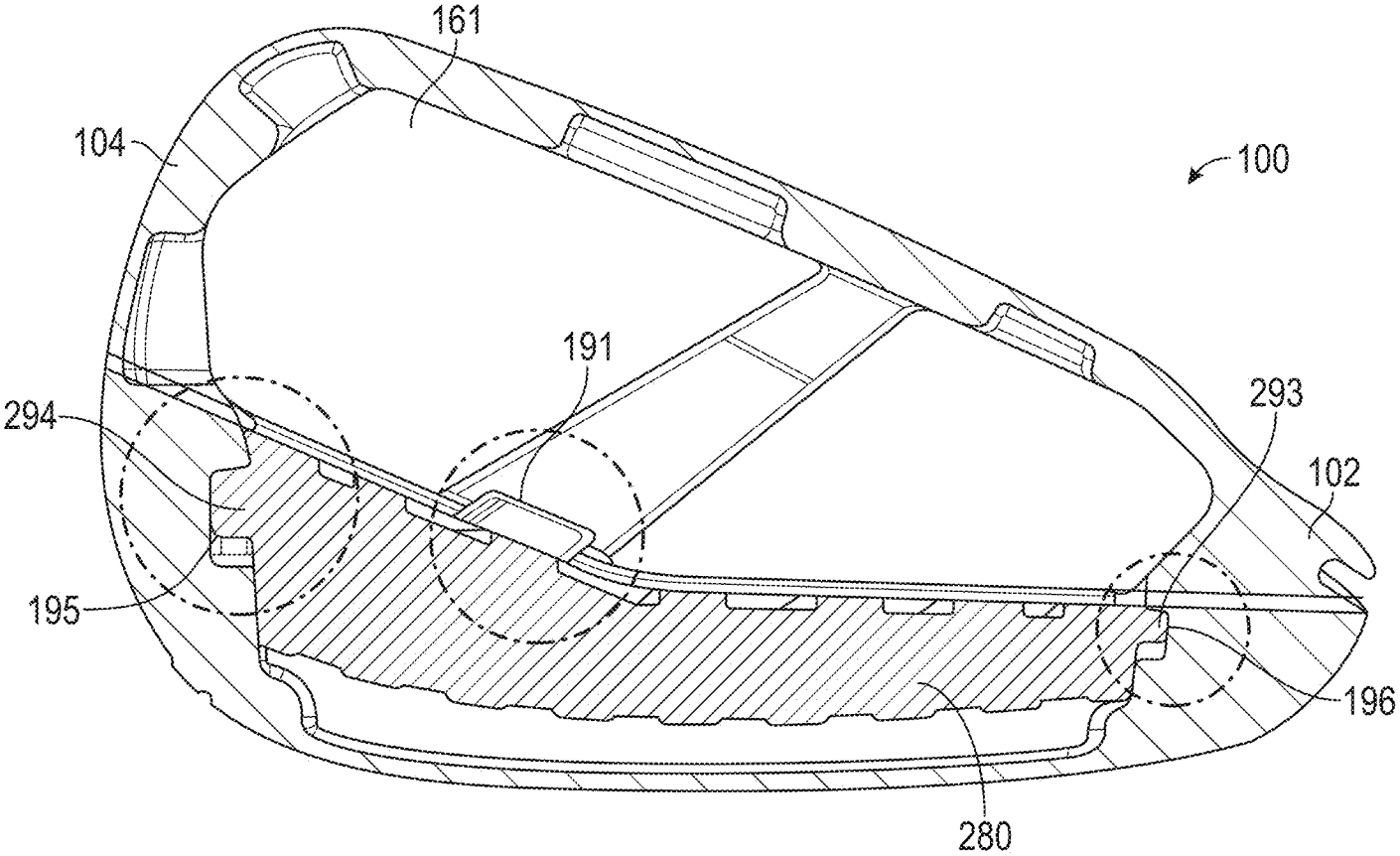
FIG. 17 is a cross-sectional back view of a golf club head, according to one or more examples of the present disclosure.

FIG. 17 illustrates another cross-section view of one embodiment of the damper 280 positioned within the cavity 161 of a golf club head 100. The heel portion 102 of the club head 100 includes a negative heel tab 196 for receiving the heel tab 293 of the damper 280. The toe portion 104 of the club head 100 includes a negative toe tab 195 for receiving the toe tab 294 of the damper 280. During installation, the damper 280 may be inserted into the cavity 161 and locked into place using the toe tab 294 and the heel tab 293. The club head 100 may also include a center tab 191 for further securing the damper 280 within the cavity 161.

As depicted in FIG. 17, a portion of the negative toe tab 195 overlaps a portion of the damper 280 when the damper 280 is positioned within the cavity 161. Likewise, a portion of the negative heel tab 196 overlaps a portion of the damper 280 when the damper 280 is positioned within the cavity 161. In one or more embodiments, the top edge of each of the negative toe tab 195, the center tab 191, and the negative heel tab 196 are not substantially colinear.

Localized Stiffened Regions and Inverted Cone Technology

In one or more embodiments, the striking face of a golf club head may include localized stiffened regions, variable thickness regions, or inverted cone technology (ICT) regions located on the striking face at a location that surrounds or that is adjacent to the ideal striking location of the striking face. The aforementioned regions may also be referred to as a "donut" or a "thickened central region." The regions may be circular, elliptical, or another shape. For example, the localized stiffened region may include an area of the striking face that has increased stiffness due to being relatively thicker than a surrounding region, due to being constructed of a material having a higher Young's Modulus (E) value than a surrounding region, and/or a combination of these factors. Localized stiffened regions may be included on a striking face for one or more reasons, such as to increase the durability of the club head striking face, to increase the area of the striking face that produces high CT and/or COR, or a combination of these reasons.

Examples of localized stiffened regions, variable thickness configurations, and inverted cone technology regions are described in U.S. Pat. Nos. 6,800,038, 6,824,475, 6,904,663, 6,997,820, and 9,597,562, which are incorporated by reference herein in their entireties. For example, ICT regions may include symmetrical "donut" shaped areas of increased thickness that are located within the unsupported face region. In some embodiments, the ICT regions are centered on the ideal striking location of the striking face. In other embodiments, the ICT regions are centered heelward of the ideal striking location of the striking face, such as to stiffen the heel side of the striking face and to add flexibility to the toe side of the striking face, such as to reduce lateral dispersion (e.g., a draw bias) produced by the golf club head.

In some embodiments, the ICT region(s) include(s) an outer span and an inner span that are substantially concentric about a center of the ICT regions. For example, the outer span may have a diameter of between about 15 mm and about 25 mm, or at least about 20 mm. In other embodiments, the outer span may have a diameter greater than about 25 mm, such as about 25-35 mm, about 35-45 mm, or more than about 45 mm. The inner span of the ICT region may represent the thickest portion of the unsupported face region. In certain embodiments, the inner diameter may be between about 5 mm and about 15 mm, or at least about 10 mm.

In other embodiments, the localized stiffened region comprises a stiffened region (e.g., a localized region having increased thickness in relation to its surrounding regions) having a shape and size other than those described above for the inverted cone regions. The shape may be geometric (e.g., triangular, square, trapezoidal, etc.) or irregular. For these embodiments, a center of gravity of the localized stiffened region (CGLSR) may be determined by defining a boundary for the localized stiffened region and calculating or otherwise determining the center of gravity of the defined region. An area, volume, and other measurements of the localized stiffened region are also suitable for measurement upon defining the appropriate boundary.

Club Head Measurements

Figure 18:
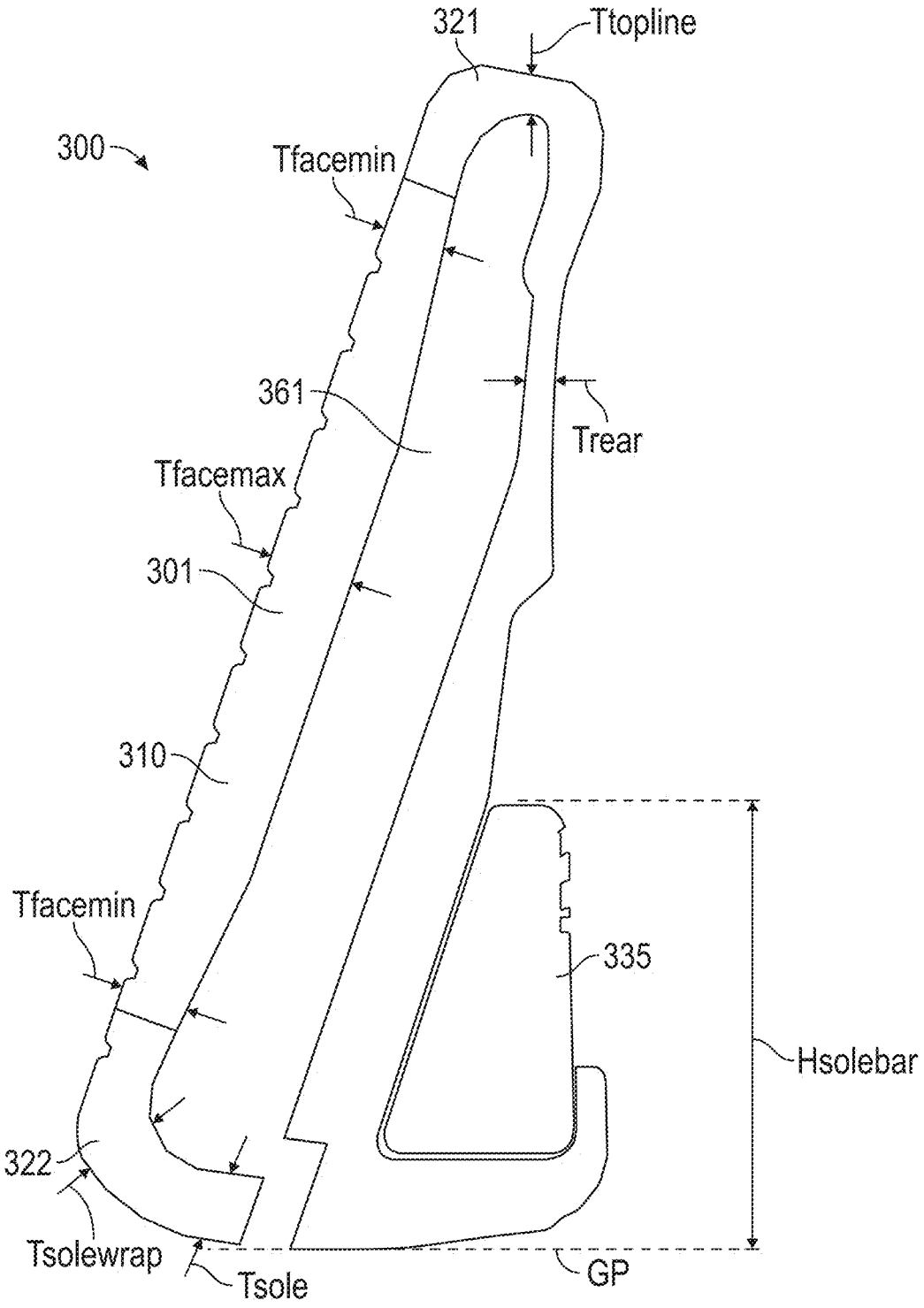
FIG. 18 is a cross-sectional back view of a golf club head, according to one or more examples of the present disclosure.

FIG. 18 illustrates club head measurements that may apply to one or more embodiments, including club head 100, club head 300, or another club head. In one or more embodiments the golf club head 300, as shown in FIG. 18, the internal cavity 361 is partially or entirely filled with a filler material and/or a damper, such as a non-metal filler material of a thermoplastic material, a thermoset material, or another material. In other embodiments, the internal cavity 361 is not filled with a filler material and remains an unfilled or partially filled hollow cavity within the club head. In other embodiments, such as the club head 100, as shown in FIG. 1, the cavity 161 is not closed by a back wall and remains unfilled or partially filled with a filler material and/or a damper. In some embodiments, the golf club head 300 may include a face insert 310 that wraps from the face into the crown, topline, rear portion, and/or sole, such as in a face to crown to rear transition region 321 and/or a face to sole transition region 322.

Referring back to FIG. 18, club head 300 includes a sole bar 335. A maximum sole bar height Hsolebar, measured as the distance perpendicular from the ground plane (GP) to a top edge of the sole bar 335 when the golf club head is in proper address position on the ground plane, may be between 7.5 and 8 mm, between 6 mm and 9 mm, between 8 mm and 10 mm, between 9 and 12 mm, between 11 mm and 15 mm, or another distance.

FIG. 18 also shows the thicknesses of various portions of the golf club head 300. The golf club head 300 has a topline thickness $T_{topline}$, a minimum face thickness $T_{facemin}$, a maximum face thickness $T_{facemax}$, a sole wrap thickness $T_{solewrap}$, a sole thickness $T_{sole}$, and a rear thickness $T_{rear}$. The topline thickness $T_{topline}$ is the minimum thickness of the wall of the body defining the top portion of the body of the golf club head. The minimum face thickness $T_{facemin}$ is the minimum thickness of the wall or plate of the body defining the face portion of the body of the golf club head. The maximum face thickness $T_{facemax}$ is the maximum thickness of the wall or plate of the body defining the face portion of the body of the golf club head. The sole wrap thickness $T_{solewrap}$ is the minimum thickness of the wall of the body defining the transition between the face portion and the sole portion of the body of the golf club head. The sole thickness $T_{sole}$ is the minimum thickness of the wall of the body defining the sole portion of the body of the golf club head. The rear thickness $T_{rear}$ is the minimum thickness of the wall of the body defining the rear portion of the body or the rear panel of the golf club head.

In one or more embodiments, the topline thickness $T_{topline}$ is between 1 mm and 3 mm, inclusive (e.g., between 1.4 mm and 1.8 mm, inclusive), the minimum face thickness $T_{facemin}$ is between 2.1 mm and 2.4 mm, inclusive, the maximum face thickness $T_{facemax}$ (typically at center face or an ideal strike location 301) is between 3.1 mm and 4.0 mm, inclusive, the sole wrap thickness Tsoiewrap is between 1.2 and 3.3 mm, inclusive (e.g., between 1.5 mm and 2.8 mm, inclusive), the sole thickness $T_{sole}$ is between 1.2 mm and 3.3 mm, inclusive (e.g., between 1.7 mm and 2.75 mm, inclusive), and/or the rear thickness $T_{rear}$ is between 1 mm and 3 mm, inclusive (e.g., between 1.2 mm and 1.8 mm, inclusive). In certain embodiments, a ratio of the sole wrap thickness $T_{solewrap}$ to the maximum face thickness $T_{facemax}$ is between 0.40 and 0.75, inclusive, a ratio of the sole wrap thickness $T_{solewrap}$ to the maximum face thickness $T_{facemax}$ is between 0.4 and 0.75, inclusive (e.g., between 0.44 and 0.64, inclusive, or between 0.49 and 0.62, inclusive), a ratio of the topline thickness $T_{topline}$ to the maximum face thickness $T_{facemax}$ is between 0.4 and 1.0, inclusive (e.g., between 0.44 and 0.64, inclusive, or between 0.49 and 0.62, inclusive), and/or a ratio of the sole wrap thickness $T_{solewrap}$ to the maximum sole bar height Hsolebar is between 0.05 and 0.21, inclusive (e.g., between 0.07 and 0.15, inclusive). In certain embodiments, a ratio of a minimum thickness in the face to sole transition region 322 to $T_{facemax}$ is between 0.40 and 0.75, inclusive (e.g., between 0.44 and 0.64, preferably between 0.49 and 0.62), and a ratio of the minimum face thickness $T_{facemin}$ to the face to crown to rear transition region 321 (excluding the weld bead) is between 0.40 and 1.0, inclusive (e.g. between 0.44 and 0.64, preferably between 0.49 and 0.62).

In one or more embodiments, the face portion may be welded to the body (e.g., a cast body), defining the cavity behind the face portion and forward of the rear portion, such as by welding a strike plate welded to a face opening on the body. In some embodiments, the face portion is manufactured with a forging process and the body is manufactured with a casting process. The welded face portion may include an undercut portion that wraps underneath the cavity and forms part of the sole portion. The undercut portion of the topline portion may include a minimum topline thickness, such as 1 mm, 1.1 mm, 1.2 mm, 1.3 mm, 1.4 mm, less than 1.5 mm, or another thickness. In an embodiment, the minimum topline thickness is between 1.4 mm and 1.8 mm, 1.3 mm and 1.9 mm, 1 mm and 2.5 mm, or another thickness. The welded face portion may include an undercut portion that wraps above the cavity and forms part of the topline portion. The undercut portion of the sole portion may include a minimum sole thickness, such as 1.25 mm, 1.4 mm, 1.55 mm, less than 1.6 mm, or another thickness. In an embodiment, the minimum sole thickness is between 1.6 mm and 2 mm, 1.5 mm and 2.2 mm, 1 mm and 3 mm, or another thickness. In some embodiments, the face portion is integrally cast or forged with the body. In some embodiments, the body and the face portion form a one-piece, unitary, monolithic construction.

The golf club head may be described with respect to a coordinate system defined with respect to an ideal striking location. The ideal striking location defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin.

The golf club head may also be described with respect to a central region of the golf club head. For example, the body may be described with respect to a central region defined by a location on the x-axis, such as −25 mm<x<25 mm, −20 mm<x<20 mm, −15 mm<x<15 mm, −30 mm<x<30 mm, or another location. In some embodiments, the aforementioned measurements and other features may be described with respect to the central region, such as maximum face thickness $T_{facemax}$ of 3.5 mm within the central region of the face. In some embodiments, the damper may be described with respect to the central region, such as having a length from the heel portion to the toe portion of between 80% to 150% of the length of the central region, between 30% to 200% of the length of the central region, or between other percentages. In one example, defining a central region at −25 mm<x<25 mm has a length of 50 mm. In this example, providing a damper having a length of 75 mm from the heel portion to the toe portion results in the damper being 150% of the length of the central region.

The golf club head may also be described with respect to other characteristics of the golf club head, such as a face length measured from the par line to the toe portion ending at approximately the Z-up location of the club head. In another example, the golf club head may be described with respect to the score lines of the face, such as from a heelward score line location to a toeward score line location. In yet another example, the golf club head may be described by a blade length measured from a point on the surface of the club head on the toe side that is furthest from the ideal striking location on the x-axis to a point a point on the surface of the club head on the heel side that is furthest from the ideal striking location on the x-axis.

Additional Club Head Structure

Figure 19:
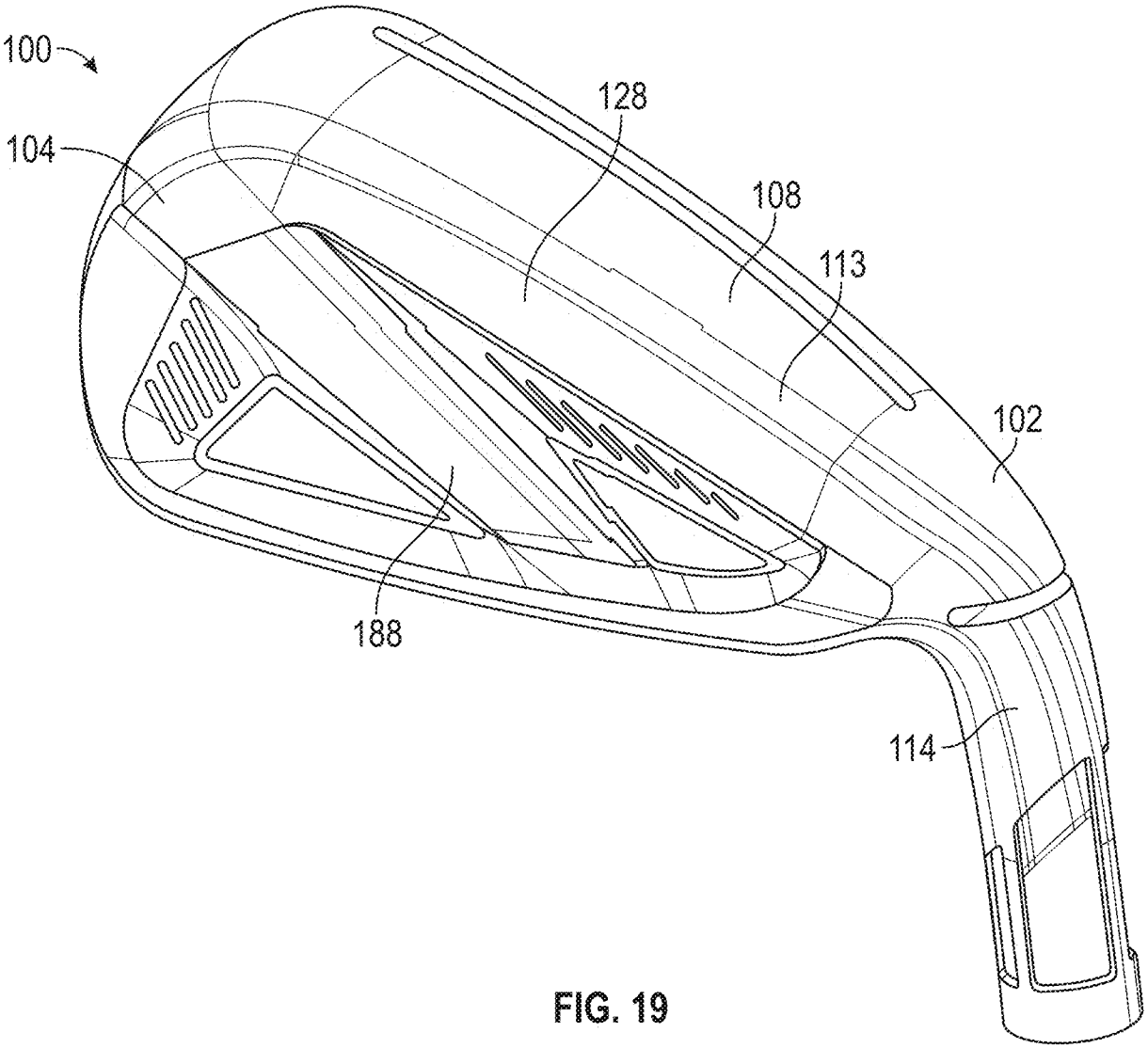
FIG. 19 is a perspective view of a golf club head, from a rear of the golf club head, according to one or more examples of the present disclosure.

FIG. 19 illustrates one embodiment of an iron-type golf club head 100 including a body 113 having a heel portion 102, a toe portion 104, a sole portion 108, a topline portion 106, a rear portion 128, and a hosel 114. The golf club head 100 is manufactured with a cavity 161 (not depicted in FIG. 19), and a shim or badge 188 is adhered, bonded, or welded to the body 100 to produce a cap-back iron, giving the appearance of a hollow-body iron. In this way, the golf club 100 can be manufactured with the performance benefits of a game improvement iron, while providing the appearance of a blade, player's iron, and/or a hollow-body iron.

For example, a cap-back iron can capitalize on the performance benefits of a low CG, cavity-back iron, and the sound and feel benefits of a hollow-body iron. For example, by using a lightweight and rigid shim or badge 188 to close a cavity opening 163 in the cavity 161, the golf club head can provide increased stiffness in the topline portion 106, while maintaining a low CG. Various shim or badge 188 arrangements and materials can be used, and a filler material and/or damper 180 can be included within the cavity 161 to improve sound and feel, while minimizing loss in COR.

In some embodiments, the club head 100 is manufactured using as a unitary cast body 113. In these embodiments, the heel portion 102, toe portion 104, sole portion 108, topline portion 106, rear portion 128, face portion 110 (not depicted in FIG. 19 and including striking face 109), and hosel 114 are cast as a single body 113. A separately formed shim 188 is then received at least in part by the body 113, such as by the topline portion 106 and the rear portion 128. In some embodiments, the club head 100 includes an upper ledge 193 (not depicted in FIG. 19) and a lower ledge 194 (not depicted in FIG. 19) configured to receive the shim 188. In some embodiments, at least a portion of the rear surface of the striking face 109 can be machined or chemical etched before installing the shim 188, such as to finish the surface to increase durability and/or to machine variable face thicknesses across the striking face 109. For example, in embodiments where the striking face 109 is cast from Ti as part of a unitary cast body 113, the rear surface of the striking face can be machined or chemical etched to remove the potentially brittle alpha case layer from the striking face.

The shim 188 is separately formed from and affixed to the unitary cast body 113. For example, the shim 188 can be bonded to exterior of club head (i.e., not bladder molded or co-molded) as a separately formed piece.

The shim 188 is configured to close a cavity opening 163 in the cavity 161 and to form, enclose, or otherwise define an internal cavity. The volume of the internal cavity can be between about 1 cc and about 50 cc, and preferably between 5 cc to 20 cc. In some embodiments, the volume of the internal cavity is between about 5 cc and about 30 cc, or between about 8 cc and about 20 cc. For the purposes of measuring the internal cavity volume herein, the shim 188 is assumed to be removed and an imaginary continuous wall or substantially back wall is utilized to calculate the internal cavity volume.

The club head 100 can have an external water-displaced clubhead volume between about 15 cc and about 150 cc, preferably between 30 cc and 75 cc, preferably between 35 cc and 65 cc, more preferably between about 40 cc and about 55 cc. A water-displaced volume is the volume of water displaced when placing the fully manufactured club head 100 into a water bath and measuring the volume of water displaced by the club head 100. The water-displaced volume differs from the material volume of the club head 100, as the water-displaced volume can be larger than the material volume, such as due to including the enclosed internal cavity and/or other hollow features of the club head. In some embodiments, the external water-displaced clubhead volume can be between about 30 cc and about 90 cc, between about 30 cc and about 70 cc, between about 30 cc and about 55 cc, between about 45 cc and about 100 cc, between about 55 cc and about 95 cc, or between about 70 cc and about 95 cc.

A ratio of the internal cavity volume to external water displaced clubhead volume can be between about 0.05 and about 0.5, between 0.1 and 0.4, preferably between 0.14 and 0.385. In some embodiments, the ratio of the internal cavity volume to external water displaced clubhead volume can between 0.20 and 0.35, or between 0.23 and 0.30.

In some embodiments, the club head 100 is manufactured by casting or forging a body 113 without the face portion 110 and/or striking face 109. In these embodiments, the face portion 110 and/or striking face 109 can be welded or otherwise attached to the body 113. In some embodiments, at least part of the face portion 110 and/or striking face 109 wraps one or more of the heel portion 102, toe portion 104, sole portion 108, and/or topline portion 106. For example, the body 113 can be cast from a steel alloy (e.g., carbon steel with a modulus of elasticity of about 200 GPa) and the face portion 110 and/or striking face 109 can be cast or forged from higher strength steel alloy (e.g., stainless steel 17-4 with a modulus of elasticity of about 210 GPa or 4140 with a modulus of elasticity of about 205 GPa), from a titanium alloy (e.g., with a modulus of elasticity between 110 GPa and 120 GPa), or manufactured from another material. Examples of golf club head constructions are disclosed in U.S. Pat. No. 10,543,409, filed Dec. 29, 2016, issued Jan. 28, 2020, and U.S. Pat. No. 10,625,126, filed Sep. 15, 2017, issued Apr. 21, 2020, which are incorporated herein by reference in their entirety.

In some embodiments, the club head 100 is manufactured with an unfinished, raw surface material. In some embodiments, the club head 100 has a finished surface material, such as with a satin finish, a physical vapor deposition (PVD) coating, a quench polish quench (QPQ) coating, or another finish. In some embodiments, a color can be embedded into the club head 100 material before casting, forging, or another process. In these embodiments, the embedded color gives the club head 100 an appearance of having a finish applied, while allowing the color to last longer than a coating or another finish applied during manufacturing.

The club head 100 can have a Zup between about 10 mm and about 20 mm, more preferably less than 19 mm, more preferably less than 18 mm, more preferably less than 17 mm, more preferably less than 16 mm. As used herein, "Zup" means the CG z-axis location determined according to this above ground coordinate system. Zup generally refers to the height of the CG above the ground plane as measured along the z-axis. In some embodiments, the club head 100 has a CG location (without the shim) between about 17 mm and about 18 mm above the ground plane, or between about 15 mm and about 18 mm above the ground plane.

The club head 100 can have a moment of inertia (MOI) about the CGz (also referred to as "Izz") of between about 180 kg-mm$^2$ and about 290 kg-mm$^2$, preferably between 205 kg-mm$^2$ and 255 kg-mm$^2$, a MOI about the CGx (also referred to as "Ixx") of between about 40 kg-mm$^2$ and about 75 kg-mm$^2$, preferably between 50 kg-mm$^2$ and 60 kg-mm$^2$, and a MOI about the CGy (also referred to as "Iyy") of between about 240 kg-mm$^2$ and about 300 kg-mm$^2$, preferably between 260 kg-mm$^2$ and 280 kg-mm$^2$. For example, by placing discretionary weight at the toe can increase the MOI of the golf club resulting in a golf club that resists twisting and is thereby easier to hit straight even on mishits.

Figure 20:
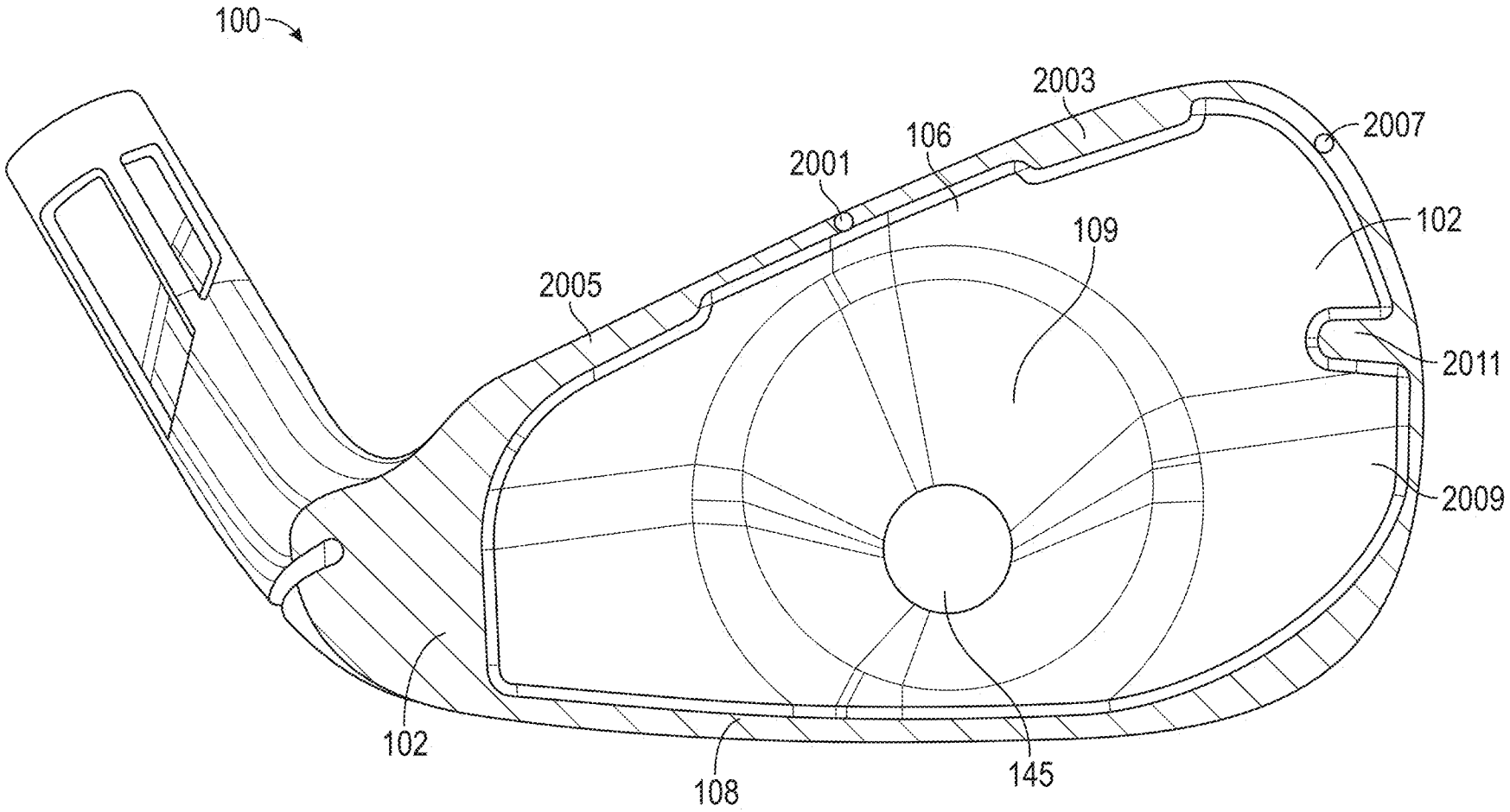
FIG. 20 is a rear cross-sectional view of the golf club head of FIG. 19, according to one or more examples of the present disclosure.

FIG. 20 illustrates cross-sectional back view of the golf club head 100. Numerals 2001, 2003, 2005, 2007, 2007, 2009, and 2011 refer to features of club head 100. The features of club head 100 may also be applicable to club heads 300, 500, and 600. As depicted, the heel portion 102, toe portion 104, sole portion 108, and/or topline portion 106 can include thinned regions. The thinned regions can redistribute discretionary weight within the club head 100. For example, including thinned region 2001 in the topline portion 106 can allow discretionary weight to be redistributed low, such as to lower the center of gravity of the golf club head 100. Targeted thick regions, such as thickened regions 2003, 2005, can be included to retain stiffness in the topline portion 106, such as to maintain acoustic frequencies, producing a better sound and feel of the golf club head 100. Likewise, thinned regions 2007, 2009 and a thickened region 2011 can be included the toe portion 102. For example, the thinned region 2001 can be between about 0.8 mm and about 1.4 mm, preferably between about 0.95 mm and about 1.25 mm. The thinned region 2007 can be between about 0.8 mm and about 2.5 mm, preferably between about 1.95 mm and about 2.25 mm, or between about 0.95 mm and about 1.25 mm.

The striking face 109 can include a donut 145 (also referred to as a thickened central region, localized stiffened regions, variable thickness regions, or inverted cone technology (ICT)). The center of the donut 145 can be the location of a peak thickness of the striking face 109. For example, a peak or maximum thickness of the donut 145 can be between about 2.5 mm and about 3.5 mm, preferably between about 2.75 mm and about 3.25 mm, more preferably between about 2.9 mm and about 3.1 mm. The striking face 109 can have a minimum or off-peak thickness of the donut 145 can be between about 1.4 mm and about 2.6 mm, preferably between about 1.55 mm and about 2.35 mm, more preferably between about 1.70 mm and about 2.2 mm.

The position of the donut 145 relative to a geometric center of the striking face 109 can be different for one or more irons within a set of clubheads. For example, a set of clubheads may include a selection of clubheads, designated based on having different lofts of the striking face 109 at address, typically including numbered irons (e.g., 1-9 irons) and/or wedges (e.g., PW, AW, GW, and LW). The geometric center of the striking face 109 is determined using the procedures described in the USGA "Procedure for Measuring the Flexibility of a Golf Club head," Revision 2.0, Mar. 25, 2005.

For example, in longer irons with less loft (e.g., typically designated with numerically lower numbers), the position of the donut 145 can be lower and more toeward relative to the geometric center of the striking face 109. In shorter irons (e.g., typically designated with numerically higher number) and wedges, the position of the donut 145 can be higher and more heelward relative to the geometric center of the striking face 109. The location of the donut 145 relative to a geometric center of the striking face 109 can influence localized flexibility of the striking face 109 and can influence launch conditions. For example, shifting the donut 145 can stiffen heelward locations the striking face 145 and can add flexibility to toeward locations on the striking face 145. Further, shifting the donut 145 upward, downward, toeward, and heelward can influence launch conditions, such impart a draw bias, fade bias, or to otherwise reduce lateral dispersion produced by the golf club head.

Figure 21:
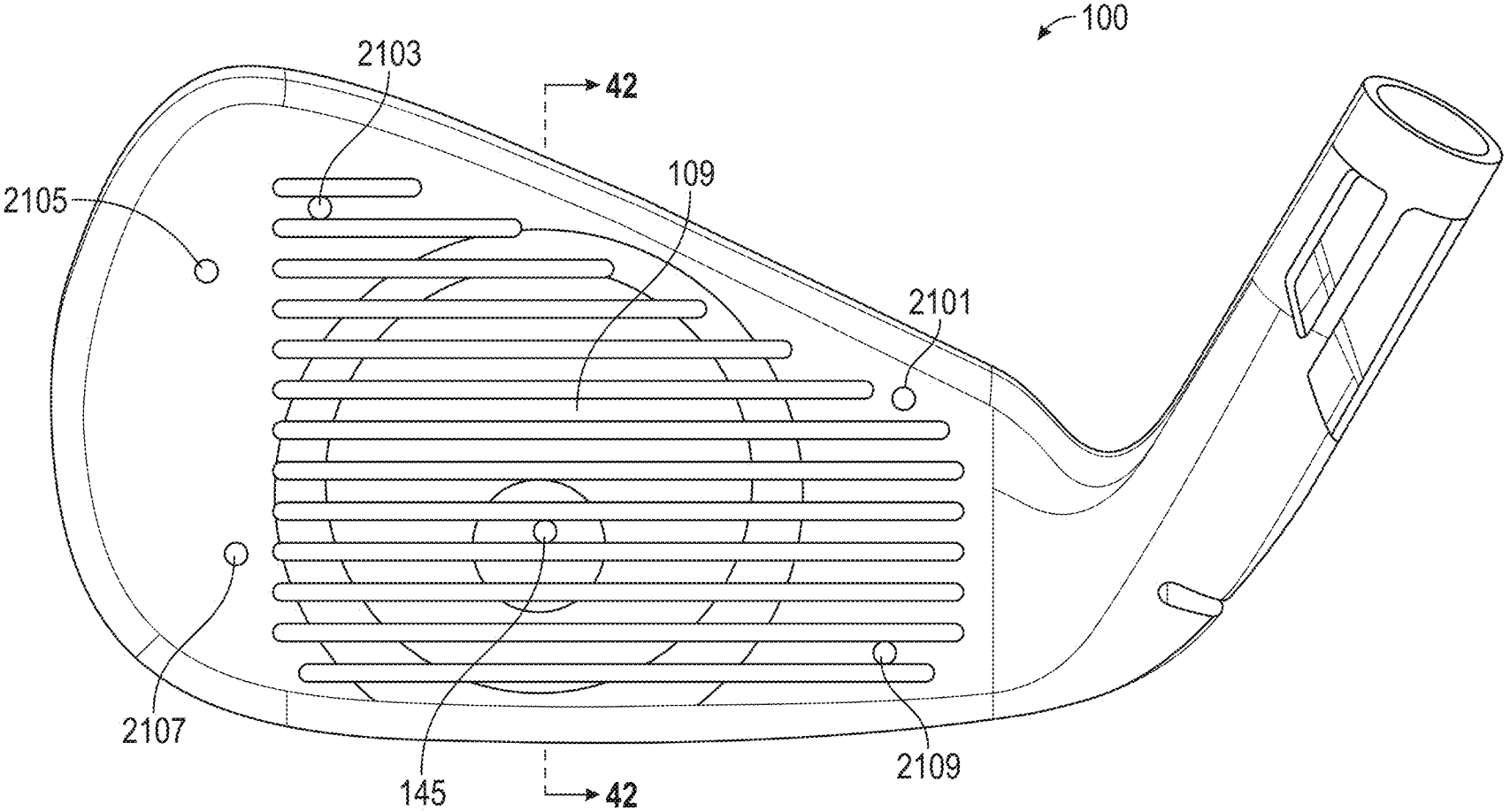
FIG. 21 is a front elevation view of the golf club head of FIG. 19, according to one or more examples of the present disclosure.

FIG. 21 a front elevation view of the golf club head 100 showing a peak/maximum and minimum/off-peak thicknesses of the striking face 109 of club head 100, measured at locations on the striking face 109 without grooves and/or scoring lines. Numerals 2101, 2103, 2105, 2107, 2109 refer to features of club head 100. The features of club head 100 may also be applicable to club heads 300, 500, and 600.

The striking face 109 has a peak or maximum thickness, such as at a center of donut 145, between about 2.5 mm and about 3.5 mm, preferably between about 2.75 mm and about 3.25 mm, more preferably between about 2.9 mm and about 3.1 mm. The striking face 109 has a minimum or off-peak thickness of the donut 145 can be between about 1.4 mm and about 2.6 mm, preferably between about 1.55 mm and about 2.35 mm, more preferably between about 1.70 mm and about 2.2 mm. The maximum face thickness may not be aligned with the geometric center of the face, such as when the donut 145 is shifted lower and toeward to create a draw bias, such as in longer irons (e.g., 1-7 irons). In some embodiments, the donut 145 can be centered higher in short irons and wedges, and the donut 145 can be centered lower in middle and long irons.

For example, the minimum or off-peak thicknesses 2101, 2103, 2105, 2107, 2109 can vary based on iron loft. For example, for long irons with lofts between about 16 degrees and about 25 degrees (e.g., 1-5 irons), the off-peak thicknesses 2101, 2103, 2105, 2107, 2109 are preferably between about 1.6 mm and 1.9 mm, and a peak thickness between about and about 2.95 mm and about 3.25 mm. For example, for mid irons with lofts between about 21.5 degrees and about 32.5 degrees (e.g., 6-7 irons), the off-peak thicknesses 2101, 2103, 2105, 2107, 2109 are preferably between about 1.55 mm and 1.85 mm, and a peak thickness between about 2.9 mm and about 3.2 mm. For example, for short irons and wedges with lofts between about 28.5 degrees and about 54 degrees (e.g., 8 iron-AW), the off-peak thicknesses 2101, 2103, 2105, 2107, 2109 are preferably between about 1.95 mm and 2.25 mm, and a peak thickness between about 2.7 mm and about 3.05 mm. For example, for wedges with lofts between about 49 degrees and about 65 degrees (e.g., SW-LW), the off-peak thicknesses 2101, 2103, 2105, 2107, 2109 are preferably between about 1.6 mm and 1.9 mm, and a peak thickness between about 2.85 and about 3.15.

The striking face 109 of the golf club head 100 has coefficient of restitution (COR) change value between −0.015 and +0.008, the COR change value being defined as a difference between a measured COR value of the striking face 109 and a calibration plate COR value. In some embodiments, the damper 280 and/or filler material reduces the COR of the golf club head by no more than 0.010. A characteristic time (CT) at a geometric center of the striking face 109 is at least 250 microseconds. In some embodiments, the striking face 109 is made from a titanium alloy and a maximum thickness of less than 3.9 millimeters, inclusive. The striking face 109, excluding grooves, has a minimum thickness between 1.5 millimeters and 2.6 millimeters. The striking face 109 is a first titanium alloy and the body is a second titanium alloy, and the first titanium alloy is different than the second titanium alloy.

In some embodiments, the striking face 109 is a titanium alloy and the body 113 is a steel alloy. For example, the body can be a carbon steel with a modulus of elasticity of about 200 GPa and the face can be a higher strength titanium or steel alloy (e.g., stainless (17-4) with a modulus of elasticity of about 210 GPa, 4140 with a modulus of elasticity of about 205 GPa, or a Ti alloy with a modulus of elasticity between 110 GPa and 120 GPa).

In some embodiments, club heads within a set can have bodies 113 and/or striking faces 109 of different alloys. For example, longer irons can have bodies 113 and/or striking faces 109 of a first alloy (e.g., 3-8 irons using 450 SS with a modulus of elasticity of about 190-220 GPa), middle and short irons can have bodies 113 and/or striking faces 109 of a second alloy (e.g., 9 iron-AW using 17-4 PH SS with a modulus of elasticity of about 190-210 GPa), and short irons and wedges can have bodies 113 and/or striking faces 109 of a third alloy (SW-LW using 431 SS with a modulus of elasticity of about 180-200 GPa). Additional and different alloys can be used for different irons and wedges. In some embodiments, the club heads can be cast using alloys with a yield strength between 250 MPa and 1000 MPa, preferably greater than 500 MPa. Preferably, the iron-type club heads having a loft between 16 degrees and 33 degrees are formed from a material having a higher modulus of elasticity than the iron-type club heads having a loft greater than 33 degrees. Preferably, the iron-type club heads having a loft between 16 degrees and 33 degrees are formed from a material having a nickel content of at least 5% by weight and a Copper content of no more than 2% by weight.

In some embodiments, short irons and/or wedges can be manufactured using a different alloy and can have a thicker face than mid and long irons. In some embodiments, club heads with lofts greater 40 degrees can be manufactured using a different alloy (e.g., 17-4 PH SS) than club heads with lofts below 40 degrees (e.g., 450 SS). In some embodiments, a relatively stronger alloy may be required to cast ledges 193, 194 for receiving the shim 188. In embodiments without ledges 193, 194, a relatively weaker alloy may be used.

In some embodiments, the club head 100 has a blade length between about 75 mm and about 86.5 mm, preferably between 77.5 mm and 84 mm. In some embodiments, the club head 100 has a topline width between about 5.5 mm and about 11 mm, preferably between 7 mm and 9 mm. In some embodiments, the club head 100 has a toeward face height between about 52 mm and about 68 mm, preferably between 54 mm and 66 mm. In some embodiments, the club head 100 has a PAR face height between about 28 mm and about 43 mm, preferably between 30 mm and 41 mm. In some embodiments, the club head 100 has a hosel to PAR width between about 4 mm and about 8 mm, preferably between 5 mm and 7 mm.

Figure 22:
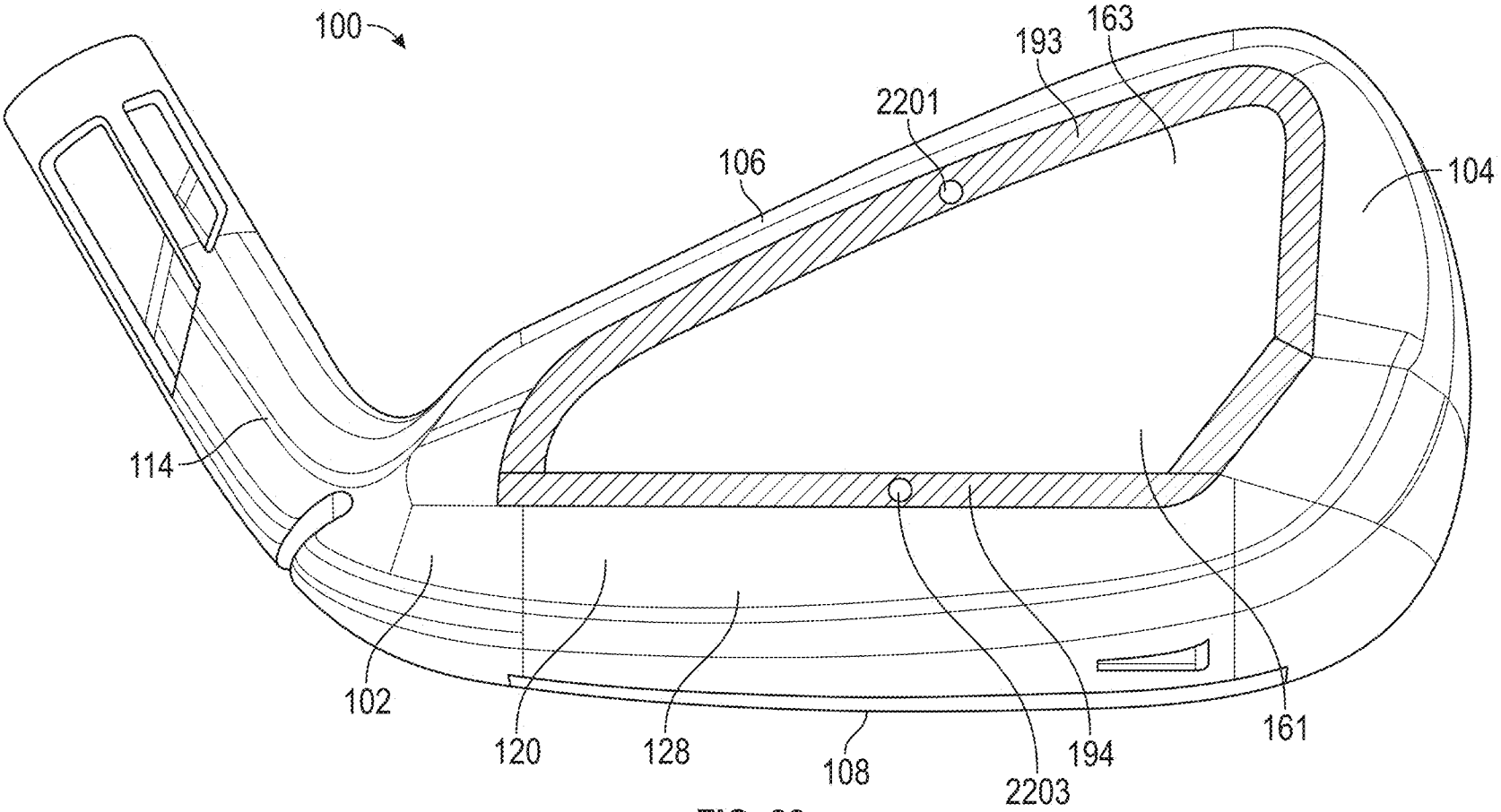
FIG. 22 is a back perspective view of a golf club head of FIG. 19, according to one or more examples of the present disclosure.

FIG. 22 illustrates a back perspective view of the golf club head 100 showing an upper ledge 193 and a lower ledge 194 configured to receive the shim or badge 188 (not depicted in FIG. 22). Numerals 2201 and 2203 refer to features of club head 100. The features of club head 100 may also be applicable to club heads 300, 500, and 600. The shim or badge 188 can close the cavity opening 163, enclosing and defining an internal cavity. The body 113 includes a heel portion 102, a toe portion 104, a sole portion 108, a topline portion 106, a rear portion 128, and a hosel 114. For example, the sole portion 108 extends rearwardly from a lower end of the face portion 110 to a lower end of the rear portion 128. A sole bar 135 can define a rearward portion of the sole portion 108. A cavity 161 can defined by a region of the body 113 rearward of the face portion 110, forward of the rear portion 128, above the sole portion 108, and below the top-line portion 106.

The upper ledge 193 can be formed at least as part of the topline portion 106 and the lower ledge 194 can be formed at least as part of the rear portion 120. In some embodiments, the upper ledge 193 is formed at least as part of both the topline portion 106 and the rear portion 120. In some embodiments, the lower ledge 194 is formed at least as part of both the topline portion 106 and the rear portion 120.

The shim 188 (not depicted in FIG. 22) can be received at least in part by the upper ledge 193 and the lower ledge 194. The shim 188 is configured to close an opening 163 in the cavity 161, enclosing an internal cavity volume. The upper ledge 193 and the lower ledge 194 can be planar or non-planar, and are shaped to receive at least a portion of the shim 188 with a corresponding planar or non-planar shape.

In some embodiments, the ledges 193, 194 can be discontinuous, such as provided as a one or more partial ledges and/or a series of tabs forming a discontinuous ledge. In some embodiments, a sealing wiper can be provided around shim 188 to prevent water from intruding into the cavity 161. The sealing wiper can be a gasket or another material provided around shim, such as to seal a discontinuous ledge.

For example, the upper ledge 193 has an upper ledge width 2201 with a width between about 0.5 mm and about 4.0 mm, preferably 3.25 mm, and a thickness between about 0.5 mm and about 1.5 mm, preferably about 1.0 mm. The lower ledge 194 has a lower ledge width 2203 has a width between about 0.1 mm and about 3.0 mm, preferably about 2.25 mm, and a thickness between about 0.8 mm and about 2 mm, preferably about 1.3 mm. In some embodiments, the width and thickness of the upper ledge 193 and/or lower ledge 194 are minimized to allow additional discretionary weight to be relocated in the clubhead 100, such as lower in the clubhead 100. In some embodiments, the upper ledge 193 is wider than the lower ledge 194 to provide additional structural support for the topline portion 106, such as to improve feel, sound, and to better support the striking face 109. The shim has an area as projected onto the face portion of between about 1200 $mm^2$ and about 2000 $mm^2$, more preferably between 1500 $mm^2$ and 1750 $mm^2$.

According to the embodiment depicted in FIG. 22, the upper ledge 193 extends from in a general heel-to-toe direction from the heel portion 102 to the toe portion 104 and across the topline portion 106, such as from the lower heelside of the cavity opening 163 to the toeside of the cavity opening 163, such as forming an upper edge, heelward edge, and toeward edge of the cavity opening 163. The lower ledge 194 extends in a general heel-to-toe direction across the rear portion 120, such as from the lower heelside of the cavity opening 163 to the lower toeside of the cavity opening 163, such as forming a lower edge of the cavity opening 163. In some embodiments, the upper ledge 193 can have an area between about 75 $mm^2$ and about 750 $mm^2$, preferably between 200 $mm^2$ and 500 $mm^2$. The lower ledge 194 can have an area between about 25 $mm^2$ and about 250 $mm^2$, preferably between 100 $mm^2$ and 300 $mm^2$. A total ledge area of the upper and lower ledges 193, 194, as projected onto the face portion 110, can be relatively small compared to an area of the cavity opening 163. For example, the total ledge area can be between about 100 $mm^2$ and about 1000 $mm^2$, preferably between about 300 $mm^2$ and about 800 $mm^2$.

The area of the cavity opening 163, as projected onto the face portion 110, can be between about 800 $mm^2$ and about 2500 $mm^2$, preferably between 1200 $mm^2$ and 2000 $mm^2$, more preferably between 800 $mm^2$ and 1400 $mm^2$ or more preferably between 300 $mm^2$ and about 800 $mm^2$. For example, a ratio of the total ledge area to the area of the cavity opening 163 can be between about 4% and about 55%, preferably between 30% and 45%.

The total ledge area of the upper and lower ledges 193, 194, as projected onto the face portion 110, can also be relatively small compared to an area of the shim 188, as projected onto the face portion 110. For example, a ratio of the total ledge area to the area of the shim 188 can be between about 15% and about 63%, preferably between 25% and 40%. A ratio the area of the cavity opening 163, as projected onto the face portion 110, to the area of the shim 188, as projected onto the face portion 110, is at least about 50%, 53%, 56%, 59%, 62%, 65%, 68%, 71%, and no more than about 100%.

In some embodiments, the upper ledge 193 and/or lower ledge 194 can be eliminated, and the shim or badge 188 can be received at least in part by the topline portion 106 and/or rear portion 128. For example, the shim or badge 188 can be bonded directly to a surface of the topline portion 106 and/or rear portion 128. In another example, the topline portion 106 and/or the rear portion 128 can include a notch, slot, channel, or groove for receiving at least a portion of the shim 188. In this example, the shim 188 can first hook into the topline portion 106 or the rear portion 128, then the shim 188 can be rotated and bonded to the rear portion 128 or the topline portion 106, respectively.

Figure 23:
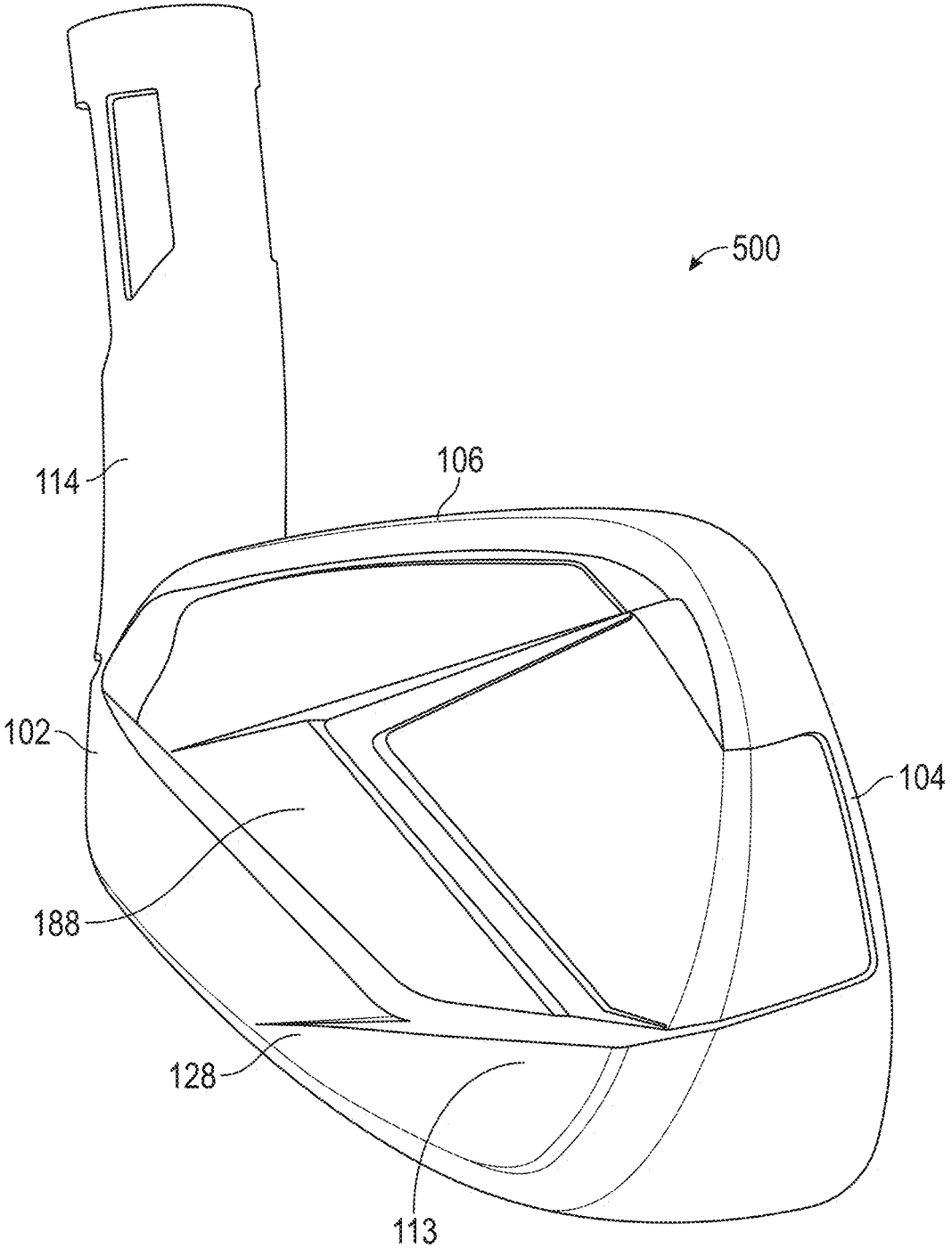
FIG. 23 is a perspective view of a golf club head, from a rear of the golf club head, according to one or more examples of the present disclosure.

FIG. 23 illustrates another embodiment of an iron-type golf club head 500 including a body 113 having a heel portion 102, a toe portion 104, a sole portion 108, a topline portion 106, a rear portion 128, and a hosel 114. The golf club head 500 is manufactured with a cavity 161 (not depicted in FIG. 23), and a shim or badge 188 is adhered, bonded, or welded to the body 100 to produce a cap-back iron, giving the appearance of a hollow-body iron. In this embodiment, the shim 188 wraps into at least a portion of the toe portion 104. In some embodiments, the shim 188 also wraps into at least a portion of the heel portion 102, toe portion 104, sole portion 108, topline portion 106, and/or rear portion 128. Various shim or badge 188 arrangements and materials can be used, and a filler material and/or damper 180 can be included within the cavity 161 to improve sound and feel, while minimizing loss in COR.

Although golf club heads 100, 500 can have different shims 188, other design elements of the golf club heads 100, 500 can be used interchangeably between the embodiments. For example, the dimensions, material properties, and other design elements that are discussed with respect to golf club head 100 can be incorporated into the club head 500, and vice versa. For example, both club heads 100, 500 can be configured to receive a damper 180, 280 and/or a filler material within an internal cavity defined by affixing a shim or badge 188 to the golf club head 100, 500.

Figure 24:
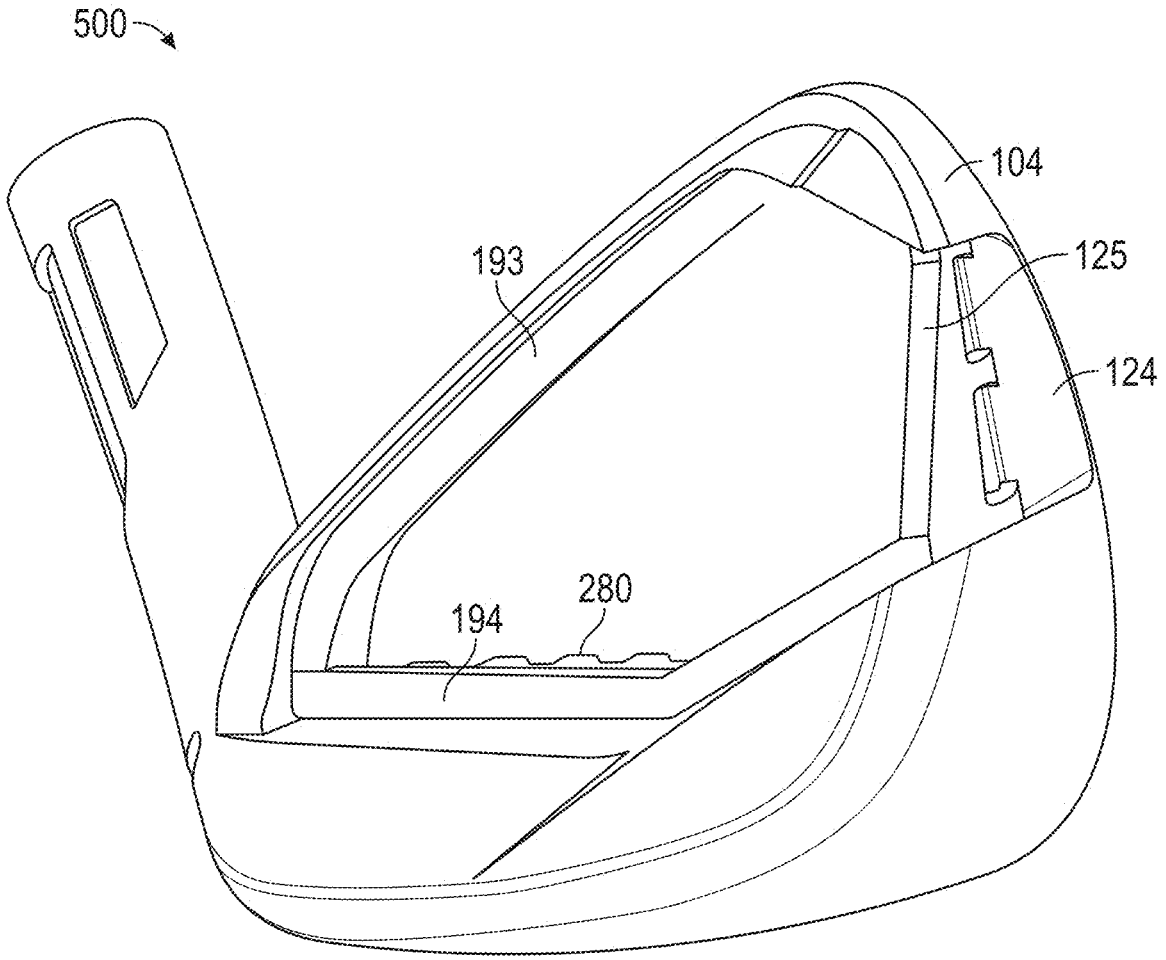
FIG. 24 is a rear perspective view of the golf club head of FIG. 23 without a shim or badge installed, according to one or more examples of the present disclosure.

FIG. 24 illustrates the iron-type golf club head 500 without the shim or badge 188 installed. In some embodiments, in addition to the club head 500 including an upper ledge 193 and a lower ledge 194 configured to receive the shim 188, the club head 500 can also include a toeside ledge 125 in the toe portion 104 for receiving at least a portion of the shim 188 in the toe portion 104. In these embodiments, at least a portion of the shim 188 is received in and/or enclosing a toeside cavity 124.

In some embodiments, a damper 280 is installed in the cavity 161 before installing the shim or badge 188. In some embodiments, the damper 280 is received entirely within the lower undercut region 164, which is defined within the cavity 161 rearward of the face portion 110, forward of the sole bar 135, and above the sole portion 108. In some embodiments, at least a portion of the damper 280 is received within the lower undercut region 164. In some embodiments, a filler material (e.g., a foam or another material) can be injected into the cavity 161 after installing the shim or badge 188.

Figure 25:
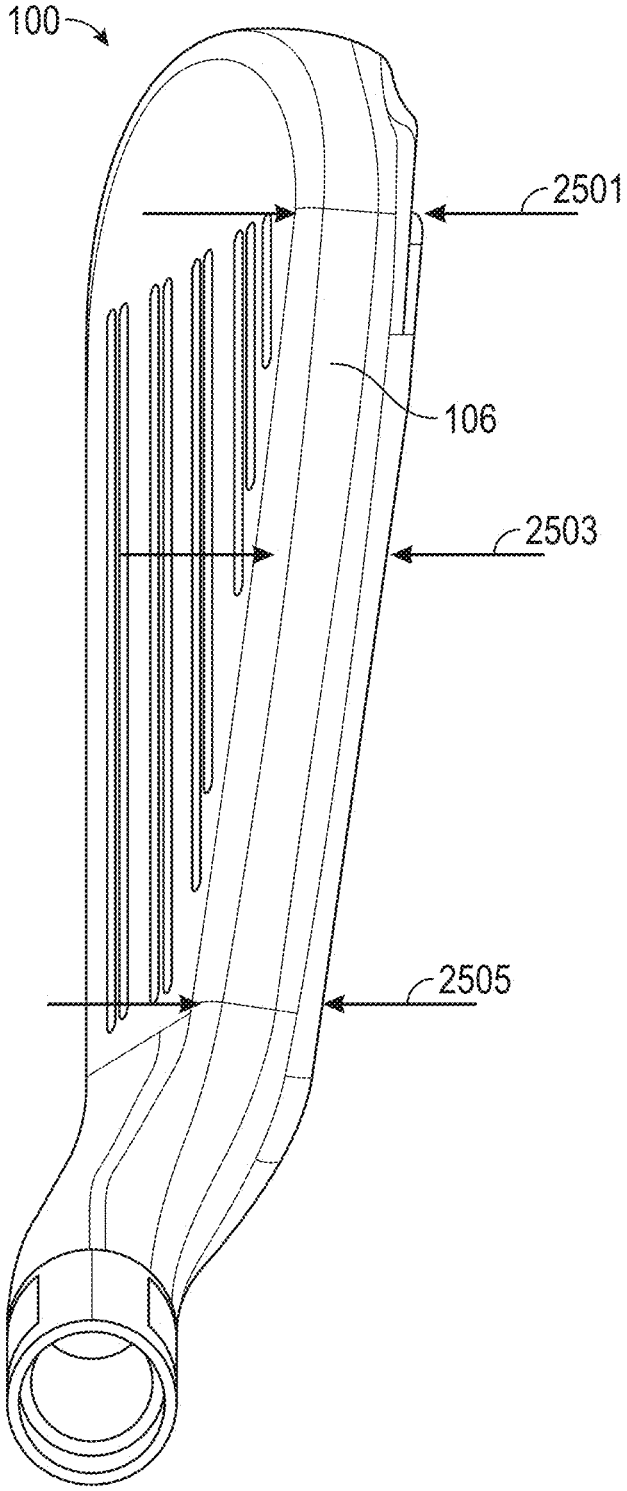
FIG. 25 is a top perspective view of a golf club head of FIG. 19, according to one or more examples of the present disclosure.

FIG. 25 illustrates is a top perspective view of a golf club head 100 showing topline portion 106 and hosel 114. Numerals 2501, 2503, and 2505 refer to features of club head 100. The features of club head 100 may also be applicable to club heads 300, 500, and 600. The topline portion 106 can have a topline width, measured at various locations 2501, 2503, 2505 across the topline portion 106, between about 5 mm and about 10 mm, preferably between 7 mm and 9 mm. In some embodiment the topline width varies at the locations 2501, 2503, 2505. In some embodiments, longer irons in a set can have a wider topline width than shorter irons. For example, short irons and wedges (e.g., 9 iron-LW) can have a topline width between about 7.15 mm and about 7.65 mm, mid irons (e.g., 8 iron) can have a topline width between about 7.55 mm and about 8.05 mm, and long irons (e.g., 4-7 iron) can have a topline width between about 7.75 mm and about 8.25 mm. The aforementioned dimensions are also applicable to golf club heads 300, 500, and 600.

In some embodiments, a weight reducing feature can be used to selectively reduce the wall thickness around the hosel 114, such as for freeing up discretionary weight in the club head 100. For example, the weight reducing features removing weight from the hosel 114 can be used to remove mass from the hosel 114 wall thickness. The weight reducing feature can remove at least 1 g, such as at least 2 g, such as at least 3 g, such as at least 4 g of mass from the hosel. In the design shown, about 4 g was removed from the hosel 114 and reallocated to lower in the club head, resulting in a downward Zup shift of about 0.6 mm while maintaining the same overall head weight. The flute design shown can use flutes on the front side, rear side, and underside of the hosel 114, making the flutes less noticeable from address. By employing weight reducing features on the side and/or underside of the hosel, the golf club head can have a traditional look, while providing the performance benefits of weight reducing features and weight redistribution in the golf club head. For example, U.S. Pat. No. 10,265,587, incorporated herein by reference in its entirety, discloses additional details on weight reducing features.

In some embodiments, variable length hosels can be used within a set of irons. For example, shorter hosels can be used to redistribute mass lower in the club head 100. In some embodiments, a peak hosel height can be less than a peak toe height relative to ground plane when club head is at address.

Figure 26:
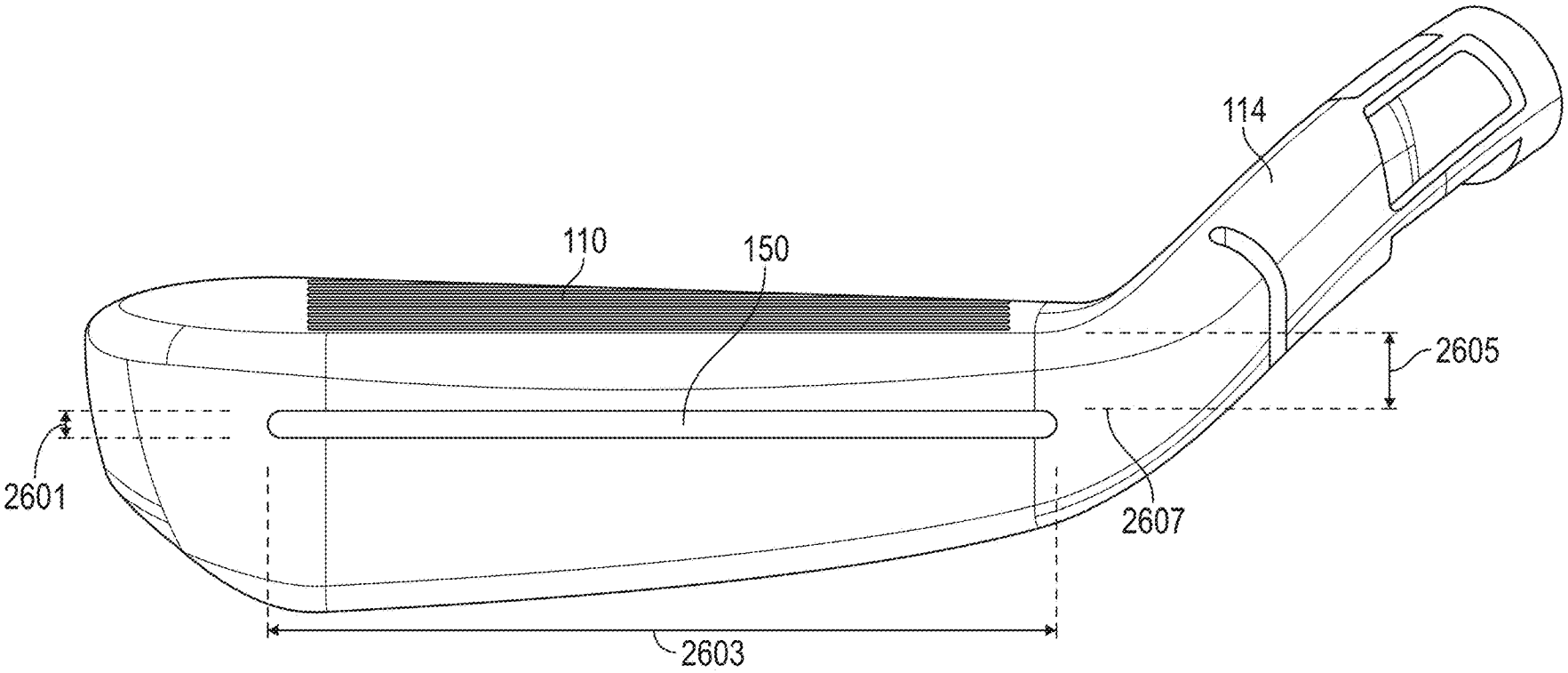
FIG. 26 is a bottom perspective view of a golf club head of FIG. 19, according to one or more examples of the present disclosure.

FIG. 26 illustrates is a bottom perspective view of a golf club head 100 showing a hosel 114, a channel 150 and a weld point 2607. Numerals 2601, 2603, 2605, and 2607 refer to features of club head 100. The features of club head 100 may also be applicable to club heads 300, 500, and 600. The hosel 114 includes a weight reducing feature can be used to selectively reduce the wall thickness around the hosel 114. The flute design shown can use flutes on the front side, rear side, and underside of the hosel 114, making the flutes more noticeable from below. By employing weight reducing features on the side and/or underside of the hosel, the golf club head can have a traditional look, while providing the performance benefits of weight reducing features and weight redistribution in the golf club head.

The channel 150 can have a channel width 2601 between 1.5 mm and 2.5 mm, preferably between 1.85 mm and 2.15 mm. The channel 150 can have a channel length 2603 between about 55 mm and about 70 mm, preferably between 63.85 mm and 64.15 mm. A channel setback 2605 from the leading edge between about 5 mm and about 20 mm, preferably between about 5 mm and about 9 mm, more preferably between 6 mm and 8 mm, more preferably between 6.35 mm and 7.35 mm. In embodiments with striking faces 109 welded to the body 113, a weld point 2607 can be offset from the leading edge, such as by the channel setback 2605.

Figure 27:
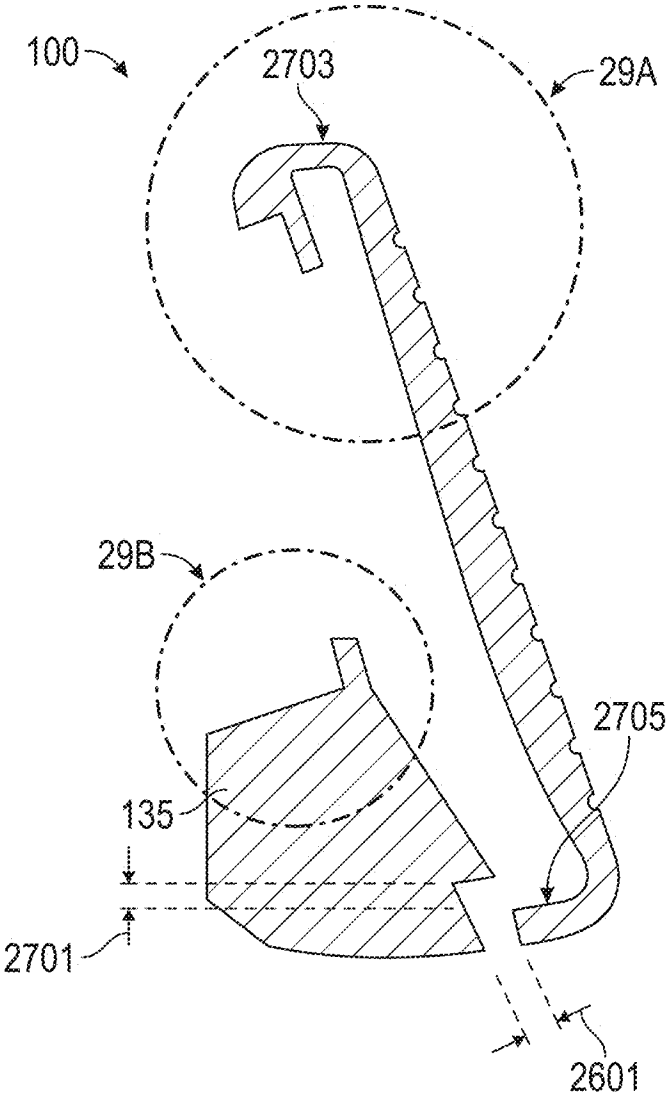
FIG. 27 is a side cross-sectional view of the golf club head of FIG. 19, according to one or more examples of the present disclosure.

FIG. 27 is a side cross-sectional view of the golf club head 100 showing a lower undercut region 164 in lower region 29B and an upper undercut region 165 in upper region 29A. Numerals 2701, 2703, and 2705 refer to features of club head 100. The features of club head 100 may also be applicable to club heads 300, 500, and 600. The channel 150 has a width 2601 and a channel depth 2701 beyond the sole portion 108. The channel depth 2701 beyond the sole portion can be between about 1.0 mm and about 3.0 mm, preferably between 1.5 mm and 2.5 mm, preferably between 1.85 mm and 2.15 mm. The sole portion 108 has a sole thickness 2705 of between about 1.5 mm and about 3 mm, more preferably between 1.85 mm and 2.35 mm. A total channel depth can be a combination of the sole thickness 2705 and the channel depth 2701 beyond the sole portion 108. A topline thickness 2703 of the topline portion 106 can be between about 0.5 mm and about 2 mm, more preferably between 0.95 mm and 1.25 mm.

The sole bar 135 has a height, measured as the distance perpendicular from the ground plane (GP) to a top edge of the sole bar 135 when the golf club head is in proper address position on the ground plane. For example, the sole bar height can be between about 7.5 mm and about 35 mm, preferably between 10 mm and 30 mm, more preferably 15 mm and 26 mm. In some embodiments, the sole bar 135 can have a peak height between about 10 mm and about 30 mm, preferably between 15 mm and 26 mm. The sole bar 135 can have an off-peak height between about 7.5 mm and about 26 mm, preferably between 7.5 mm and 15 mm. A ratio of the sole bar height to the sole thickness 2705 can be between about 2:1 and about 20:1, more preferably 5:1, 6:1, 10:1, or 15:1. A ratio of the sole thickness 2705 to the sole bar height can be between about 1:25 and about 1:2.5, preferably between 1:14 and 1:7.

Figure 28:
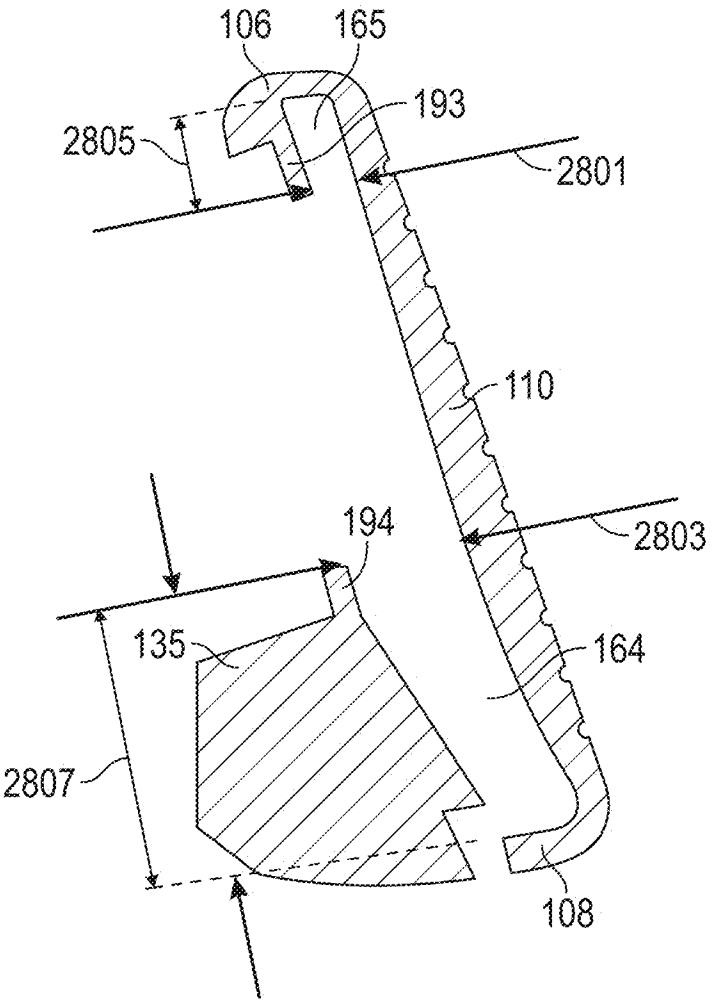
FIG. 28 is a side cross-sectional view of the golf club head of FIG. 19, according to one or more examples of the present disclosure.

FIG. 28 is a side cross-sectional view of the golf club head 100 of FIG. 19 showing the topline portion 106, the sole portion 108, the striking face 110, the sole bar 135, the upper ledge 193, the lower ledge 194, the lower undercut region 164 and the upper undercut region 165. Numerals 2801, 2803, 2805, and 2807 refer to features of club head 100. The features of club head 100 may also be applicable to club heads 300, 500, and 600.

The lower undercut region 164 is defined within the cavity rearward of the face portion 110, forward of the sole bar 135, and above the sole portion 108. The lower undercut region 164 can be forward of the lower ledge 194. For example, the lower ledge 194 can extend above the sole bar 135 to further define the lower undercut region 164. An upper undercut region 165 is defined within the cavity rearward of the face portion 110, and below the topline portion 106. The upper undercut region 165 can be forward of the upper ledge 193. For example, upper ledge 193 can extend below the topline portion 106 to further define the upper undercut region 165 forward of an upper ledge 193. In various embodiments, the upper ledge 193 can extend inward toward the face portion 110, outward away from the face portion 110, or downward parallel with the face portion 110.

The upper undercut region 165 can be defined at least in part by the upper ledge 193, and includes an upper undercut width 2801 and an upper undercut depth 2805. The upper undercut width 2801 can be between about 1.5 mm and about 7.5 mm, preferably between 2 mm and 6.5 mm, more preferably about 2.75 mm. The upper undercut depth 2805 can be between about 3 mm and about 15 mm, preferably between 4 mm and 13 mm, more preferably about 5 mm. A ratio of the upper undercut depth 2805 to the upper undercut width 2801 is at least 1.25, preferably at least 1.5, preferably at least 1.75. For example, an upper undercut depth 2805 can be 5 mm and upper undercut width 2801 as 2.75 mm, resulting in a ratio of about 1.8. The upper undercut width 2801 and the upper undercut depth 2805 is measured at a cross-section taken at the geometric center face or at a scoreline midline. Alternatively, the upper undercut depth 2805 is measured in a cross-section through 5 mm toeward or 5 mm heelward of the geometric center face in the y-z plane.

The lower undercut region 164 can be defined at least in part by the lower ledge 194, and includes a lower undercut width 2803 and a lower undercut depth 2807. The lower undercut width 2803 can be between about 2 mm and about 15 mm, preferably between 4 mm and 6 mm. The lower undercut depth 2807 can be between about 10 mm and about 30 mm, preferably between 11 mm and 26 mm. The lower undercut width 2803 and the lower undercut depth 2807 is measured at a cross-section taken at the geometric center face or at a scoreline midline.

In some embodiments, the lower undercut depth 2807 is greater than the upper undercut depth 2806, such as having a ratio of at least 2:1, preferably 2.5:1, more preferably 3:1.

In some embodiments, in order to cast a unitary body 113 without metal defects, a ratio of an undercut width to undercut depth should not exceed about 1:3.5. For example, to cast the golf club head 113 as a single piece (i.e., a unitary casting), the ratio of undercut width to undercut depth should not be greater than about 1:3.5 or 1:3.6 to allow for ample space for wax injection pickouts within the undercut. The ratio of the lower undercut width 2803 to the lower undercut depth 2807 can be between about between about 1:4.0 and about 1:2.0, preferably between about 1:3.5 and about 1:2.5. Table 1 below provides examples of lower undercut widths 2803, lower undercut depths 2807, and corresponding ratios:

TABLE 1

Exemplary Lower Undercut Ratios

| Example No. | Lower Undercut Width | Lower Undercut Depth | Ratio |
|---|---|---|---|
| 1 | 6.5 mm | 17 mm | 1:2.6 |
| 2 | 5.25 mm | 19 mm | 1:3.6 |
| 3 | 4.5 mm | 15.3 mm | 1:3.4 |
| 4 | 4.7 mm | 16.9 mm | 1:3.6 |
| 5 | 5.2 mm | 17.9 mm | 1:3.4 |
| 6 | 7.5 mm | 26 mm | 1:3.5 |

In embodiments where the club head 113 comprises a striking face 110 welded to the body, and in embodiments where the lower undercut region 164 and/or the upper undercut region 165 are machined in the club head 113, the ratio of width to depth of an undercut can be less than 25-28%.

Figure 29A:
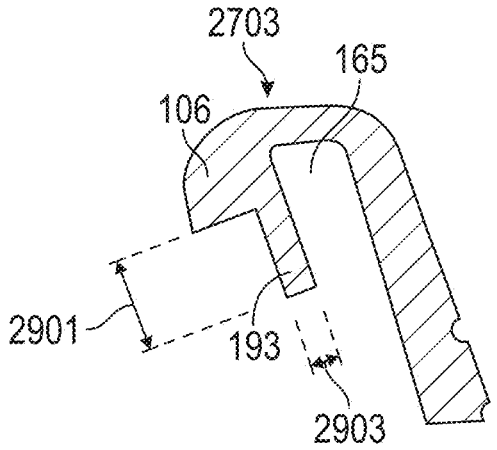
FIG. 29A is a side cross-sectional view of the upper region of FIG. 27, according to one or more examples of the present disclosure.

FIG. 29A is a side cross-sectional view of the upper region 29A of FIG. 27. Numerals 2901 and 2903 refer to features of club head 100. The features of club head 100 may also be applicable to club heads 300, 500, and 600. The upper region 29A includes the upper undercut region 165. The upper undercut region 165 is at least in part defined by the upper ledge 193. The upper ledge 193 has an upper ledge width 2901 is between about 0.5 mm and about 4.0 mm, preferably 3.25 mm, and an upper ledge thickness 2903 between about 0.5 mm and about 1.5 mm, preferably about 1.0 mm. The topline portion 106 has a topline thickness 2703 is between about 0.5 mm and about 2 mm, more preferably between 0.95 mm and 1.25 mm.

The upper undercut region 165 can be defined as a cavity formed rearward of the face portion 110, below the topline portion 106, forward of the upper ledge 193, heelward of the toe portion 104, and toeward of the heel portion 102. In some embodiments, the upper undercut region 165 can be defined as a cavity formed rearward of the face portion 110, forward of and below the topline portion 106, heelward of the toe portion 104, and toeward of the heel portion 102.

Figure 29B:
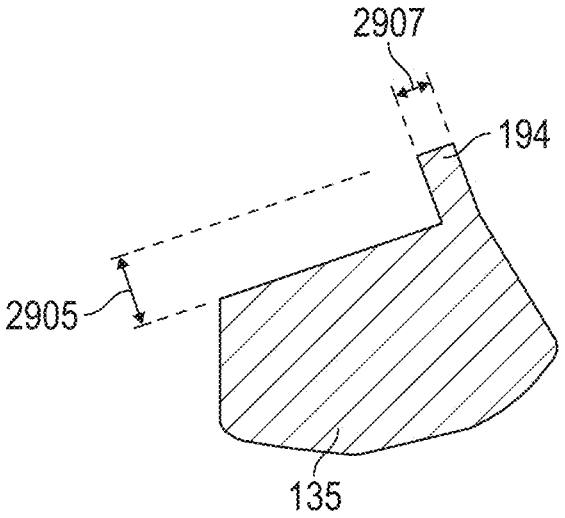
FIG. 29B is a side cross-sectional view of a lower region of FIG. 27, according to one or more examples of the present disclosure.

FIG. 29B is a side cross-sectional view of the lower region 29B of FIG. 27. Numerals 2905 and 2907 refer to features of club head 100. The features of club head 100 may also be applicable to club heads 300, 500, and 600. The lower region 29B includes the lower ledge 164. The lower ledge 194 has a lower ledge width 2905 is between about 0.1 mm and about 3.0 mm, preferably about 2.25 mm, and a lower ledge thickness 2907 is between about 0.8 mm and about 2 mm, preferably about 1.3 mm.

Referring back to FIG. 28, the lower undercut region 164 is at least in part defined by the lower ledge 194. For example, the lower undercut region 164 can be defined as a cavity formed rearward of the face portion 110, forward of the lower ledge 194 and the sole bar 135, heelward of the toe portion 104, and toeward of the heel portion 102. In some embodiments, lower undercut region 164 can be defined as a cavity formed rearward of the face portion 110, forward of the sole bar 135, heelward of the toe portion 104, and toeward of the heel portion 102.

Damper and/or Filler Materials

Figure 30:
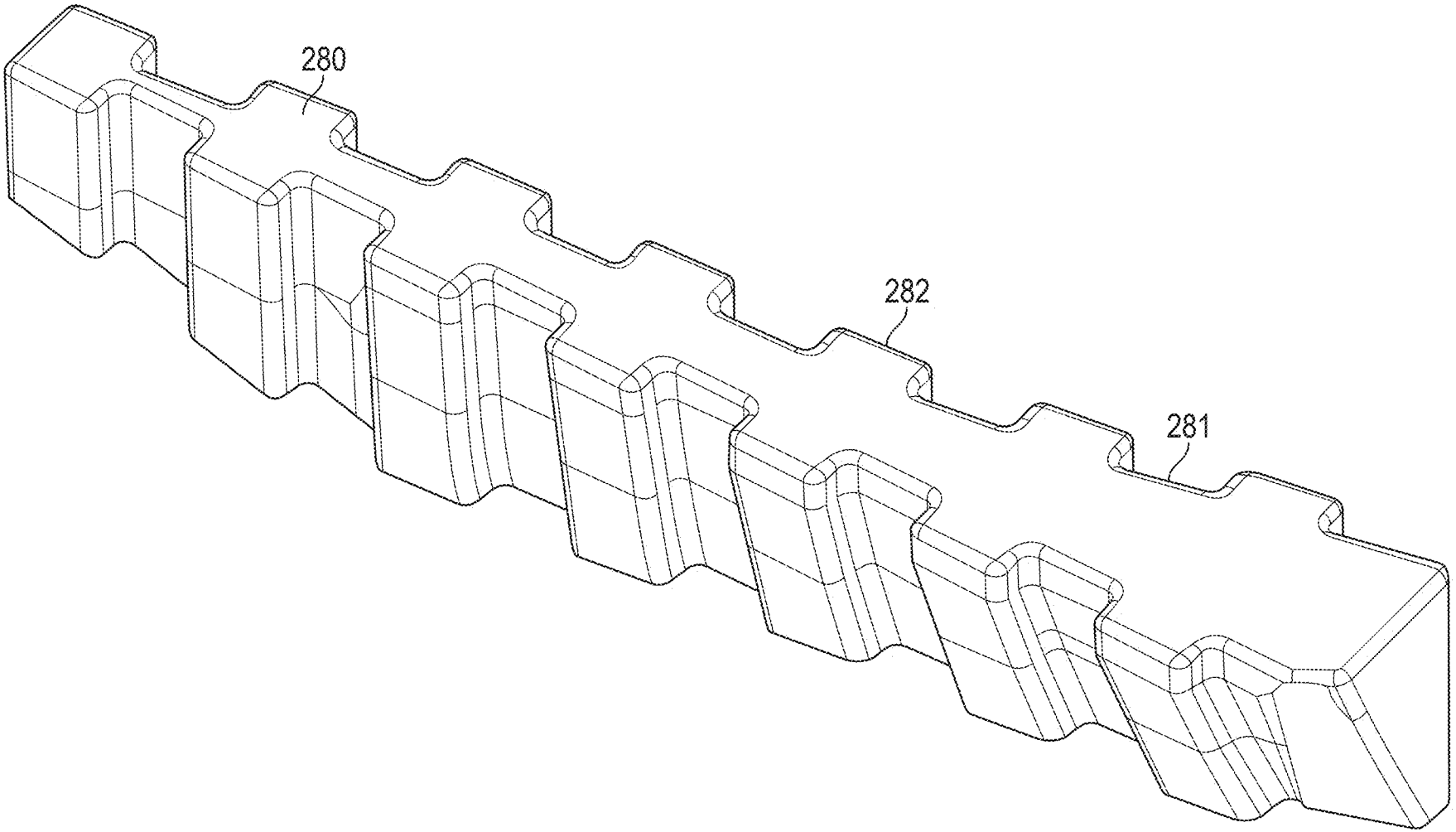
FIG. 30 is a perspective view of the damper from the golf club head of FIG. 19, according to one or more examples of the present disclosure.

FIG. 30 is a perspective view of a damper 280 from the golf club head 100 of FIG. 19. The damper 280 includes one or more projections 282. For example, when the damper 280 is installed, each of the projections 282 can make contact with a rear surface of the striking face 110 or a front surface of the sole bar 135. The damper 280 also includes one or more relief cutouts 281, such as between the projections 282, which do not contact the rear surface of the striking face 110 or the front surface of the sole bar 135.

In some embodiments, the damper 280 is a combination of a combination of Santoprene and Hybrar, such as with a hybrar content between about 10% and about 40%, more particularly 15% or 30%. Other materials can also be used. The damper 280 can also be co-molded using different materials with different durometers, masses, densities, colors, and/or other material properties. In some embodiments, using a damper 280 can lower the CG when compared to using a filler material. Additional weighted materials can also be included in the damper 280, such as to further lower CG of the golf club head, such as using weight plugs or inserts made from a Tungsten alloy, another alloy, or another material.

In some embodiments, a damper 280 and/or a filler material is only used in a subset of clubs within a set. For example, some club heads 100 can provide adequate sound and feel without a damper 280 and/or a filler material. In this example, only long and mid irons (e.g., 2-8 irons) include a damper 280 and/or a filler material. Short irons and wedges (e.g., 9 iron-LW) can be manufactured without a damper 280 or a filler material. In these embodiments, each club head 100 within a set can be manufactured with or without the damper 280 and/or the filler material based on the sound and feel characteristics independent to each club head 100.

In some embodiments, a filler material can be used in place of the damper 280. In other embodiments, a filler material can be used in conjunction with the damper 280. For example, a foam, hot melt, epoxy, adhesive, liquified thermoplastic, or another material can be injected into the club head 100 filling or partially filling the cavity 161. In some embodiments, the filler material is heated past melting point and injected into the club head 100.

In some embodiments, the filler material is used to secure the damper 280 in place during installation, such as using hot melt, epoxy, adhesive, or another filler material. In some embodiments, a filler material can be injected into the club head 100 to make minor changes to the weight of the club head 100, such as to adjust the club head for proper swing weight, to account for manufacturing variances between club heads, and to achieve a desired weight of each head. In these embodiments, the club head weight can be increased between about 0.5 grams and about 5 grams, preferably up to 2 grams.

Shim Structure and Materials

Figure 31:
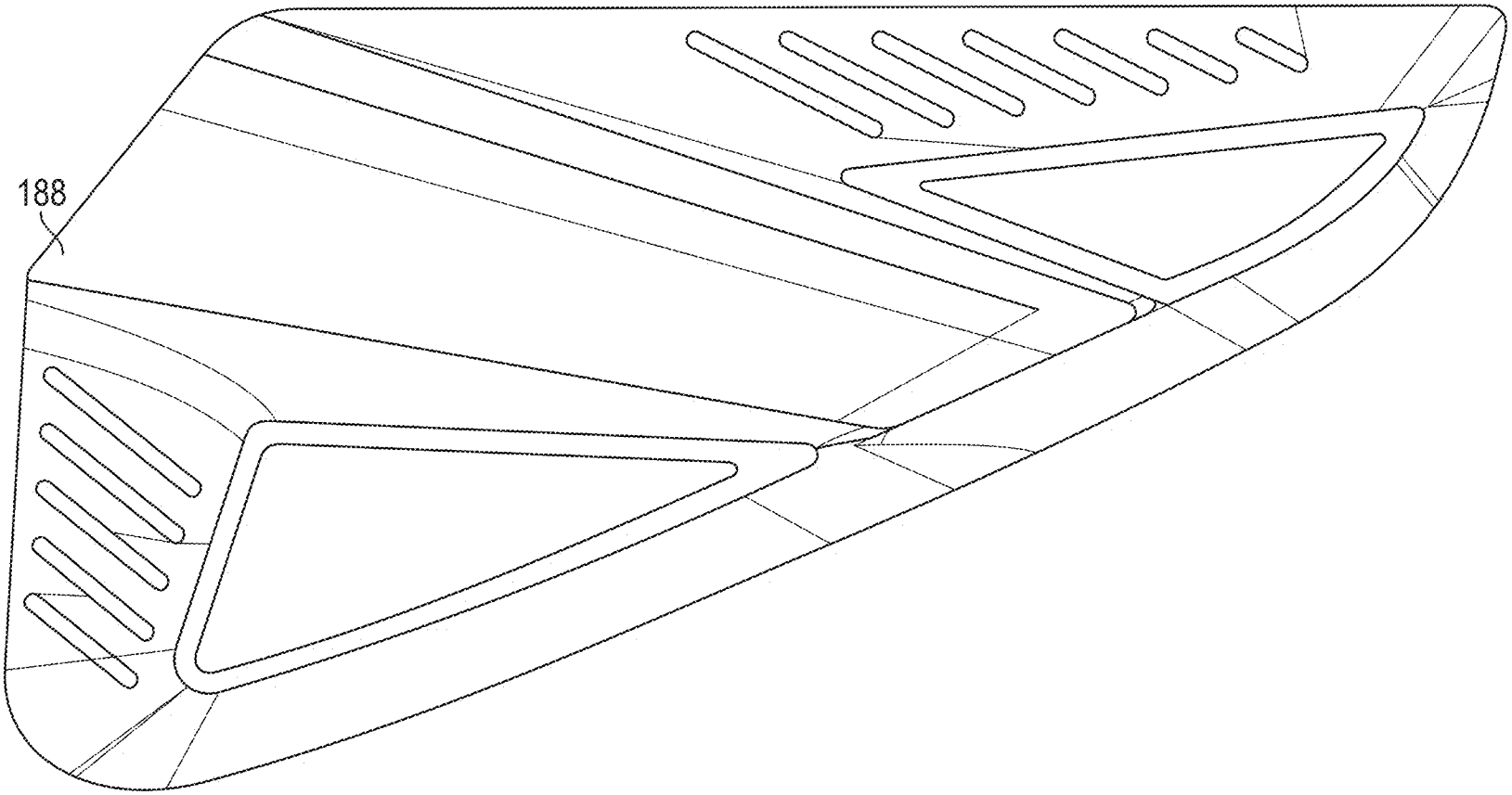
FIG. 31 is a rear elevation view of the shim from the golf club head of FIG. 19, according to one or more examples of the present disclosure.

FIG. 31 is a rear elevation view of the shim or badge 188 from the golf club head of FIG. 19. The shim or badge 188 is manufactured from a light weight, stiff material(s), which may provide additional support for the topline portion 106 to provide better sound and feel. The shim or badge 188 may dampen vibrations and sounds. Examples of such shims, badges, and inserts are disclosed in U.S. Pat. No. 8,920,261, which is incorporated by reference herein in its entirety. Additionally, the shim or badge 188 can also be used for decorative purposes and/or for indicating the manufacturer name, logo, trademark, or the like.

The shim or badge 188 can be manufactured from one or more materials. The shim or badge 188 may be made from any suitable material that provides a desired stiffness and mass to achieve one or more desired performance characteristics. In some embodiments, shim or badge 188 is co-molded or otherwise formed from multiple materials. For example, the shim or badge 188 can be formed from one or more of ABS (acrylonitrile-butadiene-styrene) plastic, a composite (e.g., true carbon or another material), a metal or metal alloy (e.g., titanium, aluminum, steel, tungsten, nickel, cobalt, an alloy including one or more of these materials, or another alloy), one or more of various polymers (e.g., ABS plastic, nylon, and/or polycarbonate), a fiber-reinforced polymer material, an elastomer or a viscoelastic material (e.g., rubber or any of various synthetic elastomers, such as polyurethane, a thermoplastic or thermoset material polymer, or silicone), any combination of these materials, or another material. In some embodiments, the shim or badge 188 can be formed from a first material (e.g., ABS plastic) with a second material (e.g., aluminum) inlayed into the first material.

The average thickness of the shim or badge 188 can be between about 0.5 mm and about 6 mm. A relatively thicker shim or badge 188 (e.g., average thickness of about 3 mm) may be more effective than a thinner shim or badge 188 (e.g., average thickness of about 1 mm).

The shim or badge 188 can have an average density (i.e., mass divided by water-displaced volume) that is lower than the body 113, such as between about 0.5 g/cc and about 20 g/cc, preferably between 1 g/cc and 2 g/cc, between 3 g/cc and 4 g/cc, or between 4 g/cc and 5 g/cc. A thinner shim or badge 188 can be used with a tighter material stack-up, increasing the density and durability of the shim or badge 188. The shim or badge 188 can have a mass between about 2.5 grams and about 15 grams, preferably between 2.5 grams and 10 grams, more preferably between 2.5 grams and 9 grams. A ratio of the average density to the mass can be between about 0.033 1/cc and about 8 1/cc, preferably between 0.08 1/cc and 0.8 1/cc, more preferably between 0.15 1/cc and 0.375 1/cc. The material density of the shim or badge 188, defined by the mass of the shim or badge 188 divided by the volume of the shim or badge 188, can be less than 7.8 g/cc, preferably between 1 g/cc and 2 g/cc, more preferably between 1.0 g/cc and 1.5 g/cc.

The shim or badge 188 can have an area weight (e.g., average thickness divided by average density) of between about 0.0065 $cm^4/g$ and about 1.2 $cm^4/g$. The mass and thickness of the shim or badge 188 can vary within a set of club heads 100. For example, shorter irons and wedges have relatively thicker and heavier shims or badges 188 than mid and long irons.

Figure 32:
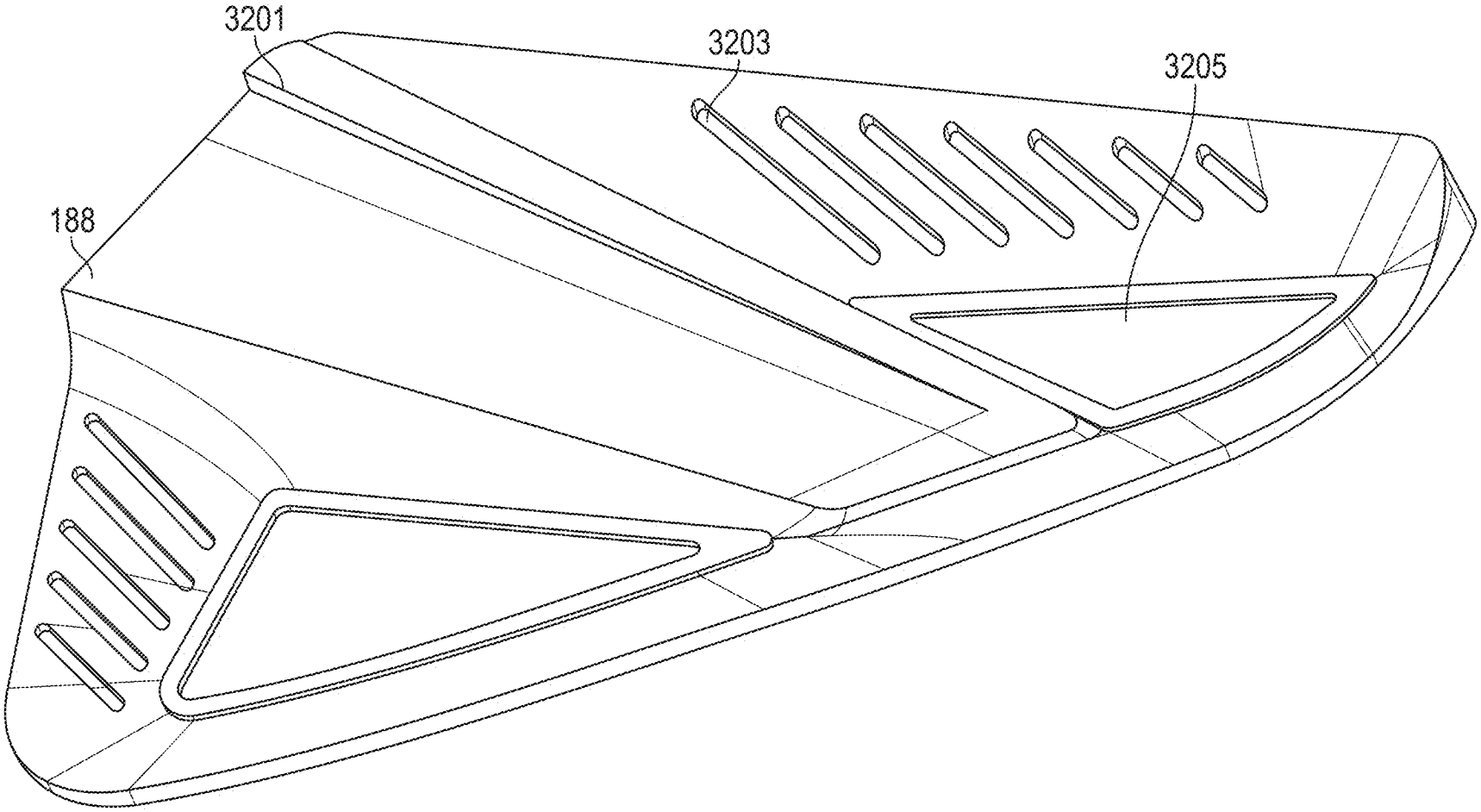
FIG. 32 is a rear perspective view of the shim from the golf club head of FIG. 19, according to one or more examples of the present disclosure.

FIG. 32 is a rear perspective view of the shim or badge 188 from the golf club head of FIG. 19. Numerals 3201, 3203 and 3205 refer to features of club head 100. The features of club head 100 may also be applicable to club heads 300, 500, and 600. The shim or badge 188 can be three-dimensional and non-planar. A rear surface of the shim or badge 188 can include one or more three-dimensional features, such as ridges, depressions, ledges, lips, valleys, inlays, channels, slots, cavities, and other features. The three-dimensional features on the rear surface the shim or badge 188 can confer aesthetic and performance benefits to the club head 100.

For example, the three-dimensional features on the rear surface the shim or badge 188 can correspond to features of the golf club head 100, such as to give the appearance of a hollow body iron. In other examples, the three-dimensional features on the rear surface the shim or badge 188 can reduce the weight of at least a portion of the shim or badge 188, such as to redistribute discretionary weight lower in the club head 100. In further examples, the three-dimensional features on the rear surface the shim or badge 188 can increase structural stability of the shim and/or badge 188, and can provide additional support the topline portion 106, and can provide other performance benefits to the golf club head 110, such as altering sound and feel characteristics of the golf club head 100.

In some embodiments, the shim or badge 188 can include a ridge 3201, a channel 3203, a depression 3205. Given the three-dimensional features of the shim or badge 188, the projected area can be less than a surface area of one or more surfaces of the shim or badge 188. The shim or badge 188 has an area as projected onto the face portion of between about 1200 $mm^2$ and about 2000 $mm^2$, more preferably between 1500 $mm^2$ and 1750 $mm^2$.

Figure 33:
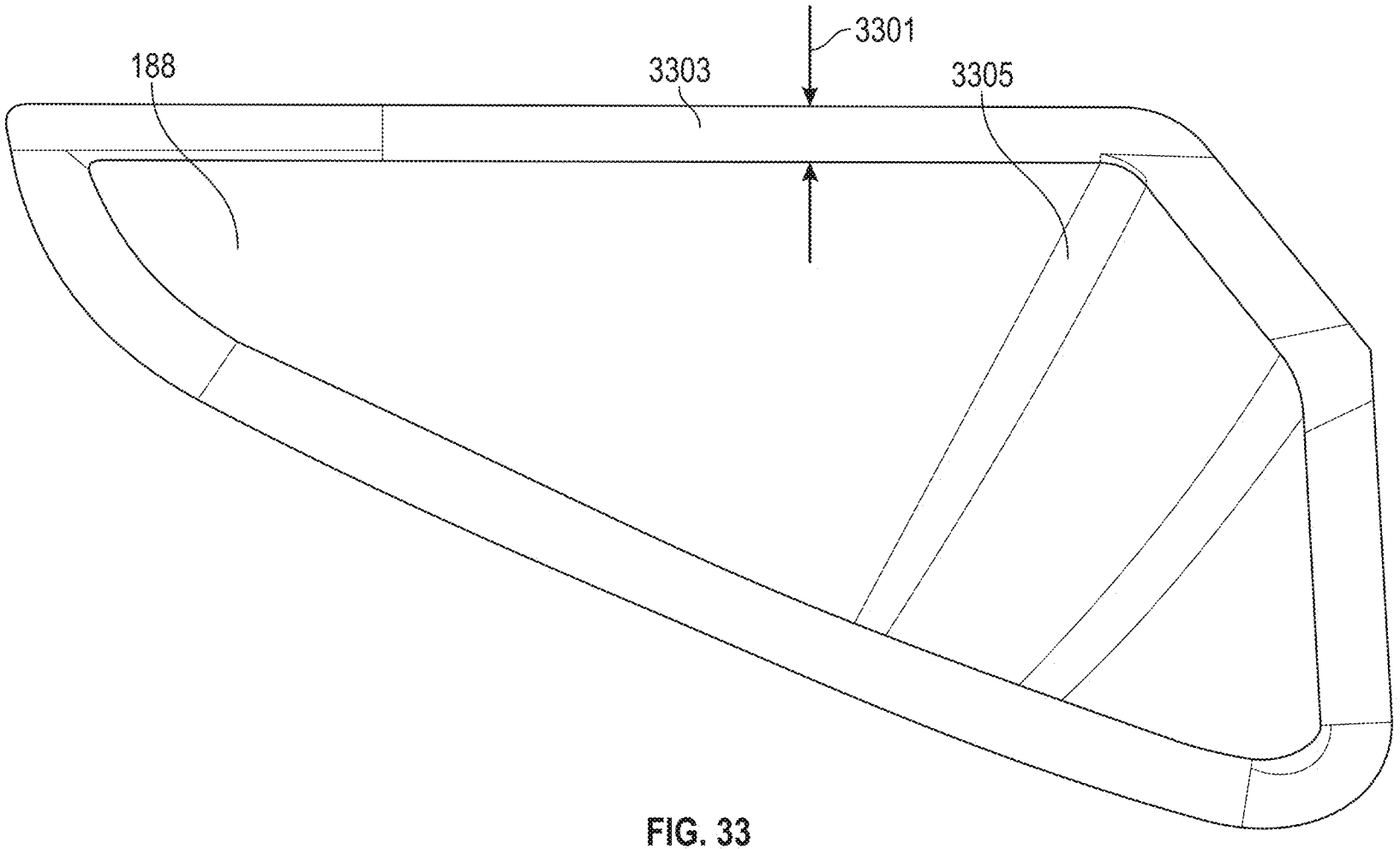
FIG. 33 is a front elevation view of the shim from the golf club head of FIG. 19, according to one or more examples of the present disclosure.

FIG. 33 is a front elevation view of the shim or badge 188 from the golf club head of FIG. 19. Numerals 3301, 3303 and 3305 refer to features of club head 100. The features of club head 100 may also be applicable to club heads 300, 500, and 600. A front surface of the shim or badge 188 can have one or more three-dimensional features, such as ridges, depressions, ledges, lips, valleys, inlays, channels, slots, cavities, and other features. The three-dimensional features on the front surface the shim or badge 188 can performance benefits to the club head 100, such as weight reduction and redistribution, increasing structural stability, altering sound and feel characteristics, and providing other performance benefits to the golf club head 100.

The shim or badge 188 can have a ledge 3303 used for installing the shim or badge 188 onto the golf club head 100. In some embodiments, the width 3301 of the ledge 3303 is between about 0.5 mm and 5.0 mm, more preferably between 0.5 mm to 3.5 mm, more preferably between 1.0 mm and 3.0 mm, more preferably between 1.0 mm and 2.0 mm, more preferably between 1.25 mm and 1.75 mm. In some embodiments, the ledge width 3301 is variable, such as with a wider or narrower width on one or more of an upper portion, lower portion, toeward portion, heelward portion, and/or another portion of the ledge 3303. In some embodiments, a ledge width 3301 less than 1 mm can negatively impact durability of the shim or badge 188, such as when an ABS plastic is used.

Figure 34:
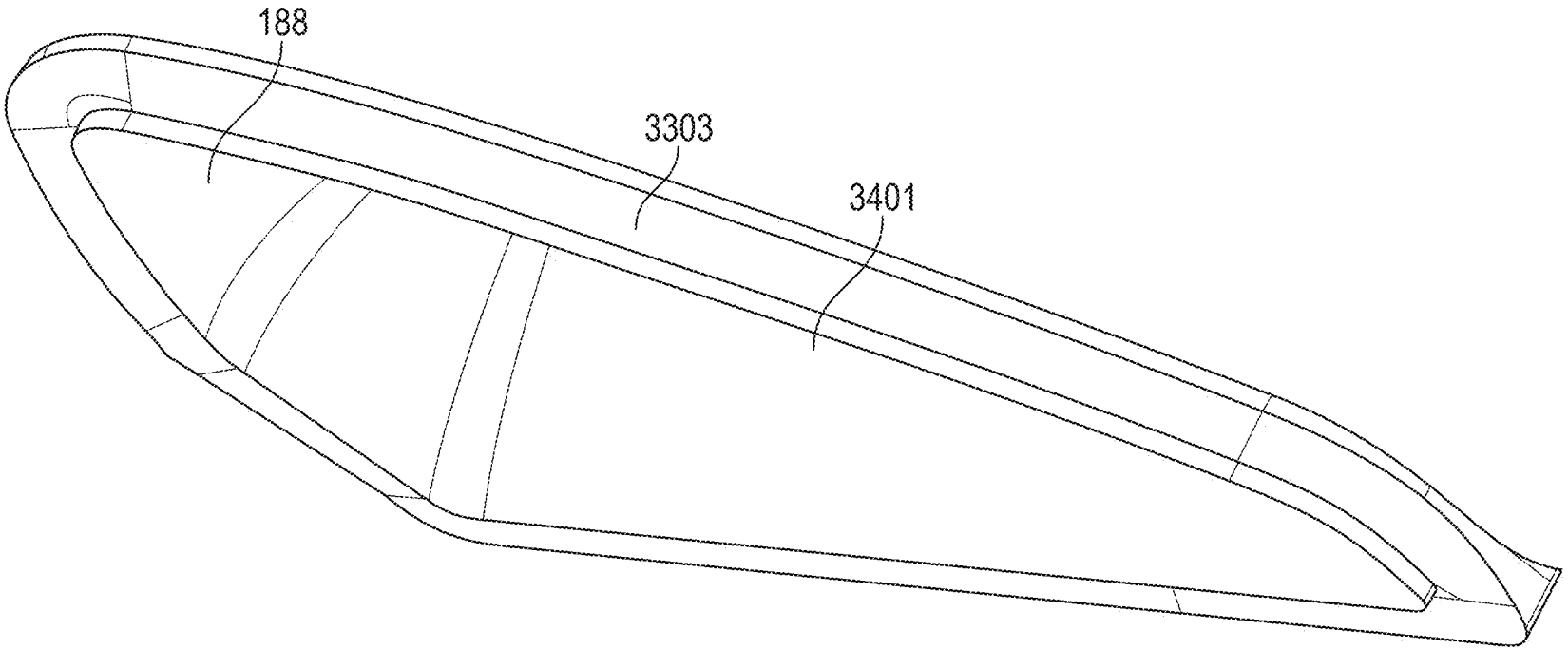
FIG. 34 is a front perspective view of the shim from the golf club head of FIG. 19, according to one or more examples of the present disclosure.

FIG. 34 a front perspective view of the shim or badge 188 from the golf club head of FIG. 19. Numeral 3401 refers to a feature of club head 100. The features of club head 100 may also be applicable to club heads 300, 500, and 600. In some embodiments, the ledge 3303 extends around the perimeter of the shim or badge 188. In other embodiments, the ledge 3303 is discontinuous, such as with the ledge 3303 separated into one or more of an upper ledge portion, a lower ledge portion, a toeward ledge portion, a heelward ledge portion, and/or another ledge portion. Support ridges 3305 can also be provided to stiffen and provide structural support for the shim or badge 188 and the topline portion 106.

The ledge 3303 can be defined by a center thickened region 3401. In some embodiments, the center thickened region 3401 is configured to fit within and close a cavity opening 163 in the cavity 161. In some embodiments, the center thickened region 3401 is configured to fit over and close a cavity opening 163 in the cavity 161. In some embodiments, the ledge 3303 can receive a portion of the club head 110 during installation. In this example, the shape of the ledge 3303 can correspond to the upper ledge 193 and the lower ledge 194 of the club head 110.

The ledge 3303 can be non-planar in one or more of the upper portion, lower portion, toeward portion, heelward portion, and/or another portion of the ledge 3303. For example, the ledge 3303 can be convex, concave, wavy, rounded, or provided with another non-planar surface.

Figure 35:
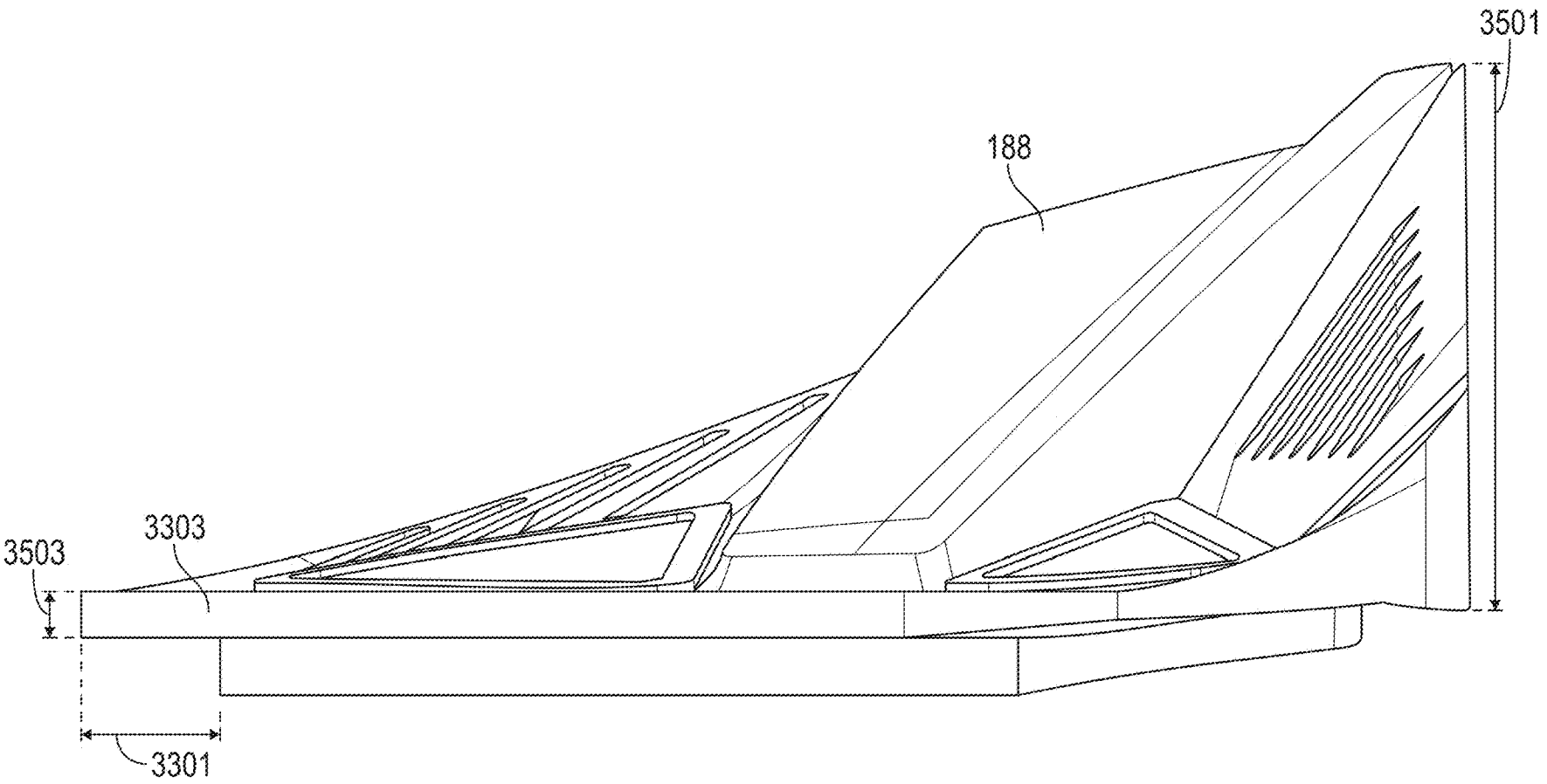
FIG. 35 is a heelward perspective view of the shim from the golf club head of FIG. 19, according to one or more examples of the present disclosure.

FIG. 35 is a heelward perspective view of the shim or badge 188 from the golf club head of FIG. 19. Numerals 3501 and 3503 refer to features of club head 100. The features of club head 100 may also be applicable to club heads 300, 500, and 600. In some embodiments, the shim or badge thickness, as measured from the front surface to the rear surface of the shim or badge 188, can vary from the upper portion to the lower portion of the shim or badge 188. For example, an upper thickness 3501 of the shim or badge 188 is different from the lower thickness 3503 of the shim or badge 188. In some embodiments, the shim or badge 188 is thickest in the lower portion of the shim or badge 188, such as near to or at the bottom of the badge, and the shim or badge 188 is thinnest in the upper portion of the shim or badge 188, such as near to or at the top of the badge.

FIG. 35 also depicts the ledge 3303 and the ledge width 3301 discussed above with respect to FIG. 33. The ledge 3303 can extend around the perimeter of the shim or badge 188 and can provide a bonding surface between the shim or badge 188 and golf club head.

In some embodiments, a ratio of the upper thickness 3501 to the lower thickness 3503 to the can be between about 150% and about 500%, more preferably at least 150%, 200%, 250%, or 300%. Likewise, a ratio of the thinnest portion to the thickest portion of the shim or badge 188 can also be between about 150% and about 500%, more preferably at least 150%, 200%, 250%, or 300%.

In some embodiments, the shim or badge 188 has a minimum thickness between about 0.5 mm and about 3 mm, preferably between 0.5 mm and 1.5 mm. In some embodiments, the shim or badge 188 has a maximum thickness between about 0.75 mm and about 17 mm, preferably between 3 mm and 13 mm.

Figure 36:
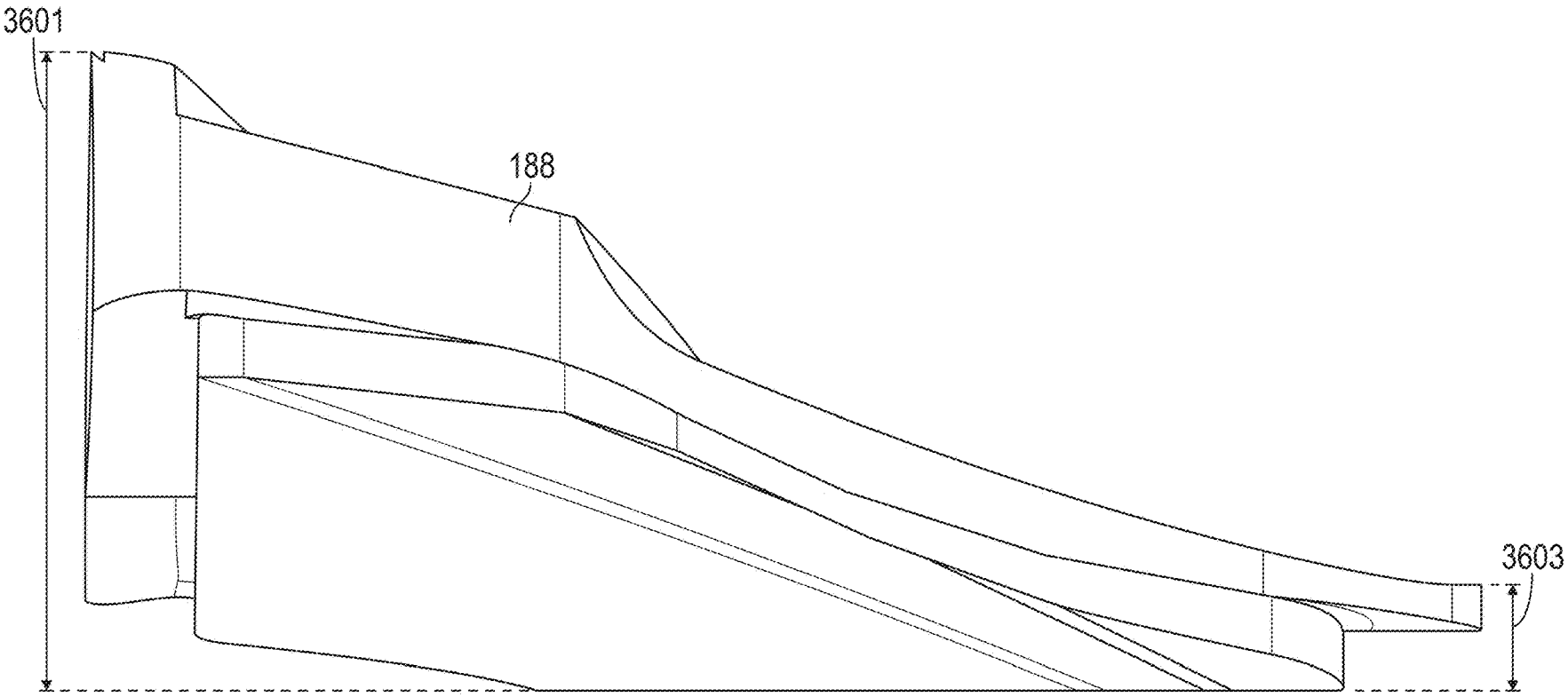
FIG. 36 is a toeward perspective view of the shim from the golf club head of FIG. 19, according to one or more examples of the present disclosure.

FIG. 36 is a toeward perspective view of the shim or badge 188 from the golf club head of FIG. 19. Numerals 3601 and 3603 refer to features of club head 100. The features of club head 100 may also be applicable to club heads 300, 500, and 600. In some embodiments, the shim or badge 188 has a maximum depth 3601 between about 5 mm and about 20 mm, preferably less than 16 mm, and more preferably less than 15 mm. In some embodiments, the shim or badge 188 has a minimum depth 3603 between about 1 mm and about 6 mm, preferably at least 2 mm, more preferably at least 2.5 mm.

Figure 37:
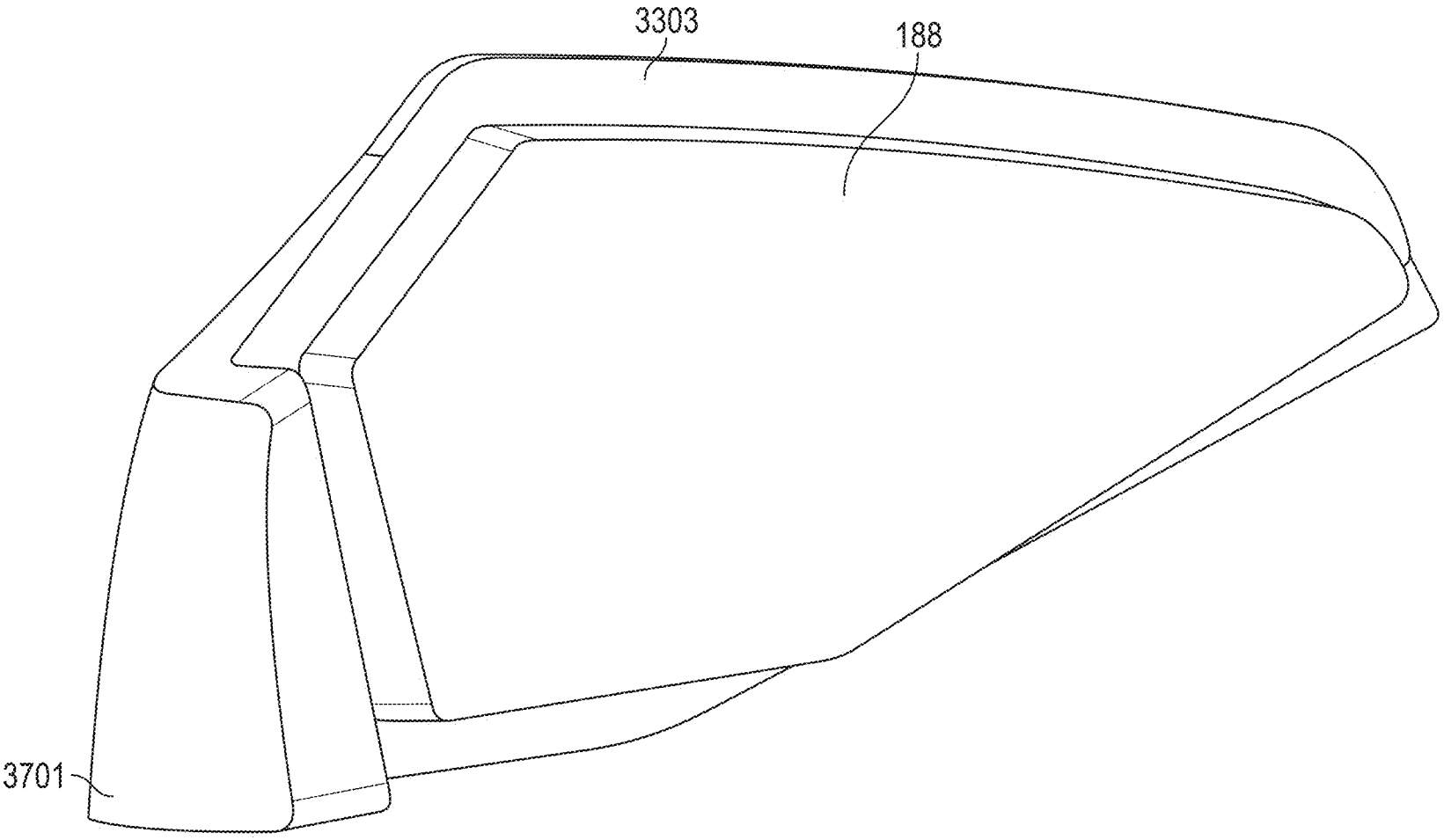
FIG. 37 is a front perspective view of the shim from the golf club head 500 of FIG. 23, according to one or more examples of the present disclosure.

FIG. 37 is a front perspective view of the shim or badge 188 from the golf club head 500 of FIG. 23. Numeral 3701 refers to a feature of club head 500. The features of club head 100 may also be applicable to club heads 100, 300, and 600. In this embodiment, the shim or badge 188 is configured to wrap into at least a portion of the toe portion 104. For example, the shim or badge 188 has a toewrap portion 3701, such as to be received by or enclosing the toeside cavity 124 of the golf club head 500. In some embodiments, the toewrap portion 3701 is separated from the center thickened region 3401 by a channel or slot for receiving at least a portion of the toeside ledge 125 in the toe portion 104 of the golf club head 500. In this embodiment, additional discretionary mass can be freed up in the toe portion and redistributed in the body, such as to further lower Zup. For example, high density steel in the toe portion can be replaced with the lower density material of the shim.

Figure 38:
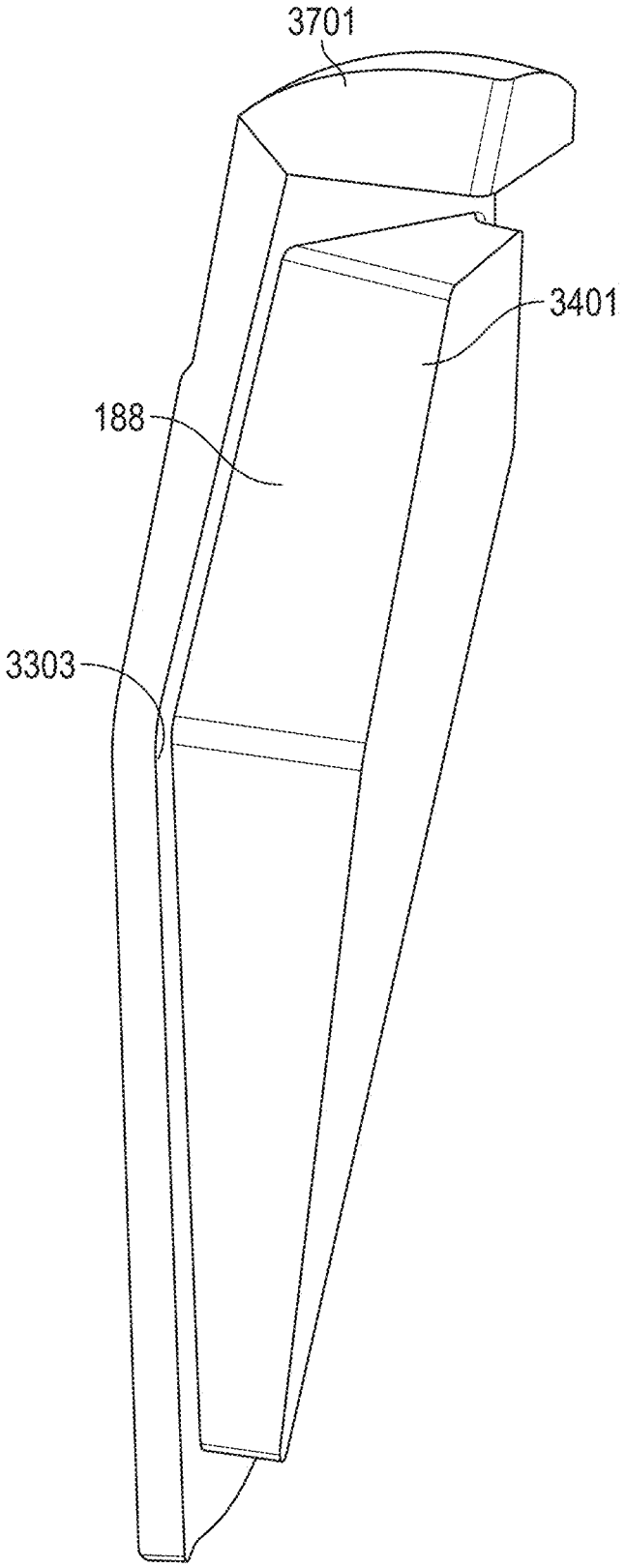
FIG. 38 is a lower perspective view of the shim from the golf club head of FIG. 23, according to one or more examples of the present disclosure.

FIG. 38 is a lower perspective view of the shim or badge 188 from the golf club head of FIG. 23. In some embodiments, the shim or badge 188 has a ledge 3303. In some embodiments, the ledge 3303 of the shim or badge 188 is configured to match a profile of the sole bar 135, the upper ledge 193, the lower ledge 194, or another feature of the golf club head 500.

Rear Fascia, Shim, Plate, or Badge

Exemplary club head structures, including a rear fascia, plate, or badge, are described in U.S. patent application Ser. No. 16,870,714, filed May 8, 2020, titled "IRON-TYPE GOLF CLUB HEAD," which is incorporated herein by reference in its entirety.

Figure 39:
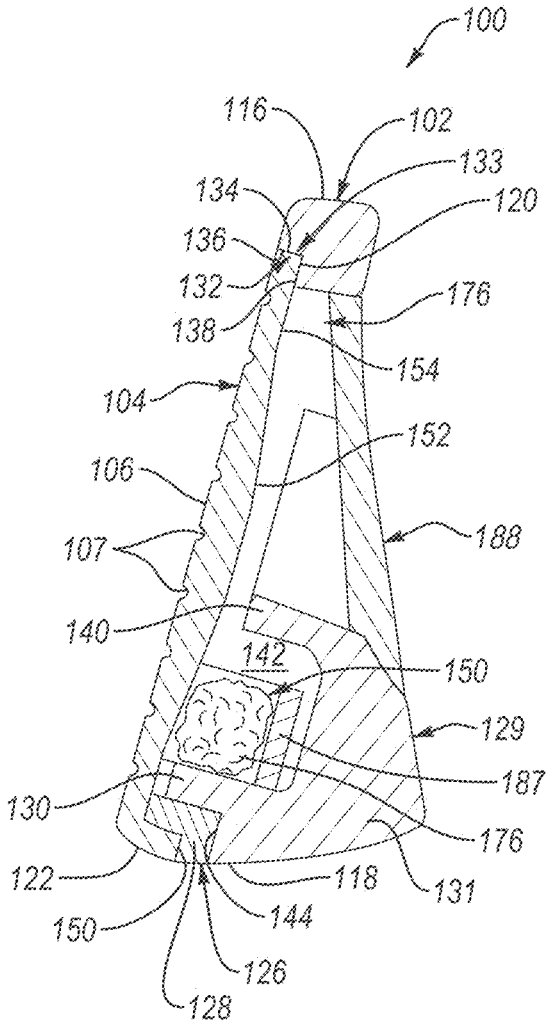
FIG. 39 a side cross-sectional view of a golf club head according to one or more examples of the present disclosure.

According to some examples of the golf club head 100, as shown in FIG. 39, the body 102 of the golf club head 100 has a cavity-back configuration and the golf club head 100 further includes a rear fascia 188, shim, rear plate, or badge, coupled to the back portion 129 of the body 102. As used herein, the terms rear fascia, shim, rear plate, and badge can be used interchangeably. The rear fascia 188 encloses the internal cavity 142 by covering, at the back portion 129 of the body 102, the plate opening 176. Accordingly, the rear fascia 188, in effect, converts the cavity-back configuration of the golf club head 100 into more of a hollow-body configuration. As will be explained in more detail, enclosing the internal cavity 142 with the rear fascia 188 allows a filler material 201 and/or damper to retainably occupy at least a portion of the internal cavity 142. The filler material 201 and/or damper can include organic and/or inorganic materials. In some examples, the filler material 201 and/or damper does not contain glass bubbles or inorganic solids.

As depicted in FIG. 39, the rear fascia 188 can bond to a surface without a pronounced ledge. For example, the upper edge of the rear fascia 188 can bond directly to the top portion 116. Likewise, the lower edge of the rear fascia 188 can bond directly to the back portion 129. In some embodiments, the rear fascia 188 does not bond to a ledge of the top portion 116 or back portion 129, such as one or more substantially vertical ledges (e.g., approximately 90 degrees with respect to the ground plane at address). In some embodiments, the rear fascia 188 bonds to a first surface on the top portion 116 and a second surface on the back portion 129. In some embodiments, the first surface and the second surface are not parallel surfaces, the surfaces are transverse to each other, or the surfaces are at an angle to each other, such as an angle between 25 25 degrees and 90 degrees to each other.

The rear fascia 188 is made from one or more of the polymeric materials described herein, in some examples, and adhered or bonded to the body 102. In other examples, the rear fascia 188 is made from one or more of the metallic materials described herein and adhered, bonded, or welded to the body 102. The rear fascia 188 can have a density ranging from about 0.9 g/cc to about 5 g/cc. Moreover, the rear fascia 188 may be a plastic, a carbon fiber composite material, a titanium alloy, or an aluminum alloy. In certain embodiments, where the rear fascia 188 is made of aluminum, the rear fascia 188 may be anodized to have various colors such as red, blue, yellow, or purple.

The golf club head 100 disclosed herein may have an external head volume equal to the volumetric displacement of the golf club head 100. For example, the golf club head 100 of the present application can be configured to have a head volume between about 15 $cm^3$ and about 150 $cm^3$. In more particular embodiments, the head volume may be between about 30 $cm^3$ and about 90 $cm^3$. In yet more specific embodiments, the head volume may be between about 30 $cm^3$ and about 70 $cm^3$, between about 30 $cm^3$ and about 55 $cm^3$, between about 45 $cm^3$ and about 100 $cm^3$, between about 55 $cm^3$ and about 95 $cm^3$, or between about 70 $cm^3$ and about 95 $cm^3$. The golf club head 100 may have a total mass between about 230 g and about 300 g.

In some embodiments, the volume of the internal cavity is between about 1 $cm^3$ and about 50 $cm^3$, between about 5 $cm^3$ and about 30 $cm^3$, or between about 8 cc and about 20 cc. For the purposes of measuring the internal cavity volume herein, the aperture is assumed to be removed and an imaginary continuous wall or substantially back wall is utilized to calculate the internal cavity volume.

In some embodiments, the mass of the filler material 201, and/or the damper, divided by the external head volume is between about 0.08 g/$cm^3$ and about 0.23 g/$cm^3$, between about 0.11 g/$cm^3$ and about 0.19 g/$cm^3$, or between about 0.12 g/$cm^3$ and about 0.16 g/$cm^3$. For example, in some embodiments, the mass of the filler material 201 and/or damper may be about 5.5 grams and the external head volume may be about 50 $cm^3$ resulting in a ratio of about 0.11 g/$cm^3$.

In some embodiments, the density of the filler material 201 and/or the damper, after it is fully formed and/or positioned within the internal cavity 142, is at least 0.21 g/cc, such as between about 0.21 g/cc and about 0.71 g/cc or between about 0.22 g/cc and about 0.49 g/cc. In certain embodiments, the density of the filler material 201 and/or the damper is in the range of about 0.22 g/cc to about 0.71 g/cc, or between about 0.35 g/cc and 0.60 g/cc. The density of the filler material 201 and/or the damper impacts the COR, durability, strength, and filling capacity of the club head. In general, a lower density material will have less of an impact on the COR of a club head. The density of the filler material 201 and/or the damper is the density after the filler material 201 and/or the damper is fully formed and/or positioned within and enclosed by the internal cavity 142.

During development of the golf club head 100, use of a lower density filler material and/or damper having a density less than 0.21 g/cc was investigated, but the lower density did not meet certain sound performance criteria. This resulted in using a filler material 201 and/or the damper having a density of at least 0.21 g/cc to meet sound performance criteria.

In one embodiment, the filler material 201 and/or the damper has a minor impact on the coefficient of restitution (herein "COR") as measured according to the United States Golf Association (USGA) rules set forth in the Procedure for Measuring the Velocity Ratio of a Club Head for Conformance to Rule 4-1e, Appendix II Revision 2 Feb. 8, 1999, herein incorporated by reference in its entirety.

Table 2 below provides examples of the COR change relative to a calibration plate of multiple club heads of the construction described herein both a filled and unfilled state. The calibration plate dimensions and weight are described in section 4.0 of the Procedure for Measuring the Velocity Ratio of a Club Head for Conformance to Rule 4-1e.

Due to the slight variability between different calibration plates, the values described below are described in terms of a change in COR relative to a calibration plate base value. For example, if a calibration plate has a 0.831 COR value, Example 1 for an un-filled head has a COR value of −0.019 less than 0.831 which would give Example 1 (Unfilled) a COR value of 0.812. The change in COR for a given head relative to a calibration plate is accurate and highly repeatable.

TABLE 2

COR Values Relative to a Calibration Plate

| Example No. | Unfilled COR Relative to Calibration Plate | Filled COR Relative to Calibration Plate | COR Change Between Filled and Unfilled |
|---|---|---|---|
| 1 | −0.019 | −0.022 | −0.003 |
| 2 | −0.003 | −0.005 | −0.002 |
| 3 | −0.006 | −0.010 | −0.004 |
| 4 | −0.006 | −0.017 | −0.011 |
| 5 | −0.026 | −0.028 | −0.002 |
| 6 | −0.007 | −0.017 | −0.01 |
| 7 | −0.013 | −0.019 | −0.006 |
| 8 | −0.007 | −0.007 | 0.000 |
| 9 | −0.012 | −0.014 | −0.002 |
| 10 | −0.020 | −0.022 | −0.002 |
| Average | −0.0119 | −0.022 | −0.002 |

Table 2 illustrates that before the filler material 201 and/or the damper is introduced into the cavity 142 of the golf club head 100, an Unfilled COR drop off relative to the calibration plate (or first COR drop off value) is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005. In one embodiment, the average COR drop off or loss relative to the calibration plate for a plurality of Unfilled COR golf club heads 100, within a set of irons, is between 0 and −0.05, between 0 and −0.03, between −0.00001 and −0.03, between −0.00001 and −0.025, between −0.00001 and −0.02, between −0.00001 and −0.015, or between −0.00001 and −0.01.

Table 2 further illustrates that after the filler material 201 and/or the damper is introduced into the cavity 142 of golf club head 100, a Filled COR drop off relative to the calibration plate (or second COR drop off value) is more than the Unfilled COR drop off relative to the calibration plate. In other words, the addition of the filler material 201 and/or the damper in the Filled COR golf club heads slows the ball speed (Vout—Velocity Out) after rebounding from the face by a small amount relative to the rebounding ball velocity of the Unfilled COR heads. In some embodiments shown in Table 2, the COR drop off or loss relative to the calibration plate for a Filled COR golf club head is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005. In one embodiment, the average COR drop off or loss relative to the calibration plate for a plurality of Filled COR golf club head within a set of irons is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

However, the amount of COR loss or drop off for a Filled COR head is minimized when compared to other constructions and filler materials. The last column of Table 2 illustrates a COR change between the Unfilled and Filled golf club heads which are calculated by subtracting the Unfilled COR from the Filled COR table columns. The change in COR (COR change value) between the Filled and Unfilled club heads is between 0 and −0.1, between 0 and −0.05, between 0 and −0.04, between 0 and −0.03, between 0 and −0.025, between 0 and −0.02, between 0 and −0.015, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002. Remarkably, one club head was able to achieve a change in COR of zero between a filled and unfilled golf club head. In other words, no change in COR between the Filled and Unfilled club head state. In some embodiments, the COR change value is greater than −0.1, greater than −0.05, greater than −0.04, greater than −0.03, greater than −0.02, greater than −0.01, greater than −0.009, greater than −0.008, greater than −0.007, greater than −0.006, greater than −0.005, greater than −0.004, or greater than −0.003. In certain examples, the filler material in the internal cavity reduces the COR by no more than 0.025 or 0.010.

In some embodiments, at least one, two, three, or four golf clubs out of an iron golf club set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In yet other embodiments, at least one pair or two pair of iron golf clubs in the set have a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In other embodiments, an average of a plurality of iron golf clubs in the set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

The filler material 201 and/or the damper fills the cavity 142 located above the sole slot 126. A recess or depression in the filler material 201 and/or the damper engages with the thickened portion of the strike plate 104. In some embodiments, the filler material 201 and/or the damper is a two-part polyurethane foam that is a thermoset and is flexible after it is cured. In one embodiment, the two-part polyurethane foam is any methylene diphenyl diisocyanate (a class of polyurethane prepolymer) or silicone based flexible or rigid polyurethane foam.

Shim Mass Per Unit Length

Exemplary club head structures are described in U.S. Pat. No. 10,493,336, titled "IRON-TYPE GOLF CLUB HEAD," which is incorporated herein by reference in its entirety.

Referring to FIG. 19, an areal mass of the shim or badge 188 of the golf club head 100 between the rear portion 128, the topline portion 106, the sole portion 108, the toe portion 104, and the heel portion 102 is between 0.0005 g/mm$^2$ and 0.00925 g/mm$^2$, such as, for example, about 0.0037 g/mm$^2$. Generally, the areal mass of the shim or badge 188 is the mass per unit area of the area defined by the opening 163 to the cavity 161 (see FIG. 22). In some implementations, the area of the opening 163 is about 1,600 mm$^2$.

In some embodiments, the shim or badge 188 has a mass per unit length of between about 0.09 g/mm and about 0.40 g/mm, such as between about 0.09 g/mm and about 0.35 g/mm, such as between about 0.09 g/mm and about 0.30 g/mm, such as between about 0.09 g/mm and about 0.25 g/mm, such as between about 0.09 g/mm and about 0.20 g/mm, such as between about 0.09 g/mm and about 0.17 g/mm, or such as between about 0.1 g/mm and about 0.2 g/mm. In some embodiments, the shim or badge 188 has a mass per unit length less than about 0.25 g/mm, such as less than about 0.20 g/mm, such as less than about 0.17 g/mm, such as less than about 0.15 g/mm, such as less than about 0.10 g/mm. In one implementation, the shim or badge 188 has a mass per unit length of 0.16 g/mm.

Club Head, Damper, Filler Material, and Shim Interaction

Figure 40:
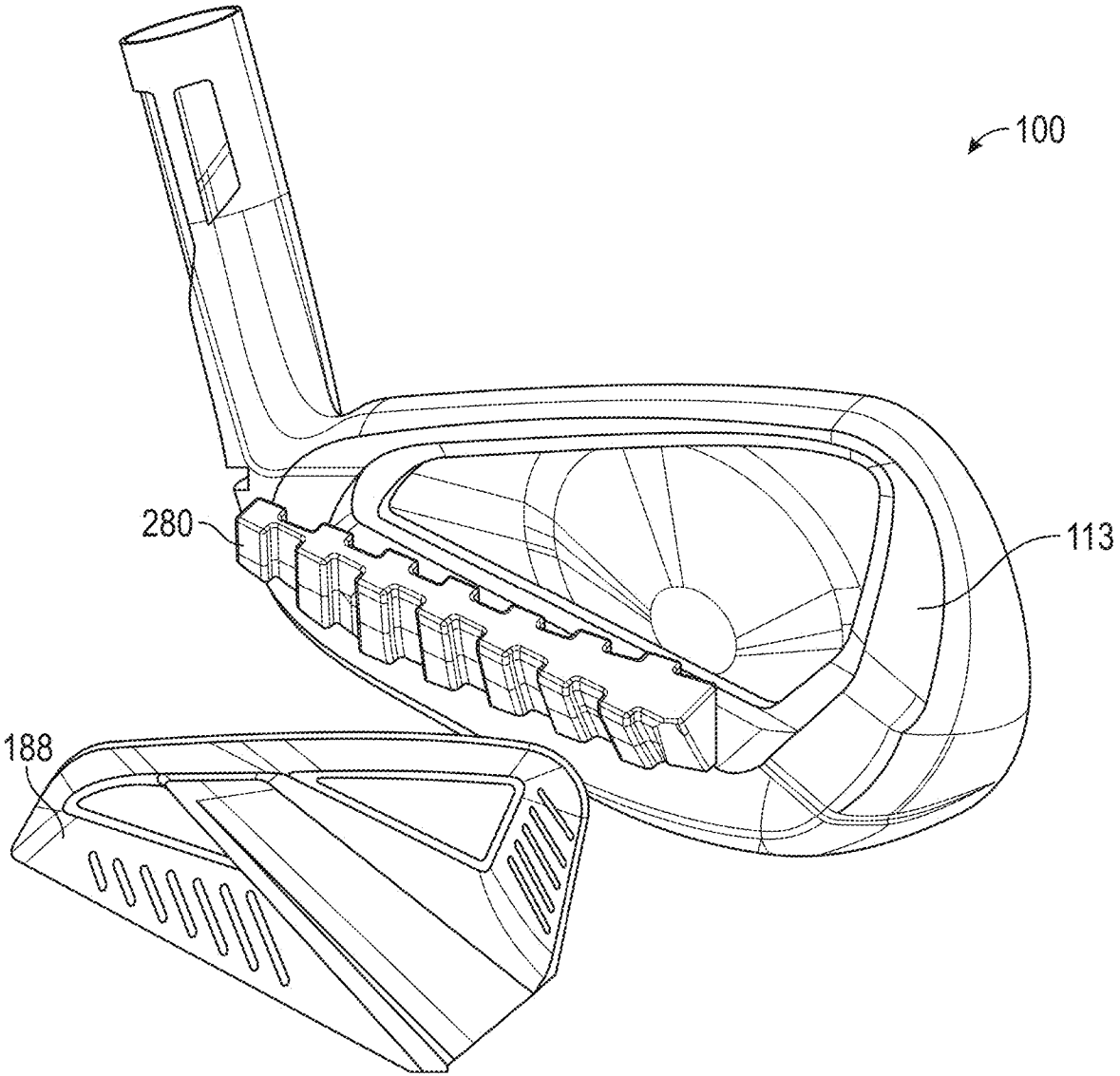
FIG. 40 is an exploded view of the golf club head of FIG. 19, according to one or more examples of the present disclosure.

FIG. 40 is an exploded view of the golf club head 100 showing the body 113, the damper 280 and the shim or badge 188. In some embodiments, a unitary cast body 113 is provided. A unitary cast body is manufactured by casting the face portion 110 and the striking face 109 with the body 113 as a single piece. In other embodiments, the body 113 is cast separately from the face portion 110 and/or the striking face 109, and the face portion 110 and/or the striking face 109 is welded to the body 113.

After the body 113 is manufactured, the damper 280 can be installed within the cavity 161 of the body 113. In some embodiments, an adhesive, an epoxy, and/or a hotmelt is used to install the damper 280 within the cavity. For example, an adhesive can be applied to the damper 280 before installation and/or a hotmelt can be injected into the cavity 161 after the damper 280 has been installed. In some embodiments, hotmelt can injected into the toeside of the cavity 161. In some embodiments, an adhesive can be applied to a rear surface of the damper 280, such as to bond the rear surface of the damper 280 to the sole bar 135 or rear portion 128.

After the damper 280 is installed in the body 113, the shim or badge 188 can be installed on the body 113, enclosing at least a portion of the cavity 161 to define or form an internal cavity. In some embodiments, the shim or badge 188 can be installed using a tape, such as an industrial strength double-sided tape (e.g., DC2000 series 0.8 mm 3M Very High Bond (VHB) or 1.1 mm 3M VHB tape), an adhesive, an epoxy, a weld, a screw(s), or another fastener(s). In some embodiments, a tape is used rather than screws, clamps, or other fasteners to improve aesthetics of the club head. In some embodiments, at least a portion of the shim or badge 188 snaps in place, such as using a friction fit. After installation, the force required to remove the shim or badge 188 can be between about 20 kilogram-force (kgf) and about 50 kgf, more preferably between 25 kgf and 35 kgf. In some embodiments, a sealing wiper is installed around shim to help prevent water intrusion, such as when a discontinuous ledge is used.

After installing the damper 280 to the body 113, the club head 100 has the appearance of a hollow body iron. The shim or badge 188 seals the cavity 161, such as preventing water from entering the cavity 161. In some embodiments, no portion of the shim or badge 188 contacts the striking face 109. In some embodiments, no structure attached to the badge or shim 188 contacts the striking face 109. In some embodiments, at least a portion of the shim protrudes forward of one or more of the ledges 193, 194 and toward the striking face 109. For example, at least a portion of the cavity 161 separates the shim or badge 188 from the face portion 110.

An assembled club head weight can be between about 200 grams and about 350 grams, more preferably between 230 grams and 305 grams. A combined weight of damper 280 and shim or badge 188 can be between about 8 g and about 20 g, preferably less than about 13 g, more preferably less than 12 g. In some embodiments, the combined weight of damper 280 and shim or badge 188 can be between about 0.2% and about 10% of the assembled club head weight, preferably between 2.6% and 8.7%, more preferably less than about 5%.

Figure 41:
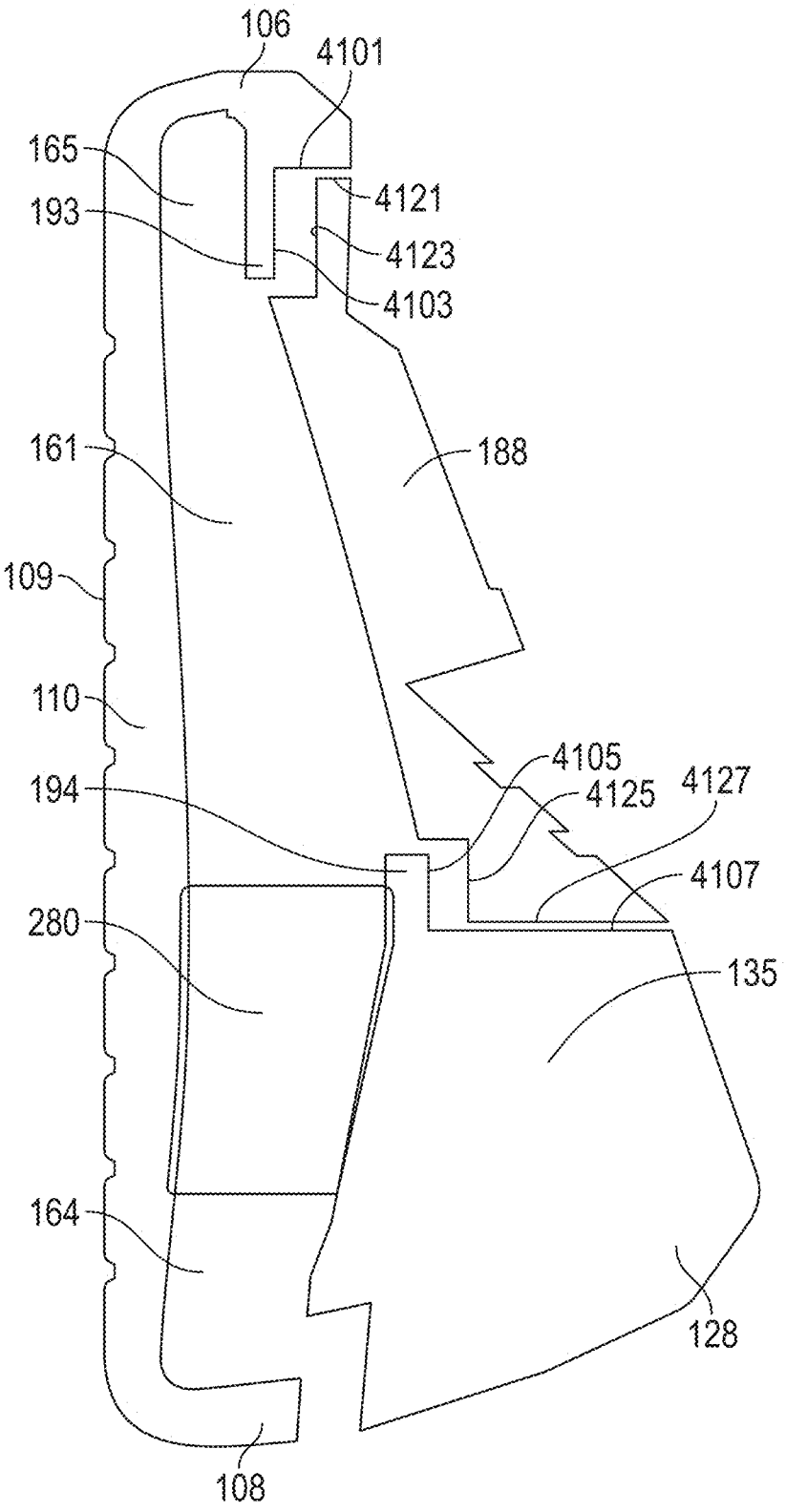
FIG. 41 is a side cross-sectional view of the golf club head of FIG. 19, according to one or more examples of the present disclosure.

FIG. 41 is a side cross-sectional view of the golf club head 100. Numerals 4101, 4103, 4105, 4107, 4121, 4123, 4125, and 4127 refer to features of club head 100. The features of club head 100 may also be applicable to club heads 300, 500, and 600. The golf club head 100, as assembled, includes a sole portion 108, a topline portion 106, a rear portion 128, face portion 110, a striking face 109, a sole bar 135, a damper 280, and a shim or badge 188.

The golf club head 100 includes an upper undercut region 165. In some embodiments, no part of the damper 280 or the shim or badge 188 is within the upper undercut region 165. In some embodiments using a filler material, no filler material is within the upper undercut region 165.

The golf club head 100 includes a lower undercut region 164. In some embodiments, the damper 280 is installed entirely within the lower undercut region 164. In some embodiments, at least a portion of the damper 280 is installed partially within the lower undercut region 164, thus the damper extends above an opening of the lower undercut region 164 defined by a line perpendicular to the striking face 109 and extending to the upper most point of the lower ledge 194. In some embodiments, the damper 280 does not contact the sole portion 108 and does not entirely fill the lower undercut region 164. The damper 280 can fill a portion of the cavity 161. In some embodiments, the damper 280 fills between about 5% and about 70% of the cavity 161, preferably between 5% and 50%, preferably between 20% and 50%, preferably between 5% and 20%, preferably between 50% and 70%.

The golf club head 100 may include installation surfaces 4101, 4103, 4105, 4107 for receiving at least a portion of the shim or badge 188. Likewise, the shim or badge 188 can include corresponding installation surfaces 4121, 4123, 4125, and 4127 for receiving at least a portion of the club head 100. In some embodiments, the shim or badge 188 is adhered, taped, bonded, welded, or otherwise affixed to the body 113 between installation surfaces 4101, 4103, 4105, 4107 and installation surfaces 4121, 4123, 4125, and 4127. In some embodiments, the shim or badge 188 is installed using a tape between the installation surfaces 4123, 4125 and the installation surfaces 4103, 4105, respectively. In some embodiments, the tape separates the body 113 from the shim or badge 188. The separation can be between about 0.5 mm and about 1.5 mm, preferably between 0.8 mm and 1.1 mm. In some embodiments, the shim or badge 188 does not contact any portion of the striking face 109 or the face portion 110. For example, when installed, the shim or badge 188 can be up to 10 mm from the striking face 109, such as between 0.1 mm and 10 mm, preferably between 0.1 mm and 5 mm, alternatively between 2 mm and 7 mm. In some embodiments, the shim or badge 188 extends within the cavity 161 and contacts at least a portion of the striking face 109 and/or the face portion 110.

When compared to using a bridge bar 140 (e.g., depicted in FIG. 6), the shim or badge 188 can allow the club head 100 to have a lower center of gravity (CG). For example, by manufacturing the shim or badge 180 from a light weight, stiff material(s), the shim or badge 180 can provide support for the topline portion 106, such as to provide better sound and feel, while allowing additional discretionary weight be positioned lower in the golf club head 100. Thus, using a shim or badge 188 can allow the golf club head 100 to achieve similar modes for sound and feel, while conferring additional performance benefits achieved by freeing up additional discretionary weight.

A coefficient of restitution (COR) of the golf club head 100 can be affected by installation of the damper 280 and/or the shim or badge 188. For example, installing the damper 280 and/or a filler material can reduce the COR by between about 1 and about 4 points, preferably no more than 3 points, more preferably no more than 2 points. Installing the shim or badge 188 (e.g., such as a shim 188 that does not contact a rear surface of the striking face and stiffens the topline portion 106) can increase COR by between about 1 and about 6 points, preferably by at least 1 point, more preferably by at least 2 points. Installing the shim or badge 188 with the damper 280 can minimize or negate the loss of COR caused by the damper 280, and in some cases can increase COR for the striking face. For example, installing the shim or badge 188 with the damper 280 can affect COR by between a loss of about 2 points and a gain of about 6 points.

TABLE 3

COR Values Relative to a Calibration Plate

| Example No. | COR Relative to Calibration Plate Without Shim and Without Damper | COR Relative to Calibration Plate With Shim and With Damper | COR Change Between Without Shim and Damper and with Shim and Damper |
|---|---|---|---|
| 1 | −0.004 | −0.004 | −0.000 |
| 2 | −0.002 | −0.004 | −0.002 |
| 3 | −0.004 | −0.003 | 0.001 |
| 4 | −0.004 | −0.004 | −0.000 |
| 5 | −0.003 | −0.004 | −0.001 |
| Average | −0.0034 | −0.0038 | −0.0004 |
| 6 | 0.000 | −0.010 | −0.010 |
| 7 | −0.004 | −0.009 | −0.005 |
| 8 | 0.000 | −0.011 | −0.011 |
| 9 | −0.003 | −0.007 | −0.004 |
| 10 | −0.005 | −0.009 | −0.004 |

TABLE 3-continued

| COR Values Relative to a Calibration Plate | | | |
|---|---|---|---|
| Example No. | COR Relative to Calibration Plate Without Shim and Without Damper | COR Relative to Calibration Plate With Shim and With Damper | COR Change Between Without Shim and Damper and with Shim and Damper |
| Average | −0.0024 | −0.0092 | −0.0068 |
| 11 | −0.001 | −0.004 | −0.003 |
| 12 | −0.001 | −0.006 | −0.005 |
| 13 | −0.003 | −0.007 | −0.004 |
| 14 | −0.005 | −0.008 | −0.003 |
| 15 | −0.002 | −0.002 | 0.000 |
| Average | −0.0024 | −0.0054 | −0.003 |
| 16 | −0.004 | −0.010 | −0.006 |
| 17 | −0.004 | −0.009 | −0.005 |
| 18 | −0.004 | −0.008 | −0.004 |
| 19 | 0.000 | −0.005 | −0.005 |
| 20 | −0.005 | −0.008 | −0.003 |
| Average | −0.0034 | −0.008 | −0.0046 |

Table 3 illustrates the results of COR testing on four different iron embodiments. Examples 1-5 are results for a first 4 iron embodiment. Examples 1-5 show that adding a shim and damper can reduce COR by less than 1 point (i.e., 0.4 points). Examples 6-10 are results for a second 4 iron embodiment. Examples 6-10 show that adding a shim and damper can reduce COR by over 6 points (i.e., 6.8 points). Examples 11-15 are results for a first 7 iron embodiment. Examples 11-15 show that adding a shim and damper can reduce COR by an average of 3 points. Examples 16-20 are results for a second 7 iron embodiment. Example 16-20 show that adding a shim and damper can reduce COR by an average of 4.6 points. In some embodiments, installing a damper and a shim results in a COR change value of no more than −0.011 compared to a club head without the badge and damper installed.

As used herein, a COR change value of 0.001 is considered a change value of 1 point and a negative sign means a decrease in COR. If no sign is present, then that represents an increase. For example, Example No. 3 shows an initial COR value of −0.004 without a shim or damper and a value of −0.003 including a shim and damper for a positive COR change value of 0.001 or a 1 point change in COR (i.e., COR increased).

Figure 42:
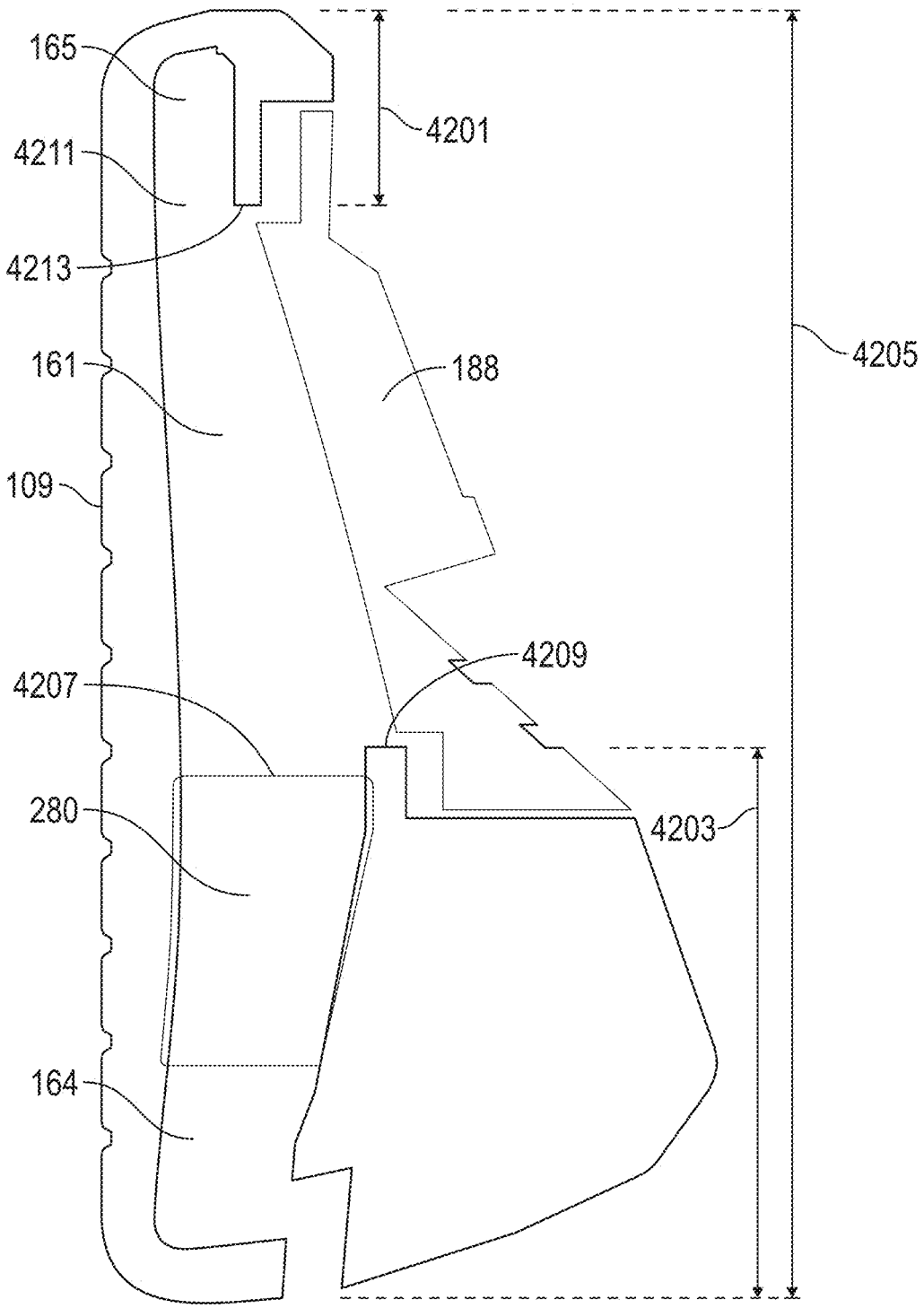
FIG. 42 is a side cross-sectional view of the golf club head of FIG. 19, according to one or more examples of the present disclosure.

FIG. 42 is a side cross-sectional view of the golf club head 100, showing a cross-section through the Y-Z plane though a geometric center of the striking face 109, with the club head at zero loft (depicted as cross-section 42-42 in FIG. 21). Numerals 4201, 4203, 4205, 4207, 4209, 4211, and 4213 refer to features of club head 100. The features of club head 100 may also be applicable to club heads 300, 500, and 600. The club head 100 has an upper undercut depth 4201, a lower undercut depth 4203, and a club head section height 4205. In some embodiments, no portion of shim or badge 188 extends into upper undercut region 165 or the lower undercut region 164.

An upper portion 4207 of the lower undercut region 164 is at least partial defined by an upper surface 4209 of the lower ledge 194. In some embodiments, the geometric center of the striking face 109 is located above the upper portion 4207 of the lower undercut region 164. In some embodiments, the lower undercut region 164 does not extend beyond the geometric center of the striking face 109.

A lower portion 4211 of the upper undercut region 165 is at least partial defined by a lower surface 4213 of the lower ledge 193. In some embodiments, the geometric center of the striking face 109 is located below the lower portion 4211 of the upper undercut region 165. In some embodiments, the upper undercut region 165 does not extend beyond the geometric center of the striking face 109.

In some embodiments, the upper undercut depth 4201 is between about 2 mm and about 10 mm, preferably at least 3 mm, more preferably less than the lower undercut depth 4203, more preferably less than a maximum depth of the lower undercut depth 4203. In some embodiments, the upper undercut depth 4201 is between about 25% and about 50% of the lower undercut depth 4203, preferably between 30% and 40% of the lower undercut depth 4203. In some embodiments, the upper undercut depth 4201 is between about 10% and about 25% of the club head section height 4205, preferably between 13% and 18% of the club head section height 4205, more preferably at least 5% of the club head section height 4205.

In some embodiments, the lower undercut depth 4203 is less than 50% of the club head section height 4205, more preferably between 30% and 50% of the club head section height 4205, more preferably between 38% and 43% of the club head section height 4205.

In some embodiments, the lower undercut depth 4203 is at least 2 times the upper undercut depth 4201, preferably at least 2.5 times the upper undercut depth 4201.

Figure 43:
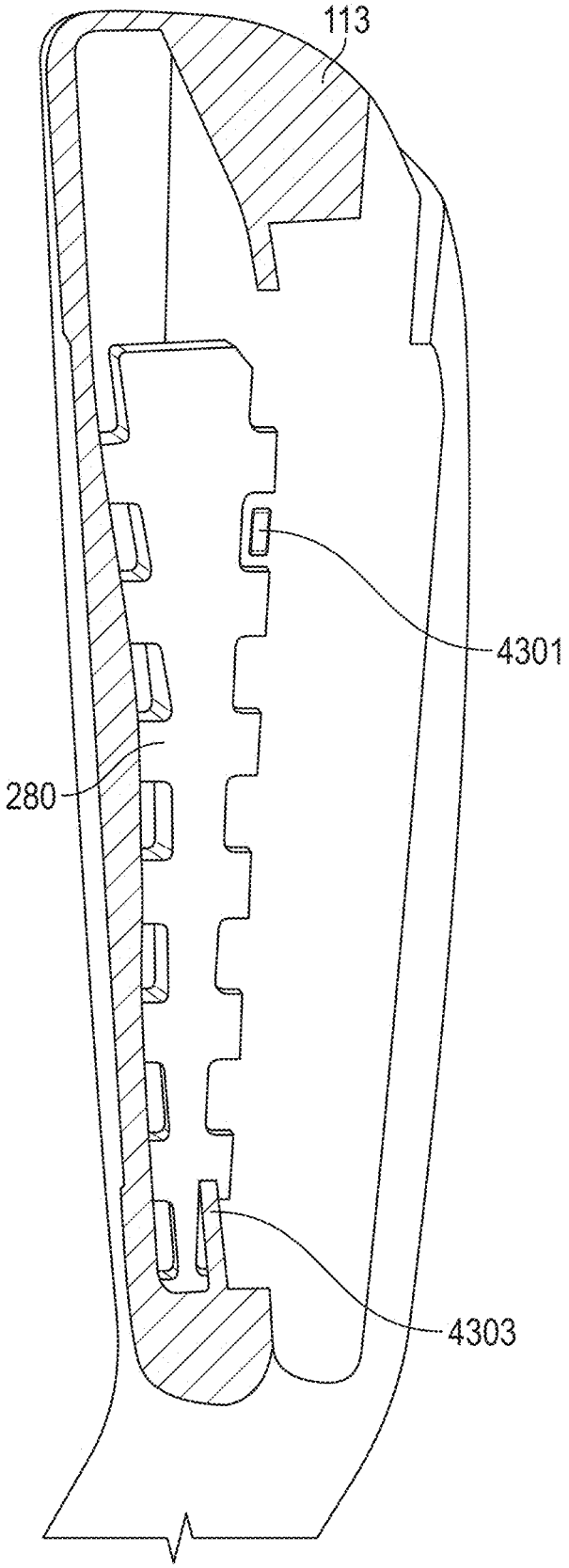
FIG. 43 is a top cross-sectional view of the golf club head of FIG. 19, according to one or more examples of the present disclosure.

FIG. 43 is a top cross-sectional view of the golf club head 100, showing the body 113 including locating or interlocking features 4301, 4303. Numerals 4301 and 4303 refer to features of club head 100. The features of club head 100 may also be applicable to club heads 300, 500, and 600. In some embodiments, the body 113 includes one or more locating or interlocking features 4301, 4303 that engages the damper 280 during installation. In some embodiments, there is a toeside locating or interlocking feature 4301 and a heelside locating or interlocking feature 4303. In some embodiments, the damper 280 is installed by first positioning the damper 280 in an upper position within the cavity 161, then is moved into a lower position within the cavity 161, engaging one or more of the locating or interlocking features 4301, 4303.

Figure 44:
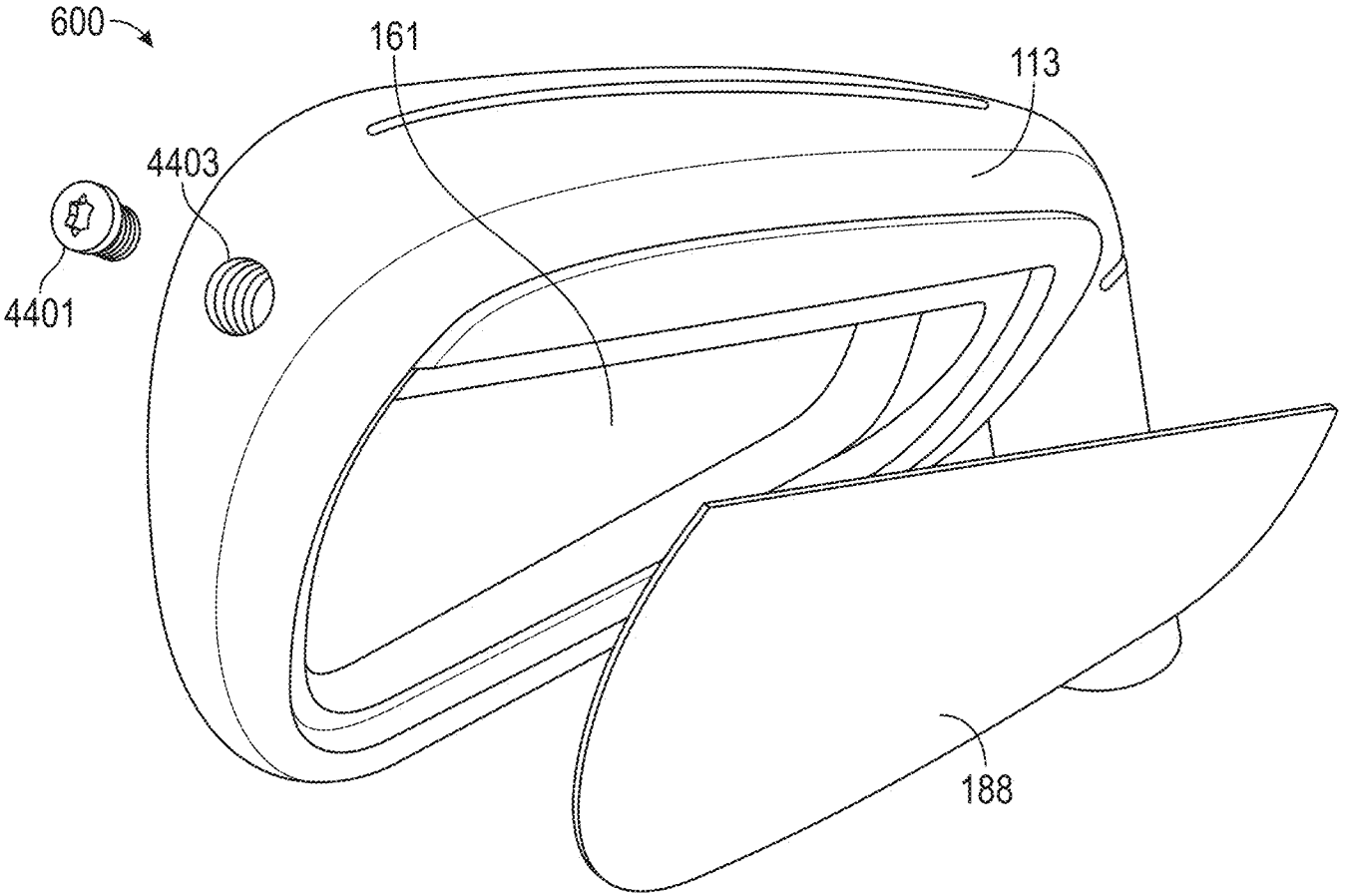
FIG. 44 is an exploded view of a golf club head according to one or more examples of the present disclosure.

FIG. 44 is an exploded view of the golf club head 600, showing the body 113 including a shim or badge 188, a fill port 4403 and a screw 4401. Numerals 4401 and 4403 refer to features of club head 600. The features of club head 100 may also be applicable to club heads 100, 300, and 500. In some embodiments, after the shim or badge 188 is installed onto the body 113, a filler material can be injected into the body 113 through the fill port 4403. After the filler material is injected into the body 113, the screw 4401 can be installed in the fill port 4403. In some embodiments, the shim or badge 188 can prevent the filler material from leaving the body 113 and can also to achieve a desired aesthetic and further dampening. In some embodiments, the filler material completely fills the cavity 161. In some embodiments, the filler material only partially fills the cavity 161, such as between 25% and 75% of the cavity 161, preferably less than 50% of the cavity 161.

Club Head Sound and Feel

Exemplary club head structures for acoustic mode altering and dampening are described in U.S. Pat. No. 10,493,336, titled "IRON-TYPE GOLF CLUB HEAD," which is incorporated herein by reference in its entirety.

The sound generated by a golf club is based on the rate, or frequency, at which the golf club head vibrates and the duration of the vibration upon impact with a golf ball. Generally, for iron-type golf clubs, a desired first mode frequency is generally above 2000 Hz, such as around 3,000 Hz and preferably greater than 3,200 Hz. Additionally, the duration of the first mode frequency is important because a longer duration may feel like a golf ball was poorly struck, which results in less confidence for the golfer even when the golf ball was well struck. Generally, for iron-type golf club heads, a desired first mode frequency duration is generally less than 10 ms and preferably less than 7 ms.

In some embodiments, the golf club head 100 has a COR between about 0.5 and about 1.0 (e.g., greater than about 0.79, such as greater than about 0.8) and a Z-up less than about 18 mm, preferably less than 17 mm, more preferably less than 16 mm. In some examples, the golf club head 100 has a first mode frequency between about 3,000 Hertz (Hz) and 4,000 Hz and a fourth mode frequency between about 5,000 Hz and about 7,000 Hz, preferably a first mode frequency between 3,394 Hz and 3,912 Hz and a fourth mode frequency between 5,443 Hz and 6,625 Hz. In these examples, the golf club head 100 has a first mode frequency duration between about 5 milliseconds (ms) and about 9 ms and a fourth mode frequency duration between about 2.5 ms and about 4.5 ms, preferably a first mode frequency duration between about 5.4 ms and about 8.9 ms and a fourth mode frequency duration of about 3.1 ms and about 3.9 ms.

Figure 45:
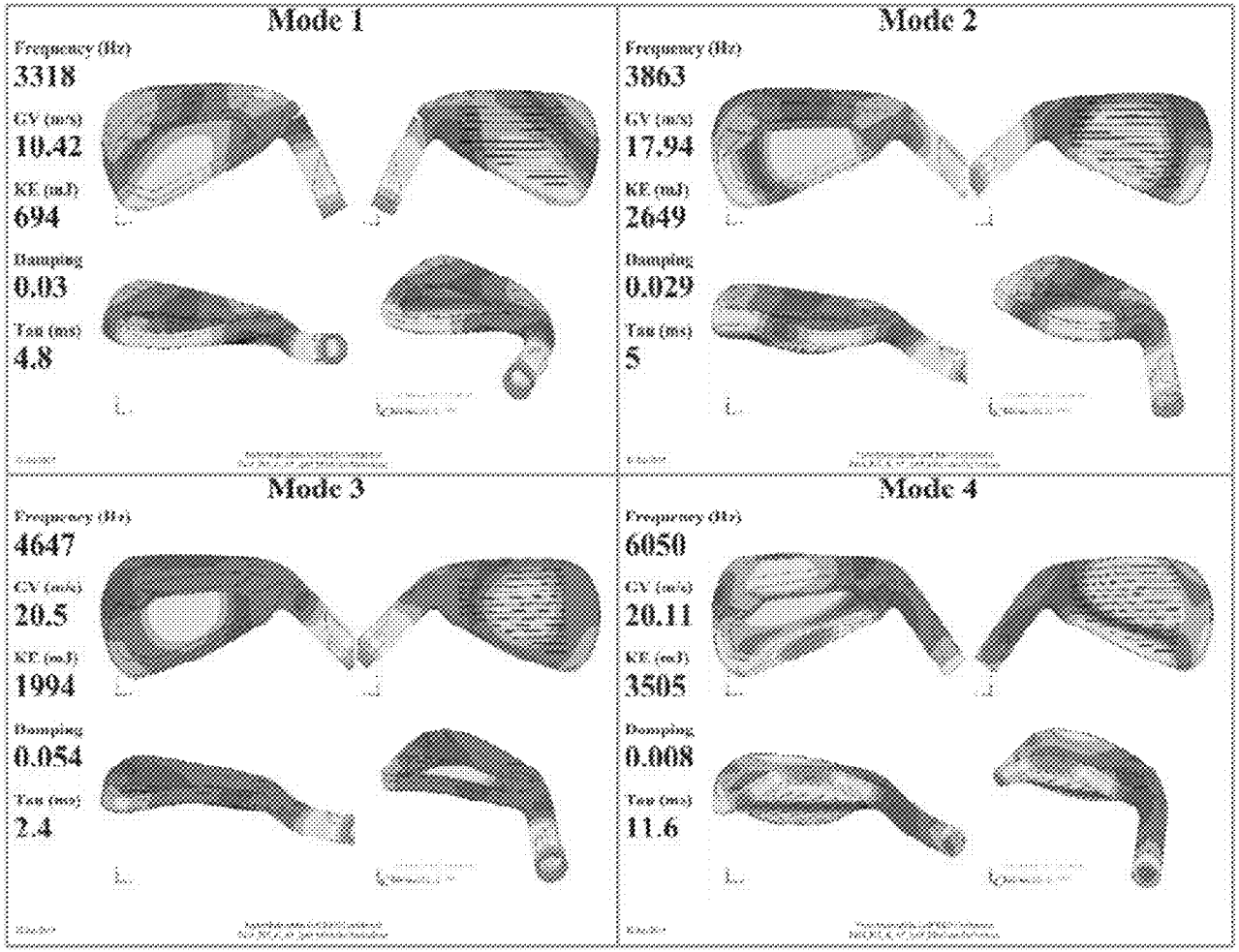
FIG. 45 includes graphical representations of a golf club head undergoing first through fourth mode frequency vibration and associated characteristics of the golf club head, according to one or more examples of the present disclosure.
Figure 46:
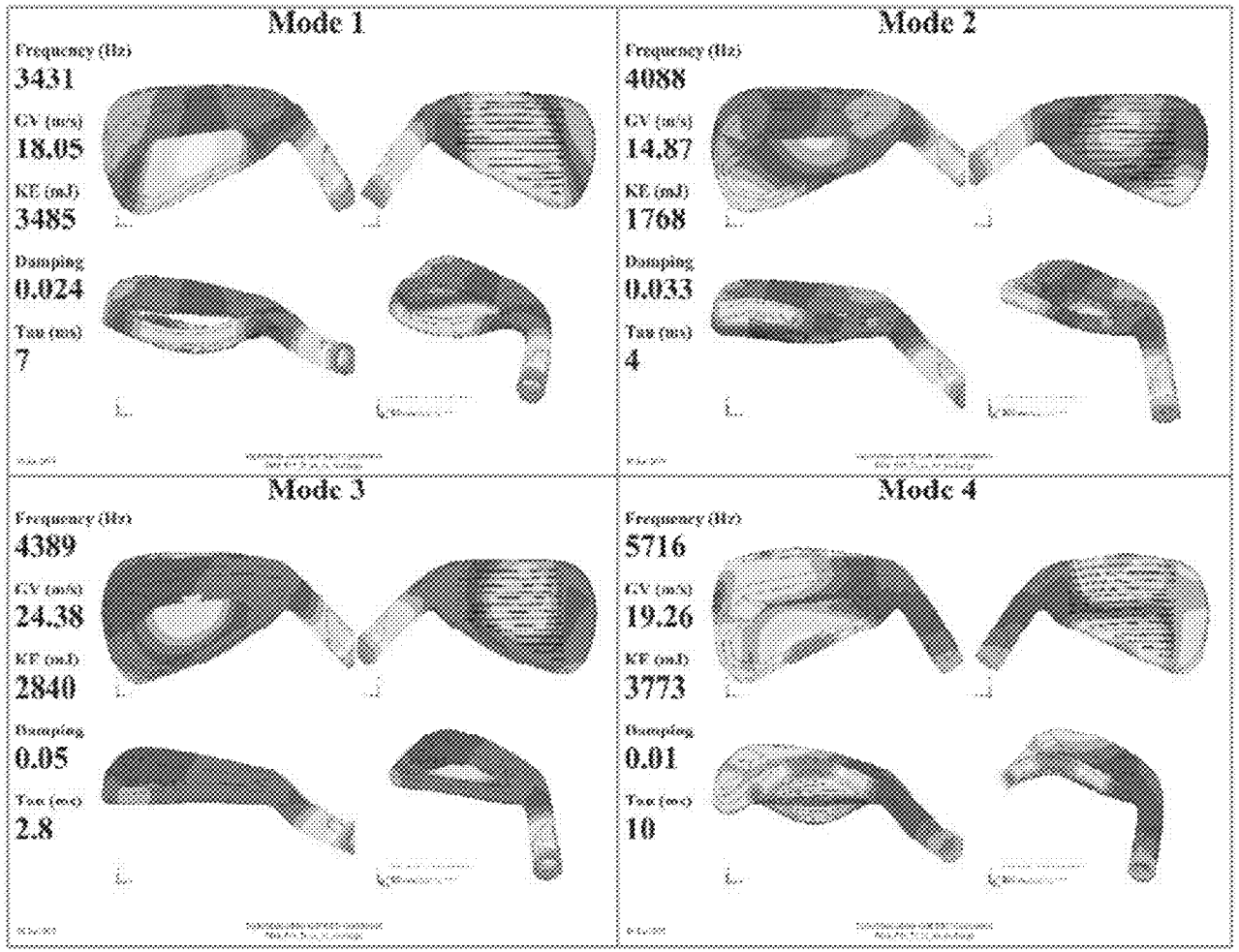
FIG. 46 includes graphical representations of a golf club head undergoing first through fourth mode frequency vibration and associated characteristics of the golf club head, according to one or more examples of the present disclosure.

FIGS. 45-46 provide graphical representations of a golf club head undergoing first through fourth mode frequency vibration and associated characteristics of the golf club head. In some embodiments, such as for a 4 iron, includes a first mode frequency of 3,318 Hz with a first mode frequency duration of 4.8 ms, a second mode frequency of 3,863 Hz with a second mode frequency duration of 5 ms, a third mode frequency of 4,647 Hz with a third mode frequency duration of 2.4 ms, and a fourth mode frequency of 6,050 Hz with a fourth mode frequency duration of 11.6 ms. In some embodiments, such as for a 7 iron, includes a first mode frequency of 3,431 Hz with a first mode frequency duration of 7 ms, a second mode frequency of 4,088 Hz with a second mode frequency duration of 4 ms, a third mode frequency of 4,389 Hz with a third mode frequency duration of 2.8 ms, and a fourth mode frequency of 5,716 Hz with a fourth mode frequency duration of 10 ms.

Although the foregoing discussion cites features related to golf club head 100 and its variations (e.g. 300, 500, 600), the many design parameters discussed above substantially apply to all golf club heads 100, 300, 500, and 600 due to the common features of the club heads. With that in mind, in some embodiments of the golf clubs described herein, the location, position or orientation of features of the golf club head, such as the golf club head 100, 300, 500, and 600, can be referenced in relation to fixed reference points, e.g., a golf club head origin, other feature locations or feature angular orientations. In some instances, the features of club heads 100, 300, 500, and 600 discussed above are referred to by numerals corresponding to their figure numbers (e.g., FIGS. 1-46) and can be applicable to all golf club heads 100, 300, 500, and 600 and other disclosed herein. Features from 100, 300, 500, and 600 can be used between embodiments. For example, each of golf club heads 100, 300, 500, and 600 can be provided with or without a damper and/or a filler material.

Toewrap Badge Structure

As clubheads continue to relocate discretionary weight low and rearward, it can become more difficult to remove additional mass from high on an iron clubhead body (i.e., above the center of gravity or Zup) and relocate the mass low on the clubhead body in order to lower the center of gravity of the club head. In some embodiments, removing too much mass in the central region of the topline portion of the clubhead can negatively impact the sound, feel, and aesthetics of the clubhead, and can also compromise durability of the clubhead body due to stress and deflection caused by removing too much weight from the topline portion.

Figure 47:
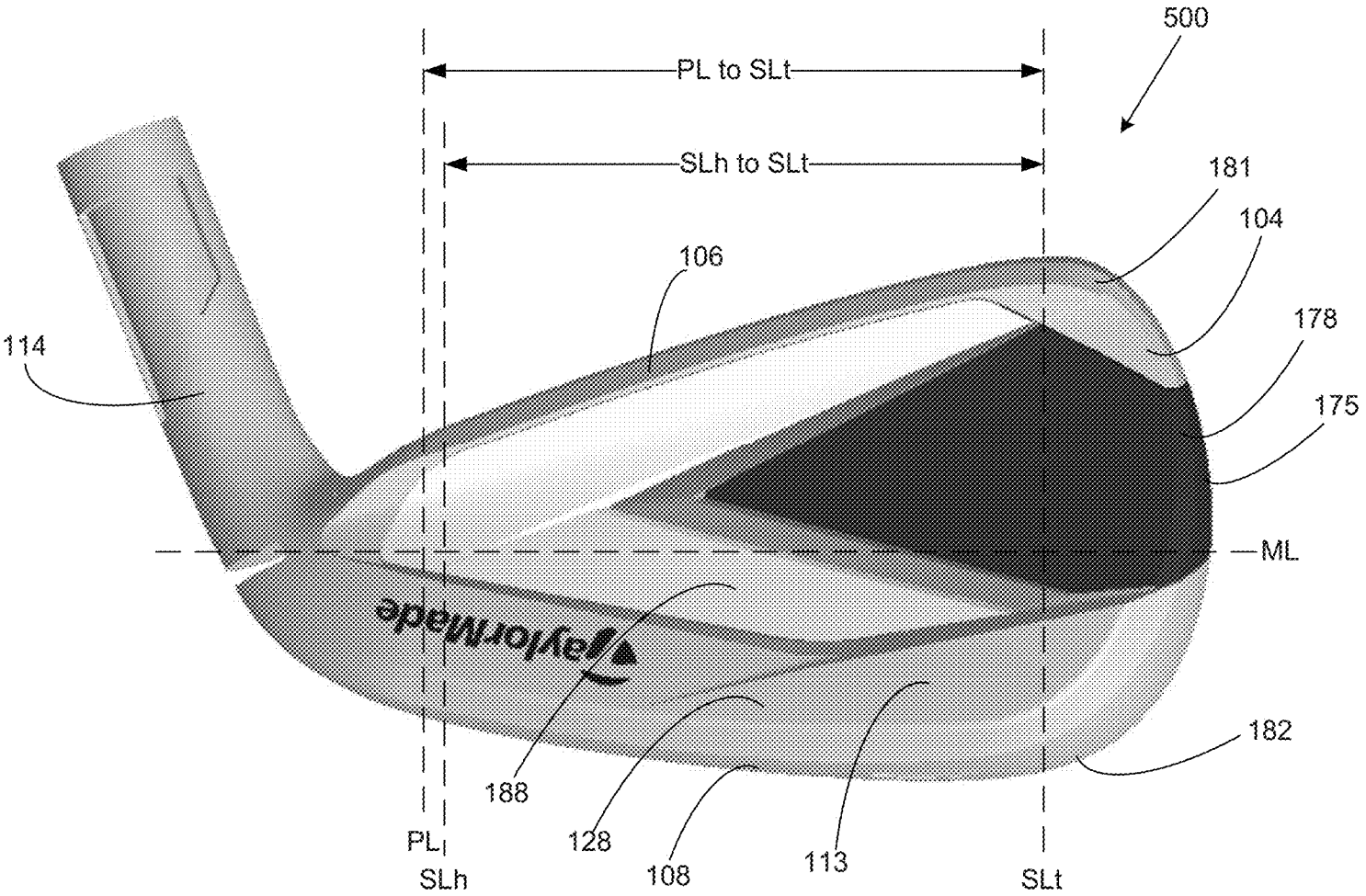
FIG. 47 is a rear perspective view of the golf club head of FIG. 23 with a shim or badge installed, according to one or more examples of the present disclosure.

Referring back to FIGS. 23, 24, 37, and 38, and as depicted in FIG. 47, the clubhead 500 can include a body 113 having a heel portion 102, a toe portion 104, a sole portion 108, a topline portion 106, a rear portion 128, a face portion 110 (not depicted in FIG. 47), and a hosel 114.

The clubhead portions can be described with respect to an x-axis, y-axis, and z-axis. An x-axis can be defined being tangent to the striking face at the origin and parallel to a ground plane. The x-axis extends in a positive direction from the origin heelward to the heel portion 102 of the clubhead body and in a negative direction toeward from the origin to the toe portion 104 of the clubhead body. The y-axis intersects the origin and is parallel to the ground plane. The y-axis is orthogonal to the x-axis and extends in a positive direction rearward from the origin to the rear portion 128 of the club head body. The z-axis intersects the origin and is orthogonal to the x-axis, the y-axis, and the ground plane. The z-axis extends in a positive direction from the origin upward to the topline portion 106 of the clubhead body and in a negative direction from the origin downward to the sole portion 108 of the club head body.

The heel portion 102 is defined as the portion of the golf club head extending to and including the hosel portion 114 (i.e., the club shaft receiving portion) from a y-z plane passing through the origin. For example, the heel portion extends heelward from a scoreline mid-plane SLmid. The scoreline mid-plane SLmid is a plane defined at the midpoint of the longest scoreline on the striking face 109, normal to the striking face 109 and normal to the ground plane GP when the golf club is in a zero-loft address position. The toe portion 104 is defined as the portion of the golf club head extending from the y-z plane in a direction opposite the heel portion. For example, the toe portion 104 extends toeward from the scoreline mid-plane SLmid.

The sole portion 108 portion is defined as the portion of the golf club extending to and including the sole of the golf club head from an x-y plane passing through the origin. The sole portion 108 extends downwards from to an address mid-plane ML, defined 20 mm above and parallel to the ground plane GP, to a lowest point of the club head (i.e., the sole), located at the ground plane GP, when the golf club is in a zero-loft address position.

The topline portion 106 portion is defined as the portion of the golf club extending to and including the topline of the golf club head from an x-y plane passing through the origin. The topline portion 106 extends upwards from the address mid-plane ML, defined 20 mm above and parallel to the ground plane GP, to a highest point of the club head (i.e., the topline) when the golf club is at a zero-loft address position.

The rear portion 128 is defined as the portion of the golf club extending to and including the sole bar of the golf club head from an x-z plane passing through the origin. The rear portion 128 extends rearward from the rear surface of the striking face 109 to a rearward-most point of the club head when the golf club is at a zero-loft address position.

The face portion 110 is defined as the portion of the golf club extending to and including the striking face of the golf club head from an x-z plane passing through the origin. The face portion 110 extends forward from the rear surface of the striking face 109 to a forward-most point of the club head when the golf club is at a zero-loft address position.

The body 113 can be a unitary cast body having the face portion 110 cast as a single piece with the other portions of the body. Alternatively, one or more of the portions of the body can be manufactured separately and attached to the body 113. For example, the face portion 110 can be welded to the body 500. Other portions of the clubhead body 113 can also be welded or otherwise attached to the body 113, such as at least a portion of the sole portion 108 and/or the topline portion 106, for example. In some embodiments, the striking face 109 can wrap into the sole portion 108 and/or the topline portion 106.

The body 113 also includes a hosel portion 114. The hosel portion 114 can include one or more weight reducing features to remove mass from the hosel portion 114, as discussed herein. For example, selectively reducing a wall thickness around the hosel portion 114 can allow for discretionary mass to be relocated to the rear portion 128 of the clubhead 500, for example.

As discussed herein, the face portion 110 (not depicted in FIG. 47) has a striking face 109, which can have a variable face thickness profile with a minimum face thickness no less than 1.0 mm and a maximum face thickness no more than 3.5 mm. The variable thickness profile can be provided symmetrically (e.g., with a "donut" shaped area of increased thickness located within the unsupported striking face) or asymmetrically (e.g., with at least one transition region between a thicker region and a thinner region within the unsupported striking face).

A shim or badge 188 can be formed separately from the body 113 and attached to the body 113. The shim or badge 188 can be received at least in part by the body 113. For example, as depicted in FIG. 47, the shim or badge 188 is received by the body 113 within the rear portion 128 and within the toe portion 104. The shim or badge 188 can be received below the topline portion 106 and above the sole bar 135. In this embodiment, the shim or badge 188 in part forms the outermost surface of the rear portion 128 and the toe portion 104. The body 113 also in part forms the outermost surface of the rear portion 128 and toe portion 104, such as above and below the badge. The body 113 also extends heelward of the shim or badge 188.

The shim or badge 188 can be formed from one or more materials. For example, the shim or badge 188 can be formed of a lower density material than the body 113. The shim or badge 188 can also be formed from a combination of materials, such as a polymer, a composite, a metal, and/or another material. In some embodiments, the shim or badge 188 can be a multi-material shim formed from a first material having a first density between about 0.5 g/cc and about 2 g/cc and a second material having a second density between about 1.5 g/cc and about 10 g/cc. For example, the first material can be a polymer material and the second material can be a metal or a composite material. In other embodiments, a first material can be a polymer material, a second material can be a composite material, and a third material can be a metal.

The iron-type golf club head 500 is provided with a weight reduction zone 175 located in the toe portion 104 of the club head 500. The weight reduction zone 175 can include one or more weight reduction features, such as a mass reduction in the toe portion 104 and the badge or shim 188 extending into the weight reduction zone 175 in the toe portion 104. The weight features in the weight reduction zone can reduce between 0.5 g and 4.0 g from the toe portion 104, more preferably between 0.7 g and 3 g, more preferably at least 0.9 g. The weight reduction zone 175 can extend between about 5 mm and 55 mm above the ground plane, preferably between about 10 mm and 45 mm above the ground plane when the clubhead is in a zero-loft address position. In some embodiments, the weight reduction zone 175 can extend from the sole (e.g., between about 0 mm and about 5 mm above the ground plane) upward. In some embodiments, the weight reduction zone can extend from the topline downward. The weight reduction zone 175 can have a length between about 5 mm and about 15 mm as measured on a plane parallel to the z-axis, such as between about 5 mm and about 10 mm, such as between about 10 mm and about 15 mm. In some embodiments, the weight reduction zone can have a length between about 15 mm and about 55 mm as measured on a plane parallel to the z-axis, such as between about 25 mm and about 45 mm.

The weight reduction features can shift a center of gravity z-axis location (Zup) by 0.5 mm toward a ground plane, such as between about 0.25 mm and about 4 mm toward the ground plane. In some embodiments, the clubhead can have a center of gravity z-axis location (Zup) between about 12 mm and about 19 mm above a ground plane, such as between about 13 and about 18 mm, such as between about 14 mm and about 17 mm, preferably no more than 18 mm, more preferably no more than 17.5 mm, and more preferably no more than 17 mm.

The toe portion the shim or badge 188 replaces high density material in the toe portion of the body (i.e., between about 2.5 g/cc and about 20 g/cc) with a lower density material of the toe portion of the shim or badge 188 (i.e., between about 0.5 g/cc and about 2 g/cc). The shim or badge 188 can wrap from a rear portion 128 of the body into the toe portion 104 of the body 113 to create a multi-material toe portion of the body. The multi-material toe portion can include a first material having a first density between about 2.5 g/cc and about 20 g/cc, and a second material having a second density between about 0.5 g/cc and about 2 g/cc. Mass removal in the high toe-region of the body allows for lower of the center-of gravity.

The shim or badge 188 includes a toe-to-rear-portion transition region 178. In some embodiments, the toe-to-rear-portion transition region 178 can form an edge as the shim or badge 188 wraps from the toe portion 104 to the rear portion 128. In some embodiments, the edge can be beveled, creating a ribbon between the rear portion 128 and toe portion 104. In other embodiments, the toe-to-rear-portion transition region 178 can rounded between the rear portion 128 and toe portion 104. The body 113 also includes a toe-to-topline-portion transition region 181 and a toe-to-sole-portion transition region 182. In some embodiments, transition regions 181, 182 can be rounded between the toe portion 104, the topline portion 106, and/or the sole portion 108. In other embodiments, the transition regions 181, 182 can be provided with an edge, such a beveled edge. Additional and different features can define the transition regions 178, 181, 182.

Figure 48:
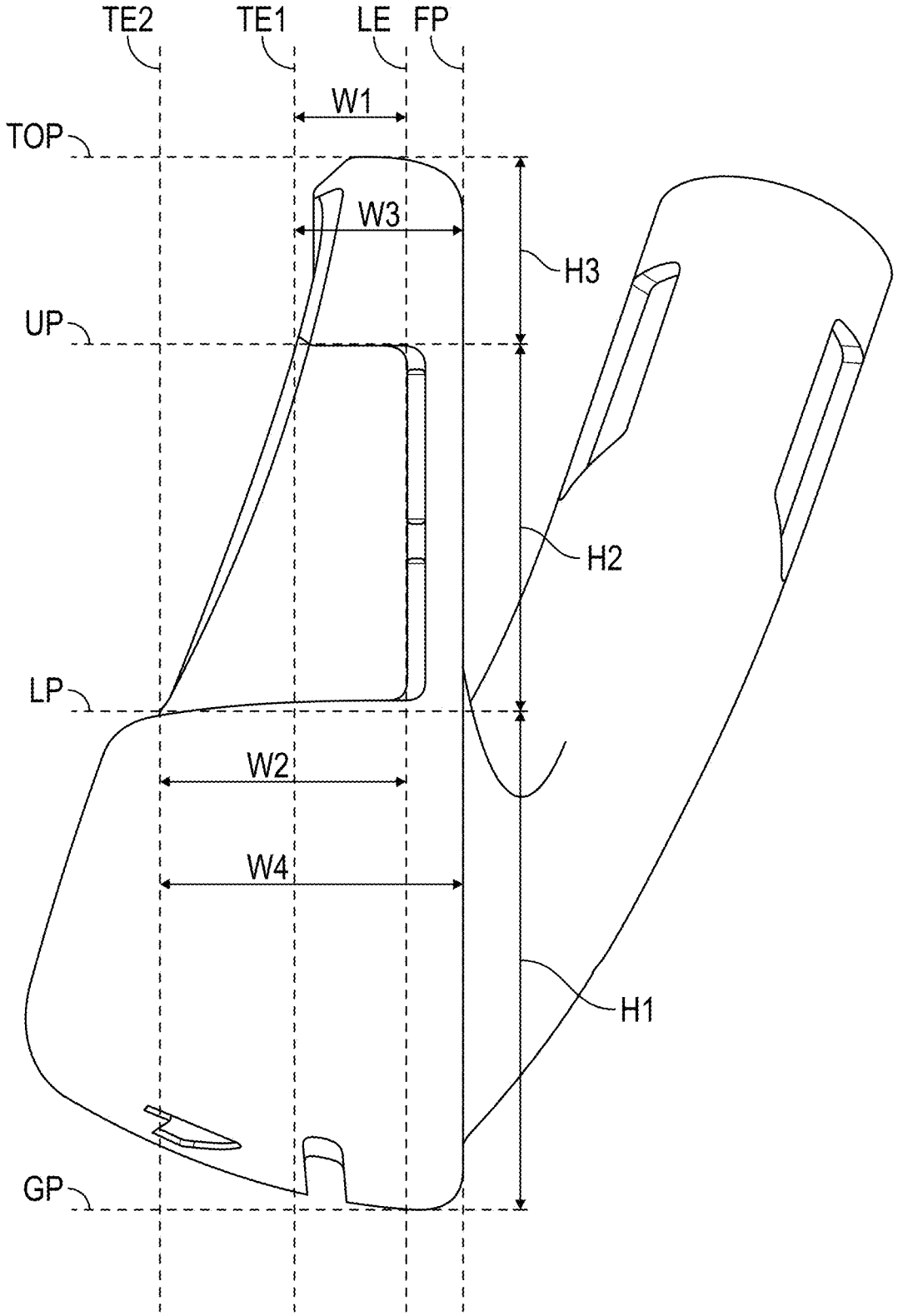
FIG. 48 is a toe-side elevation view of the golf club head of FIG. 23, according to one or more examples of the present disclosure.

FIG. 48 depicts a toe view of the clubhead 500 at zero loft. To orient the clubhead 500 into the toe view, the clubhead 500 is first oriented in a zero-loft address position. The zero-loft address position has the clubhead 500 soled on a ground plane and rotated such that a vertical axis tangent to a face plane FP and normal to ground plane GP. The clubhead is then rotated 90-degrees from a face-on view about a vertical axis counter-clockwise, resulting in a view of the toe portion 104. To orient the clubhead 500 in a rear view (not depicted in FIG. 48), the clubhead 500 is rotated another 90-degrees about a vertical axis counter-clockwise (i.e., 180-degrees from the face-on view), resulting in a view of the rear portion 128.

As depicted in FIG. 48, the shim or badge 188 can extend into the toe portion 104, in part forming an outermost surface of the toe portion 104 when received by the body 113. The outermost surface of the toe portion 104 is defined by the toe view of the clubhead discussed above. The shim or badge 188 can also form at least part of an outermost surface of the rear portion 128 when received by the body 113. The outermost surface of the rear portion 128 is defined by the rear view of the clubhead discussed above. In some embodiments, the shim or badge 188 extends into the toe portion 104 by wrapping from the toe portion 104 onto the rear portion 128 to connect at least a portion of the outermost surface of the toe portion 104 and a portion of the outermost surface of the rear portion 128.

The shim or badge 188 can extend into at least a portion of the toe portion 104 to form a non-continuous, multi-material toe portion 104. For example, the shim or badge 188 can be formed from a polymer material, or a combination of different materials, and the body 113 above and below the shim or badge 188 can be formed from a metal, such as part of a cast metal body 113.

In some embodiments, the forward-most portion of the shim or badge 188 in the toe portion 104, shown by leading edge line LE, extends beyond a forward-most portion of the shim or badge 188 in the rear portion 188, such as when positioned in the toe view of the clubhead. The forward-most portion of the shim or badge 188 in the toe portion 104, shown by leading edge line LE, does not extend beyond the face plane line FP. In some embodiments, the face plane line FP and the leading edge line LE are separated by between about 0.5 mm and about 5 mm. Further, in some embodiments, a gap is positioned between the forward-most portion of the shim or badge 188 in the toe portion 104 and the toe portion 104.

In some embodiments, the forward-most portion of the shim or badge 188 in the toe portion 104, shown by leading edge line LE, is substantially parallel to the striking face 109, shown by face plane line FP. An upper-most edge of the toe portion of the badge, shown by the upper edge line UP, and a lower-most edge of the toe portion of the badge, shown by the lower edge line LP, may be substantially perpendicular to the striking face 109.

In some embodiments, the width W1 from the leading edge line LE and the first trailing edge line TE1 is between about 2 mm and about 6 mm, preferably between about 4 mm and about 5 mm. In some embodiments, the width W2 from the leading edge line LE and the second trailing edge line TE2 is between about 10 mm and about 14 mm, preferably between about 11 mm and about 12 mm. In some embodiments, the width W3 from the face plane line FP and the first trailing edge line TE1 is between about 3 mm and about 8 mm, preferably between about 5 mm and about 6 mm. In some embodiments, the width W4 from the face plane line FP and the second trailing edge line TE2 is between about 11.5 mm and about 15.5 mm, preferably between about 12.5 mm and about 13.5 mm.

In some embodiments, the height H1 from ground plane line GP to the lower edge line LP as measured along the z-axis is between about 10 mm and about 20 mm, preferably between about 12 mm and about 18 mm. In some embodiments, the height H1 from ground plane line GP to the lower edge line LP as measured along the z-axis is within 2 mm of Zup or between Zup−2 mm and Zup+2 mm, preferably Zup±1.5 mm, even more preferably Zup±1 mm. Removing mass above Zup and then redistributing it lower in the club head is preferred, which is a reason some embodiments may have height H1 within 2 mm of Zup. In some embodiments, the height H2 from the lower edge line LP to the upper edge line UP as measured along the z-axis is between about 10 mm and about 30 mm, preferably between about 14 mm and about 25 mm. In some embodiments, the height H3 from the upper edge line UP to a topline plane line TOP as measured along the z-axis is between about 1 mm and about 15 mm, preferably between about 3 mm and about 13 mm. In some embodiments, the height H3 can be eliminated and the shim or badge 188 can extend directly from the topline downward. In some embodiments, the height H1 can be eliminated and the shim or badge 188 can extend directly from the sole upward. In some embodiments, the height H2 can be the entire height of the clubhead.

In some embodiments, the height H1 may range from 0.9*Zup to 1.1*Zup, and the height H2 may range from 0.7*Zup to 1.3*Zup.

Figure 49:
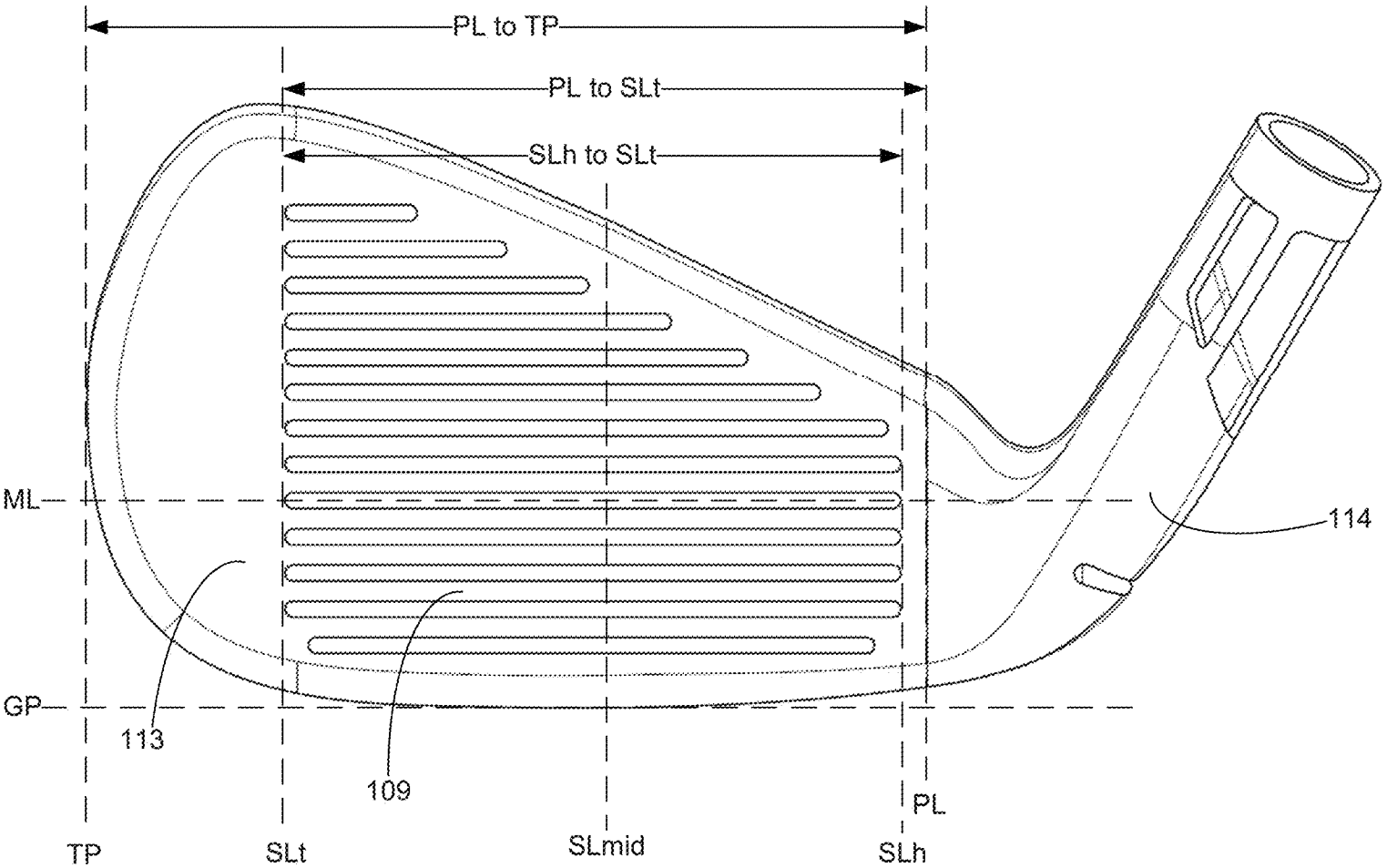
FIG. 49 is a front elevation view of the golf club head of FIG. 23, according to one or more examples of the present disclosure.

FIG. 49 is a front elevation view of the golf clubhead 500 (i.e., oriented in a face-on view). FIG. 49 depicts the toeward and heelward boundaries of the scorelines. For example, the scorelines extend toeward up to toeward line SLt and heelward up to heelward line SLh. The scorelines end just before the par line PL. The par line PL is at the transition point between the flat striking face 109 and the organically shaped region that attaches the club head body 113 to the hosel 114 (i.e., the location of a blend of the hosel 114 into the planar striking face 109). The scoreline mid-plane SLmid is a plane defined at the midpoint of the longest scoreline on the striking face 109, normal to the striking face 109 and normal to the ground plane GP when the golf club is in a zero-loft address position. The scoreline mid-plane bisects the longest scoreline.

The clubhead 500 has a projected area between the scorelines (i.e., between toeward line SLt and heelward line SLh) that is projected onto a plane tangent to the face plane between about 1300 $mm^2$ and about 2700 $mm^2$, such as between about 1400 $mm^2$ and about 2100 $mm^2$. In some embodiments, a projected area of shim or badge 188 that is projected onto a plane tangent to the face plane is greater than total area of the face within scorelines projected onto the plane tangent to the face plane (i.e., bounded by the heelward-most scoreline SLh, the toeward-most scoreline SLt, the upward-most scoreline, and the lower-most scoreline).

Referring back to FIG. 47, the shim or badge 188 can extend heelward of the scorelines (i.e., heelward of heelward line SLh) and/or heelward of the par line PL. The shim or badge 188 can also extend toeward of the scorelines (i.e., toeward of toeward line SLt). For example, a total length of the badge from a first end to a second end (in a heel-to-toe direction parallel to the ground plane) can be greater than a total length from a par line PL to the toeward-most portion of the toe portion denoted by line TP (i.e., PL to TP). In some embodiments, a total length from a heelward-most scoreline (i.e., SLh) to the toeward-most portion of the toe portion (i.e., TP) is less than a total length of the shim or badge 188.

Figure 50:
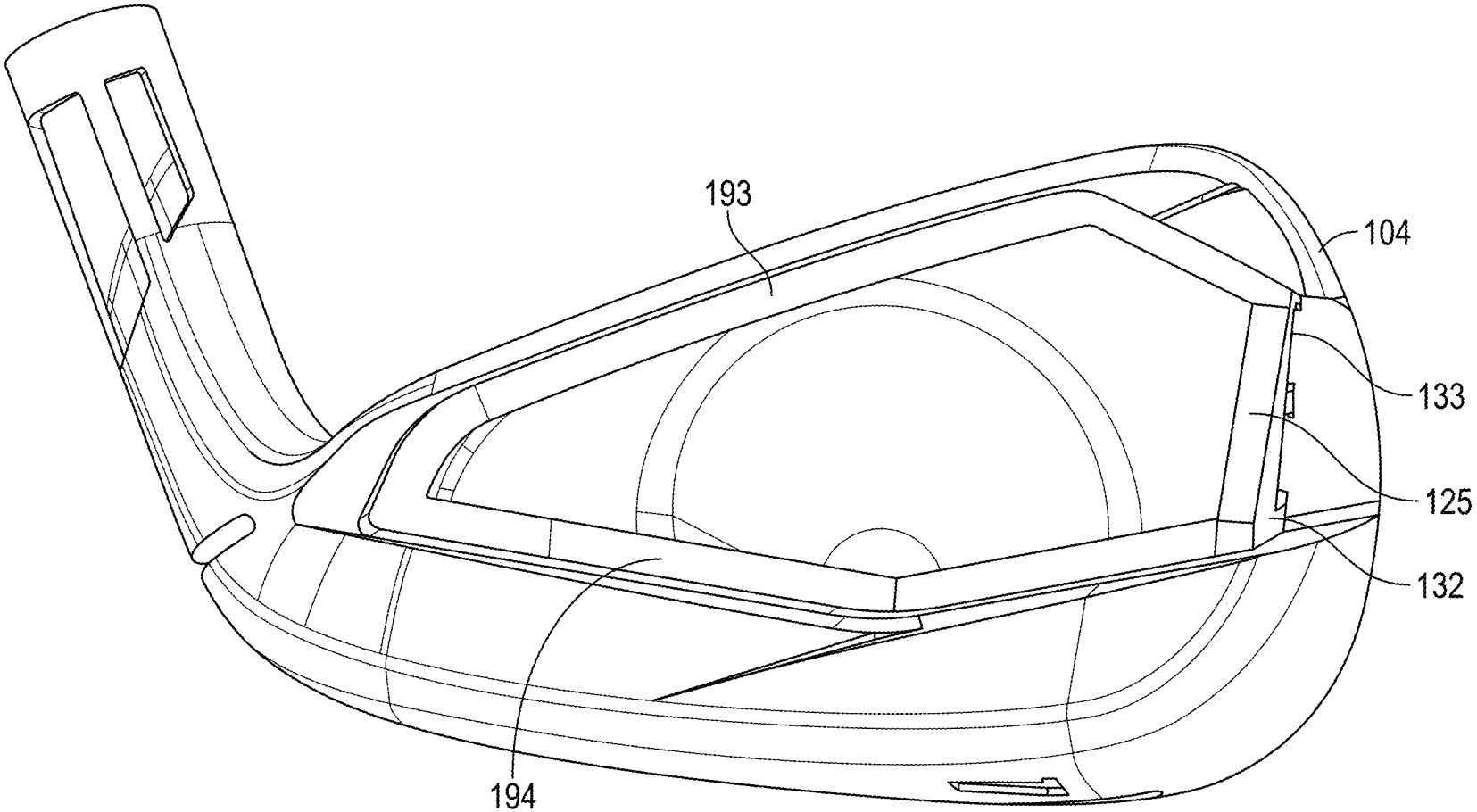
FIG. 50 is a rear perspective view of the golf club head of FIG. 23 without a shim or badge installed, according to one or more examples of the present disclosure.

FIG. 50 is a rear perspective view of the clubhead 500 without the shim or badge 188 installed. The toe portion 104 includes a beam 132 with a toeside ledge 125 for receiving at least a portion of the shim or badge 188. The beam 132 can also provide structural support for the topline portion 106 when mass is removed from the toe portion 104. In some embodiments, the toeside ledge 125 can connect the upper ledge 193 and the lower ledge 194. In other embodiments, the toeside ledge 125 is only connected to one of the upper ledge 193 or the lower ledge 194. In other embodiments, the toeside ledge 125 does not connect the upper ledge 193 or the lower ledge 194.

In some embodiments, the toe portion 104 extends toeward of the beam 132, and the shim or badge 188 wraps around the beam 132 and forward toward the face portion 110. In other embodiments, the beam 132 provides a toeward peripheral surface of the toe portion 104, and the shim or badge 132 does not extend beyond or toeward of the of the beam 132. In some embodiments, the shim or badge 188 wraps around both a toeward and a heelward side of the beam 132 and forward toward the face portion 110 on both sides of the beam 132.

The beam 132 can have one or more relief sections 133 to further reduce discretionary mass above the center of gravity of the clubhead 500. By providing relief sections 133 in the beam, additional discretionary mass can be relocated while still providing stiffness to support the badge or shim 188, the topline portion 106, and the toe portion 104. In some embodiments, the relief sections 133 extend only partially through the beam as depicted in FIG. 50. In other embodiments, the relief section 133 extend entirely through the beam 132 to the cavity 161. In some embodiments, the sections 133 are filled with a filler material.

Figure 51:
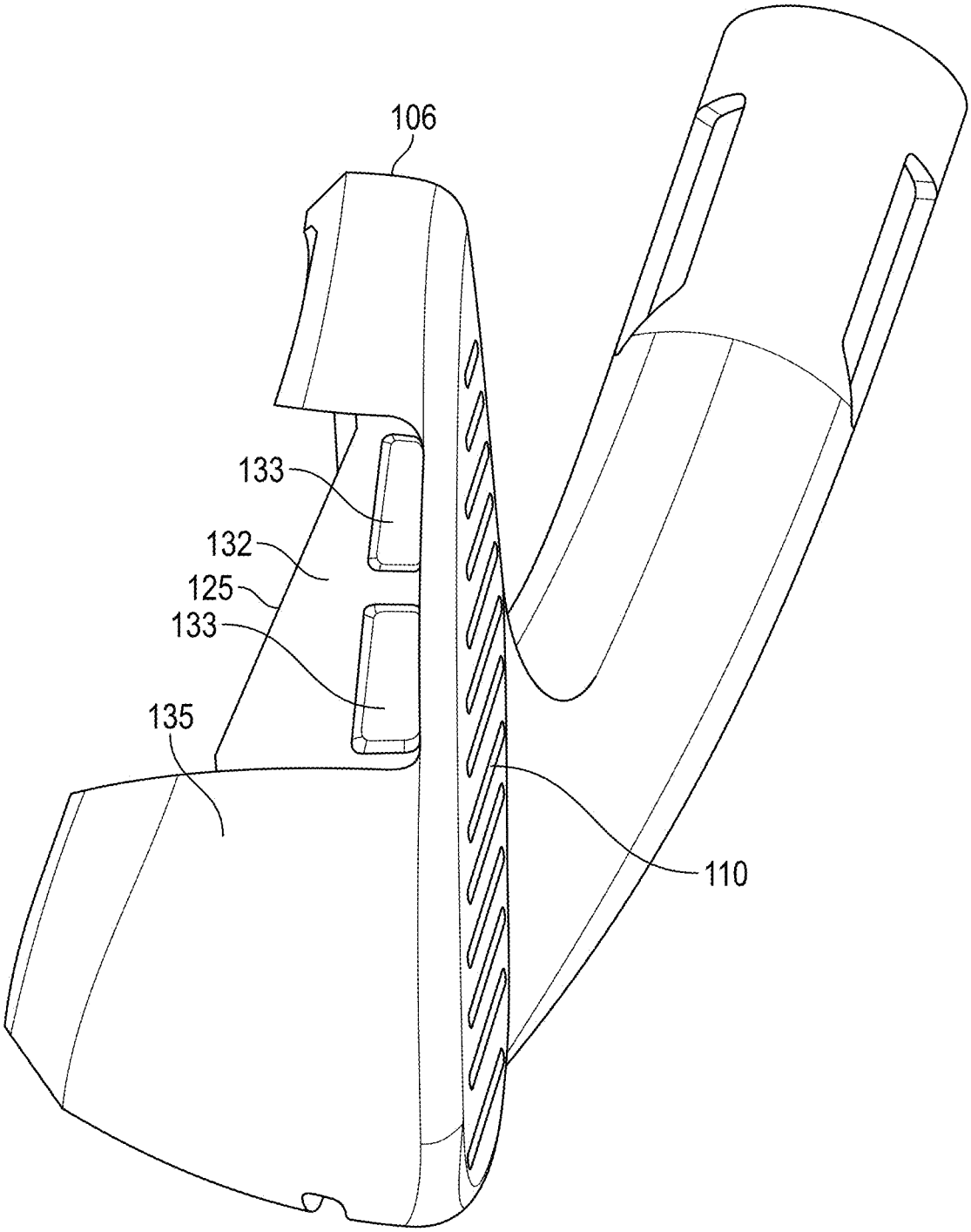
FIG. 51 is a toe-side elevation view of the golf club head of FIG. 23 without a shim or badge installed, according to one or more examples of the present disclosure.

FIG. 51 is a front elevation view of the golf clubhead 500 (i.e., oriented in a toe view at zero-loft) without the shim or badge 188 installed. The toeside ledge 125 extends below the topline portion 106 and above the sole bar 135. In some embodiments, the toeside ledge 125 connects the upper ledge 193 and the lower ledge 194. In some embodiments, the relief sections 133 are at least 20% of the toeward surface of the beam 132, such as between about 20% and about 60% of the toeward surface of the beam 132. The toeward surface of the beam 132 can be defined by the clubhead at zero-degrees loft and rotated 90 degrees counter-clockwise about a vertical axis tangent to a face plane and normal to a ground plane.

As depicted in FIG. 51, the beam 132 can have a minimum beam depth that is less than a minimum thickness of the topline portion 106. The beam 132 can also have a maximum beam depth that is less than a minimum thickness of the sole bar 135.

The beam 132 extends between the shim or badge 188 and the face portion 110. The shim or badge 188 is received at least in part by the upper ledge 193, the lower ledge 194, and the toeside ledge 125. In some embodiments, the shim or badge 188 can close an opening in the cavity and to enclose an internal cavity volume, such as between 5 cc and 20 cc. Alternatively, the shim or badge 188 can be provided within the cavity of a cavity-back iron.

The shim or badge 188 is received at least in part by the body 113 below the topline portion 106. In this embodiment, the shim or badge 188 does not form or extend into any portion of the topline portion 106. For example, an outermost surface of the topline portion 106 can be formed from a metal. For example, outermost surface of the topline portion 106 can be defined by a topline view of the clubhead at zero-degrees loft and rotated 90 degrees about a horizonal axis tangent to the face plane and parallel to the ground plane.

Figure 52:
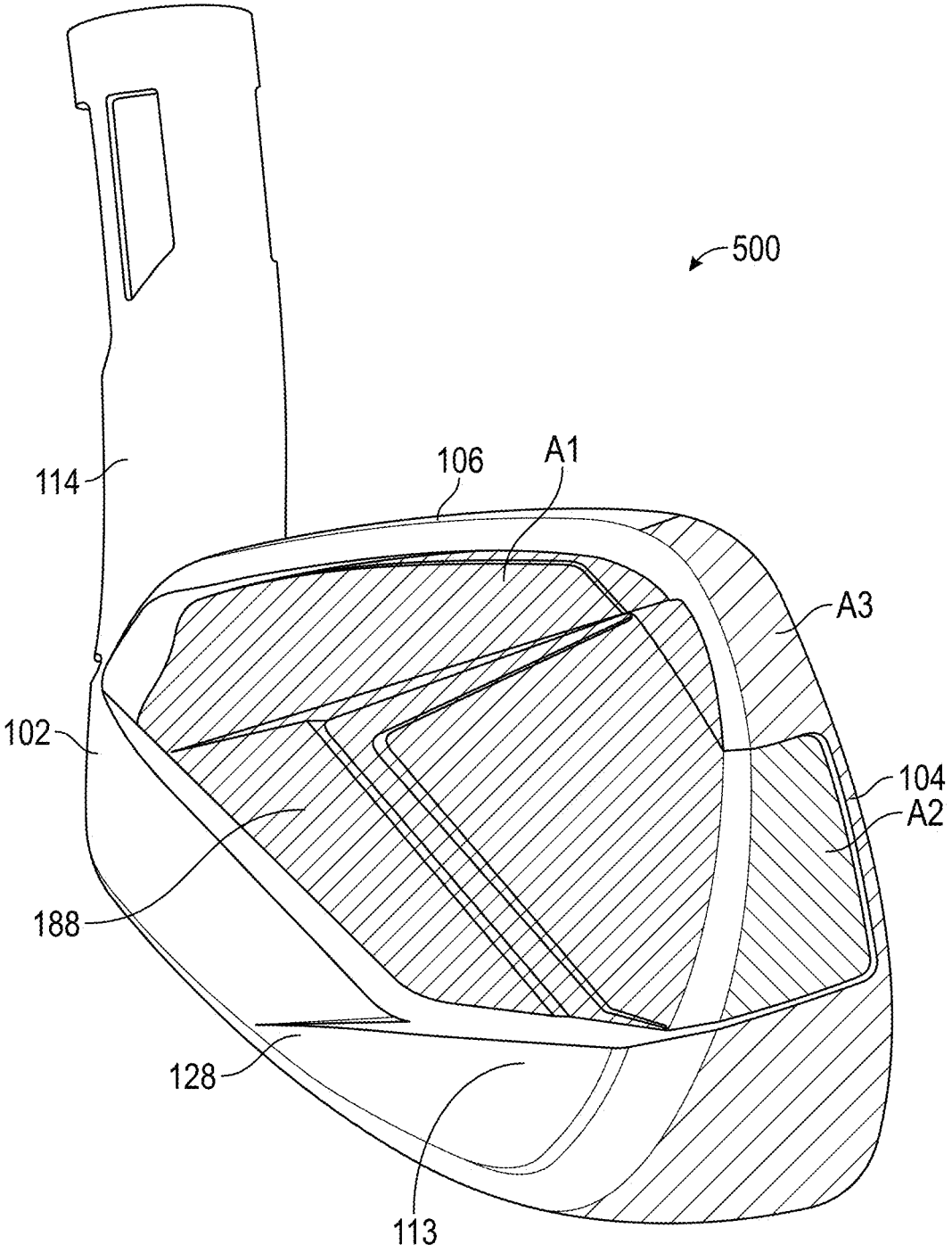
FIG. 52 is a perspective view of the golf club head of FIG. 23, according to one or more examples of the present disclosure.

FIG. 52 is a perspective view of the clubhead 500 depicting three surface areas A1, A2, A3, each depicted with a different cross-hatching. The rear portion of the shim or badge 188 can have a surface area A1 of at least 1,400 $mm^2$ and no more than 5,000 $mm^2$, such as between about 1,400 $mm^2$ and about 2,100 $mm^2$, such as between about 1,750 $mm^2$ and about 1,950 $mm^2$, such as between 2,000 $mm^2$ and 4,000 $mm^2$, such as between 3,000 $mm^2$ and 4,500 $mm^2$. The surface area A1 is the area projected onto a plane parallel to the rear view discussed herein. The toe portion of the shim or badge 188 can have a surface area A2 of at least 100 $mm^2$ and no more than 400 $mm^2$, such as between about 100 $mm^2$ and about 250 $mm^2$, such as between about 200 $mm^2$ and 400 $mm^2$, such as between 200 $mm^2$ and 350 $mm^2$, such as between about 130 $mm^2$ and about 180 $mm^2$. The toe portion 104 of the body 113 above and below shim or badge 188 can have a surface area A3 of at least 500 $mm^2$, such as between about 500 $mm^2$ and about 850 $mm^2$, such as between about 600 $mm^2$ and about 750 $mm^2$. The surface areas A2, A3 are the areas projected onto a toe plane, defined as a plane perpendicular to a strike face of the clubhead and perpendicular to a ground plane, when the clubhead is in a zero loft orientation on the ground plane. The surface area A2 is greater than a surface area of the outermost surface of the toe portion above the shim or badge 188, as projected onto the toe plane.

Figure 53:
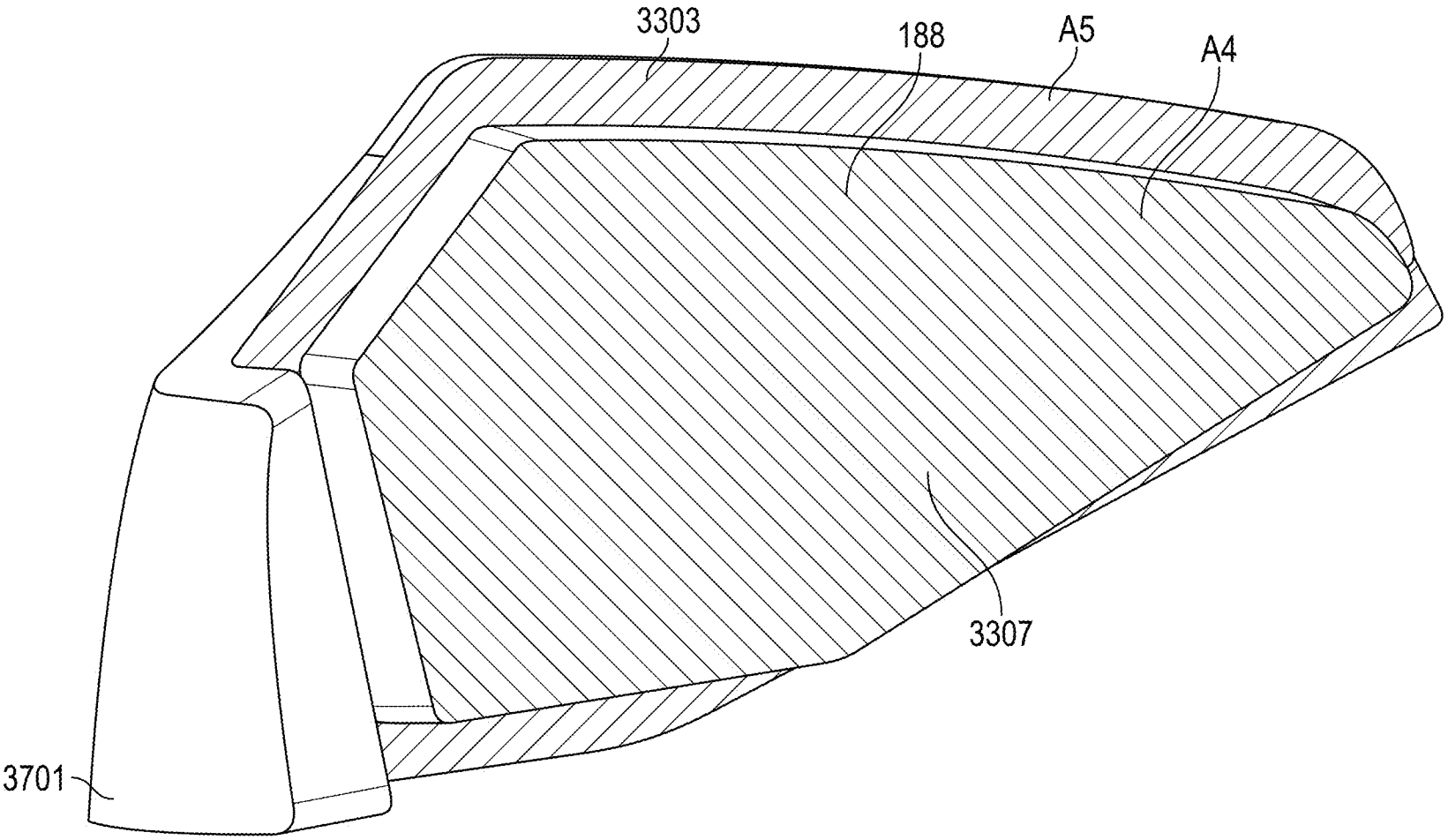
FIG. 53 is a front perspective view of the shim or badge from the golf club head 500 of FIG. 23, according to one or more examples of the present disclosure.

FIG. 53 is a perspective view of the shim or badge 188 depicting surface areas A4, A5, each depicted with a different cross-hatching. For example, the shim or badge 188 can have a ledge 3303 used for installing the shim or badge 188 onto the golf club head 500. The ledge 3303 surrounds an inner portion 3307 of the shim or badge 188. The inner portion of the shim or badge 188 can be inserted into the cavity of the clubhead 500 when the shim or badge 188 is installed. The inner portion of the shim or badge 188 can have a surface area A4 of at least 700 $mm^2$, such as between about 700 $mm^2$ and about 1,600 $mm^2$, such as between about 900 $mm^2$ and about 1,400 $mm^2$. The ledge 3303 can have a surface area A5 of at least 400 $mm^2$, such as between about 400 $mm^2$ and about 1,000 $mm^2$, such as between about 550 $mm^2$ and about 750 $mm^2$.

As depicted in FIG. 53, the shim or badge 188 has a variable thickness and with a three-dimensional outer surface including a toewrap portion 3701. The inner portion 3307 of the shim or badge 188 can be three-dimensional and can protrude into the opening in the cavity of the clubhead 500. The toewrap portion 3701 can extend beyond all other exterior surfaces of the badge and toward the face portion 110. For example, the toewrap portion 3701 can extend beyond the inner portion 3307 proximate to the face portion 110 of the clubhead 500. As such, the toewrap portion 3701 can extend forward than any other portion of the shim or badge 188 when installed and the club oriented in normal address and zero-loft positions.

In some embodiments, the toewrap portion 3701 creates an angle with respect to the rear portion 128 and/or outermost surface of the shim or badge 188. For example, the toewrap portion 3701 can form an angle with respect to the rear portion 128 of the shim or badge 188. For example, the angle can be greater than about 40 degrees, such as between about 40 degrees and about 120, such as between about 60 degrees and about 100 degrees, such as about 80 degrees, about 90 degrees, about 100 degrees, or about 110 degrees. As such, the shim or badge 188 can wrap from the toe portion 104 onto the rear portion 128 forming at least a 40-degree angle as measured between the outermost surface of the toe portion 104 and the outermost surface of the rear portion 128.

In some embodiments, no portion of the shim or badge 188 directly contacts the face portion 110, such as in a hollow-body iron. In these embodiments, at least a portion of the cavity can separate the shim or badge 188 from the face portion 110. In other embodiments, a portion of the shim or badge 110 can directly contact the face portion 110, such as in a cavity-back iron. For example, toewrap portion 3701 of the shim or badge 110 can extend rearward away from the face portion 110 in the toe portion 104 in a cavity-back iron.

Figure 54:
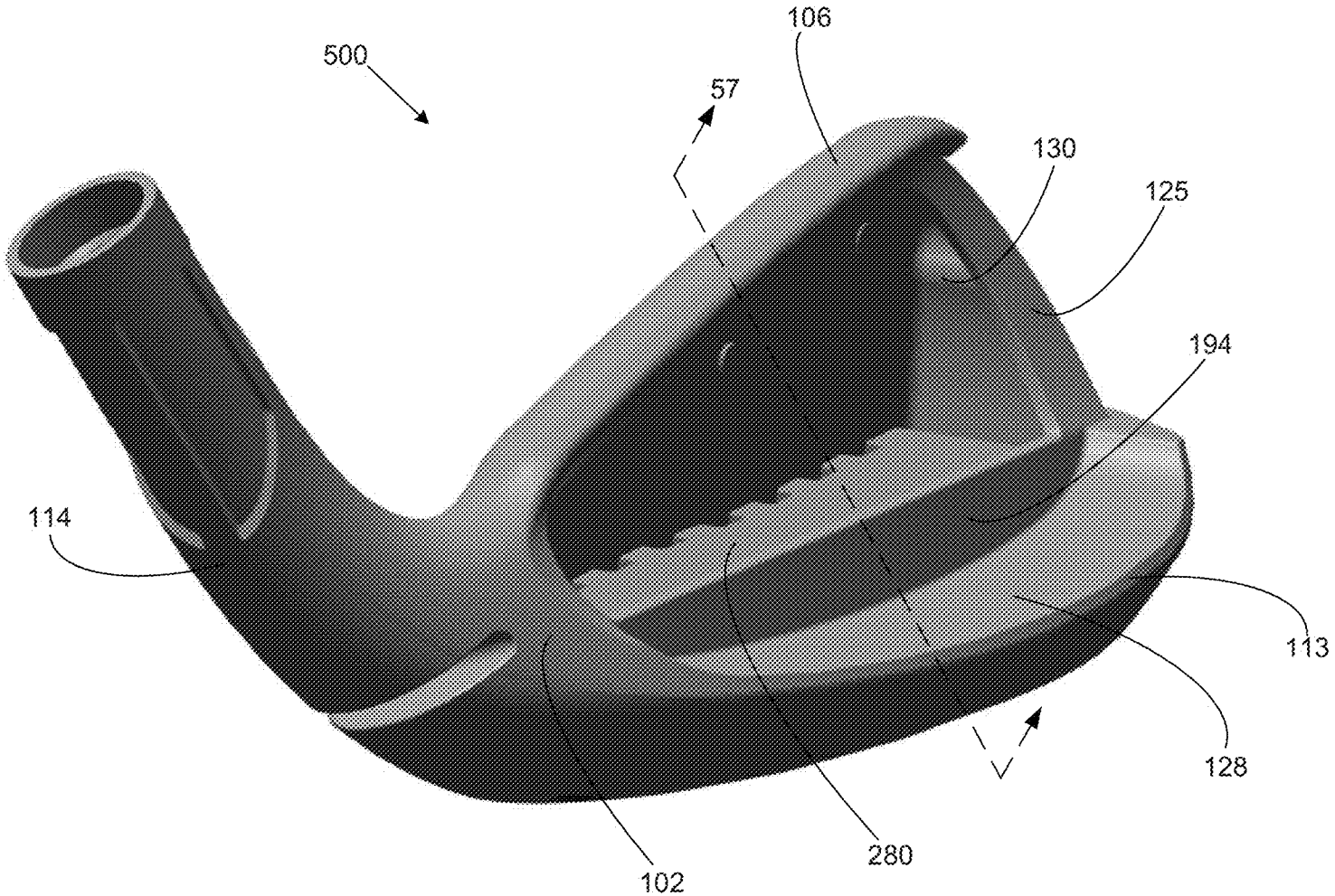
FIG. 54 is a rear, heel-side perspective view of a golf club head, without a shim or badge installed, according to one or more examples of the present disclosure.

FIG. 54 depicts another embodiment of the clubhead 500, which can include a body 113 having a heel portion 102, a toe portion 104, a sole portion 108, a topline portion 106, a rear portion 128, a face portion 110 (not depicted), and a hosel 114. As discussed herein, a damper 280 can be installed within a cavity in the body 113. Alternatively or additionally, a filler material can be injected or otherwise included within the cavity in the body 113.

A sole bar can define a rearward portion of the sole portion, and a cavity can be defined by a region of the body rearward of the striking face, forward of the sole bar, above the sole, and below the topline. A lower undercut region can be defined within the cavity rearward of the striking face, forward of the sole bar, and above the sole. A lower ledge can extend above the sole bar to further define the lower undercut region. An upper undercut region can be defined within the cavity rearward of the striking face, forward of an upper ledge and below the topline. The upper ledge can extend below the topline.

In this embodiment, no beam 132 is provided to support the shim or badge 188. Instead of including a beam 132, a recessed area 130 is provided in the toe portion 104 for supporting the shim or badge 188. For example, by hollowing out the inside the toe portion 104 and forward of the toeside ledge 125, resulting in the recessed area 130, discretionary mass can be removed and relocated lower in the body 113, while providing the toeside ledge 125 for supporting the shim or badge 188. By omitting the beam 132, the support structure for the shim or badge 188 does not need to contact the rear surface of the striking face 110, resulting a larger unsupported area of the striking face 110. The toeside ledge 125 can extend heelward from the toe portion 104 to provide support for the badge or shim 188.

In some embodiments, the toeside ledge 125 can connect with the upper ledge 193 and/or the lower ledge 194. The lower ledge 193 can have a variable surface area as projected onto a plane substantially parallel to a plane tangent to the lower ledge 193. For example, a lower edge of the lower ledge 193 can be rounded and an upper edge of the lower ledge 193 can be substantially straight. Accordingly, a midpoint of the lower ledge has a greater projected surface area than the endpoints of the lower ledge proximate to the toe and the heel of the clubhead. In this embodiment, the lower ledge 193 is tapered at each end.

Figure 55:
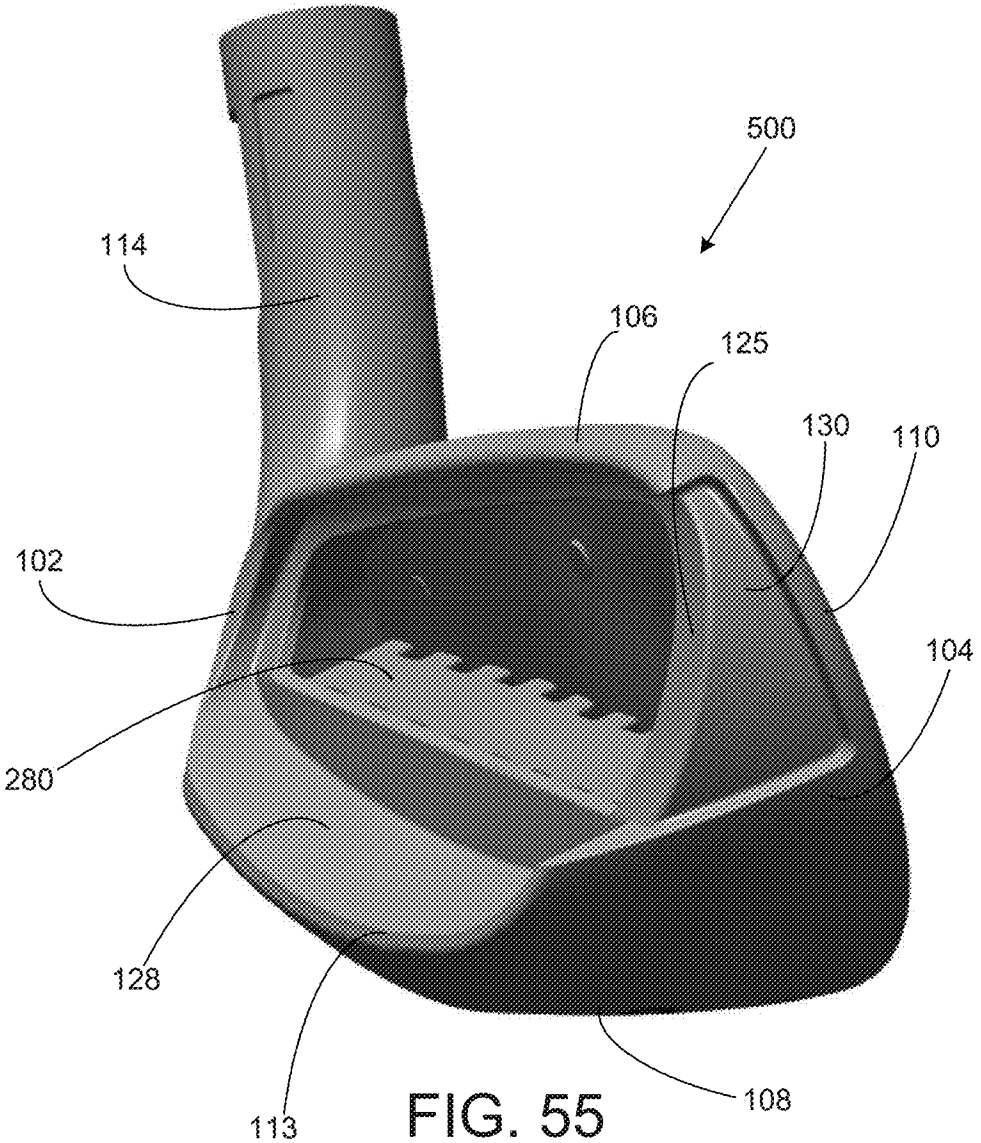
FIG. 55 is a rear, toe-side perspective view of a golf club head, without a shim or badge installed, according to one or more examples of the present disclosure.

FIG. 55 depicts a toeward view of an embodiment of the clubhead 500, without the shim or badge 188 installed. As discussed above, additional discretionary mass can be relocated by omitting the beam 132 and providing a toeside ledge 125 directly in the toeside area of the toe portion. In some embodiments, the toeside area of the toe portion can include another recessed area 130 provided in the outside surface of the toe portion 104. The additional recessed area 130 can allow for more discretionary weight to be relocated lower in the body 113 and to allow for the shim or badge 188 to wrap into the toe portion 104 and sit substantially flush with the areas of the body 113 above and below the shim or badge 188 (as depicted in FIG. 56).

As depicted in FIG. 55, the toeside ledge 125 can largely follow the shape of the toe portion, such as having an organically rounded profile. As such, when the shim or badge 188 is installed, the clubhead 500 gives the appearance of a hollow iron. The damper 280 can be installed into the cavity of the body 113 prior to attaching the shim or badge 188. As discussed herein, the shim or badge 188 can include relief portions to reduce contact between the damper 180 and the striking face 110, while improving acoustics and feel of the clubhead 500.

Figure 56:
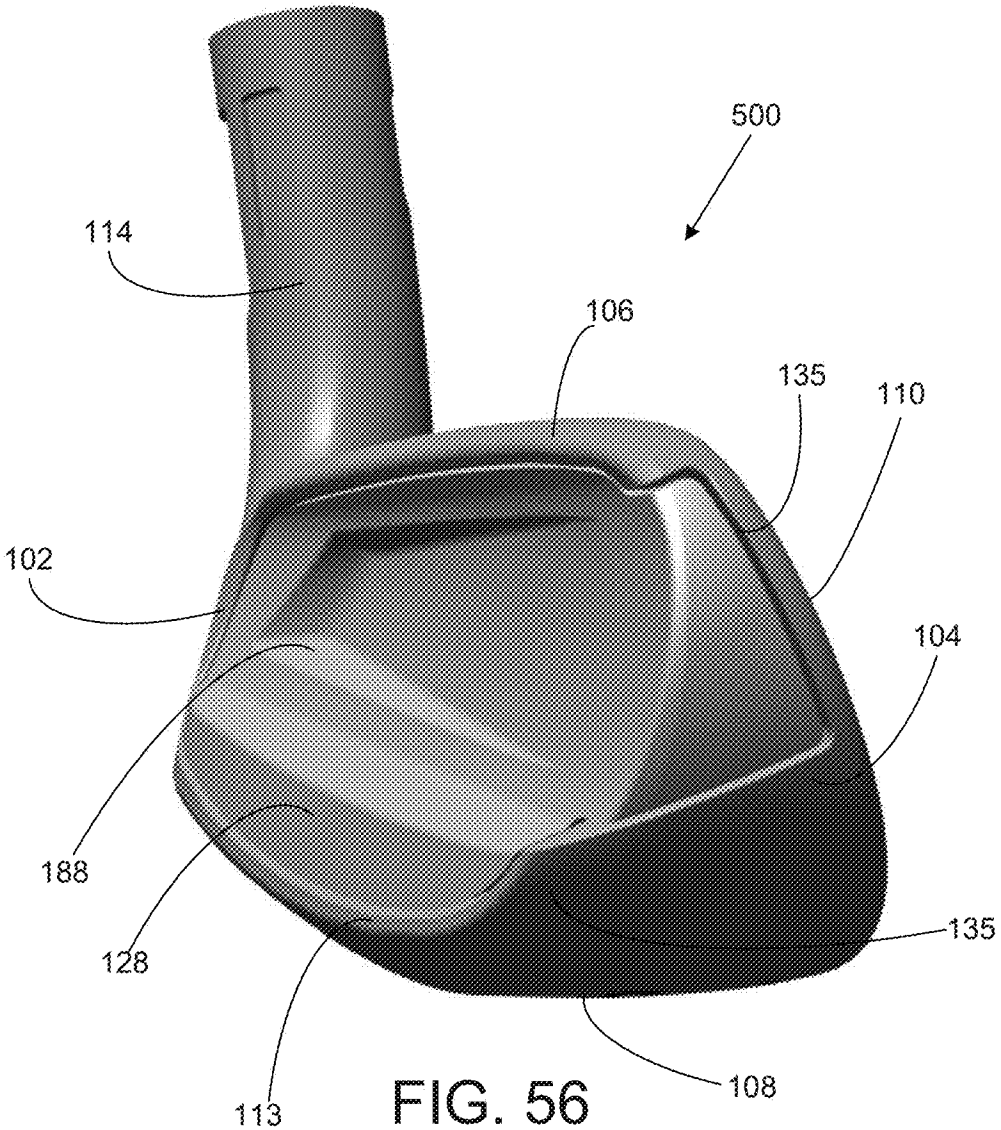
FIG. 56 is a rear, toe-side perspective view of a golf club head, with a shim or badge installed, according to one or more examples of the present disclosure.

FIG. 56 depicts a toeward view of the clubhead 500, with the shim or badge 188 installed. As depicted, the shim or badge 188 wraps from the rear of the body 113 into the toe portion 104 and toward the striking face 110. The shim or badge 188 can have a three-dimensional external surface, such as including ledges, indentions, and other features that can organically flow with the shape of the body 113. In some embodiments, a chamfered edge 135 can be provided between the shim or badge 188 and the striking face 110, such as to provide for a designed gap between the striking face 110 and the shim or badge 188.

By increasing the size of the shim or badge 188, additional discretionary weight can be relocated low in the body 113. In some embodiments, the shim or badge 188 can extend from slightly below the topline to the sole bar 135, such as to an upper edge of the sole bar 135. In some embodiments, the shim or badge 188 can extend from topline downward toward the sole portion 108. In some embodiments, the shim or badge can extend into the sole bar 135, such as below an upper edge of the sole bar 135.

Figure 57:
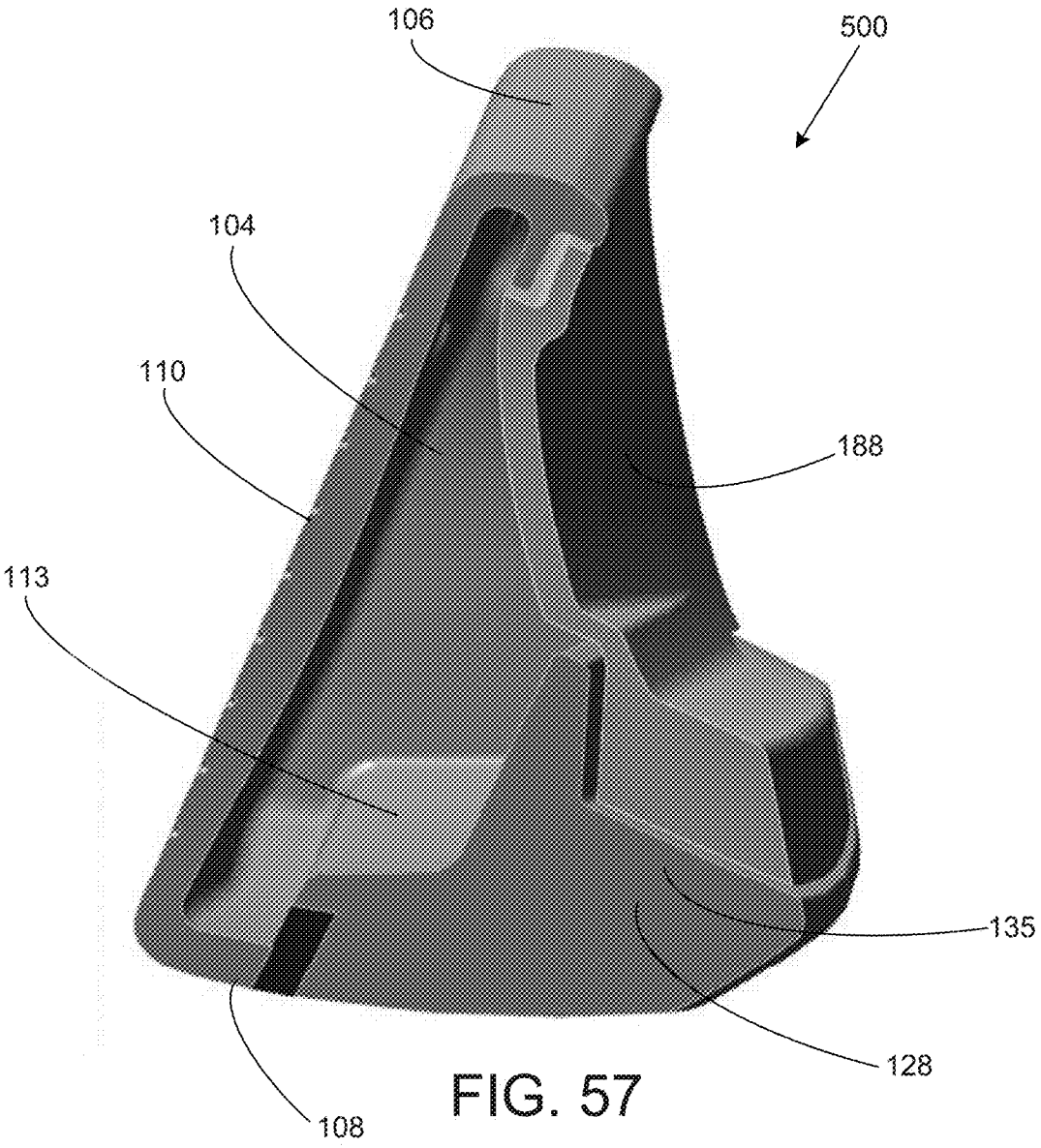
FIG. 57 is heel-side cross-sectional view of the golf club head of FIG. 19, according to one or more examples of the present disclosure.

FIG. 57 is a cross-section along line 57 in FIG. 54. As depicted in FIG. 57, the badge or shim 188 can be three-dimensional, and can be installed into the body 113 without contacting the striking face 110. The shim or badge 188 can be installed forming a portion of the rear portion 128 and the sole bar 135. The shim or badge 188 can extend from underneath the topline to above at least a portion of the rear portion 128 and the sole bar 135. Material from the toe portion 104 can be removed, increasing the size of the cavity within the body 113 and increasing the unsupported area of the striking face 104.

Central Regions, Weighted COR, and Club Head Structures

Exemplary central regions, COR weighting factors and values, weighted COR, balance point COR, COR area, club head testing for weighted COR, CT tuning, and club head structures for increasing COR values are described in U.S. patent application Ser. No. 17/171,656, filed Feb. 9, 2021, which is incorporated herein by reference in its entirety.

Examples of iron-type, fairway wood-type, driver wood-type, driving iron-type, and hybrid-type club head structures for increasing COR values are described in U.S. patent application Ser. No. 17/191,617, filed Mar. 3, 2021, U.S. patent application Ser. No. 16/673,701, filed Nov. 4, 2019, U.S. patent application Ser. No. 17/107,462, filed Nov. 30, 2020, U.S. patent application Ser. No. 17/003,610, filed Aug. 26, 2020, U.S. patent application Ser. No. 17/107,447, filed Nov. 30, 2020, U.S. Pat. No. 9,975,018, filed Feb. 8, 2017, U.S. patent application Ser. No. 16/866,927, filed May 5, 2020, U.S. patent application Ser. No. 17/110,112, filed Dec. 2, 2020, U.S. patent application Ser. No. 17/105,234, filed Nov. 25, 2020, U.S. patent application Ser. No. 16/795,266, filed Feb. 19, 2020, U.S. patent application Ser. No. 17/131,539, filed Dec. 22, 2020, U.S. patent application Ser. No. 17/198,030, filed Mar. 10, 2021, U.S. patent application Ser. No. 16/875,802, filed May 15, 2020, U.S. patent application Ser. No. 16/990,666, filed Aug. 11, 2020, which are incorporated herein by reference in their entireties.

Central Regions

In various embodiments, central regions and striking locations can be selected for weighted COR, such as based at least in part on the type of golf club head. For example, historical data (e.g., real shot data points) can indicate that different types of golf club heads (e.g., iron-type, hybrid-type, wood-type, etc.) are typically struck at different locations on the striking face. For example, iron-type golf club heads typically strike golf balls off of the ground more often than off of a tee, such as when compared to driver wood-type club heads. Further, when iron-type golf club heads strike golf balls off of a tee, the golf ball is often teed lower than when teeing a golf ball for a driver wood-type golf club head. Likewise, iron-type golf club heads typically strike golf balls with a steeper angle of attack, while driver wood-type golf club heads typically strike golf balls with a shallower angle of attack, and in some cases with a positive angle of attack. Likewise, hybrid-type and fairway wood-type club heads often strike golf balls off of the ground and off of a lower tee than driver wood-type golf club heads. Taken together, real shot data points for different types of golf club heads can indicate that the different types of golf club heads often strike the golf ball at different locations between the types of heads. For example, iron-type, hybrid-type, and fairway wood-type golf club heads often strike the golf ball lower on the face compared to some driver wood-type golf club heads. Using this data for different types of golf club heads, different central regions, striking locations, and COR weighting factors can be chosen based on the unique strike patterns for the particular golf club head type (e.g., different patterns between irons and woods), as well as different lofts within a golf club head type (e.g., different patterns between short and long irons).

In addition to differences between golf club head types, historical data can also indicate that differences in striking patterns exist between different groups of golfers. For example, low handicap golfers have more consistent striking patterns, as well as often striking the golf club low in the heel and high in the toe, and generally lower on the face. Higher handicap golfers have more erratic striking patterns, and often strike the golf ball high on the face. Different styles of golf swings can also result in different striking patterns. For example, some golfers have steeper angles of attack (e.g., so-called diggers) relative to other golfers with shallower angles of attack (e.g., so-called pickers), and can be grouped based on their relative angles of attack. Likewise, golfers can be grouped based on relative swing speeds (e.g., driver swing speeds: (1) less than 95 mph; (2) 95 mph to 105 mph; and (3) greater than 105 mph). Using this additional data, different central regions, striking locations, and COR weighting factors can be chosen based on the unique strike patterns for different groups of golfers and the particular golf club head type.

Further, in various embodiments, additional and different central regions can be used, such as with additional or fewer striking locations. In some embodiments, fewer striking locations can be used to simply design and/or manufacturing processes for the club head, such as with a tradeoff of incorporating fewer real shot data points on the striking face. In other embodiments, additional striking locations can be used to incorporate data for additional real shot data points on the striking face. For example, using three striking locations (e.g., FIG. 60) can include at least about 38% of real shots. In another example, using five striking locations (not depicted) can include at least about 62% of real shots. In another example, using eight striking location (e.g., FIG. 61) can include at least about 85% of real shots. Symmetric or asymmetric striking locations can also be selected based on the historical shot data.

Figure 58:
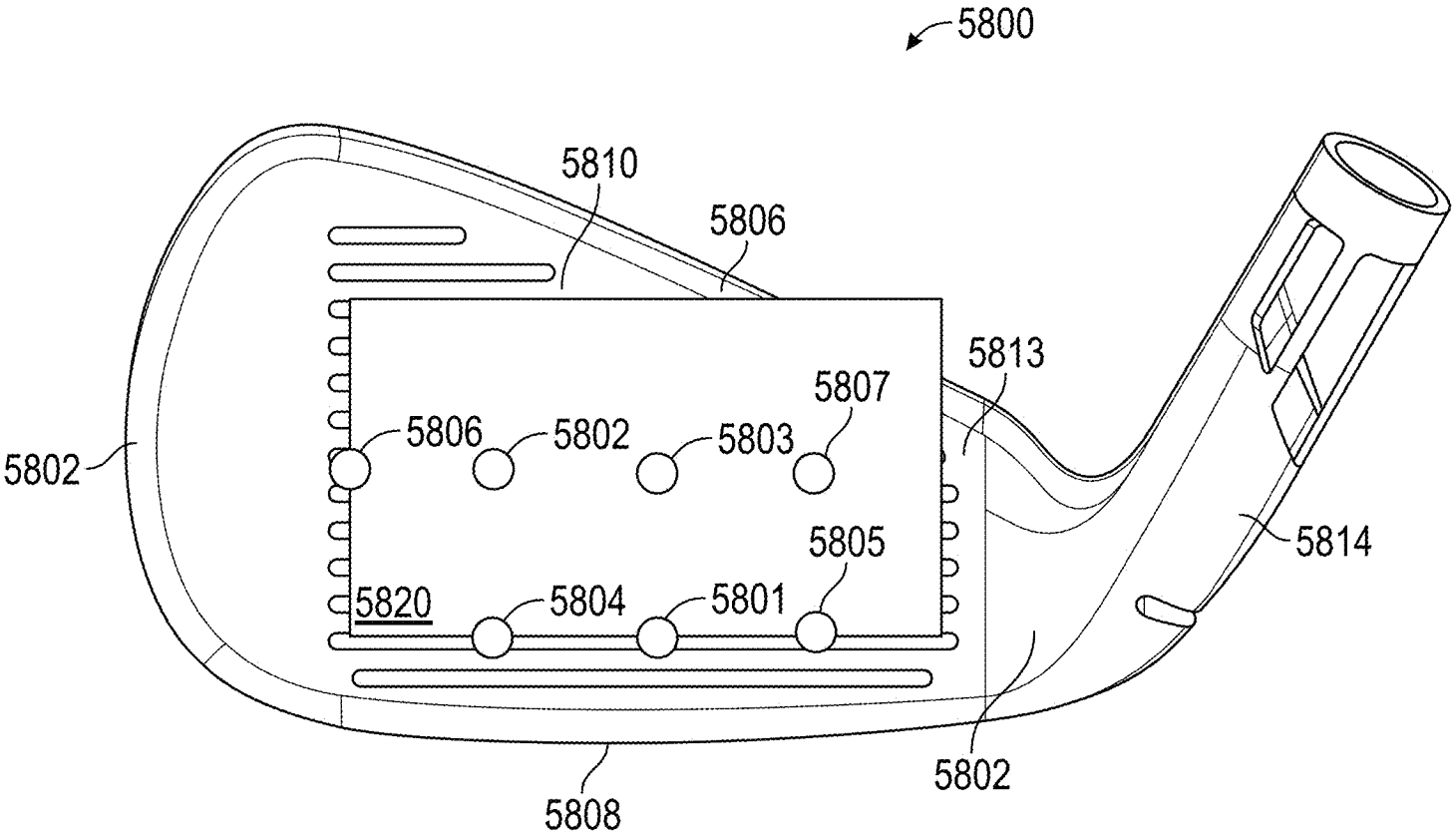
FIG. 58 is a front elevation view of a golf club head in accordance with the embodiments of the current disclosure.

In some embodiments, such as the club head 5800 of FIG. 58, the central region 5820 is centered on a geometric center of the striking face 5810. Alternatively, the central region 5820 can be centered on a point located at a mid-point of the longest scoreline on the striking face and 20.5 mm above the ground plane when the golf club head is at a normal address position.

Figure 59:
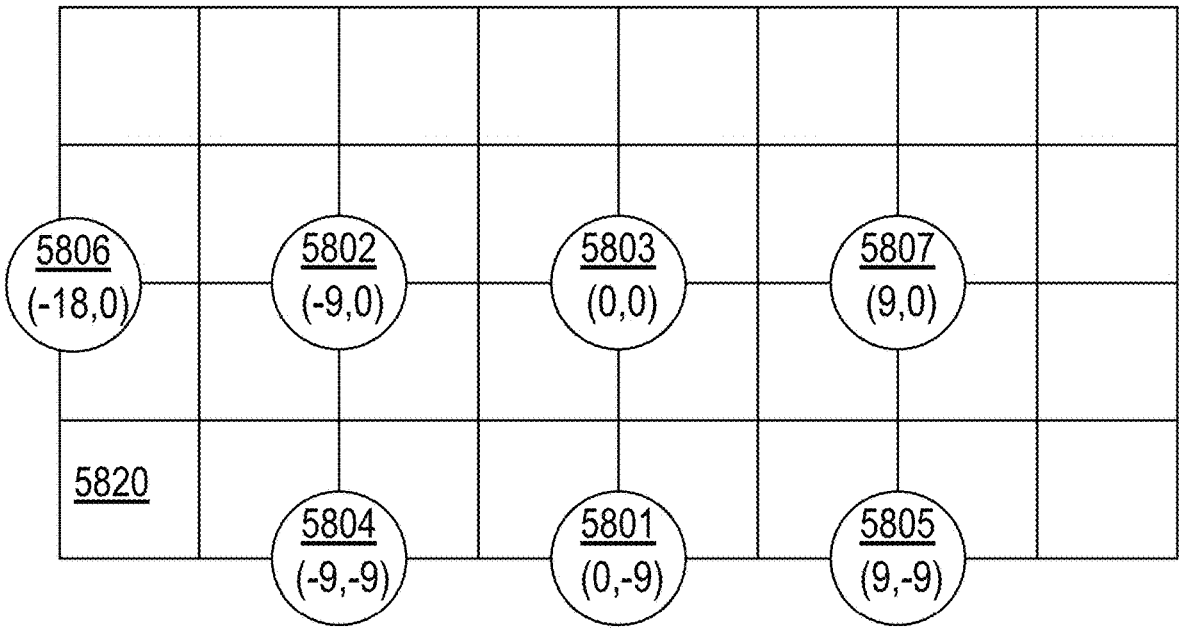
FIG. 59 is an illustration of the central region of a golf club head in accordance with the embodiments of the current disclosure.

In the embodiment depicted in FIGS. 58-59, the central region 5820 is defined for a cavity back iron-type golf club head 5800. In other embodiments, the central region 5820 can be defined for other iron-type golf club heads, including blade irons, muscle back irons, hollow irons, and other iron-types. In other embodiments, the central region can be defined for wood-type club heads, hybrid or utility-type club heads, or other golf club heads.

Figure 60:
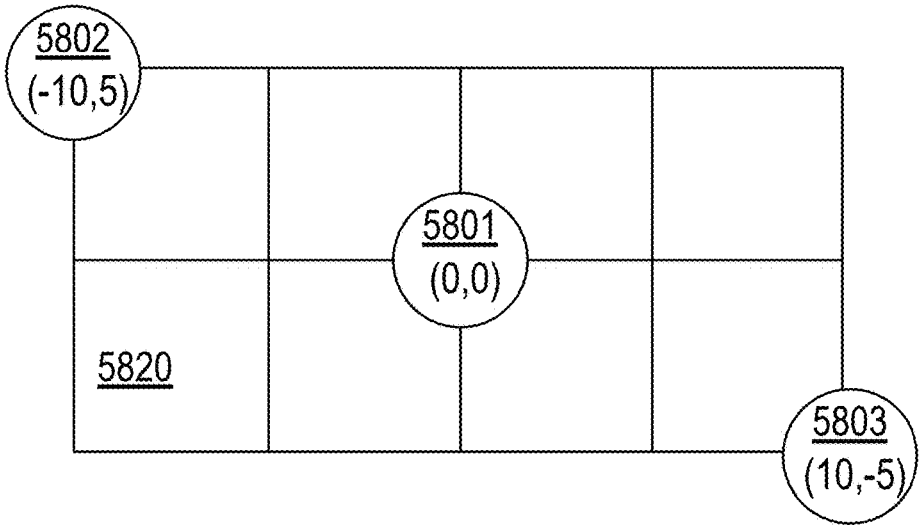
FIG. 60 is another illustration of the central region of a golf club head in accordance with the embodiments of the current disclosure.
Figure 62:
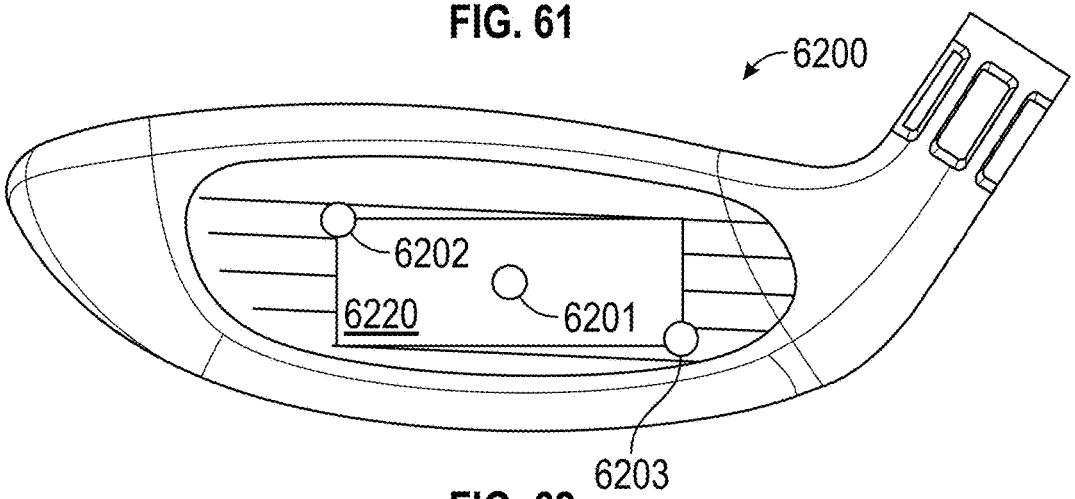
FIG. 62 is a front elevation view of a golf club head in accordance with the embodiments of the current disclosure.
Figure 63:
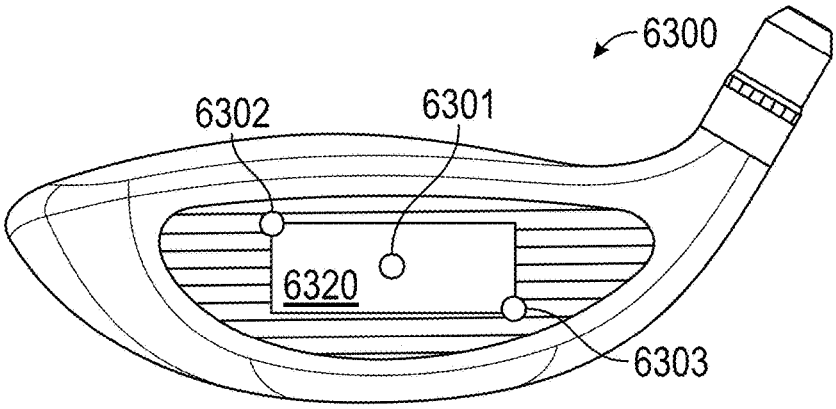
FIG. 63 is a front elevation view of a golf club head in accordance with the embodiments of the current disclosure.

For example, in the embodiment depicted in FIG. 60, the central region is defined for a wood-type (e.g., FIG. 63) or a hybrid-type (e.g., FIG. 62) golf club head. FIG. 62 illustrates a hybrid-type club head 6200 that has a central region 6220 analogous to central region 5820. Central region 6200 includes striking locations 6201, 6202, 6203 analogous to striking locations 5801, 5802, 5803 in FIG. 60. Similarly, FIG. 63 illustrates a wood-type club head 6300 that has a central region 6320 analogous to central region 5820. Central region 6300 includes striking locations 6301, 6302, 6303 analogous to striking locations 5801, 5802, 5803 in FIG. 60.

FIG. 59 illustrates a front elevation view of another golf club head 5800 with striking locations 5801, 5802, 5803, 5804, 5805, 5806, 5807 within a central region 5820 positioned on the striking face 5810. For example, the strike or striking face 5810 can include the central region 5820 centered on a geometric center of the striking face 5810. In some embodiments, the central region 5820 is defined with the club head 5810 at zero-degrees loft and the central region is positioned on a face plane normal to a ground plane. In some embodiments, the central region 5820 is centered on a different location on the face, such as the location of the club head center of gravity (CG) projected onto the striking face 5810 or another location. The central region 5820 can be defined by a 36 millimeter (mm) by 18 mm rectangular area centered on the striking face 5810. The central region can be elongated in a heel-to-toe direction, such as tangential to the face 5810 and parallel to a ground plane (GP). In some embodiments, the central region 5820 is elongated at an angle with respect to the GP, such as elongated at a 45-degree angle to GP and extending from low-to-high in a heel-to-toe direction or in another direction. In some embodiments, the central region 5820 can be defined by a larger or smaller rectangular area, defined by a different shape, such as a circular region, an octagonal region, a square region, a diamond shaped region, or another in another shape.

The central region 5820 can be used to define a central region coordinate system. For example, the central region coordinate system can be defined by the 36 millimeter (mm) by 18 mm rectangular area centered on the geometric center of the striking face. In this example, the central region coordinate system is defined with the club head at zero-degrees loft and positioned on a face plane normal to a ground plane. The central region coordinate system can be elongated in a heel-to-toe direction, and can include a central region x-axis being tangent to the striking face at the origin and parallel to a ground plane. The x-axis extends in a positive direction from the origin to the heel portion of the club head body. The central region coordinate system can also include a central region y-axis intersecting the origin being perpendicular to the ground plane and orthogonal to the x-axis. The y-axis extends in a positive direction from the origin to the top-line portion of the club head body. Locations in the central region coordinate system can be referred to with x-axis and y-axis coordinates with a "cr" subscript, such as ($x_{cr}$, $y_{cr}$).

FIG. 59 illustrates the central region 5820 depicted in FIG. 58. For example, the central region 5820 includes striking locations 5801, 5802, 5803, 5804, 5805, 5806, 5807 for a right-handed golf club head. The central region 5820 includes a first striking location 5801 positioned 9 mm below the geometric center of the striking face 5810 corresponding to an (x, y) coordinate of (0, −9). The central region 5820 includes a second striking location 5802 positioned 9 mm toe-ward of the geometric center of the striking face 5810 corresponding to an (x, y) coordinate of (−9, 0). The central region 5820 includes a third striking location 5803 positioned at the geometric center of the striking face 5810 corresponding to an (x, y) coordinate of (0, 0). The central region 5820 includes a fourth striking location 5804 positioned 9 mm toe-ward of and 9 mm below the geometric center of the striking face 5810 corresponding to an (x, y) coordinate of (−9, −9). The central region 5820 includes a fifth striking location 5805 positioned 9 mm heel-ward of and 9 mm below the geometric center of the striking face 5810 corresponding to an (x, y) coordinate of (9, −9). The central region 5820 includes a sixth striking location 5806 positioned 18 mm toe-ward of the geometric center of the striking face 5810 corresponding to an (x, y) coordinate of (−18, 0). The central region 5820 includes a seventh striking location 5807 positioned 9 mm heel-ward of the geometric center of the striking face 5810 corresponding to an (x, y) coordinate of (0, −9). The above coordinates are provided in a 1 mm scale, but other scales can be used.

FIG. 60 illustrates another embodiment of a central region 5820. The central region 5820 can be defined by a 20 millimeter (mm) by 10 mm rectangular area centered on the striking face 5810. The central region can be elongated in a heel-to-toe direction, such as tangential to the face 5810 and parallel to a ground plane (GP). For example, the central region 5820 includes striking locations 5801, 5802, 5803 for a right-handed golf club head. The central region 5820 includes a first striking location 5801 at the geometric center of the striking face 5810 corresponding to an (x, y) coordinate of (0, 0). The central region 5820 includes a second striking location 5802 positioned 10 mm toe-ward of and 5 mm above the geometric center of the striking face 5810 corresponding to an (x, y) coordinate of (−10, 5). The central region 5820 includes a third striking location 5803 positioned 10 mm heel-ward of and 5 mm below the geometric center of the striking face 5810 corresponding to an (x, y) coordinate of (10, −5). The above coordinates are provided in a 1 mm scale, but other scales can be used.

Figure 61:
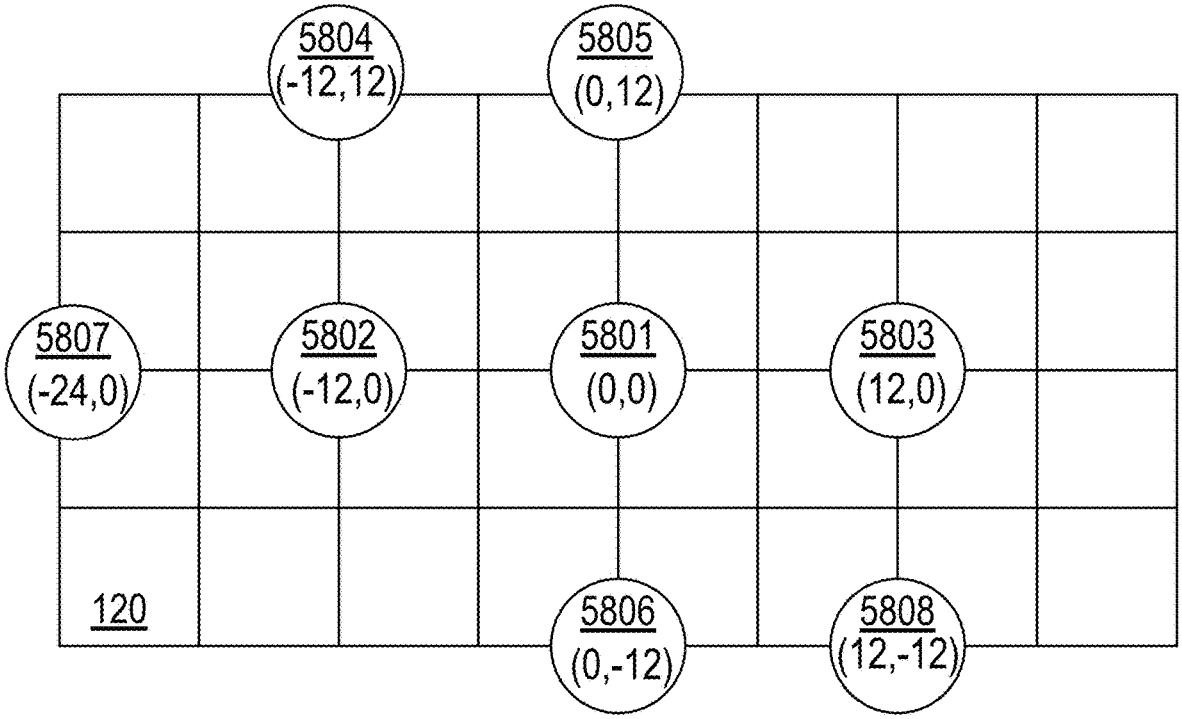
FIG. 61 is another illustration of the central region of a golf club head in accordance with the embodiments of the current disclosure.

FIG. 61 illustrates the central region 5820 depicted in FIG. 58. The central region 5820 can be defined by a 48 millimeter (mm) by 24 mm rectangular area centered on the striking face 5810. The central region can be elongated in a heel-to-toe direction, such as tangential to the face 5810 and parallel to a ground plane (GP). For example, the central region 5820 includes striking locations 5801, 5802, 5803, 5804, 5805, 5806, 5807, 5808 for a right-handed golf club head. The central region 5820 includes a first striking location 5801 positioned at the geometric center of the striking face 5810 corresponding to an (x, y) coordinate of (0, 0). The central region 5820 includes a second striking location 5802 positioned 12 mm toe-ward of the geometric center of the striking face 5810 corresponding to an (x, y) coordinate of (−12, 0). The central region 5820 includes a third striking location 5803 positioned 12 mm heel-ward of the geometric center of the striking face 5810 corresponding to an (x, y) coordinate of (12, 0). The central region 5820 includes a fourth striking location 5804 positioned 12 mm toe-ward of and 12 mm above the geometric center of the striking face 5810 corresponding to an (x, y) coordinate of (−12, 12). The central region 5820 includes a fifth striking location 5805 positioned 12 mm above the geometric center of the striking face 5810 corresponding to an (x, y) coordinate of (0, 12). The central region 5820 includes a sixth striking location 5806 positioned 12 mm below the geometric center of the striking face 5810 corresponding to an (x, y) coordinate of (0, −12). The central region 5820 includes a seventh striking location 5807 positioned 24 mm toe-ward of the geometric center of the striking face 5810 corresponding to an (x, y) coordinate of (−24, 0). The central region 5820 includes an eighth striking location 5808 positioned 12 mm heel-ward of and 12 mm below the geometric center of the striking face 5810 corresponding to an (x, y) coordinate of (12, −12). The above coordinates are provided in a 1 mm scale, but other scales can be used.

COR Weighting Factors, COR Values, and COR Drop Off Values

Each striking location has a weighting factor and a COR value. The weighting factors can be selected based on historical data on the impact locations where golfers most often impact the golf ball on the striking face. To selectively increase or optimize COR at likely impact locations on the striking face of the golf club heads, weighting factors are selected for each of the striking locations. The weighting factors and COR values are then used to calculate a weighted COR value for the golf club head. COR values are tested with the golf club head in a zero-loft address position. In some embodiments, the COR values for the striking locations can be between about 0.650 and about 0.900, such as between about 0.700 and about 0.840, such as between about 0.710 and about 0.850. In some embodiments, the weighted COR value can be between about 0.740 and about 0.800, such as between about 0.780 and about 0.790.

COR values can also be expressed as COR changes relative to a calibration plate used during COR testing. The calibration plate dimensions and weight are described in section 4.0 of the Procedure for Measuring the Velocity Ratio of a Club Head for Conformance to Rule 4-1e. Due to the slight variability between different calibration plates, difference different golf balls, and other testing variabilities, the COR values can be described in terms of a change in COR relative to a calibration plate base value established during testing. For example, if a tested calibration plate has a 0.831 COR value, a 0.844 COR value, or another COR value, measuring a change in COR for a given head relative to the tested calibration plate is accurate and highly repeatable. The change in COR relative to the calibration plate can be described as a COR drop off relative to the calibration plate. For example, COR drop off values can be calculated by subtracting a measured COR value of the calibration plate from a COR value measured at the respective coordinate of a striking location to determine a respective drop off value for the location. In some embodiments, the COR drop off value for a particular striking location can be between about −0.150 and about 0.050, preferably between about −0.140 and about 0.000. In some embodiments, the weighted COR drop off value can be between about −0.104 and about −0.044, such as between about −0.064 and about −0.054.

For example, Table 4 includes exemplary values for an embodiment of an iron-type golf club head. In this example, a COR drop off value for location 5801 can be between about −0.100 and about −0.130, for location 5802 can be between about 0.000 and about −0.090, for location 5803 can be between about 0.040 and about −0.050, for 5804 can be between about −0.100 and about −0.200, for location 5805 can be between about −0.090 and about −0.160, for 5806 can be between about −0.100 and about −0.170, and for location 5807 can be between about 0.000 and about −0.090. In this example, a weighted COR can be between about 0.740 and about 0.800, such as about 0.759.

TABLE 4

| Striking Location | COR Weighting Factor | COR Value | COR Dropoff Value |
|---|---|---|---|
| 101 (0, −9) | 0.2347 | 0.730 | −0.114 |
| 102 (−9, 0) | 0.1935 | 0.804 | −0.040 |
| 103 (0, 0) | 0.1715 | 0.840 | −0.004 |
| 104 (−9, −9) | 0.1518 | 0.701 | −0.143 |
| 105 (9, −9) | 0.1230 | 0.717 | −0.127 |
| 106 (−18, 0) | 0.0740 | 0.707 | −0.137 |
| 107 (9, 0) | 0.0515 | 0.804 | −0.040 |

The exemplary weighting factors in Table 4 can be applicable for a club head that is typically struck relatively lower on the face (e.g., a 7 iron vs. a 4 iron) and/or applicable for players that typically strike the club head relatively lower on the face. Alternatively, different weighting factors can be used for club heads that are typically struck relatively higher on the face (e.g., a 4 iron vs. a 7 iron) and/or are applicable for players that typically strike the club head relatively higher on the face. For example, location 5801 (0, −9) can have a weighting factor of about 0.1390, location 5802 (−9, 0) can have a weighting factor of about 0.2520, location 5803 (0, 0) can have a weighting factor of about 0.2770, location 5804 (−9, −9) can have a weighting factor of about 0.0700, location 5805 (9, −9) can have a weighting factor of about 0.0890, location 5806 (−18, 0) can have a weighting factor of about 0.0740, and location 5807 (9, 0) can have a weighting factor of about 0.0980. The exemplary weighing factors and COR values described herein can be applicable to any club head, including any iron within a set of iron-type club heads.

In some embodiments, an iron-type club head (e.g., a 7 iron, a 4 iron, or another iron) can have a first COR drop off value between −0.090 and −0.130, a second COR drop off value is between 0.000 and −0.090, a third COR drop off value is between 0.010 and −0.010, a fourth COR drop off value is between −0.100 and −0.200, a fifth COR value is between −0.090 and −0.160, a sixth COR value is between −0.100 and −0.170, and a seventh COR value is between 0.000 and −0.090.

In some embodiments, an iron-type club head (e.g., a 7 iron, a 4 iron, or another iron) can have a first COR drop off value is between −0.100 and −0.130, a second COR drop off value is between −0.020 and −0.040, a third COR drop off value is between 0.006 and −0.006, a fourth COR drop off value is between −0.130 and −0.160, a fifth COR value is between −0.115 and −0.135, a sixth COR value is between −0.110 and −0.135, and a seventh COR value is between −0.010 and −0.040.

In another embodiment, Table 5 includes exemplary values for a wood-type golf club head (e.g., a fairway wood). In this example, using three (3) striking locations can incorporate historical data for approximately 38% of real shots. Further, in this example, the fairway wood can be a 15-degree fairway wood with a weighted COR of 0.804 and an unweighted COR of 0.801, resulting in a change (i.e., a delta) of 0.003.

TABLE 5

| Striking Location | COR Weighting Factor | COR Value | COR Dropoff Value |
|---|---|---|---|
| 101 (0, 0) | 0.4531 | 0.812 | −0.032 |
| 102 (−10, 5) | 0.3796 | 0.800 | −0.044 |
| 103 (10, −5) | 0.1673 | 0.790 | −0.054 |

In another embodiment, Table 6 includes exemplary values for another wood-type golf club head using three (3) striking locations. In this example, the fairway wood can be a 15-degree fairway wood with a weighted COR of 0.807 and an unweighted COR of 0.799, resulting in a change of 0.008.

TABLE 6

| Striking Location | COR Weighting Factor | COR Value | COR Dropoff Value |
|---|---|---|---|
| 101 (0, 0) | 0.4531 | 0.823 | −0.021 |
| 102 (−10, 5) | 0.3796 | 0.805 | −0.039 |
| 103 (10, −5) | 0.1673 | 0.770 | −0.074 |

In another embodiment, Table 7 includes exemplary values for another wood-type golf club head using three (3) striking locations. In this example, the fairway wood can be a 15-degree fairway wood with a weighted COR of 0.781 and an unweighted COR of 0.778, resulting in a change of 0.003.

TABLE 7

| Striking Location | COR Weighting Factor | COR Value | COR Dropoff Value |
|---|---|---|---|
| 101 (0, 0) | 0.4531 | 0.791 | −0.053 |
| 102 (−10, 5) | 0.3796 | 0.776 | −0.068 |
| 103 (10, −5) | 0.1673 | 0.766 | −0.078 |

In another embodiment, Table 8 includes exemplary values for another wood-type golf club head using three (3) striking locations. In this example, the fairway wood can be a 15-degree fairway wood with a weighted COR of 0.789 and an unweighted COR of 0.785, resulting in a change of 0.004.

TABLE 8

| Striking Location | COR Weighting Factor | COR Value | COR Dropoff Value |
|---|---|---|---|
| 101 (0, 0) | 0.4531 | 0.802 | −0.042 |
| 102 (−10, 5) | 0.3796 | 0.780 | −0.064 |
| 103 (10, −5) | 0.1673 | 0.773 | −0.071 |

In another embodiment, Table 9 includes exemplary values for another wood-type golf club head using three (3) striking locations. In this example, the fairway wood can be a 15-degree fairway wood with a weighted COR of 0.793 and an unweighted COR of 0.789, resulting in a change of 0.004.

TABLE 9

| Striking Location | COR Weighting Factor | COR Value | COR Dropoff Value |
|---|---|---|---|
| 101 (0, 0) | 0.4531 | 0.816 | −0.028 |
| 102 (−10, 5) | 0.3796 | 0.771 | −0.073 |
| 103 (10, −5) | 0.1673 | 0.782 | −0.062 |

In another embodiment, Table 10 includes exemplary values for a wood-type golf club head (e.g., a driver). In this example, using eight (8) striking locations can incorporate historical data for approximately 85% of real shots. In this example, the wood-type club head can be a 9-degree driver with a weighted COR of 0.803 and an unweighted COR of 0.793, resulting in a change of 0.010.

TABLE 10

| Striking Location | COR Weighting Factor | COR Value | COR Dropoff Value |
|---|---|---|---|
| 101 (0, 0) | 0.3107 | 0.823 | −0.021 |
| 102 (−12, 0) | 0.2261 | 0.805 | −0.039 |
| 103 (12, 0) | 0.1083 | 0.77 | −0.074 |
| 104 (−12, 12) | 0.1046 | 0.799 | −0.045 |
| 105 (0, 12) | 0.0957 | 0.813 | −0.031 |
| 106 (0, −12) | 0.0742 | 0.787 | −0.057 |
| 107 (−24, 0) | 0.0417 | 0.78 | −0.064 |
| 108 (12, −12) | 0.0388 | 0.772 | −0.072 |

In another embodiment, Table 11 includes exemplary values for another wood-type golf club head using eight (8) striking locations. In this example, the wood-type club head can be a 9-degree driver with a weighted COR of 0.814 and an unweighted COR of 0.805, resulting in a change of 0.009.

TABLE 11

| Striking Location | COR Weighting Factor | COR Value | COR Dropoff Value |
|---|---|---|---|
| 101 (0, 0) | 0.3107 | 0.833 | 0.011 |
| 102 (−12, 0) | 0.2261 | 0.815 | 0.029 |
| 103 (12, 0) | 0.1083 | 0.78 | 0.064 |
| 104 (−12, 12) | 0.1046 | 0.809 | 0.035 |
| 105 (0, 12) | 0.0957 | 0.818 | 0.026 |
| 106 (0, −12) | 0.0742 | 0.804 | 0.04 |
| 107 (−24, 0) | 0.0417 | 0.795 | 0.049 |
| 108 (12, −12) | 0.0388 | 0.782 | 0.062 |

In another embodiment, Table 12 includes exemplary values for a wood-type golf club head (e.g., a fairway wood). In this example, using five (5) striking locations can incorporate historical data for approximately 62% of real shots. In this embodiment, the historical data dictates the striking locations chosen, resulting in asymmetric striking locations being included in the Table 12 (e.g., three locations toe-ward and only one location heel-ward of the origin). In this example, the wood-type club head can be a 15-degree fairway wood with a weighted COR of 0.813 and an unweighted COR of 0.812, resulting in a change of 0.001.

TABLE 12

| Striking Location | COR Weighting Factor | Shots Captured | COR Value | COR Dropoff Value |
|---|---|---|---|---|
| 101 (−3.2, 1.4) | 0.2631 | 33,090 (16%) | 0.817 | −0.027 |
| 102 (0, 0) | 0.2219 | 27,908 (14%) | 0.823 | −0.021 |
| 103 (−11.4, 3.7) | 0.1935 | 24,339 (12%) | 0.803 | −0.041 |

TABLE 12-continued

| Striking Location | COR Weighting Factor | Shots Captured | COR Value | COR Dropoff Value |
|---|---|---|---|---|
| 104 (4.6, −3.3) | 0.1664 | 20,940 (10%) | 0.809 | −0.035 |
| 105 (−6.7, −5.4) | 0.1550 | 19,496 (10%) | 0.807 | −0.037 |

In another embodiment, Table 13 includes exemplary values for a wood-type golf club head using five (5) striking locations. In this example, the wood-type club head can be a 15-degree fairway wood with a weighted COR of 0.804 and an unweighted COR of 0.803, resulting in a change of 0.001.

TABLE 13

| Striking Location | COR Weighting Factor | Shots Captured | COR Value | COR Dropoff Value |
|---|---|---|---|---|
| 101 (−3.2, 1.4) | 0.2631 | 33,090 (16%) | 0.807 | 0.037 |
| 102 (0, 0) | 0.2219 | 27,908 (14%) | 0.812 | 0.032 |
| 103 (−11.4, 3.7) | 0.1935 | 24,339 (12%) | 0.797 | 0.047 |
| 104 (4.6, −3.3) | 0.1664 | 20,940 (10%) | 0.803 | 0.041 |
| 105 (−6.7, −5.4) | 0.1550 | 19,496 (10%) | 0.797 | 0.047 |

In another embodiment, Table 14 includes exemplary values for a wood-type golf club head using six (6) striking locations. In this example, the wood-type club head can be a 15-degree fairway wood, such as with a steel face welded to the body, with a weighted COR of 0.802 and an unweighted COR of 0.798, resulting in a change of 0.004.

TABLE 14

| Striking Location | COR Weighting Factor | COR Value | COR Dropoff Value |
|---|---|---|---|
| 101 (0, 0) | 0.3000 | 0.814 | 0.030 |
| 102 (0, 2.2) | 0.2000 | 0.816 | 0.028 |
| 103 (0, 5) | 0.1250 | 0.811 | 0.033 |
| 104 (0, −5) | 0.1250 | 0.793 | 0.051 |
| 105 (−12.7, 0) | 0.1250 | 0.771 | 0.073 |
| 106 (12.7, 0) | 0.1250 | 0.781 | 0.063 |

In another embodiment, Table 15 includes exemplary values for a wood-type golf club head (e.g., a fairway wood). In this embodiment, the historical data also dictates the striking locations chosen, resulting in asymmetric striking locations being included in the Table 15 (e.g., four locations toe-ward origin, one location heel-ward of the origin, and no locations at the origin). In this example, the wood-type club head can be a 15-degree fairway wood with a weighted COR of 0.810 and an unweighted COR of 0.810, resulting in a change of 0.000.

TABLE 15

| Striking Location | COR Weighting Factor | Shots Captured | COR Value | COR Dropoff Value |
|---|---|---|---|---|
| 101 (−3.84, 2.42) | 0.2262 | 6,136 | 0.812 | −0.032 |
| 102 (−0.45, 0.25) | 0.2124 | 5,761 | 0.819 | −0.025 |
| 103 (−7.30, 1.49) | 0.2085 | 5,656 | 0.807 | −0.037 |
| 104 (−2.46, −3.15) | 0.1817 | 4,930 | 0.805 | −0.039 |
| 105 (3.38, −0.89) | 0.1712 | 4,643 | 0.805 | −0.039 |

In another embodiment, Table 16 includes exemplary values for a wood-type golf club head with asymmetric striking locations being included. In this example, the wood-type club head can be a 15-degree fairway wood with a weighted COR of 0.804 and an unweighted COR of 0.803, resulting in a change of 0.001.

TABLE 16

| Striking Location | COR Weighting Factor | Shots Captured | COR Value | COR Dropoff Value |
|---|---|---|---|---|
| 101 (−3.84, 2.42) | 0.2262 | 6,136 | 0.808 | −0.036 |
| 102 (−0.45, 0.25) | 0.2124 | 5,761 | 0.809 | −0.035 |
| 103 (−7.30, 1.49) | 0.2085 | 5,656 | 0.793 | −0.051 |
| 104 (−2.46, −3.15) | 0.1817 | 4,930 | 0.804 | −0.040 |
| 105 (3.38, −0.89) | 0.1712 | 4,643 | 0.803 | −0.041 |

In another embodiment, Table 17 includes exemplary values for a hybrid-type golf club head using three (3) striking locations. In this example, the hybrid-type club head can be a 19-degree hybrid with a weighted COR of 0.789 and an unweighted COR of 0.786, resulting in a change of 0.003.

TABLE 17

| Striking Location | COR Weighting Factor | COR Value | COR Dropoff Value |
|---|---|---|---|
| 101 (0, 0) | 0.4531 | 0.797 | −0.047 |
| 102 (−10, 5) | 0.3796 | 0.785 | −0.059 |
| 103 (10, −5) | 0.1673 | 0.775 | −0.069 |

In another embodiment, Table 18 includes exemplary values for a hybrid-type golf club head using three (3) striking locations. In this example, the hybrid-type club head can be a 19-degree hybrid with a weighted COR of 0.792 and an unweighted COR of 0.784, resulting in a change of 0.008.

TABLE 18

| Striking Location | COR Weighting Factor | COR Value | COR Dropoff Value |
|---|---|---|---|
| 101 (0, 0) | 0.4531 | 0.808 | −0.036 |
| 102 (−10, 5) | 0.3796 | 0.790 | −0.054 |
| 103 (10, −5) | 0.1673 | 0.755 | −0.089 |

In another embodiment, Table 19 includes exemplary values for a hybrid-type golf club head using three (3) striking locations. In this example, the hybrid-type club head can be a 19-degree hybrid, such as with a cast face, with a weighted COR of 0.766 and an unweighted COR of 0.763, resulting in a change of 0.003.

TABLE 19

| Striking Location | COR Weighting Factor | COR Value | COR Dropoff Value |
|---|---|---|---|
| 101 (0, 0) | 0.4531 | 0.776 | −0.068 |
| 102 (−10, 5) | 0.3796 | 0.761 | −0.083 |
| 103 (10, −5) | 0.1673 | 0.751 | −0.093 |

In another embodiment, Table 20 includes exemplary values for a hybrid-type golf club head using three (3) striking locations. In this example, the hybrid-type club head can be a 19-degree hybrid with a weighted COR of 0.774 and an unweighted COR of 0.770, resulting in a change of 0.004.

TABLE 20

| Striking Location | COR Weighting Factor | COR Value | COR Dropoff Value |
|---|---|---|---|
| 101 (0, 0) | 0.4531 | 0.787 | −0.057 |
| 102 (−10, 5) | 0.3796 | 0.765 | −0.079 |
| 103 (10, −5) | 0.1673 | 0.758 | −0.086 |

In another embodiment, Table 21 includes exemplary values for a hybrid-type golf club head using three (3) striking locations. In this example, the hybrid-type club head can be a 19-degree hybrid with a weighted COR of 0.797 and an unweighted COR of 0.789, resulting in a change of 0.008.

TABLE 21

| Striking Location | COR Weighting Factor | COR Value | COR Dropoff Value |
|---|---|---|---|
| 101 (0, 0) | 0.4531 | 0.813 | −0.031 |
| 102 (−10, 5) | 0.3796 | 0.795 | −0.049 |
| 103 (10, −5) | 0.1673 | 0.760 | −0.084 |

In another embodiment, Table 22 includes exemplary values for a hybrid-type golf club head using three (3) striking locations. In this example, the hybrid-type club head can be a 19-degree hybrid with a weighted COR of 0.802 and an unweighted COR of 0.794, resulting in a change of 0.008.

TABLE 22

| Striking Location | COR Weighting Factor | COR Value | COR Dropoff Value |
|---|---|---|---|
| 101 (0, 0) | 0.4531 | 0.818 | −0.026 |
| 102 (−10, 5) | 0.3796 | 0.800 | −0.044 |
| 103 (10, −5) | 0.1673 | 0.765 | −0.079 |

In some embodiments, the striking face can have a COR area from 50 $mm^2$ to 300 $mm^2$, from 100 $mm^2$ to 300 $mm^2$, such as from 150 $mm^2$ to 200 $mm^2$, or from 85 $mm^2$ to 125 $mm^2$, such as from 95 $mm^2$ to 115 $mm^2$. In these embodiments, the COR area is the area of the striking face defined by locations on the striking face with a COR drop off value above −0.045, such as above −0.044. In some embodiments, the COR area is the area of the striking face defined by locations on the striking face with a COR value of at least 0.790, 0.800, or COR another value.

Head Structures for Increasing COR Values

In some embodiments, such as depicted in FIG. 58, the club head 5800 includes a body 5813 having a heel portion 5802, a toe portion 5804, a top-line portion 5806, a rear portion 5828, a face portion 5810 comprising a striking face 5809, a sole portion 5808 extending rearwardly from a lower end of the face portion 5810 to a lower portion of the rear portion 5828. The striking face 5809 includes a geometric center defining an origin of a coordinate system when the club head is at a normal address position. For example, the coordinate system includes: an x-axis being tangent to the striking face at the origin and parallel to a ground plane; a y-axis intersecting the origin being parallel to the ground plane and orthogonal to the x-axis; and a z-axis intersecting the origin being orthogonal to both the x-axis and the y-axis. The x-axis extends in a positive direction from the origin to the heel portion of the club head body, the y-axis extends in a positive direction from the origin to the rear portion of the club head body, and the z-axis extends in a positive direction from the origin to the top-line portion of the club head body.

The heel portion 5802 is defined as the portion of the golf club head extending to and including the hosel portion 5814 (i.e., the club shaft receiving portion) from a y-z plane passing through the origin. For example, the heel portion 5802 extends heelward from a scoreline mid-plane. The scoreline mid-plane is a plane defined at the midpoint of the longest scoreline on the striking face 5809, normal to the striking face 5809 and normal to the ground plane when the golf club is in a zero-loft address position. The toe portion 5804 is defined as the portion of the golf club head extending from the y-z plane in a direction opposite the heel portion 5802. For example, the toe portion 5804 extends toeward from the scoreline mid-plane.

The sole portion 5808 portion is defined as the portion of the golf club extending to and including the sole of the golf club head from an x-y plane passing through the origin. The sole portion 5808 extends downwards from to an address mid-plane defined 20 mm above and parallel to the ground plane GP, to a lowest point of the club head (i.e., the sole), located at the ground plane, when the golf club is in a zero-loft address position. The topline portion 5806 portion is defined as the portion of the golf club extending to and including the topline of the golf club head from an x-y plane passing through the origin. The topline portion 5806 extends upwards from the address mid-plane, defined 20 mm above and parallel to the ground plane, to a highest point of the club head (e.g., the topline) when the golf club is at a zero-loft address position.

The rear portion 5828 is defined as the portion of the golf club extending to and including the sole bar of the golf club head from an x-z plane passing through the origin. The rear portion 5828 extends rearward from the rear surface of the striking face 5809 to a rearward-most point of the club head when the golf club is at a zero-loft address position. The face portion 5810 is defined as the portion of the golf club extending to and including the striking face of the golf club head from an x-z plane passing through the origin. The face portion 5810 extends forward from the rear surface of the striking face 5809 to a forward-most point of the club head when the golf club is at a zero-loft address position.

In some embodiments, the heel portion 5802 extends towards, and includes, the golf club shaft receiving portion (e.g., the hosel portion 5814) from a y-z plane passing through the origin, and the toe portion 5804 can be defined as the portion of the club head extending from the y-z plane in a direction opposite the heel portion 5802. In some embodiments, a sole bar can define a rearward portion of the sole portion 5808. In some embodiments, a cavity can be defined by a region of the body 5813 rearward of the face portion 5810, forward of the rear portion 5828, above the sole portion 5808, and below the top-line portion 5806.

In some embodiments, the club head body can be a unitary cast body. A unitary cast body is manufactured by casting the body 5813 with the striking face 5809. In other embodiments, the body 5813 and the striking face 5809 can be cast or forged separately. In some of these embodiments, the striking face 5809 is welded to the body 5813. For example, the club head can be a hollow body iron with a forged striking face 5809 that is welded to a cast body 5813. In some embodiments, the club head has a center of gravity z-axis location ($Z_{up}$) between 10 mm and 20 mm above a ground plane, such as less than 19 mm, less than 18 mm, less than 17 mm, or less than 16 mm.

One or more club head features can be manipulated to increase COR and CT at different locations across the striking face. For example, applicable club head features can be found in U.S. patent application Ser. No. 17/132,520, filed Dec. 23, 2020, which is incorporated by reference herein in its entirety. For example, a shim or badge can be received at least in part by the body to create the appearance of a hollow-body iron. The shim or badge can be configured to close an opening in the cavity and to enclose an internal cavity volume between 5 cc and 20 cc. In some embodiments, no portion of the shim or badge directly contacts the face portion, allowing the unsupported are of the striking face to flex without being restricted by the shim or badge.

In some embodiments, the shim or badge includes a first layer of acrylonitrile-butadiene-styrene (ABS) plastic and a second layer of very high bond (VHB) tape. The VHB tape can have a thickness between 0.5 mm and 1.5 mm and can dampen vibrations of the club head. For example, the VHB tape can be applied directly to the topline portion 5806 and can dampen some vibrations directly at the source of those vibrations at the topline. By applying damping at the propagation location of the vibrations, the vibrations can be dampened at the source, reducing vibrations that can excite other modes in the iron at other locations.

In some embodiments, a damper can be positioned within the internal cavity and can extend from the heel portion 5802 to the toe portion 5804. In some embodiments, the front surface of the damper can include one or more relief portions, and the front surface of the damper can contact a rear surface of the face portion 5810 (e.g., the striking face 5809) between the one or more relief portions. In some embodiments, the striking face 5809 comprises an unrestricted face area extending above the damper and below the topline portion 5806. In some embodiments, the club head can be configured to receive a filler material within the internal cavity, such as through a filler port in the toe portion 5804. The filler material can extend from the heel portion 5802 to the toe portion 5804.

Depending on the type of club head (e.g., iron-type, hybrid-type, wood-type, etc.), the club head can have a head height between about 25 mm and about 60 mm, such as less than about 46 mm, as measured with the club head in a normal address position. An iron-type club head can have a volume between about 10 cc and about 120 cc, such as between about 30 cc and about 100 cc, such as between about 40 cc and about 90 cc, such as between about 50 cc and about 80 cc, such as between about 60 cc and about 80 cc. In various embodiments, the iron-type club head can include a projected face area between about 2,900 $mm^2$ and about 3,400 $mm^2$, such as between about 3,000 $mm^2$ and about 3,200 $mm^2$, such as between about 3,100 $mm^2$ and about 3,200 $mm^2$. A wood-type club head (e.g., a fairway wood) can have a volume between about 120 cc and about 240 cc, and a projected face area between about 1,800 $mm^2$ and 2,500 $mm^2$, such as between about 2,000 $mm^2$ and about 2,300 $mm^2$. A hybrid-type club head can have a volume between about 60 cc and about 150 cc, and a projected face area between about between about 2,000 $mm^2$ and 3,000 $mm^2$, such as between about 2,200 $mm^2$ and about 2,800 $mm^2$.

In some embodiments, an unsupported area of the striking face can be increased, resulting in higher COR and CT values. For example, by removing material from the heel portion 5802, the toe portion 5804, the top-line portion 5806, and/or the sole portion 5808, the unsupported face area can be increased by between about 1% and about 12%, such as between 4% and 10%, such as about 6%. In some embodiments, material is removed from low in the toe portion 5804 and/or low in the heel portion 5802, resulting in an increased unsupported area of the striking face 5809 toward the perimeter of the club head. In some embodiments, the striking face includes an unsupported face area between about 2300 $mm^2$ and about 3500 $mm^2$, such as between about 2500 $mm^2$ and about 3200 $mm^2$, such as between about 2700 $mm^2$ and about 3000 $mm^2$, such as between about 2600 $mm^2$ and about 2800 $mm^2$.

In some embodiments, the striking face 5809 can include variable thickness regions that surround or are adjacent to an ideal striking location of the striking face 5809. For example, the variable thickness regions can include a minimum thickness of the striking face no less than 1.4 mm and a maximum thickness that is greater than the minimum thickness and that is no more than 3.4 mm. As discussed herein, the variable face thickness profile can be non-symmetrical, such as incorporating one or more blend zones, off-sets, elliptical and/or other profile shapes, and other non-symmetrical features. In some embodiments, the variable face thickness profile can be offset toe-ward of the geometric center of the striking face. In some embodiments, the variable face thickness profile can include at least one transition region (e.g., a blend zone) between a thicker region and a thinner region of the striking face 5809.

In some embodiments, the club head has a characteristic time (CT) greater than 257 microseconds, such as greater than 259 microseconds, and such as less than 300 microseconds.

In some embodiments, the striking face does not include a bulge and roll profile, such as an iron-type club head with a substantially flat striking face. In other embodiments, such as in a hybrid-type or wood-type club head, the striking face includes a bulge and roll profile, such as with a bulge radius greater than 500 mm and less than 1.5 inches in a front to back direction along the y-axis.

In some embodiments, the club head face thickness can vary depending on the type of club head (e.g., iron-type, hybrid-type, wood-type, and other club head types). For example, a fairway wood-type club head (e.g., club head 6300 in FIG. 63) can have a face thickness between about 1 mm and about 3.1 mm, such as between about 1.4 mm and about 2.9 mm, such as between about 1.55 mm and about 2.75 mm. For example, a hybrid-type club head (e.g., club head 6200 in FIG. 62) can have a face thickness between about 1.0 mm and about 3.5 mm, such as between about 1.7 mm and about 2.5 mm, such as between about 1.75 mm and about 2.25 mm. Additional and different face thicknesses can be provided.

Additional Features

In some embodiments, the badge wraps from a toe portion to a rear portion of the golf club head. In some embodiments, the golf club head is a cavity back iron.

In some embodiments, the club head includes a transition region that transitions from the toe portion to the rear portion, and at least a portion of the transition region is formed of a material having a density between about 1.0 g/cc and about 3.0 g/cc.

In some embodiments, the transition region that transitions from the toe portion to the rear portion is formed by a badge that is separately formed from the club head body and is attached to the body. The badge can be formed from a low-density material, such that a mass of the badge divided by a volume of the badge is between about 1 g/cc and about 3 g/cc.

In some embodiments, a length of the transition region that transitions from the toe portion to the rear portion formed by the badge is at least 10 mm, more preferably at least 12.5 mm, more preferably at least preferably 15 mm, more preferably at least 17.5 mm, and no more than 25 mm. The length of the transition region can be defined in an up-down direction along the Z-axis when the club head is in a zero-loft orientation.

In some embodiments, at least a first portion of the badge on a toe portion has a width greater than 3 mm, more preferably greater than 4 mm, more preferably greater than 5 mm, more preferably greater than 6 mm, and less than 15 mm, and at least a second portion of the badge on at toe portion has a width greater than 9 mm, more preferably greater than 10 mm, more preferably greater than 11 mm, more preferably greater than 12 mm, and less than 25 mm.

In some embodiments, the badge comprises a toe portion, wherein the toe portion of the badge is tapered from a top portion of the badge to a bottom portion of the badge such that a top portion width is less than a bottom portion width of the badge on the toe portion.

In some embodiments, at least a portion of the badge extends above and below the balance point of the clubhead as measured relative to the Z-axis when the club head is in a zero-loft orientation.

In some embodiments, at least a portion of the badge extends above and below the Zup point or the center of gravity of the golf club head as measured relative to the Z-axis when the club head is in a zero-loft orientation.

In some embodiments, at least a portion of the toe portion located above the badge is formed of a metal and at least a portion of the toe portion located below the badge is formed of a metal. In these embodiments, portions of the body adjacent to the badge are formed from a metal.

In some embodiments, a toe-to-topline transition region of the golf club head is formed of metal.

In some embodiments, a toe-to-sole transition region of the golf club head is formed of metal.

In some embodiments, at least a portion of the toe portion in-between the toe-to-topline transition region and in-between the toe-to-sole transition region is formed of a non-metal material having a density between about 1 g/cc and about 3 g/cc.

In some embodiments, the badge wraps from a rear portion of the club head onto a toe portion of the club head, and further wraps from a rear portion of the club head onto a topline portion of the club head. The topline portion can be formed at least in part by the badge and the toe portion can be formed at least in part by the badge. In various embodiments, a topline portion of the badge and a toe portion of the back can be connected or separated by a portion of the body of the club head (i.e., not connected).

In some embodiments, at least a portion of the badge on the toe portion extends above and below Zup.

In some embodiments, with the club head at zero-loft orientation, the badge forms at least 30% of the outer surface area of the toe portion above a midplane of the club head. The midplane is halfway between an uppermost portion of the toe portion and a lowermost toe portion of the club head. More preferably, the badge can form at least 35% of the outer surface area of the toe portion above a midplane, more preferably at least 37% of the outer surface area of the toe portion above a midplane, more preferably at least 39% of the outer surface area of the toe portion above a midplane, more preferably at least 41% of the outer surface area of the toe portion above a midplane, more preferably at least 43% of the outer surface area of the toe portion above a midplane, and no more than 65% of the outer surface area of the toe portion above a midplane.

In some embodiments, a combined outermost surface area of the badge, as projected onto a rear plane, defined as a plane perpendicular to the toe plane and perpendicular to the ground plane, when the clubhead is in the zero loft orientation on the ground plane, or as projected onto the rear plane and onto the toe plane, is greater than an entire area of the face between scorelines formed in the face. The surface area of the face between scorelines is defined as the surface area in-between a heel-most portion of the scorelines and a toe-most portion of the scorelines, and is further defined as a surface area of the face between the scorelines that is projected onto a front plane, defined as a plane parallel to the rear plane, when the clubhead is in the zero loft orientation on the ground plane.

In some embodiments, the club head has a flat face projected area, excluding the scoreline grooves within the flat face projected area, and a badge surface area is between about 85% and about 125% of the flat face area. Accordingly, in some embodiments, the badge can have a projected surface area that is larger than the flat face projected surface area located between the grooves of the face.

In some embodiments, the flat face area is measured as if the face lacks scoreline grooves (i.e., has no grooves milled into the face).

In some embodiments, the badge forms at least part of a toe portion of the club head, at least part of a topline portion of the club head, at least part of a rear portion of the clubhead, and includes transition regions in between the rear portion and the toe portion, the rear portion and the topline portion, and the top line portion and the toe portion.

In some embodiments, the badge extends further heelward than the heelward-most scorelines and/or farther toeward than the toeward-most scorelines In some embodiments, a total length of the badge from a first end to a second end is greater than a total length from a par line (i.e., the transition from a flat face surface to a curved surface proximate heel) to the toeward-most portion of the toe portion.

In some embodiments, a total length from a heelward-most scoreline to the toeward-most portion of the toe portion is less than a total length of the badge.

In some embodiments, an area of the toe portion of the badge, projected onto the toe plane when the clubhead is in the zero loft orientation on the ground plane, is at least 15%, or more preferably, at least 17%, of the total area of the toe portion, excluding the hosel that is projected onto the toe plane when the clubhead is in the zero loft orientation on the ground plane. In some embodiments, the projected area of the toe portion is at least 100 $mm^2$ when viewed from a toe view.

In some embodiments, the projected area of the toe portion of badge, when viewed from a toe view, is at least 5% of the projected area of the back portion of the badge, which view from a rear view, more preferably at least 7% of the projected area of the back portion of the badge.

In some embodiments, the area of badge is greater than total area of the face within scorelines (i.e., bounded by the heelward-most scoreline, the toeward-most scoreline, the upward-most scoreline, and the lower-most scoreline).

Variable Face Thickness Profiles

1. Iron Type Golf Club Heads

Figure 64:
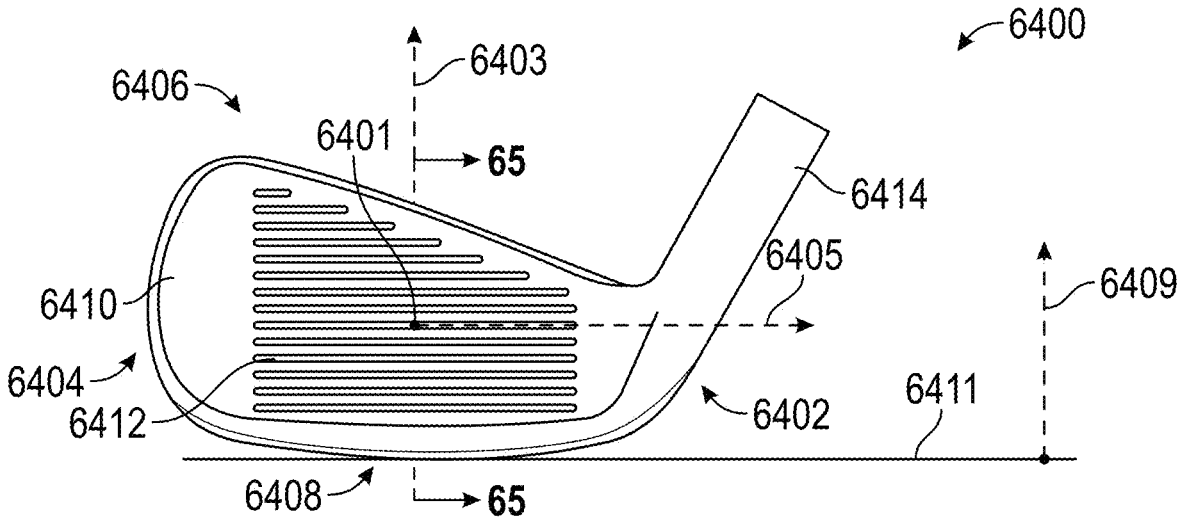
FIG. 64 is a front view of an embodiment of a golf club head.

FIG. 64 illustrates an iron type golf club head 6400 including a body 6413 having a heel 6402, a toe 6404, a sole portion 6408, a top line portion 6406, and a hosel 6414. The golf club head 6400 is shown in FIG. 64 in a normal address position with the sole portion 6408 resting upon a ground plane 6411, which is assumed to be perfectly flat. As used herein, "normal address position" means the club head position wherein a vector normal to the center of the club face substantially lies in a first vertical plane (i.e., a vertical plane is perpendicular to the ground plane 6411), a centerline axis of the hosel 6414 substantially lies in a second vertical plane, and the first vertical plane and the second vertical plane substantially perpendicularly intersect. The center of the club face is determined using the procedures described in the USGA "Procedure for Measuring the Flexibility of a Golf Clubhead," Revision 2.0, Mar. 25, 2005.

The striking face 6410 defines a face plane 6425 and includes grooves 6412 that are designed for impact with the golf ball. In some embodiments, the golf club head 6400 can be a single unitary cast piece, while in other embodiments, a striking plate can be formed separately to be adhesively or mechanically attached to the body 6413 of the golf club head 6400.

Figure 67:
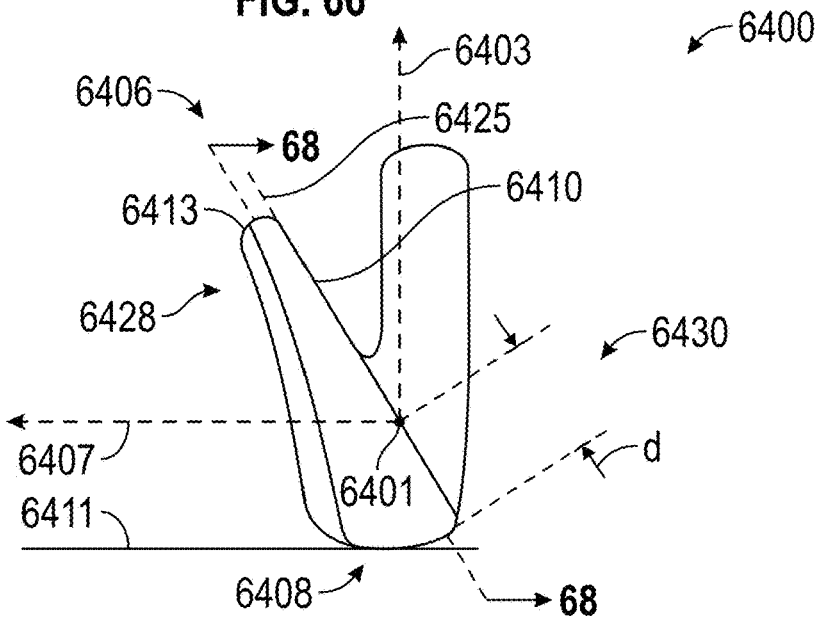
FIG. 67 is an elevated toe perspective view of a golf club head.

FIGS. 64 and 67 also show an ideal striking location 6401 on the striking face 6410 and respective orthogonal CG axes. As used herein, the ideal striking location 6401 is located within the face plane 6425 and coincides with the location of the center of gravity (CG) of the golf club head along the CG x-axis 6405 (i.e., CG-x) and is offset from the leading edge (defined as the intersection of the sole portion 6408 and the face plane 6425) by a distance d of about 16.5 mm within the face plane 6425, as shown in FIG. 67. A CG x-axis 6405, CG y-axis 6407, and CG z-axis 6403 intersect at the ideal striking location 6401, which defines the origin of the orthogonal CG axes. With the golf club head 6400 in the normal address position, the CG x-axis 6405 is parallel to the ground plane 6411 and is oriented perpendicular to a normal extending from the striking face 6410 at the ideal striking location 6401. The CG y-axis is also parallel to the ground plane and is perpendicular to the CG x-axis. The CG z-axis 6403 is oriented perpendicular to the ground plane. In addition, a CG z-up axis 6409 is defined as an axis perpendicular to the ground plane 6411 and having an origin at the ground plane 6411.

In certain embodiments, a desirable CG-y location is between about 0.25 mm to about 20 mm along the CG y-axis 6407 toward the rear portion of the club head. Additionally, a desirable CG-z location is between about 12 mm to about 25 mm along the CG z-up axis 6409, as previously described.

Figure 65:
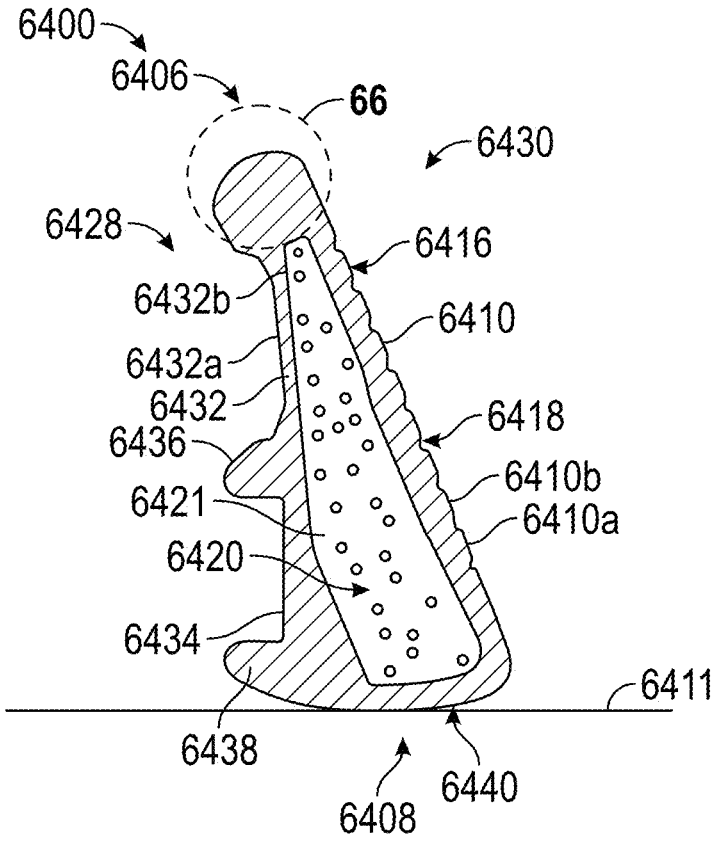
FIG. 65 is a cross-sectional view taken along section lines 65-65 in FIG. 64.

The golf club head may be of hollow, cavity back, or other construction. FIG. 65 shows a cross sectional side view along the cross-section lines 65-65 shown in FIG. 64 of an embodiment of the golf club head having a hollow construction. The cross-section lines 65-65 are taken through the ideal striking location 6401 on the striking face 6410. The striking face 6410 includes a front surface **6410*a* and a rear surface 6410*b*. The hollow iron golf club head 6400 embodiment further includes a back portion 6428 and a front portion 6430**.

In the embodiment shown in FIGS. 64-68, the grooves 6412 are located on the striking face 6410 such that they are centered along the CG x-axis about the ideal striking location 6401, i.e., such that the ideal striking location 6401 is located within the striking face plane 6425 on an imaginary line that is both perpendicular to and that passes through the midpoint of the longest score-line groove 6412. In other embodiments (not shown in the drawings), the grooves 6412 may be shifted along the CG x-axis to the toe side or the heel side relative to the ideal striking location 6401, the grooves 6412 may be aligned along an axis that is not parallel to the ground plane 6411, the grooves 6412 may have discontinuities along their lengths, or the grooves may not be present at all. Still other shapes, alignments, and/or orientations of grooves 6412 on the surface of the striking face 6410 are also possible.

FIG. 65 further shows an optional ridge 6436 extending across a portion of the outer back wall surface 6432*a* forming an upper concavity and a lower concavity. An inner back wall surface 6432*b* defines a portion of the cavity 6420 and forms a thickness between the outer back wall surface 6432*a* and the inner back wall surface 6432*b*. In some embodiments, the back wall thickness varies between a thickness of about 1 mm to about 3 mm, or about 1 mm to about 4 mm. Furthermore, the sole portion 6408 has a sole thickness dimension 6440 that extends within a region between a rear protrusion 6438 and the striking face 6410. In certain embodiments, the sole thickness dimension 6440 is between about 1 mm and about 2 mm, or less than about 2 mm. In one embodiment, a preferred sole thickness 6440 is about 1.7 mm or less.

Figure 66:
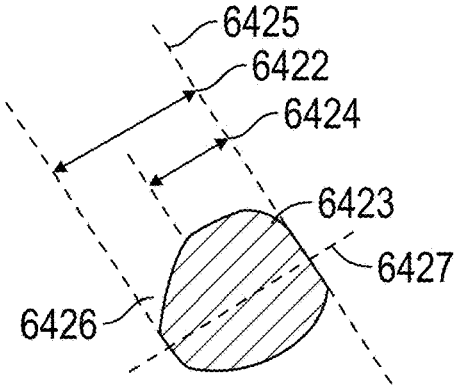
FIG. 66 is a magnified view of DETAIL 66 in FIG. 65.

FIG. 66 is a magnified view of the top line 6406 DETAIL 66 of the golf club embodiment shown in FIG. 65. FIG. 66 shows the top line 6406 and a striking plane 6425 that is parallel to and contains the front striking surface 6410. A second plane 6427 is shown being perpendicular to the striking plane 6425 and the striking surface 6410. The top line 6406 includes a return surface 6423 immediately adjacent to the striking face 6410 in the top line portion 6406. The return surface 6423 extends from the striking face 6410 toward the back portion 6428 and a majority of the return surface 6423 is generally parallel with the second plane 6427. A transition surface 6426 connects the return surface 6423 to the outer back wall surface 6432*a*.

In certain embodiments, the return surface 6423 extends from the striking face 6410 a return distance 6424 (or "effective top line thickness") of between about 3.5 mm and 5 mm, or about 4.8 mm or less, as measured along the second plane 6427 and perpendicular to the striking plane 6425. In some embodiments, the return surface 6423 extends less than 60% of the total top line thickness 6422. In certain embodiments, the total top line thickness 6422 is between about 6 mm and about 9 mm, or about 8.5 mm or less, as measured along the second plane 6427 and perpendicular to the striking plane 6425.

A small effective top line thickness 6424 of the return surface 6423 creates the perception to a golfer that the entire top line 6406 of the club head 6400 is thin. A perceived thin top line 6406 can enhance the aesthetic appeal to a golf player.

FIG. 67 illustrates an elevated toe view of the golf club head 6400 including a back portion 6428, a front portion 6430, a sole portion 6408, a top line portion 6406, and a striking face 6410, as previously described.

In certain embodiments of iron type golf club heads having hollow construction, a recess 6434 is located above the rear protrusion 6438 in the back portion 6428 of the club head. A back wall 6432 encloses the entire back portion 6428 of the club head to define a cavity 6420 that is optionally filled with a filler material 6421. Suitable filler materials are described in US Patent Application Publication No. 2011/0028240, which is incorporated herein by reference.

Figure 69:
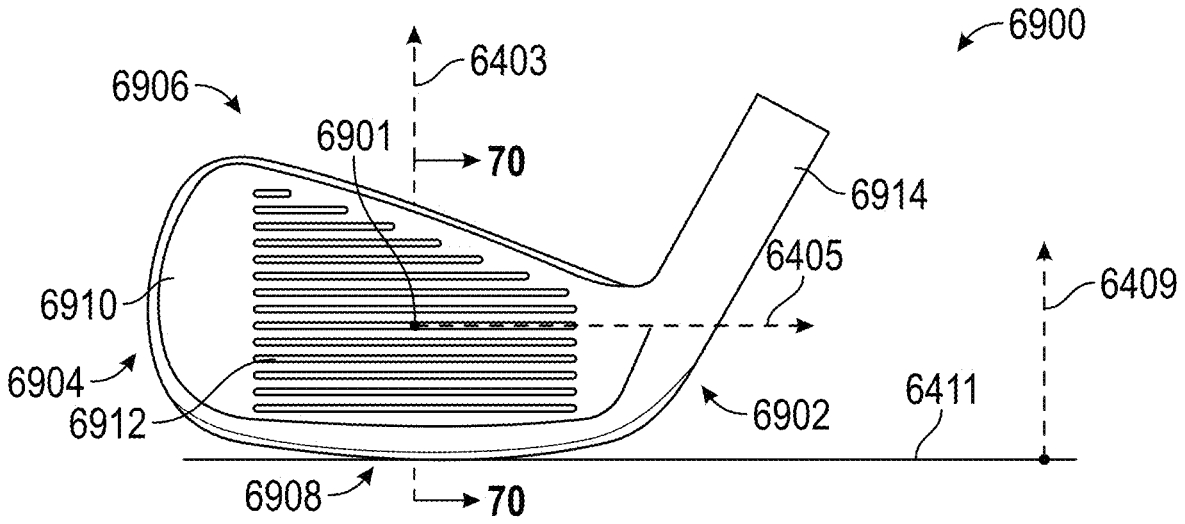
FIG. 69 is a front view of another embodiment of a golf club head.

Turning next to FIGS. 69-72, an embodiment of a golf club head 6900 having a cavity back construction is shown. Like the hollow construction golf club 6400, the cavity back golf club head 6900 includes a body 6913 having a heel 6902, a toe 6904, a sole portion 6908, a top line portion 6906, and a hosel 6914. The golf club head 6900 is shown in FIG. 69 in a normal address position with the sole portion 6908 resting upon a ground plane 6411, which is assumed to be perfectly flat. The striking face 6910 defines a face plane 6925 and includes grooves 6912 that are designed for impact with the golf ball. In some embodiments, the golf club head 6900 can be a single unitary cast piece, while in other embodiments, a striking plate can be formed separately to be adhesively or mechanically attached to the body 6913 of the golf club head 6900.

Figure 71:
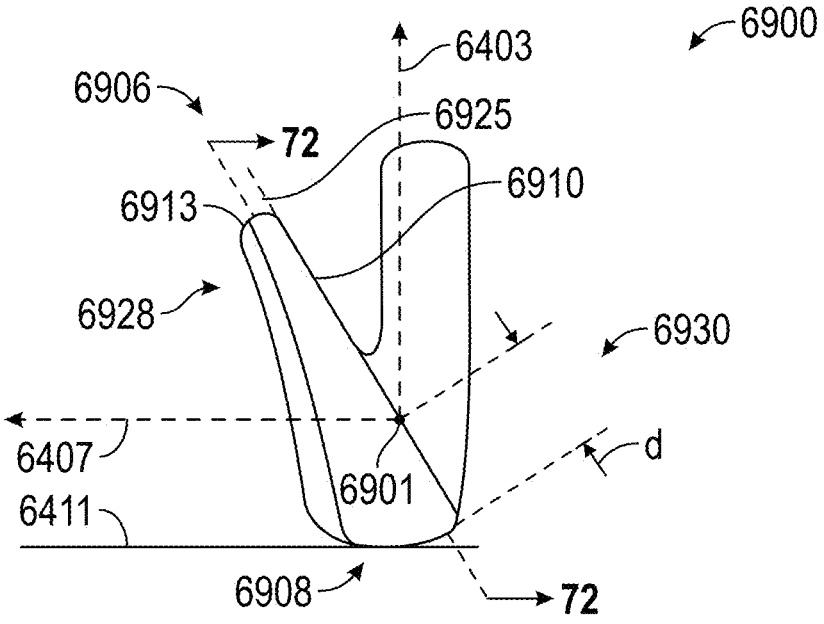
FIG. 71 is an elevated toe perspective view of a golf club head.

FIGS. 69 and 71 also show an ideal striking location 6901 on the striking face 6910 and respective orthogonal CG axes (CG x-axis 6405, CG y-axis 6407, and CG z-axis 6403) as described previously. The ideal striking location 6901 in the cavity back golf club head 6900 is located within the face plane 6925 at the same location relative to the CG x-axis and the leading edge as the ideal striking location 6401 of the hollow golf club head 6400, described above. In certain embodiments of the cavity back golf club head 6900, a desirable CG-y location is between about 0.25 mm to about 20 mm along the CG y-axis 6407 toward the rear portion of the club head. Additionally, a desirable CG-z location is between about 12 mm to about 25 mm along the CG z-up axis 6409, as previously described.

Figure 70:
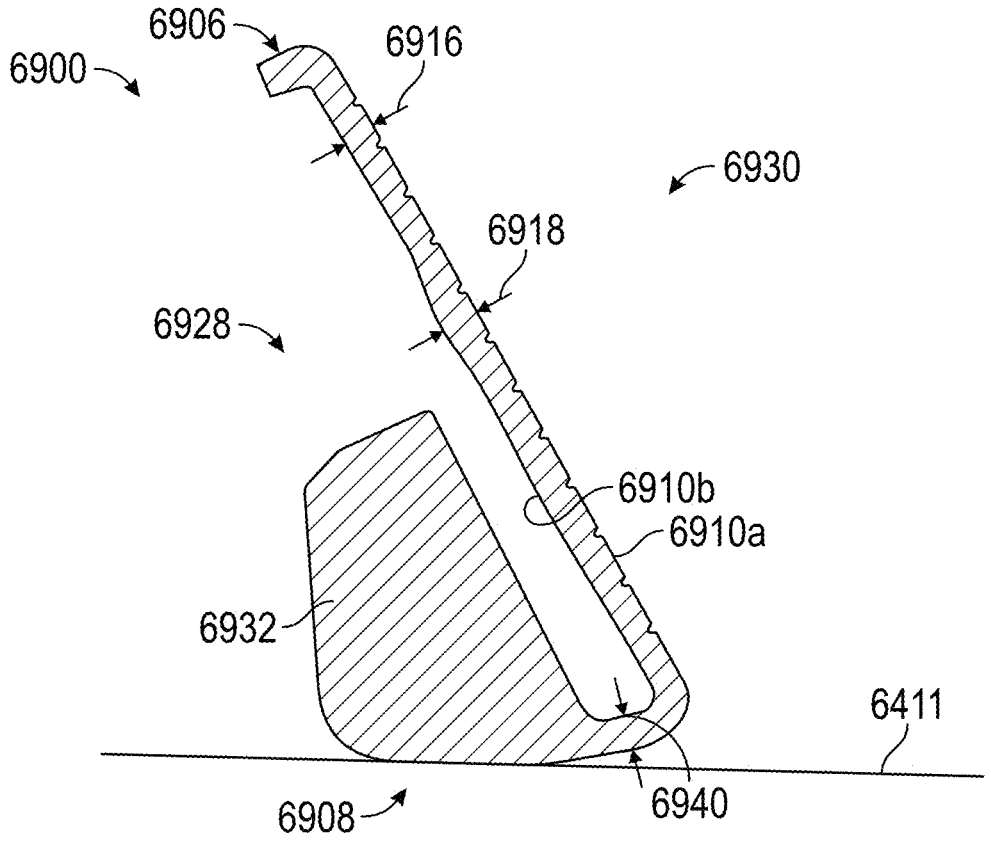
FIG. 70 is a cross-sectional view taken along section lines 70-70 in FIG. 69.

FIG. 70 shows a cross sectional side view along the cross-section lines 70-70 shown in FIG. 69. The cross-section lines 70-70 are taken through the ideal striking location 6901 on the striking face 6910. The striking face 6910 includes a front surface 6910*a* and a rear surface 6910*b*. The cavity back iron golf club head 6900 embodiment further includes a back portion 6928 and a front portion 6930. In the embodiment shown in FIGS. 69-72, the grooves 6912 are located on the striking face 6910 having the same shape and orientation as with the golf club head 6400 described above in relation to FIGS. 64-68. As with the previous embodiment, still other shapes, alignments, and/or orientations of grooves 6912 on the surface of the striking face 6910 are also possible.

FIG. 70 further shows a back wall 6932 of the cavity back golf club head 6900. The back wall 6932 has a relatively large thickness in relation to the striking plate and other portions of the golf club head 6900, thereby accounting for a significant portion of the mass of the golf club head 6900, and thereby shifting the center of gravity (CG) of the golf club head 6900 relatively lower and rearward. Furthermore, the sole portion 6908 has a sole thickness dimension 6940 that extends within a region between the back wall 6932 and the striking face 6910. In certain embodiments, the sole thickness dimension 6940 is between about 1 mm and about 2 mm, or less than about 2 mm. In one embodiment, a preferred sole thickness 6940 is about 1.7 mm or less.

In certain embodiments of the golf club heads 6400, 6900 that include a separate striking plate attached to the body 6413, 6913 of the golf club head, the striking plate can be formed of forged maraging steel, maraging stainless steel, or precipitation-hardened (PH) stainless steel. In general, maraging steels have high strength, toughness, and malleability. Being low in carbon, they derive their strength from precipitation of inter-metallic substances other than carbon.

The principle alloying element is nickel (15% to nearly 30%). Other alloying elements producing inter-metallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the striking plate. In other embodiments, the striking plate is a precipitation hardened stainless steel such as 17-4, 15-5, or 17-7.

The striking plate can be forged by hot press forging using any of the described materials in a progressive series of dies. After forging, the striking plate is subjected to heat-treatment. For example, 17-4 PH stainless steel forgings are heat treated by 1040° C. for 90 minutes and then solution quenched. In another example, C455 or C450 stainless steel forgings are solution heat-treated at 830° C. for 90 minutes and then quenched.

In some embodiments, the body 6413, 6913 of the golf club head is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In still other embodiments, the body 6413, 6913 and/or striking plate of the golf club head are made from fiber-reinforced polymeric composite materials, and are not required to be homogeneous. Examples of composite materials and golf club components comprising composite materials are described in U.S. Patent Application Publication No. 2011/0275451, which is incorporated herein by reference in its entirety.

The body 6413, 6913 of the golf club head can include various features such as weighting elements, cartridges, and/or inserts or applied bodies as used for CG placement, vibration control or damping, or acoustic control or damping. For example, U.S. Pat. No. 6.811,496, incorporated herein by reference in its entirety, discloses the attachment of mass altering pins or cartridge weighting elements.

After forming the striking plate and the body 6413, 6913 of the golf club head, the striking plate and body portion 6413, 6913 contact surfaces can be finish-machined to ensure a good interface contact surface is provided prior to welding. In some embodiments, the contact surfaces are planar for ease of finish machining and engagement.

Figure 73:
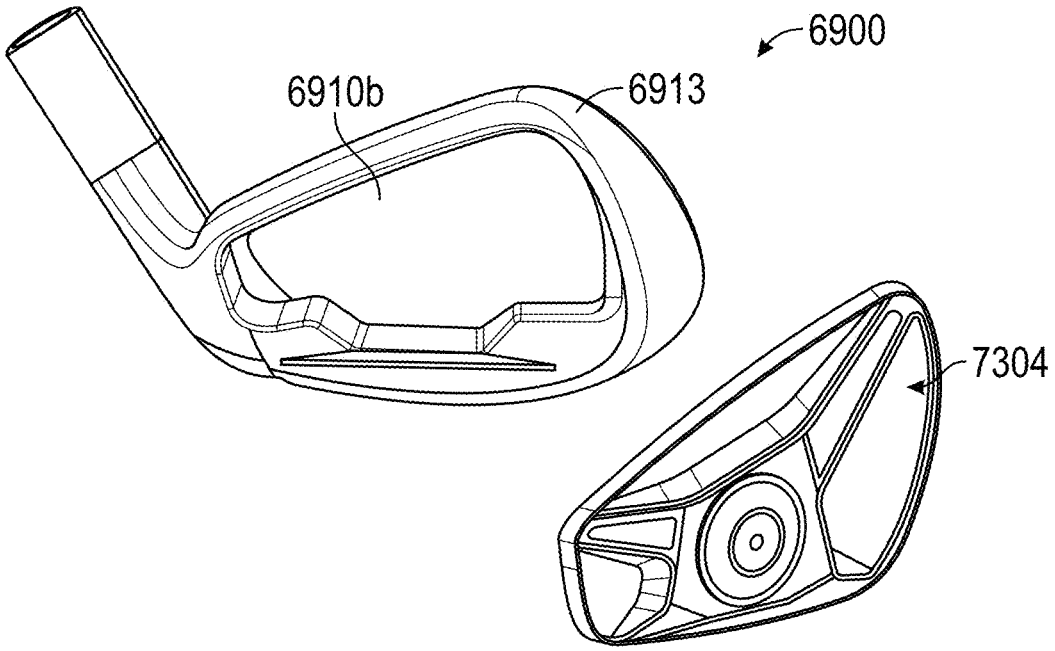
FIG. 73 is an isometric view of a golf club head assembly.

FIG. 73 illustrates a cavity back golf club head 6900 including a club head body 6913 and a badge 7304 (or third piece). The badge 7304 is adhesively bonded to the rear surface 6910*b* of the striking face of the club head 6900. The badge 7304 obscures any weld beads, deformations, markings, or other visible items on the rear surface 6910*b* of the striking face so that no visual difference can be observed by the user. For example, applying the badge 7304 allows a weld to be placed on the face of the iron with minimal cost. Furthermore, the badge 7304 can have desirable effects on sound and vibration dampening upon impact with a golf ball.

Figure 74:
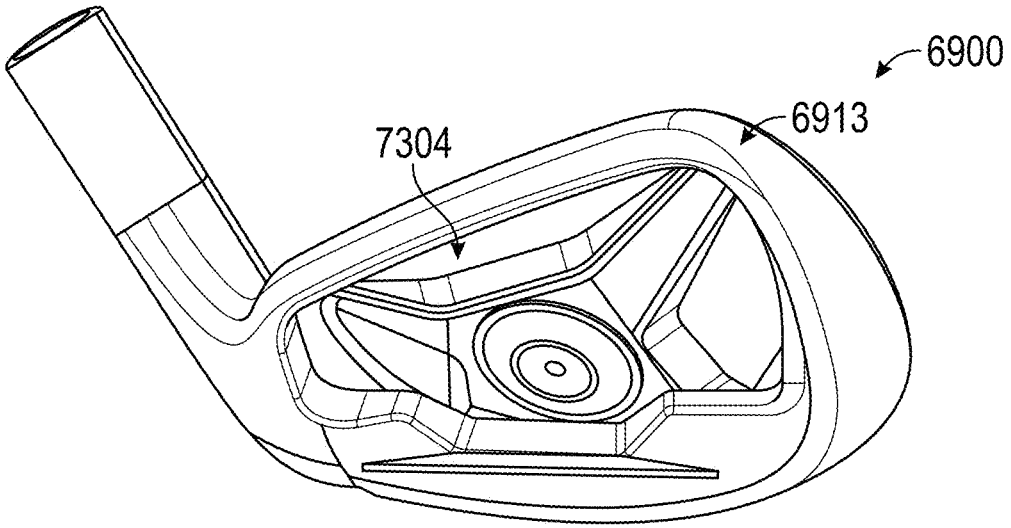
FIG. 74 is an isometric view of an assembled golf club head.

FIG. 74 illustrates an assembled view of the golf club head 6900 where the badge 7304 has been adhesively applied with epoxy or any known adhesive. For example, an epoxy such as 3MTM DP460 can be used. It is possible for the badge 7304 to be mechanically attached to the club head portion 6913.

2. Features of Iron Type Golf Club Heads

Several specific features of iron type golf club heads are described below, in reference to the perimeter weighted golf club heads described in the preceding sections.

A. Unsupported Face Area

Conventional perimeter weighted iron type golf club heads (e.g., hollow and cavity back designs) include a perimeter annular mass in the rear portion of the club head that wholly or partially surrounds the hollow back or cavity back formed in the center of the golf club head. As a result, the striking face of such club heads is made up of a supported region located in front of the perimeter annular mass, and an unsupported region located in front of the hollow back or cavity. In some designs, a backing member such as a badge or other member may be attached to the rear side of the unsupported region.

A point on the face of a club head can be considered beam-like in cross-section and its bending stiffness at a given location on the face can be calculated as a product of the Young's Modulus (E) of the material making up the face at the point and the cube of the face thickness, $t^3$, at the point. That is, the bending stiffness at a point on the face of a club head is a function of $Et^3$ at that point. Thus, the bending stiffness of a conventional perimeter weighted iron type golf club head having a striking face made of a homogeneous material will vary significantly between the supported region (where cross-sectional thickness, t, is relatively greater) and the unsupported region (where cross-sectional thickness, t, is relatively less).

Figure 68:
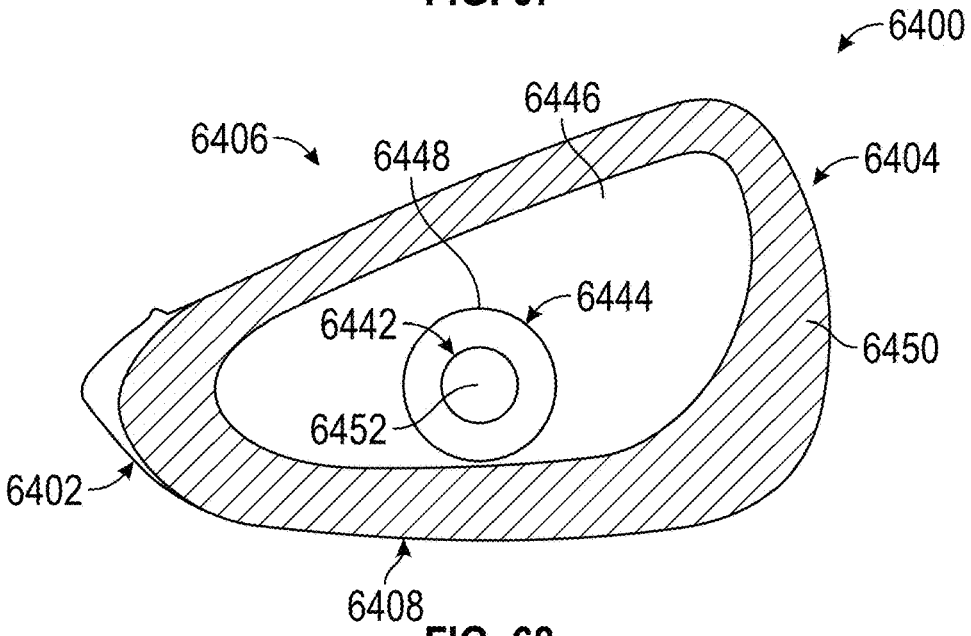
FIG. 68 is a cross-sectional view taken along section lines 68-68 in FIG. 67.
Figure 72:
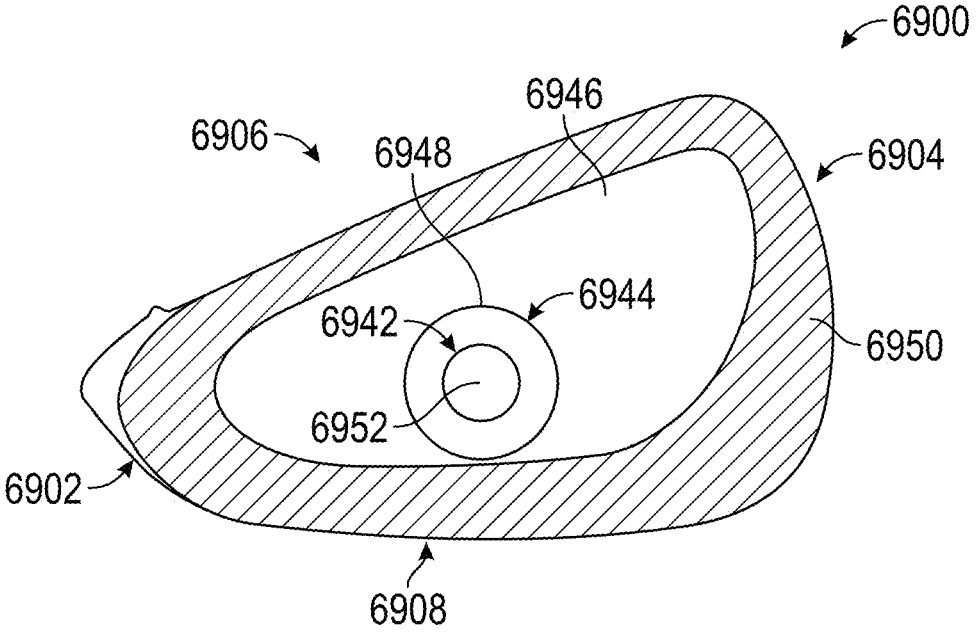
FIG. 72 is a cross-sectional view taken along section lines 72-72 in FIG. 71.

FIG. 68 illustrates a cross-sectional view taken along cross-sectional lines 68-68 of FIG. 67. FIG. 72 shows a similar cross-sectional view taken along cross-sectional lines 72-72 of FIG. 71. FIGS. 68 and 72 show rear unsupported face regions 6446 and 6946, inverted cone technology regions 6448 and 6948 (hereinafter, "ICT region" or "Thickened Central Region"), and rear supported face regions 6450 and 6950. The unsupported face region 6446, 6946 is a region of the striking face 6410, 6910 where the cross-sectional bending stiffness of the face is low relative to the cross-sectional bending stiffness of the supported region 6450, 6950. For example, the unsupported face region 6446, 6946 may be the area of the striking face 6410, 6910 where the thickness of the face is thin (e.g., less than 3 mm, less than 3.25 mm, less than 3.5 mm, less than 3.75 mm, less than 4 mm, less than 4.25 mm, less than 4.5 mm, less than 4.75 mm, and/or less than 5 mm) and is not supported by any separate or integrated metallic structure having a significant impact on the stiffness of the striking face 6410, 6910.

The rear supported face region 6450, 6950 is located about a periphery of the unsupported face region 6446, 6946. The rear supported face region 6450, 6950 includes the areas of the striking face 6410, 6910 that are supported by the separate or integrated metallic structure making up the body portion 6413, 6913 of the golf club head.

B. Flexible Striking Face

The striking plate of the golf club heads described herein include construction and materials that produce relatively high coefficients of restitution (COR) and characteristic times (CT) (as these terms are defined herein), while maintaining sufficient durability for a commercially acceptable golf club head. For example, in some embodiments, the striking plate of the club head is constructed having a relatively thin cross-section in order to increase the flexibility of the striking plate, thereby increasing both CT and COR. In other embodiments, the striking plate of the golf club head comprises a material or materials having a relatively low Young's Modulus (E) value, also in order to increase the flexibility of the striking plate. Combinations of these design factors are also possible in order to obtain a striking plate having a relatively high amount of flexibility, thereby increasing the efficiency of clubface to golf ball impact, increasing COR, and/or increasing CT.

In some embodiments, the striking face of the golf club head has a uniform thickness of between about 1.5 mm to about 3.0 mm, such as between about 1.7 mm to about 2.5 mm, or between about 1.8 mm to about 2.0 mm. In these embodiments, the striking face comprises steel, titanium, polymer-fiber composite, or one or more of the materials described above.

In the embodiments shown in FIGS. 64-68 and 69-72, the golf club heads 6400, 6900 each include a striking face 6410, 6910 having a first thickness 6416, 6916 located generally in a peripheral region of the striking face and a second thickness 6418, 6918 located generally in a central region of the striking face. The second thickness is greater than the first thickness. In certain embodiments, the first thickness can be between about 1.5 mm and about 3.0 mm, with a preferred thickness of about 2 mm or less. The second thickness can be between about 1.7 mm and about 3.5 mm, with a preferred thickness of about 3.1 mm or less. Furthermore, as described above, the sole portion 6408, 6908 has a sole thickness dimension 6440, 6940 that is between about 1 mm and about 2 mm, or less than about 2 mm. In some embodiments, a preferred sole thickness is about 1.7 mm or less.

The thickness profiles and low thickness values of the striking face can be achieved during the forging of the striking face. In one embodiment, a 0.3 mm to 1.0 mm machine stock plate can be added to the striking face to increase tolerance control. After forging, the striking face can be slightly milled and engraved with score-lines. A key advantage of being able to forge such a thin face is the freeing up of discretionary mass (up to about 20 g) that can be placed elsewhere in the club head (such as the rear piece) for manipulation of the moment of inertia or center of gravity location.

The thickness of the striking face in the thin face area is generally consistent in thickness and non-variable. Of course, manufacturing tolerances may cause some variation in the thin face area. In certain embodiments, the thin face area is about 50% or more of the unsupported face region 6446, 6946.

C. Localized Stiffened Regions

In several embodiments, the striking plate of the golf club head includes a localized stiffened region that is located on the striking face at a location that surrounds or that is adjacent to the ideal striking location. The localized stiffened region comprises an area of the striking face that has increased stiffness due to being relatively thicker than a surrounding region, due to being constructed of a material having a higher Young's Modulus (E) value than a surrounding region, and/or a combination of these factors. Localized stiffened regions may be included on a striking face for one or more reasons, such as to increase the durability of the club head striking face, to increase the area of the striking face that produces high COR, or a combination of these reasons.

Several examples of localized stiffened regions are the variable thickness configurations or inverted cone technology regions such as those discussed in, for example, U.S. Pat. Nos. 6,800,038, 6,824,475, 6,904,663, and 6,997,820, all incorporated herein by reference. For example, FIG. 68 and FIG. 72 each show a rear view of an unsupported face region 6446, 6946 having an inverted cone technology region 6448, 6948 and a rear view of a supported face region 6450, 6950.

The inverted cone regions 6448, 6948 each comprise symmetrical "donut" shaped areas of increased thickness that are located within the unsupported face region 6446, 6946. The inverted cone regions 6448, 6948 are centered on the ideal striking location 6401, 6901. The inverted cone region includes an outer span 6444, 6944 and an inner span 6442, 6942 that are substantially concentric about a center 6452, 6952. In some embodiments, the outer span has a diameter of between about 15 mm and about 25 mm, or at least about 20 mm. In other embodiments, the outer span has a diameter greater than about 25 mm, such as about 25-35 mm, about 35-45 mm, or more than about 45 mm. The inner span of the inverted cone region represents the thickest portion of the unsupported face region. In certain embodiments, the inner diameter 6442, 6942 is between about 5 mm and about 15 mm, or at least about 10 mm.

In other embodiments, the localized stiffened region comprises a stiffened region (e.g., a localized region having increased thickness in relation to its surrounding regions) having a shape and size other than those described above for the inverted cone regions. The shape may be geometric (e.g., triangular, square, trapezoidal, etc.) or irregular. For these embodiments, a center of gravity of the localized stiffened region (CGLSR) may be determined by defining a boundary for the localized stiffened region and calculating or otherwise determining the center of gravity of the defined region. An area, volume, and other measurements of the localized stiffened region are also suitable for measurement upon defining the appropriate boundary.

3. Performance of Previous High-COR Iron Type Golf Clubs

As used herein, the terms "coefficient of restitution," "COR," "relative coefficient of restitution," "relative COR," "characteristic time," and "CT" are defined according to the following. The coefficient of restitution (COR) of an iron clubhead is measured according to procedures described by the USGA Rules of Golf as specified in the "Interim Procedure for Measuring the Coefficient of Restitution of an Iron Clubhead Relative to a Baseline Plate," Revision 1.2, Nov. 30, 2005 (hereinafter "the USGA COR Procedure"). Specifically, a COR value for a baseline calibration plate is first determined, then a COR value for an iron clubhead is determined using golf balls from the same dozen(s) used in the baseline plate calibration. The measured calibration plate COR value is then subtracted from the measured iron clubhead COR to obtain the "relative COR" of the iron clubhead.

To illustrate by way of an example: following the USGA COR Procedure, a given set of golf balls may produce a measured COR value for a baseline calibration plate of 0.845. Using the same set of golf balls, an iron clubhead may produce a measured COR value of 0.825. In this example, the relative COR for the iron clubhead is 0.825−0.845=−0.020. This iron clubhead has a COR that is 0.020 lower than the COR of the baseline calibration plate, or a relative COR of −0.020.

The characteristic time (CT) is the contact time between a metal mass attached to a pendulum that strikes the face center of the golf club head at a low speed under conditions prescribed by the USGA club conformance standards.

Most commercially available iron type golf clubs have relative COR values that are lower than about −0.045. One exception has been the Burner® and Burner® 2.0 irons produced and sold by the TaylorMade Golf Company. The Burner® and Burner® 2.0 irons have relative COR values of up to about −0.020 for the longer irons included in the set. The high relative COR values for the Burner® and Burner® 2.0 irons are provided by, among other features, the thin, flexible striking plate and large unsupported face area included on these golf clubs.

Testing has shown that the flexible striking plate and large unsupported face area of the Burner® and Burner® 2.0 irons produce launch conditions that result in a rightward deviation for (right-handed) centerface golf shots hit using these clubs. For example, under certain test conditions, a golf ball struck at centerface using a Burner® 2.0 4 iron will have a rightward deviation of up to about 7 yards.

The present inventors investigated the performance of the high-COR Burner® and Burner® 2.0 irons and other high-COR club head designs and determined that the rightward tendency was caused primarily by the occurrence of a sidespin component of the spin imparted to the golf ball upon launch off the face of the clubhead. For example, iron golf club head designs were modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc. Under simulation, a model of a Burner® 2.0 4 iron was observed to produce sidespin of about 158.23 rpm under a conventional set of launch conditions (ball speed of 133.43 fps, launch angle 16.22°, backspin of 4750 rpm), which contributed to a rightward deviation of about 6.76 yards over a shot distance (carry only) of about 207.58 yards. This performance and, in particular, the degree of rightward deviation for golf ball shots made using the longer irons included in the Burner® 2.0 iron set, has been confirmed via robot and player testing.

Further investigation of the cause of the rightward tendency of the high-COR Burner® and Burner® 2.0 irons showed that the sidespin imparted to the golf ball was caused primarily by the asymmetric deformation of the unsupported region of the striking face upon impact with the golf ball. Unlike a conventional driver, wood, or metalwood type clubhead, the unsupported region of the face of a conventional iron clubhead is asymmetric in shape, having a heel region with a relatively short face height and a toe region with a relatively large face height.

Figure 75:
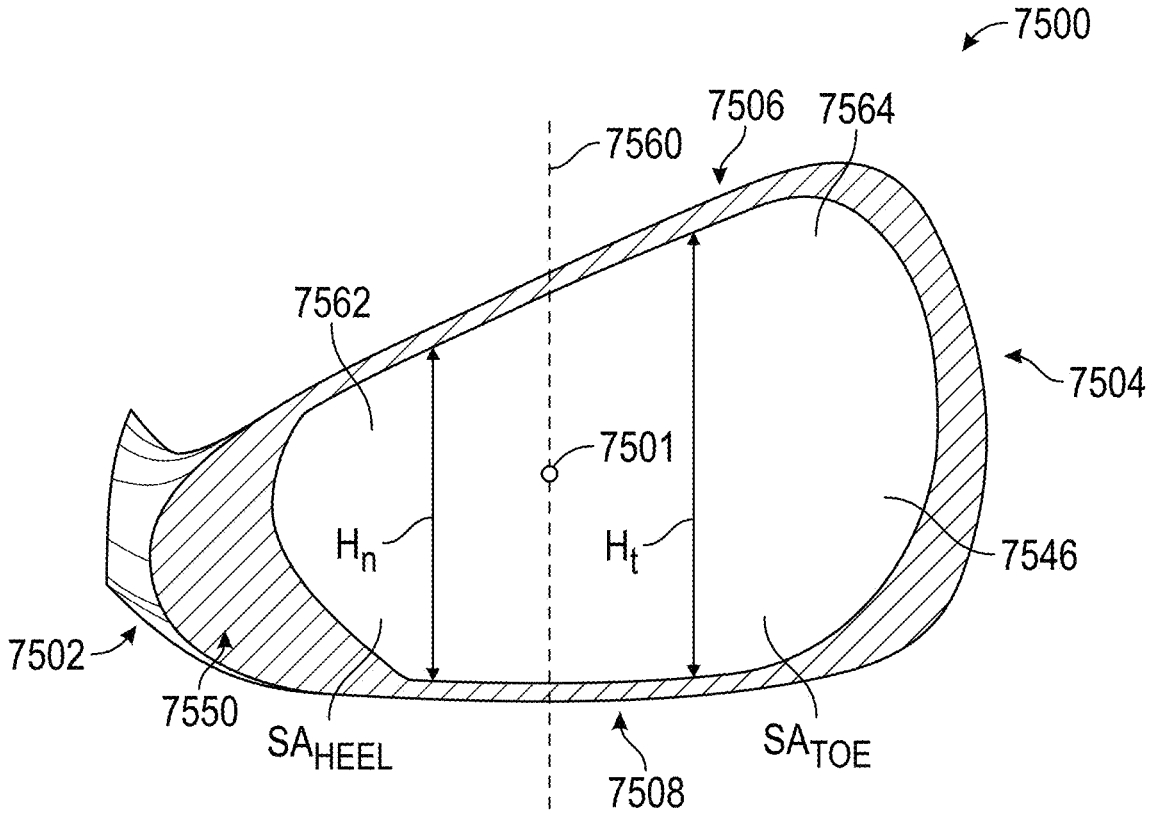
FIG. 75 is a rear cross-sectional view of a golf club head according to an embodiment.

For example, FIG. 75 shows a rear cross-sectional view of a cavity back golf club head 7500 having a heel 7502, a toe 7504, a sole portion 7508, and a top line portion 7506. An ideal striking location 7501 is located within the unsupported face region 7546, which is surrounded by the supported face region 7550. An imaginary centerface line 7560 is drawn perpendicular to the ground plane and passing through the ideal striking location 7501, thereby separating the unsupported face region 7546 into a heel unsupported face region 7562 and a toe unsupported face region 7564.

As shown in FIG. 75, the heel unsupported face region 7562 has a height $H_h$ at a given location within the region, and the toe unsupported face region 7564 has a height $H_t$ at a given location within the region. In addition, the heel unsupported face region 7562 has a surface area $SA_{HEEL}$ and the toe unsupported face region 7564 has a surface area $SA_{TOE}$. Because a conventional iron type club head includes a top line 7506 that diverges upward (i.e., away from) the sole region 7508 as the top line 7506 extends from the heel 7502 to the toe 7504, the height $H_t$ at a given location with the toe region will be greater than the height $H_h$ at a given location within the heel region. Also, the surface area of the toe unsupported face region $SA_{TOE}$ will be greater than the surface area of the heel unsupported face region $SA_{HEEL}$, i.e., $SA_{TOE}>SA_{HEEL}$.

For a striking plate of a given thickness or stiffness, the broader area of the toe unsupported face region 7564 relative to that of the heel unsupported face region 7562 will allow the striking plate to deform more in the toe region than it does in the heel region under a given load. As a result, a given amount of force applied to the unsupported region of the face of a conventional iron club head will create an increased amount of deformation of the striking plate when the force is applied toward the toe region 7564 of the striking plate relative to the same force applied toward the heel region 7562 of the striking plate. In the case of a golf ball impacting a clubface at typical clubhead speeds encountered during normal use, the golf ball impact area on the striking face can be sufficiently large that the deformation area itself can be asymmetric when the striking plate stiffness is sufficiently low and the unsupported face area 7546 is sufficiently asymmetric (i.e., $H_t>H_r$ and/or $SA_{TOE}>SA_{HEEL}$). When the deformation area is asymmetric, the launch conditions of the struck golf ball will include a significant sidespin component and the golf ball will have a significant rightward deviation (for a right handed shot).

4. Descriptions of Inventive High-COR Iron Type Golf Clubs

The high-COR iron type club heads described herein include a localized stiffened region that is located on the striking face of the club head such that the localized stiffened region alters the launch conditions of golf balls struck by the club head in a way that wholly or partially compensates for, overcomes, or prevents the occurrence of the foregoing rightward deviation. In particular, the localized stiffened region is located on the striking face such that a golf ball struck under typical conditions will not impart a right-tending sidespin to the golf ball.

The inventors of the club heads described herein investigated the effect of modifying the stiffness of particular regions of the striking face of high-COR iron type club heads. Iron golf club head designs were modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc. Under simulation, models of high-COR club heads having localized stiffened regions at several locations in the unsupported face region of the club heads were observed to produce reduced or no right-tending sidespin and reduced or no rightward deviation for right handed golf shots. In some cases, the inventive club heads produced a left-tending sidespin and leftward deviation for right handed golf shots.

For example, Table 23 below shows simulation data for several club head designs that include an inverted cone technology region located at various locations on the striking face of the club head. With the exceptions listed below, the ICT Region for each of the club heads described in Table 23 included an inner diameter of about 11 mm and an outer diameter of about 22 mm. The exceptions are the entries identified as Rev. G, which included an inner diameter of 17 mm and an outer diameter of 28 mm, and Rev. J, which included an inner diameter of 23 mm and an outer diameter of 34 mm. In addition, Rev. L included a transition region having a diameter of about 45 mm, and Rev. M included a non-symmetric transition region.

TABLE 23

| ID | ICT Peak (mm) | ICT x-loc (mm) | ICT y-loc (mm) | Toe/ Heel thk (mm) | Top thk (mm) | Bottom thk (mm) | Deviation (yds) | Relative COR |
|---|---|---|---|---|---|---|---|---|
| B 2.0 | 2.6 | 0.0 | 18.0 | 1.8 | 1.9 | 2.1 | 6.76 | −0.024 |
| Rev. B | 3.1 | 10.8 | 17.9 | 1.8 | 1.8 | 2.0 | −3.19 | −0.018 |
| Rev. C | 3.1 | 11.9 | 13.4 | 1.8 | 1.8 | 2.0 | −2.04 | −0.015 |
| Rev. D | 3.1 | 19.8 | 22.9 | 1.8 | 1.8 | 2.0 | −0.25 | |
| Rev. E | 3.1 | 21.8 | 13.4 | 1.8 | 1.8 | 2.0 | −0.17 | −0.013 |
| Rev. F | 3.1 | 6.9 | 15.5 | 1.8 | 1.8 | 2.0 | −2.97 | |
| Rev. G | 3.1 | 8.9 | 17.0 | 1.8 | 1.8 | 1.8 | −3.30 | −0.020 |
| Rev. H | 3.1 | 11.9 | 18.7 | 1.8 | 1.8 | 1.8 | −2.70 | |
| Rev. I | 3.1 | 13.9 | 19.8 | 1.8 | 1.8 | 1.8 | −1.90 | |
| Rev. J | 3.1 | 8.9 | 17.0 | 1.8 | 1.8 | 1.8 | −3.22 | −0.024 |
| Rev. K | 3.1 | 8.9 | 17.0 | 2.0 | 2.0 | 2.0 | −2.41 | −0.021 |
| Rev. L | 3.1 | 8.9 | 17.0 | 1.8 | 1.8 | 1.8 | −2.46 | −0.020 |
| Rev. M | 3.1 | 9.0 | 17.0 | 1.8 | 1.8 | 1.8 | −1.27 | −0.023 |
| Rev. N | 2.6 | 8.9 | 17.0 | 1.8 | 1.9 | 2.1 | −0.95 | −0.017 |
| Rev. O | 3.1 | 8.9 | 17.0 | 1.8 | 1.9 | 2.1 | −1.56 | −0.029 |

In Table 23, the entry for "B 2.0" represents data corresponding to a Burner® 2.0 4 iron golf club. The "ICT Peak" is the thickness of the ICT Region at its inner span 6442, 6942. The "ICT x-loc" is the club head face plane 6425, 6925 coordinate (in mm) along the CG x-axis of the center 6452, 6952 of the ICT Region. The "ICT y-loc" is the distance (in mm) within the club head face plane that the center of the ICT Region is offset from the leading edge (defined as the intersection of the sole portion 6408, 6908 and the face plane). The "Toe/Heel Thk," "Top thk," and "Bottom thk" are the thicknesses of the periphery of the unsupported face region 6446, 6946 in the areas of the toe and heel, top line, and sole portion, respectively. "Deviation" is the deviation from the target of a simulated golf ball struck by the club head, with positive numbers representing a rightward deviation (for right handed shots) and negative numbers representing a leftward deviation (for right handed shots). "Relative COR" is the predicted relative COR value for the club head.

As the data contained in Table 23 shows, a thickened ICT Region 6442, 6942 located on the striking face 6410, 6910 of a high-COR iron can be located such that the occurrence of a rightward deviation can be compensated for and/or overcome. In particular, the rightward deviation is compensated for and/or overcome where the ICT region is located on the toe side of and near to the ideal striking location.

Figure 76A:
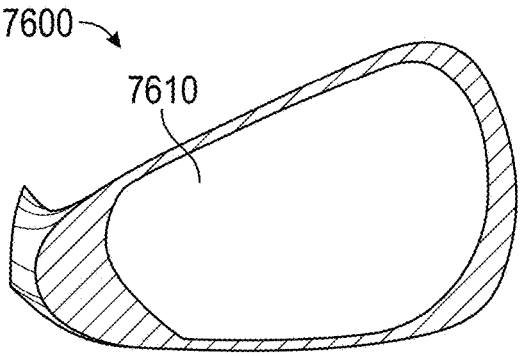
FIGS. 76A-76F are rear cross-sectional views of embodiments of golf club heads.
Figure 76B:
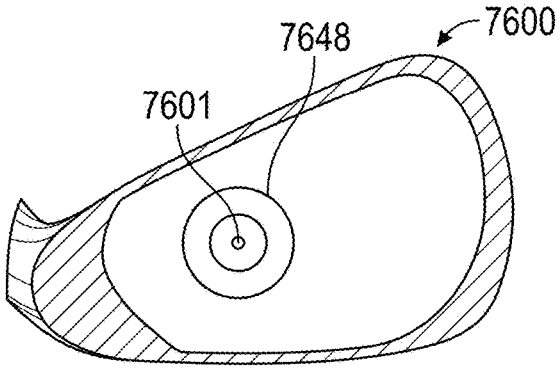

Examples of club heads 7600 having ICT Regions 7648 that are centered in the toe unsupported face region 7564 are shown by comparing the club heads shown in FIGS. 76A-76B with those shown in FIGS. 76C-76F. The club head 7600 shown in FIG. 76A does not include an ICT Region or any other localized stiffened region, instead comprising a striking face 7610 having a uniform thickness. The club head 7600 shown in FIG. 76B, on the other hand, includes an ICT Region 7648 that is centered on the ideal striking location 7601 of the club head (ICT x-loc 0.0 mm, ICT y-loc 16.5 mm). The locations of the ICT Region 7648 for the club heads shown in FIGS. 76C-76F are listed in Table 24:

TABLE 24

Figure 76C:
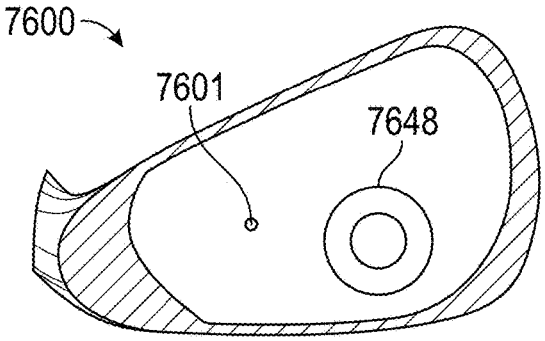
Figure 76D:
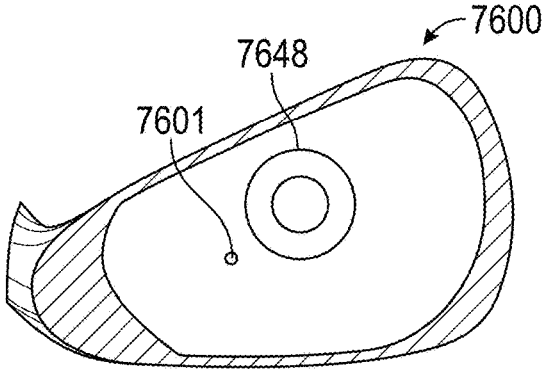
Figure 76E:
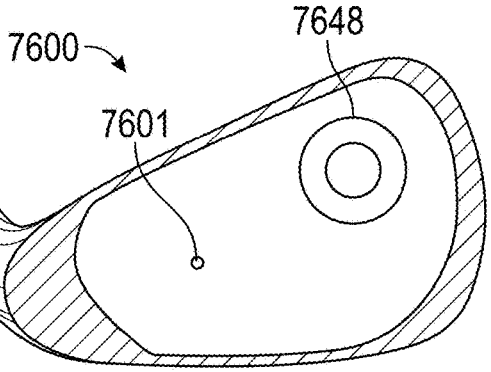
Figure 76F:
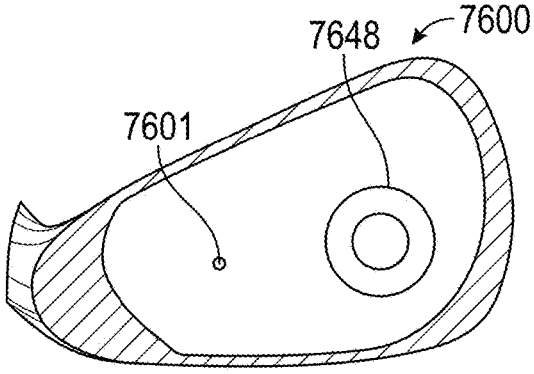

| | ICT x-loc (mm) | ICT y-loc (mm) |
|---|---|---|
| FIG. 76C | 10.0 | 18.0 |
| FIG. 76D | 7.1 | 21.4 |
| FIG. 76E | 18.0 | 27.0 |
| FIG. 76F | 20.0 | 18.0 |

Figure 77:
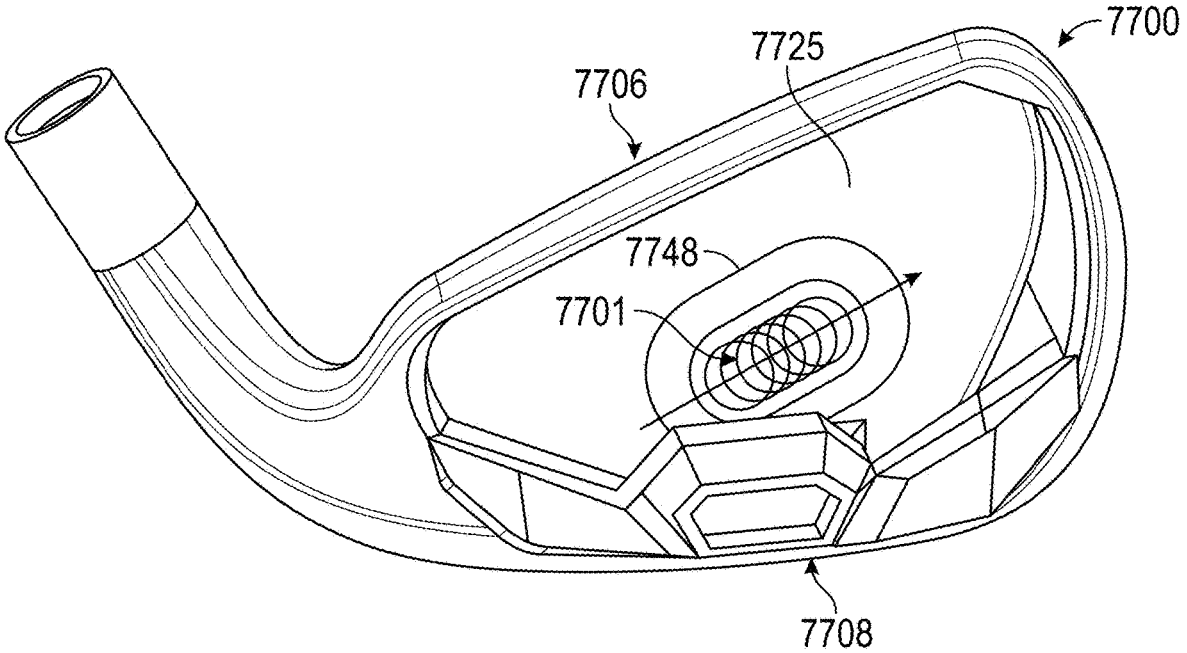
FIG. 77 is an isometric view of a golf club head showing several alternative locations of a localized stiffened region centered upon a Midline Vector.
Figure 78:
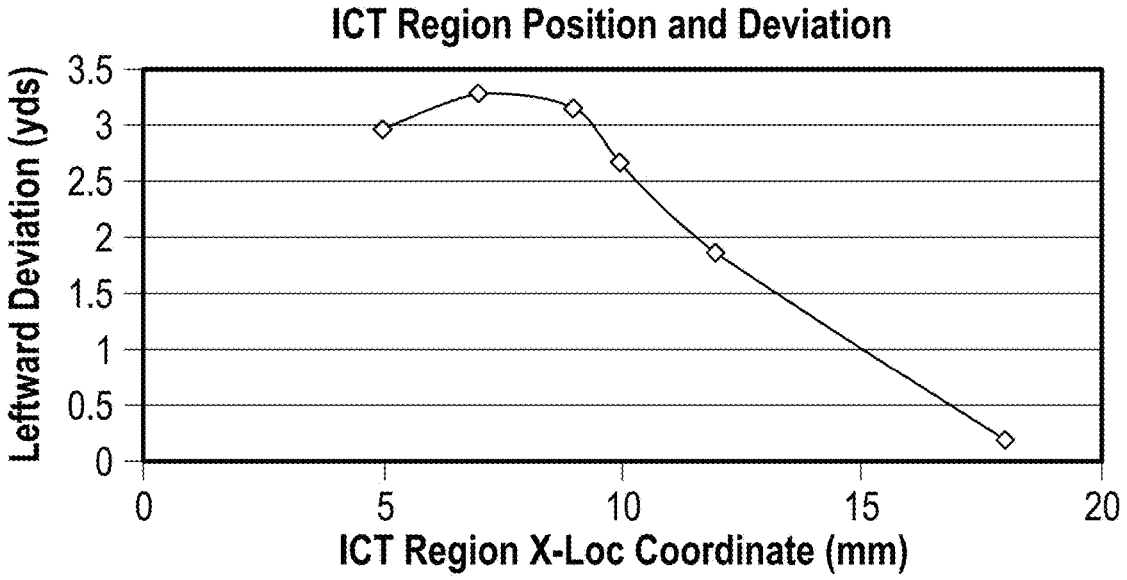
FIG. 78 illustrates a graph of a frequency response of exemplary golf club heads.

Additional data representing simulated golf ball strikes for the club head designs described above is presented in the graph contained in FIG. 78. The graph of FIG. 78 shows the amount of leftward deviation (for a right handed swing) that was observed for shots from a club head 7700 (see FIG. 77) as an ICT Region 7748 is shifted toe-ward and top line-ward along a Midline Vector that extends in the face plane 7725 through the set of points defining a midline between the top line 706 and the sole portion 708. As shown in the graph, as the ICT Region is shifted toe-ward and top line-ward along the Midline Vector, the amount of leftward deviation reaches a peak at an x-loc coordinate of about 7 mm to about 7.5 mm, and then dissipates substantially as the x-loc coordinate approaches 20 mm.

As discussed above, the primary cause of the observed compensation for the rightward deviation or the occurrence of a leftward deviation is the decrease or elimination of the occurrence of a rightward-tending sidespin, or the increase of the occurrence of a leftward-tending sidespin, on golf balls struck by the inventive golf club heads. Analytical testing was conducted to determine the relationship between the amount and direction of sidespin and the location of a localized stiffened region (such as an ICT Region) on the club head. Table 25 below reports the results of this testing for the inventive club head designs described in Table 23 above. As used herein, positive values for sidespin refer to a clockwise spin (from a frame of reference located above the golf ball) that produces a rightward (i.e., "slice" or "fade") deviation for right handed golf shots, and negative values for sidespin refer to a counter-clockwise spin (from a frame of reference located above the golf ball) that produces a leftward (i.e., "hook" or "draw") deviation for right handed golf shots.

TABLE 25

| ID | Deviation (yds) | Side spin (rpm) |
|---|---|---|
| B 2.0 | 6.76 | 158.23 |
| Rev. B | −3.19 | −91.45 |
| Rev. C | −2.04 | −61.16 |
| Rev. D | −0.25 | −24.56 |
| Rev. E | −0.17 | −24.74 |
| Rev. F | −2.97 | −88.27 |
| Rev. G | −3.30 | −94.31 |
| Rev. H | −2.70 | −78.85 |
| Rev. I | −1.90 | −58.99 |
| Rev. J | −3.22 | −88.69 |
| Rev. K | −2.41 | −70.06 |
| Rev. L | −2.46 | −70.30 |
| Rev. M | −1.27 | −37.68 |
| Rev. N | −0.95 | −38.99 |
| Rev. O | −1.56 | −51.22 |

In Table 25, negative values for sidespin indicate a sidespin that creates a leftward-deviation for golf balls struck right-handed.

The foregoing results were confirmed via robot testing. A commercial swing robot was used in conjunction with a three-dimensional optical motion analysis system, such as is available from Qualisys, Inc. The motion analysis system was electronically connected to a processor, which was used to collect club head and ball launch parameters as the golf clubs were swung by the robot to launch golf balls. Two golf club head designs were tested. The first was a commercially available TaylorMade Burner® 2.0 4 iron, and the second was a 4 iron embodiment of the inventive golf club heads described herein. The inventive club embodiment (Example 1 or "Ex. 1") included the following values for the parameters described:

| ID | ICT Peak (mm) | ICT x-loc (mm) | ICT y-loc (mm) | Toe/ Heel thk (mm) | Top thk (mm) | Bottom thk (mm) | Relative COR |
|---|---|---|---|---|---|---|---|
| Ex. 1 | 3.1 | 6.6 | 17.2 | 1.7 | 1.7 | 1.9 | −0.010 |

For the Example 1 inventive club, the ICT region included an inner diameter of about 11 mm and an outer diameter of about 40 mm.

The swing robot was set up to provide a swing path of 0 degrees and a face angle of 0 degrees. The following ball launch parameters were observed and recorded for TaylorMade TP Red™ golf balls struck by the club heads at their ideal striking locations:

TABLE 26

| | Burner ® 2.0 | Ex. 1 |
|---|---|---|
| Ball Speed (mph) | 136.40 (±0.55) | 137.00 (±0.00) |
| Launch angle (deg) | 18.12 (±0.08) | 17.60 (±0.08) |
| Back spin (rpm) | 4293.20 (±54.78) | 4517.00 (±54.78) |
| Side spin (rpm) | 173.60 (±133.48) | −176.80 (±133.48) |

As the results above show, the inventive golf club head (which has a localized stiffened region that is shifted toe-ward and top line-ward relative to the ICT Region of the Burner® 2.0 club head) produced about 350.4 rpm of increased leftward-tending sidespin relative to the Burner® 2.0 golf club head.

A. Full Unsupported Face Region Stiffness

As noted above, previous high-COR, perimeter weighted, iron type golf club head designs have included an unsupported face region in which the cross-sectional bending stiffness is generally uniformly distributed relative to the ideal striking location. For example, a club head with a striking plate having a uniform thickness of a homogeneous material will have the same point-wise cross-sectional bending stiffness at each point within the unsupported face region. As another example, a club head having a localized stiffened region (e.g., an ICT Region) that is symmetric and that is centered upon the ideal striking location will also have a point-wise cross-sectional bending stiffness that is generally uniformly distributed relative to the ideal striking location. In the latter example, the point-wise cross-sectional bending stiffness will vary at different locations on the club face, but the variations will be symmetrically distributed relative to the ideal striking location. At least the following three properties of these golf clubs are factors leading to the occurrence of a rightward deviation for golf shots hit with these clubs: (a) the high COR, (b) the asymmetric shape of the unsupported face region, and (c) the uniform bending stiffness distribution On the other hand, the inventive high-COR, perimeter weighted, iron type golf club heads described herein include a point-wise cross-sectional bending stiffness profile that is asymmetric in relation to the ideal striking location, which provides a non-uniform bending stiffness distribution that decreases or prevents the occurrence of the foregoing rightward deviation. In particular, for the inventive club head designs, the mean point-wise cross-sectional bending stiffness of the toe unsupported face region 7564 (see FIG. 75) is larger than the mean point-wise cross-sectional bending stiffness of the heel unsupported face region 7562. This is due to the fact that the centroid of a localized stiffened region (e.g., an ICT Region) is located relatively toe-ward of the ideal striking location 7501, thereby increasing the mean point-wise cross-sectional bending stiffness of the toe unsupported face region 7564 relative to that of the heel unsupported face region 7562.

The mean point-wise cross-sectional bending stiffness of a member may be calculated by dividing the member into N evenly distributed points and applying the following equation:

$$\text{Mean Bending Stiffness} = \left[\left(\sum_{n=1}^{N} E_n t_n^3\right) + N\right]$$

where $E_n$ and $t_n$ are the effective Young's Modulus and effective thickness, respectively, of an nth cross-sectional subdivision of the member. In the case of an unsupported face region of a golf club striking face, a reasonable distribution is achieved by discretizing the region into a mesh of uniform cross-sections each having a 1 mm×1 mm surface on the striking face to apply the foregoing equation.

Accordingly, for the inventive club heads described herein, the following inequality will apply in a comparison of the mean bending stiffness of the toe unsupported face region 7564 to the mean bending stiffness of the heel unsupported face region 7562:

$$\left[\left(\sum_{n=1}^{N} E_n t_n^3\right) + N\right] + \left[\left(\sum_{m=1}^{M} E_m t_m^3\right) + M\right] > C$$

where $E_n$ and $t_n$ are the effective Young's Modulus value and the thickness, respectively, for the nth cross-section of the toe portion of the unsupported region of the striking face, $E_m$ and $t_m$ are the effective Young's Modulus value and the thickness, respectively, for the mth cross-section of the heel portion of the unsupported region of the striking face, N and M have values such that 1 $mm^2$=($SA_{TOE}$/N)=($SA_{HEEL}$/M), and C is a constant having a value of 1.1.

The foregoing analysis was applied to the Burner® 2.0 golf club and the inventive golf club head designs described herein. The results are presented in Table 27:

TABLE 27

| ID | $BS_{TOE}/BS_{HEEL}$ | Deviation (yds) | Side spin (rpm) |
|---|---|---|---|
| B 2.0 | 1.06 | 6.76 | 158.23 |
| Rev. B | 1.28 | −3.19 | −91.45 |
| Rev. C | 1.30 | −2.04 | −61.16 |
| Rev. D | 1.27 | −0.25 | −24.56 |
| Rev. E | 1.34 | −0.17 | −24.74 |
| Rev. F | 1.29 | −2.97 | −88.27 |
| Rev. G | 1.28 | −3.30 | −94.31 |
| Rev. H | 1.26 | −2.70 | −78.85 |
| Rev. I | 1.27 | −1.90 | −58.99 |
| Rev. J | 1.69 | −3.22 | −88.69 |
| Rev. K | 1.23 | −2.41 | −70.06 |
| Rev. L | 1.51 | −2.46 | −70.30 |
| Rev. M | 1.25 | −1.27 | −37.68 |
| Rev. N | 1.22 | −0.95 | −38.99 |
| Rev. O | 1.37 | −1.56 | −51.22 |

As these results show, the inventive golf club head designs provide a ratio of mean bending stiffness of the toe unsupported face region ($BS_{TOE}$) to mean bending stiffness of the heel unsupported face region ($BS_{HEEL}$) that is greater than 1.1. For some embodiments, the ratio of $BS_{TOE}/BS_{HEEL}$ is greater than about 1.15. In other embodiments, the ratio of $BS_{TOE}/BS_{HEEL}$ is greater than about 1.20. In still other embodiments, the ratio of $BS_{TOE}/BS_{HEEL}$ is greater than about 1.25.

B. Hitting Region Stiffness

As noted above in relation to the data presented in FIG. 78, as the localized stiffened region is shifted toe-ward and top line-ward along the Midline Vector, the amount of leftward deviation generally reaches a peak at an x-loc coordinate of about 7 mm to about 7.5 mm, and then dissipates substantially as the x-loc coordinate approaches 20 mm. This observation illustrates that locating the localized stiffened region within a "hitting region" near to the ideal striking location will have a more significant impact on the occurrence of the rightward deviation described above. Thus, analysis of the bending stiffness profiles within the "hitting region" can show whether the club head construction will reduce and/or overcome the occurrence of the rightward deviation described above.

Two examples of "hitting regions" are defined herein for the purpose of analyzing a given iron type club head. In a first example, a "vertical wall hitting region" is defined as the portion of the unsupported face region that extends between two imaginary parallel lines drawn within the face plane 6425, 6925, perpendicularly to the ground plane 6411, and spaced 20 mm on either side of the ideal striking location. In a second example, a "circular wall hitting region" is defined as the portion of the unsupported face region that extends within an imaginary circle drawn within the face plane, having a radius of 20 mm, and having a center located at the ideal striking location.

The bending stiffness equations described in the preceding section can then be applied to the "hitting regions" defined above for a given iron type golf club head. In particular, for the inventive club heads described herein, the following inequality will apply in a comparison of the mean bending stiffness of the portion of the toe unsupported face region 7564 to the mean bending stiffness of the portion of the heel unsupported face region 7562 that lie within the specified "hitting region" of the golf club head:

$$\left[\left(\sum_{n=1}^{N} E_n t_n^3\right) + N\right] + \left[\left(\sum_{m=1}^{M} E_m t_m^3\right) + M\right] > D$$

where $E_n$ and $t_n$ are the effective Young's Modulus value and the thickness, respectively, for the nth cross-section of the toe portion of the unsupported region of the striking face lying within the hitting region, $E_m$ and $t_m$ are the effective Young's Modulus value and the thickness, respectively, for the mth cross-section of the heel portion of the unsupported region of the striking face lying within the hitting region, N and M have values determined by discretizing $SA_{TOE\ HR}$ and $SA_{HEEL\ HR}$, respectively, into 1 mm×1 mm sections, $SA_{TOE\ HR}$ and $SA_{HEEL\ HR}$ are the surface area of the toe portion and heel portion, respectively, of the unsupported region of the striking face lying with the hitting region, and D has a value defined below.

The foregoing analysis was applied to the Burner® 2.0 golf club and the inventive golf club head designs described herein. The results are presented in Table 28:

TABLE 28

| ID | $BS_{TOE}/BS_{HEEL}$ (Vert Wall HR) | $BS_{TOE}/BS_{HEEL}$ (Circle HR) | Deviation (yds) | Side spin (rpm) |
|---|---|---|---|---|
| B 2.0 | 1.16 | 1.25 | 6.76 | 158.23 |
| Rev. B | 1.52 | 1.81 | −3.19 | −91.45 |
| Rev. C | 1.55 | 1.84 | −2.04 | −61.16 |
| Rev. D | 1.32 | 1.40 | −0.25 | −24.56 |
| Rev. E | 1.28 | 1.39 | −0.17 | −24.74 |
| Rev. F | 1.54 | 1.83 | −2.97 | −88.27 |
| Rev. G | 1.51 | 1.80 | −3.30 | −94.31 |
| Rev. H | 1.47 | 1.74 | −2.70 | −78.85 |
| Rev. I | 1.49 | 1.76 | −1.90 | −58.99 |
| Rev. J | 2.22 | 2.76 | −3.22 | −88.69 |
| Rev. K | 1.40 | 1.57 | −2.41 | −70.06 |
| Rev. L | 1.81 | 2.09 | −2.46 | −70.30 |
| Rev. M | 1.50 | 1.76 | −1.27 | −37.68 |
| Rev. N | 1.40 | 1.54 | −0.95 | −38.99 |
| Rev. O | 1.64 | 1.83 | −1.56 | −51.22 |

As for the value of the constant D in the inequality set forth above, the results reported in Table 28 show that, in the case of the "vertical wall hitting region" (i.e., $D_{VW}$) the inventive golf club head designs provide a ratio of mean bending stiffness of the toe unsupported face region lying in the hitting region ($BS_{TOE\ HR}$) to mean bending stiffness of the heel unsupported face region lying in the hitting region ($BS_{HEEL\ HR}$) such that $D_{VW}$ is greater than 1.25. For some embodiments of the "vertical wall hitting region," the ratio of $BS_{TOE\ HR}/BS_{HEEL\ HR}$ is greater than about 1.30. In other embodiments, the ratio of $BS_{TOE\ HR}/BS_{HEEL\ HR}$ is greater than about 1.40. In still other embodiments, the ratio of $BS_{TOE\ HR}/BS_{HEEL\ HR}$ is greater than about 1.50.

Turning next to the case of the "circular wall hitting region" (i.e., $D_{CW}$), the inventive golf club head designs provide a ratio of mean bending stiffness of the toe unsupported face region lying in the hitting region ($BS_{TOE\ HR}$) to mean bending stiffness of the heel unsupported face region lying in the hitting region ($BS_{HEEL\ HR}$) such that the value of $D_{CW}$ is greater than 1.40. For some embodiments of the "circular wall hitting region," the ratio of $BS_{TOE\ HR}/BS_{HEEL\ HR}$ is greater than about 1.50. In other embodiments, the ratio of $BS_{TOE\ HR}/BS_{HEEL\ HR}$ is greater than about 1.65. In still other embodiments, the ratio of $BS_{TOE\ HR}/BS_{HEEL\ HR}$ is greater than about 1.80.

C. Application of Gaussian Weighting Function

An alternative analytical description of the bending stiffness distribution of the inventive golf club heads described herein incorporates a Gaussian function. Gaussian functions are used in statistics to described normal distributions, e.g., a characteristic symmetric "bell curve" shape that quickly falls off towards plus/minus infinity. For the purposes described herein, the Gaussian function is used to apply a distributive weighting to the bending stiffness contribution of cross-sectional subdivisions of the striking face in an analytical description of the golf club face construction. Similar to the "hitting region" analysis described in the preceding section, an analysis of the bending stiffness profiles using a Gaussian weighting function can show whether the club head construction will reduce and/or overcome the occurrence of the rightward deviation described above.

The two-dimensional elliptical Gaussian function has the following form:

$$f(x, y) = Ae^{-(a(x-x_0)^2+2b(x-x_0)(y-y_0)+c(x-x_0)^2)}$$

where A is the height of the peak of the function centered at $(x_0, y_0)$ and a, b, and c are the following:

$$a = (\cos^2\theta + 2\sigma_x^2) + (\sin^2\theta + 2\sigma_y^2)$$

$$b = (\sin 2\theta + 4\sigma_x^2) + (\sin 2\theta + 4\sigma_y^2)$$

$$c = (\sin^2\theta + 2\sigma_x^2) + (\cos^2\theta + 2\sigma_y^2)$$

where $\sigma_x$ and $\sigma_y$ are the full width half maxima of the weighting function. This allows the weighting function to be rotated about a specified angle θ. In the case of a description of the inventive golf club heads described herein, the following set of parameters are used to define the function:

A=1;

$x_0$=7 mm toe-ward from the ideal striking location;

$y_0$=22 mm upward from the mid-point of the sole of the club head;

$\sigma_x$=15 mm;

$\sigma_y$=20 mm; and

θ=30 degrees.

The foregoing set of parameters was determined based upon analysis of the simulation and testing data presented above which was used to identify the location on the striking face of the golf club where a localized stiffened region would be most influential in inducing the occurrence of a leftward deviation for golf balls struck by the club head.

The Gaussian weighting function, f(x, y), so defined is then applied to the bending stiffness equations and inequalities described above to determine the weighted mean bending stiffness of a region of the striking face of a golf club according to the following:

$$\text{Weighted Mean Bending Stiffness} = \left[\left(\sum_{n=1}^{N} E_n t_n^3 \times f(x, y)\right) + N\right]$$

where $E_n$ and $t_n$ are the effective Young's Modulus and effective thickness, respectively, of an nth cross-sectional subdivision of the region.

Accordingly, for the inventive club heads described herein, the following inequality will apply in a comparison of the mean bending stiffness of the toe unsupported face region 7564 to the mean bending stiffness of the heel unsupported face region 7562:

$$\left[\left(\sum_{n=1}^{N} E_n t_n^3 \times f(x, y)\right) + N\right] + \left[\left(\sum_{m=1}^{M} E_m t_m^3 \times f(x, y)\right) + M\right] > F$$

where $E_n$ and $t_n$ are the effective Young's Modulus value and the thickness, respectively, for the nth cross-section of the toe portion of the unsupported region of the striking face, $E_m$ and $t_m$ are the effective Young's Modulus value and the thickness, respectively, for the mth cross-section of the heel portion of the unsupported region of the striking face, N and M have values determined by discretizing $SA_{TOE}$ and $SA_{HEEL}$, respectively, into 1 mm×1 mm sections, f(x, y) is the Gaussian weighting function defined above, and F has a value defined below.

The foregoing analysis was applied to the Burner® 2.0 golf club and the inventive golf club head designs described herein. The results are presented in Table 29:

TABLE 29

| ID | $BS_{TOE\ WEIGHTED}/BS_{HEEL\ WEIGHTED}$ | Deviation (yds) | Side spin (rpm) |
|---|---|---|---|
| B 2.0 | 3.01 | 6.76 | 158.23 |
| Rev. B | 4.97 | −3.19 | −91.45 |
| Rev. C | 4.50 | −2.04 | −61.16 |
| Rev. D | 3.55 | −0.25 | −24.56 |
| Rev. E | 4.06 | −0.17 | −24.74 |
| Rev. F | 4.84 | −2.97 | −88.27 |
| Rev. G | 5.10 | −3.30 | −94.31 |
| Rev. H | 4.80 | −2.70 | −78.85 |
| Rev. I | 4.77 | −1.90 | −58.99 |
| Rev. J | 5.04 | −3.22 | −88.69 |
| Rev. K | 4.41 | −2.41 | −70.06 |
| Rev. L | 4.50 | −2.46 | −70.30 |
| Rev. M | 3.79 | −1.27 | −37.68 |
| Rev. N | 3.40 | −0.95 | −38.99 |
| Rev. O | 3.62 | −1.56 | −51.22 |

As these results show, the inventive golf club head designs provide a ratio of the weighted mean bending stiffness of the toe unsupported face region ($BS_{TOE\ WEIGHTED}$) to weighted mean bending stiffness of the heel unsupported face region ($BS_{HEEL\ WEIGHTED}$) that satisfies the above inequality where F is equal to 3.10. For some embodiments, the ratio of $BS_{TOE\ WEIGHED}/BS_{HEEL\ WEIGHTED}$ is greater than about 3.40 (i.e., F=3.40). In other embodiments, the ratio of $BS_{TOE}/BS_{HEEL}$ is greater than about 4.00 (i.e., F=4.00). In still other embodiments, the ratio of $BS_{TOE}/BS_{HEEL}$ is greater than about 4.40 (i.e., F=4.40).

D. Sidespin Performance Value

As discussed above, testing and analysis of the currently available iron type golf clubs confirms that those currently available golf clubs with club heads having a high COR and an asymmetric unsupported face region will have the rightward deviation (for right handed golf shots) caused by a rightward sidespin described above. As used herein, the term "high COR" refers to a relative COR of at least −0.030, such as at least −0.025 or, in some embodiments, at least −0.020. Also, as used herein, the term "asymmetric unsupported face region" refers to an unsupported face region in which $SA_{TOE}>SA_{HEEL}$, as those terms are defined above in relation to FIG. 75.

The inventive club heads described herein also have high COR and an asymmetric unsupported face region. However, testing has shown that the inventive club heads do not have the rightward deviation caused by rightward sidespin of the previous club heads. For example, as discussed above, a commercial swing robot was used in conjunction with a three-dimensional optical motion analysis system, such as is available from Qualisys, Inc., to compare the inventive club heads with a previous high COR club head having an asymmetric unsupported face region. The motion analysis system was electronically connected to a processor, which was used to collect club head and ball launch parameters as the golf clubs were swung by the robot to launch golf balls. The commercial golf club tested was a TaylorMade Burner® 2.0 4 iron, which was compared to the "Example 1" 4 iron embodiment of the inventive golf club heads described above. The swing robot was set up to provide a swing path of 0 degrees and a face angle of 0 degrees. The following ball launch parameters were observed and recorded for TaylorMade TP Red™ golf balls struck by the club heads at their ideal striking locations:

TABLE 30

| | Burner ® 2.0 | Ex. 1 |
|---|---|---|
| Ball Speed (mph) | 136.40 (±0.55) | 137.00 (±0.00) |
| Launch angle (deg) | 18.12 (±0.08) | 17.60 (±0.08) |
| Back spin (rpm) | 4293.20 (±54.78) | 4517.00 (±54.78) |
| Side spin (rpm) | 173.60 (±133.48) | −176.80 (±133.48) |

As the results above show, the inventive golf club head (which has a localized stiffened region that is shifted toe-ward and top line-ward relative to the ICT Region of the Burner® 2.0 club head) produced about 350.4 rpm of increased leftward-tending sidespin relative to the Burner® 2.0 golf club head.

Moreover, the inventive club head produced a Sidespin Performance Value that is less than 0. As used herein, the term "Sidespin Performance Value" for a given iron type golf club head refers to the sidespin of a golf ball struck by the subject club head using a conventional swing robot as measured using a conventional three-dimensional motion analysis system under the following set of "Specified Set Up and Launch Conditions":

Swing Path: 0 degrees

Face Angle: 0 degrees

Head Speed (mph): 112−0.56×(Loft)

Launch Angle: Less than static loft of club head

Ball Speed (mph): 178.8−1.27×(Loft)>Ball Speed>142.8−1.27×(Loft)

Backspin (rpm): 283.33×(Loft)+400>Backspin>200×(Loft)−2100

The Specified Set Up and Launch Conditions include Ball Speed and Backspin launch conditions that are expressed as a function of the static loft ("Loft") of the club head being tested (in degrees), thereby providing the ability to test club heads having a wide range of static lofts. The golf ball used to determine the Sidespin Performance Value of a subject club head is one that is included in the USGA list of Conforming Golf Balls.

E. Localized Stiffened Region

Several embodiments of the inventive golf club heads described herein include a localized stiffened region that is located on and that forms a portion of the striking face at a location that surrounds or that is adjacent to the ideal striking location. The localized stiffened region comprises an area of the striking face that has increased stiffness due to being relatively thicker than a surrounding region, due to being constructed of a material having a higher Young's Modulus (E) value than a surrounding region, and/or a combination of these factors.

In addition to the location of the localized stiffened region on the striking face of the club head, the localized stiffened regions of the inventive golf club heads can be described by reference to the mean bending stiffness of the localized stiffened region relative to the mean bending stiffness of the unsupported region face region of the club head. For example, the mean point-wise cross-sectional bending stiffness of a given localized stiffened region may be calculated according to the following equation:

$$\text{Mean Bending Stiffness} = \left[\left(\sum_{n=1}^{N} E_n t_n^3\right) + N\right]$$

where $E_n$ and $t_n$ are the effective Young's Modulus and effective thickness, respectively, of an $n^{th}$ cross-sectional subdivision of the localized stiffened region, and where the localized stiffened region is subdivided into a mesh of 1 mm×1 mm cross-sections to apply the foregoing equation. Accordingly, for the inventive club heads described herein, the following inequality will apply:

$$\left[\left(\sum_{n=1}^{N} E_n t_n^3\right) + N\right] + \left[\left(\sum_{m=1}^{M} E_m t_m^3\right) + M\right] > G$$

where $E_n$ and $t_n$ are the effective Young's Modulus value and the thickness, respectively, for the $n^{th}$ cross-section of the localized stiffened region of the striking face, $E_m$ and $t_m$ are the effective Young's Modulus value and the thickness, respectively, for the $m^{th}$ cross-section of the unsupported region of the striking face, N and M have values determined by discretizing $SA_{LSR}$ and $SA_{UR}$, respectively, into 1 mm×1 mm sections where $SA_{LSR}$ is the surface area of the localized stiffened region and $SA_{UR}$ is the surface area of the unsupported region, and G is a constant having a value of at least 1.6, such as 1.75, 2.0, 2.2, 2.5, or 3.0.

In several embodiments of the inventive golf club heads described herein, the localized stiffened region is an inverted cone technology region having a symmetrical "donut" shaped area of increased thickness that has a center located toe-ward of the ideal striking location. In some of these embodiments, the inverted cone region includes an outer span having a diameter of between about 15 mm and about 25 mm, or at least about 20 mm. In some embodiments, the inner span has a diameter of between about 5 mm and about 15 mm, or at least about 10 mm. Several such embodiments are described in Table 23 above.

In several other embodiments of the inventive golf club head described herein, the localized stiffened region has a shape and size other than those described above for the inverted cone regions. The shape may be geometric (e.g., triangular, square, trapezoidal, etc.) or irregular. For these embodiments, a center of gravity of the localized stiffened region ($CG_{LSR}$) may be determined, with the $CG_{LSR}$ being located toe-ward of the ideal striking location.

Optimized Face Thickness

Figure 79:
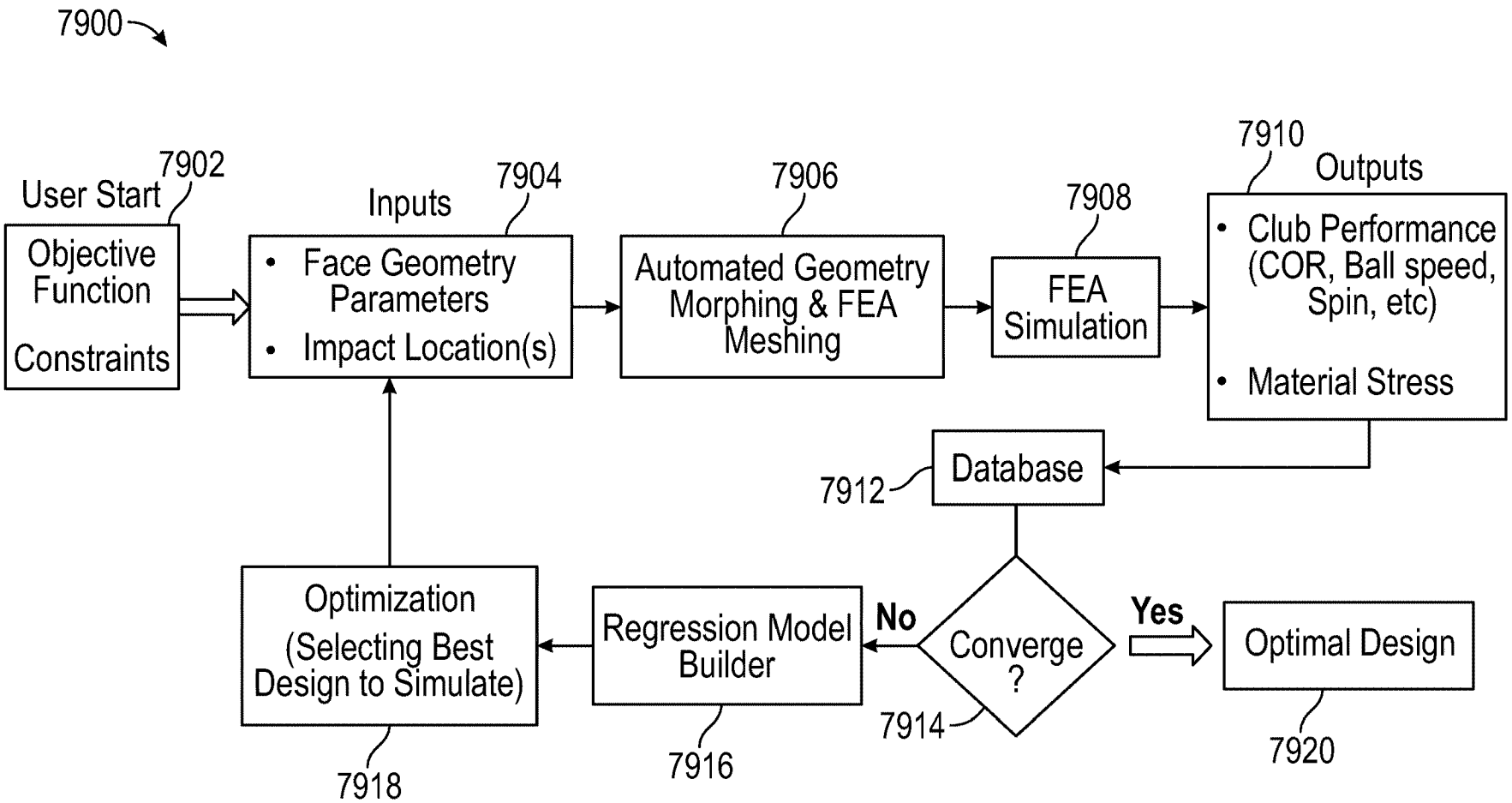
FIG. 79 is a flow chart illustrating an exemplary process for designing a golf club face.
Figure 80:
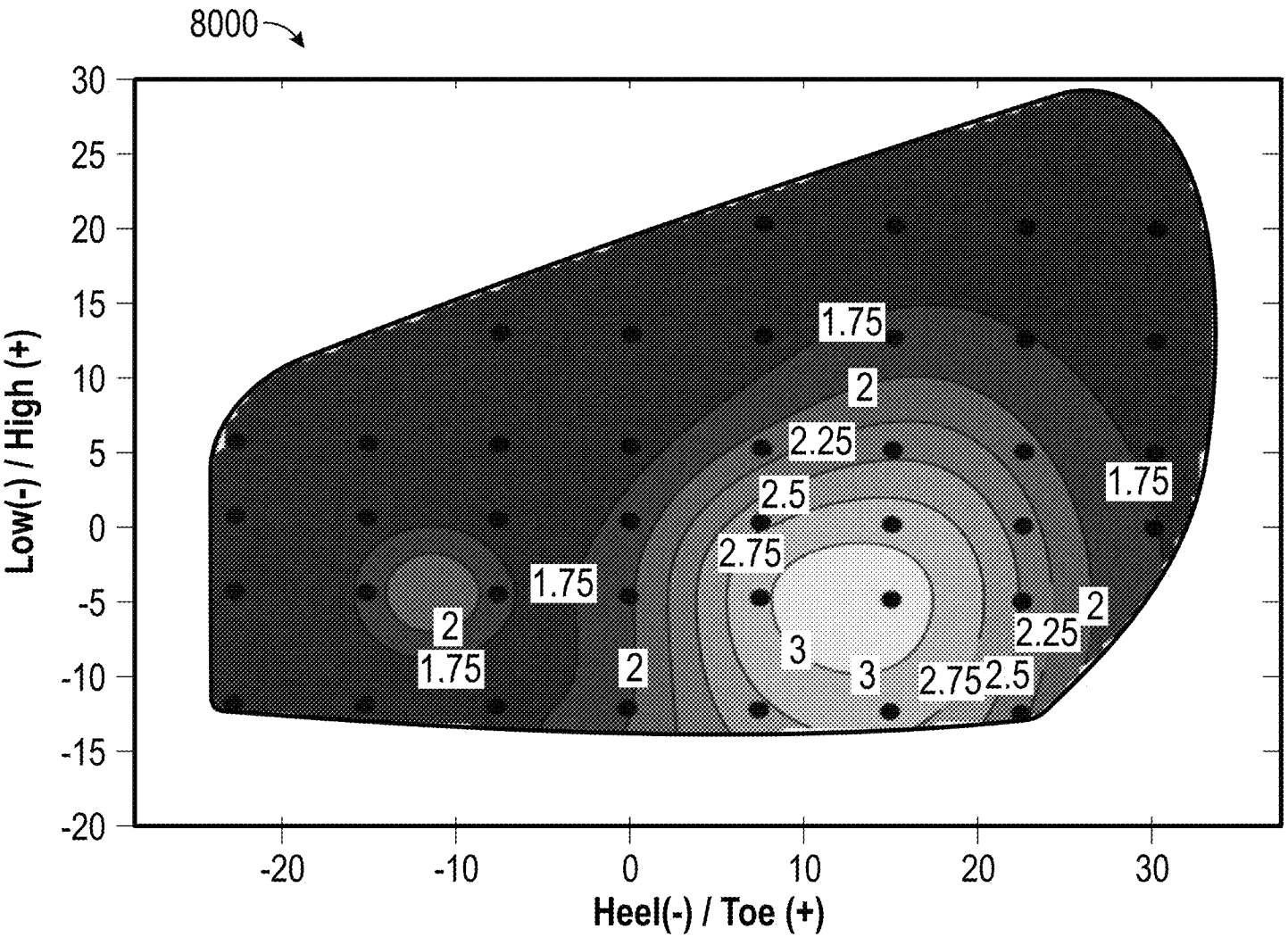
FIG. 80 is a thickness profile for an exemplary golf club face.
Figure 81:
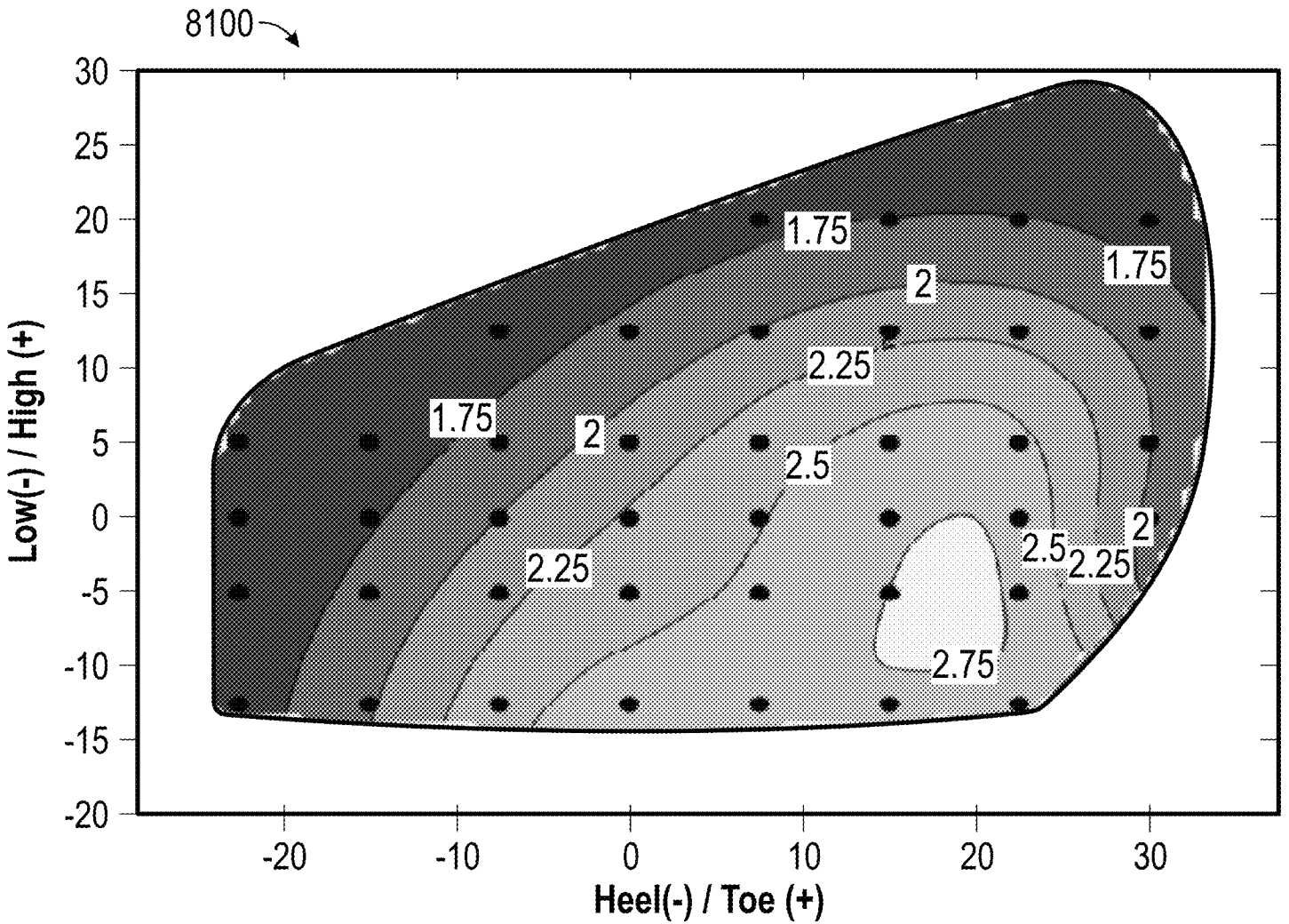
FIG. 81 is a thickness profile for another exemplary golf club face.
Figure 82:
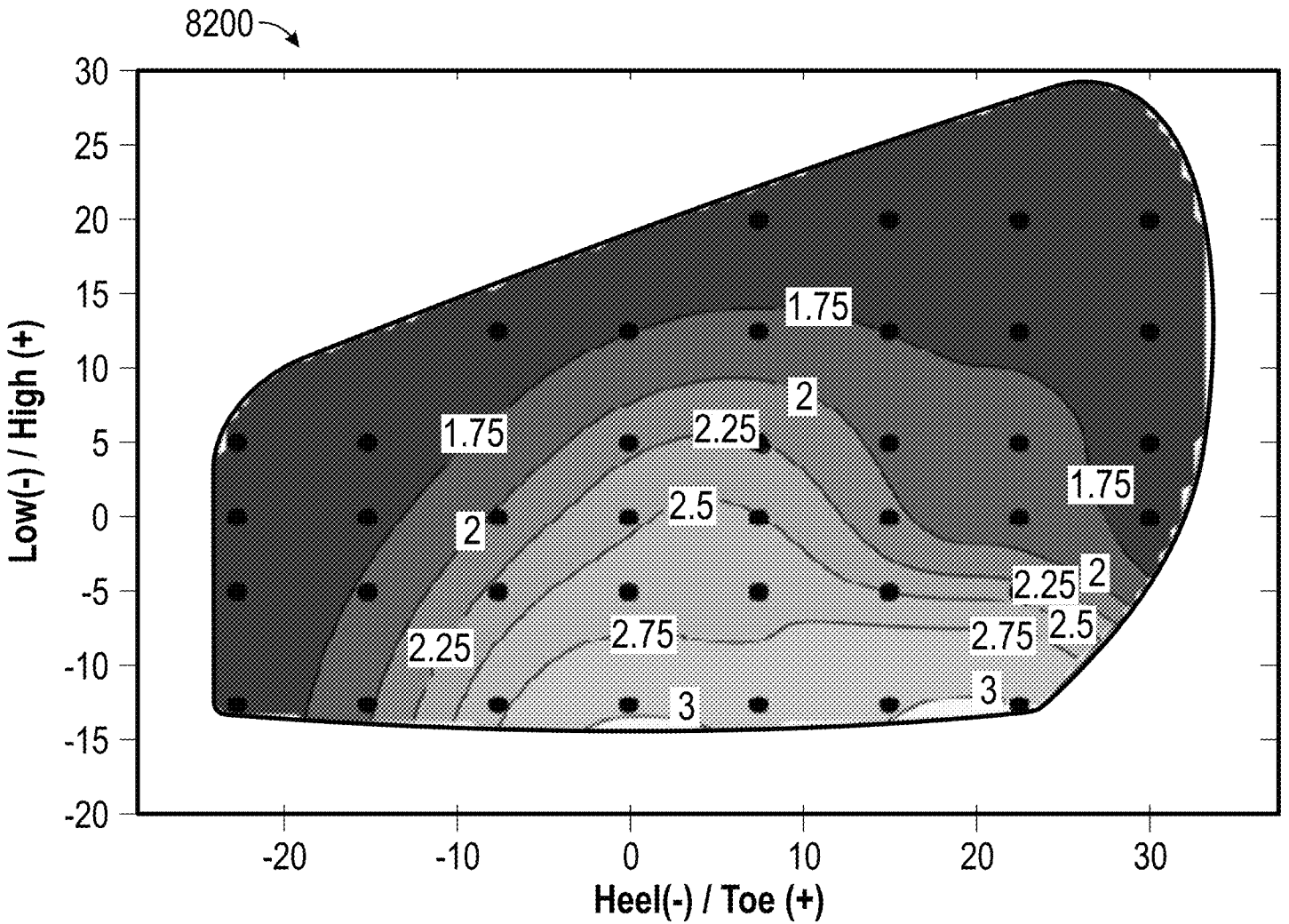
FIG. 82 is a thickness profile for yet another exemplary golf club face.
Figure 83:
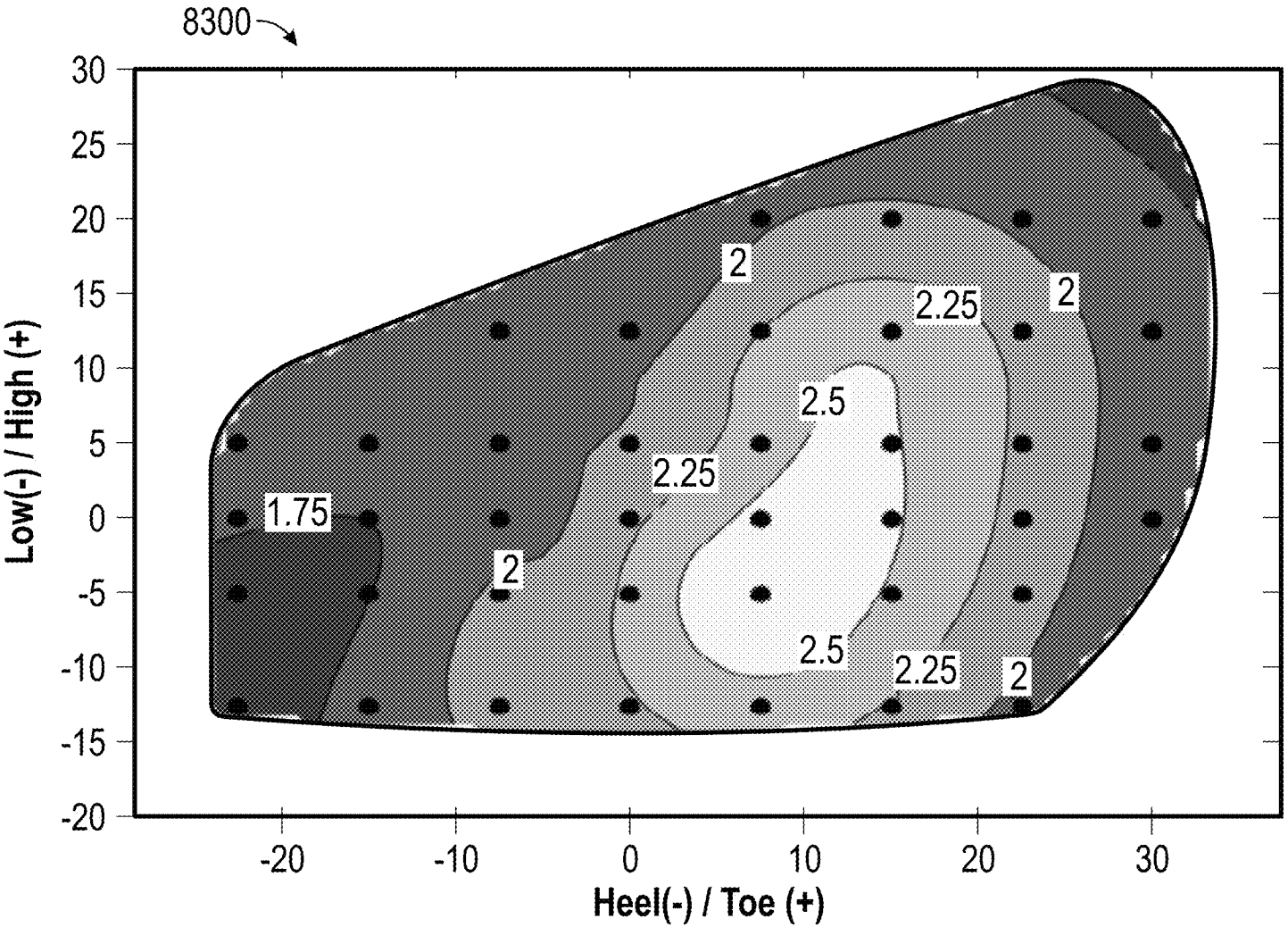
FIG. 83 is a thickness profile for still another exemplary golf club face.

FIG. 79 illustrates an exemplary process 7900 for generating an optimized golf club face geometry. The process 7900 can be implemented in a software algorithm, for example, such as an algorithm executed by a computer. Such face optimization processes can utilize finite element analysis simulations 7908 to model club head performance and stresses 7910, which can then be saved into a database 7912. The process can then build regression models based on the data in the database in which to predict performance of potential new designs. The inputs 7904 that it is able to intelligently control can include a series of parameters that define a mathematical function to generate a surface profile for the geometry of the face. The parameters are a set of values which represent properties such as thicknesses, radii, center point location, and/or other properties of the geometry.

The process can then recreate the finite element mesh of the geometry 7906 represented by the set of parameters (inputs) 7904 selected by the tool. This specific design can then be run through a full finite element simulation 7908 and can output performance properties of the club 7910, such as COR, material stresses, ball speed, backspin, launch angle, side spin, deviation angle, peak height, carry distance, left/right deviation at carry, landing angle, rollout, and/or other properties.

The process can execute these input/output simulations at any number of impact locations on the face, pre-defined by the user as locations to study for the optimization. These impact locations can effectively become additional inputs for the modeling.

With this data, the process cane then build new regression models 7916 for each of the inputs, which is a prediction that maps each input and outputs. For example, the models may estimate that increasing the center point thickness will reduce stress by 'x' amount and reduce COR by 'y' amount, and so on for each of the outputs. With these models in place, the optimization step 7918 determines the optimal values for the inputs (defining the face geometry) that will produce the best value for the objective function while staying within the acceptable range for the constraints defined. The objective function and constraints 7902 can be defined by the user and drive the optimization solution. For example, the objective function can be: Maximize COR at impact location (0,0), and the constraints would be, maximum allowable stress of 2000 MPa, maximum deviation of 1 yard right (anything left of this would be acceptable), minimum launch angle of 15°. The objective function is the primary driver of the entire optimization and the algorithm will maximize the objective function while keeping within the constraint ranges.

The primary goal of the entire optimization process begins with the objective function. This single objective can be what drives the "Optimization" step 7918 in the flowchart 7900. It can also be what is evaluated when checking for convergence at 7914. Examples of the objective function can include: maximize COR at center face, maximize weighted COR, maximize launch angle, and/or minimize sidespin (negative spin is draw spin, so this could be for a draw design).

Typically the resultant optimal design 7920 can achieve excellent results for this objective function, but the design may need more context in order to achieve a realistic design. It can be important to then include a set of constraints to complete the optimization problem set up. Typically there are multiple constraints, which are more specific and rigid requirements of the outputs. Examples of constraints can include: maximum allowable stress, minimum launch angle, limits on side spin to control deviation, limits on carry deviation, and/or minimum COR target.

The algorithm can then iterate the design parameters to maximize the objective function value while not violating any of the constraints.

FIGS. 80-83 illustrate face thickness profiles 8000, 8100, 8200, and 8300 for four exemplary optimized faces produced using the process 7900, each using different objective functions and/or constraints. The face thickness profiles 8000, 8100, 8200, and 8300 include contour lines that represent constant face thicknesses, similar to a topographical map. Each contour line is marked with a thickness value in millimeters. The contour lines are in 0.25 mm thickness increments. Areas of the face that are between adjacent contour lines have face thicknesses that are between the thickness values of the two adjacent contour lines. For example, a region of a face that is between the 2.25 contour line and the 2.5 contour line has a thickness that is from 2.25 mm to 2.5 mm. Areas of the face that are adjacent only one contour line have face thicknesses that are within 0.25 mm of the thickness values of the adjacent contour line. For example, in the profile 8000 the area outside the 1.75 contour lines has a thickness that is from 1.5 mm to 1.75 mm, the area within the 2 contour line on the heel side has a thickness that is from 2 mm to 2.25 mm, and the area within the 3 contour line has a thickness that is from 3 mm to 3.25 mm.

For the illustrated face thickness profiles, the front/external side of the face (e.g., the ball striking surface) has a planar surface or nearly planar surface (ignoring score lines) while the rear/internal side of the face has a contoured surface that provides the face with the illustrated variable thickness profiles. The face thickness profiles disclosed herein ignore thickness variations caused by score lines on the ball striking surface (thickness values provided are measured to the plane of the adjacent striking surface if a score line is present at the measurement location), though the optimization algorithm may take into account the real geometry of the club head including the scorelines. The ball striking surface may be non-planar in some embodiments, such as in embodiments having bulge and roll curvatures and/or embodiments having a twisted face (see U.S. Pat. No. 10,960,277, which is incorporated by reference herein).

In FIGS. 80-83, the toe is to the right, the heel is to the left, the sole is to the bottom, and the topline is to the top. The plane of the illustration is parallel with the plane of the striking surface of the face. The outer perimeters shown for the face thickness profiles are arbitrarily selected for illustrative purposes. These perimeters were selected for defining an area to generate the contour profiles that are shown in the figures, and are not the actual boundaries of the face. In the actual club heads, the face and the variable face thickness profiles may extend beyond the illustrated boundaries and/or end within the illustrated boundaries. Thickness values can be generated for areas of the face that extend beyond the arbitrary boundaries shown in the figures, and thickness values can be generated for areas of the club head outside the perimeter of the face as well.

In FIGS. 80-83, the horizontal axis represents a horizontal heel-to-toe face axis that is parallel to the ground plane (when the club head is in a normal address position) and is in the plane of the striking surface of the face (also referred to herein as the face plane or FP), and the vertical axis represents a low-to-high face axis that is perpendicular to the heel-to-toe face axis and also in the plane of the striking surface of the face. Note that the face axes are different from the regular x, y, and z coordinate system of the club head, which can have a different origin and in which positive x values are toward the heel, negative x values are toward the toe, and the z axis is not necessarily in the plane of the striking surface of the face.

The heel-to-toe face axis and low-to-high face axis values for FIGS. 80-83 are in millimeters. In FIGS. 80-83, the point where the heel-to-toe face axis and the low-to-high face axis are at (0, 0) is the "center point" of the striking surface of the face. The low-to-high location of the center point of the striking surface of the face is defined as being located 20 mm vertically from the ground plane when the club head is resting on the ground plane with a loft angle of 0 degrees and the score lines being parallel to the ground plane (the position shown in FIGS. 48 and 49). The heel-to-toe location of the center point is defined as being midway between the maximum horizontal ends of the scorelines. With reference to FIG. 49, the maximum horizontal extents of the scorelines are marked as SLt and SLh, and the line SLmid is midway therebetween. In FIG. 49, the horizontal line ML is 20 mm above the ground plane, and thus the center point is at the intersection of the lines SLmid and ML.

Still with reference to FIG. 49, four quadrants of the face are defined by the lines SLmid and ML, with the center point being where the four quadrants meet. A low-toe quadrant (LTQ) of the face is below ML and toeward of SLmid. A high-toe quadrant (HTQ) of the face is above ML and toeward of SLmid. A low-heel quadrant (LHQ) of the face is below ML and heelward of SLmid. A high-heel quadrant (HHQ) of the face is above ML and heelward of SLmid.

These four quadrants of the face are also applicable to the face thickness profiles 8000, 8100, 8200, 8300 illustrated in FIGS. 80-83. In these figures, the LTQ is the bottom-right portion of the face having positive heel-to-toe face axis values and negative low-to-high face axis values, the HTQ is the top-right portion of the face having positive heel-to-toe face axis values and positive low-to-high face axis values, the LHQ is the bottom-left portion of the face having negative heel-to-toe face axis values and negative low-to-high face axis values, and HHQ is the top-left portion of the face having negative heel-to-toe face axis values and positive low-to-high face axis values.

FIGS. 80-83 include several black dots that serve as reference points for measuring face thicknesses. The reference points are arranged in a grid having six horizontal rows and eight vertical columns, with 40 total reference points in each figure. The horizontal rows include rows at z=−12.5 mm, z=−5.0 mm, z=0 mm, z=5 mm, z=12.5 mm, and z=20 mm (where "z" refers the low-to-high face axis). The vertical columns include columns at x=−22.5, x=−15 mm, x=−7.5 mm, x=0 mm, x=7.5 mm, x=15 mm, x=22.5 mm, and x=30 mm (where "x" refers to the heel-to-toe face axis). The particular (x, z) locations of each reference point in each face thickness profile, along with the face thickness value at that point, are shown in Tables 31-34 below. In Tables 31-34, each reference point is labeled P1-P40. Table 31 corresponds to the face thickness profile 8000, Table 32 corresponds to the face thickness profile 8100, Table 33 corresponds to the face thickness profile 8200, and Table 34 corresponds to the face thickness profile 8300. In Tables 31-34, "x" is the heel-to-toe face axis value in mm, "z" is the low-to-high face axis value in mm, "t" is the face thickness at that point in mm, and "E" is Young's Modulus. In Tables 31-34, E is defined as 200,000 N/mm$^2$ (which is a rough approximation for a face comprising a steel material). The values in the column labeled "Et$^3$" are thus approximate values for the local stiffness of the face (in N-mm) at each reference point assuming the face is made of steel (though the face can of course be made of different materials in different embodiments).

TABLE 31

Face Thickness Profile 8000

| | x | z | t | Et$^3$ |
|---|---|---|---|---|
| P1 | −22.5 | −12.5 | 1.7312 | 1037700 |
| P2 | −22.5 | −5 | 1.653 | 903334 |
| P3 | −22.5 | 0 | 1.6731 | 936690 |
| P4 | −22.5 | 5 | 1.7262 | 1028735 |
| P5 | −15 | −12.5 | 1.6424 | 886067 |
| P6 | −15 | −5 | 1.8416 | 1249154 |
| P7 | −15 | 0 | 1.6586 | 912546 |
| P8 | −15 | 5 | 1.6583 | 912051 |
| P9 | −7.5 | −12.5 | 1.6652 | 923484 |
| P10 | −7.5 | −5 | 1.8639 | 1295084 |
| P11 | −7.5 | 0 | 1.655 | 906617 |
| P12 | −7.5 | 5 | 1.6493 | 897282 |
| P13 | −7.5 | 12.5 | 1.6844 | 955797 |
| P14 | 0 | −12.5 | 1.9751 | 1540981 |
| P15 | 0 | −5 | 1.9636 | 1514220 |
| P16 | 0 | 0 | 1.8473 | 1260789 |
| P17 | 0 | 5 | 1.6732 | 936858 |
| P18 | 0 | 12.5 | 1.6792 | 946972 |
| P19 | 7.5 | −12.5 | 2.6879 | 3883911 |
| P20 | 7.5 | −5 | 2.9518 | 5143879 |
| P21 | 7.5 | 0 | 2.6738 | 3823110 |
| P22 | 7.5 | 5 | 2.1171 | 1897816 |
| P23 | 7.5 | 12.5 | 1.6844 | 955797 |
| P24 | 7.5 | 20 | 1.673 | 936522 |
| P25 | 15 | −12.5 | 2.8522 | 4640555 |
| P26 | 15 | −5 | 3.1002 | 5959353 |
| P27 | 15 | 0 | 2.8977 | 4866203 |
| P28 | 15 | 5 | 2.433 | 2880423 |
| P29 | 15 | 12.5 | 1.832 | 1229720 |
| P30 | 15 | 20 | 1.6621 | 918336 |
| P31 | 22.5 | −12.5 | 2.2967 | 2422941 |
| P32 | 22.5 | −5 | 2.4773 | 3040646 |
| P33 | 22.5 | 0 | 2.3647 | 2644589 |
| P34 | 22.5 | 5 | 2.101 | 1854847 |
| P35 | 22.5 | 12.5 | 1.7624 | 1094822 |
| P36 | 22.5 | 20 | 1.6618 | 917838 |
| P37 | 30 | 0 | 1.7563 | 1083493 |
| P38 | 30 | 5 | 1.7178 | 1013790 |
| P39 | 30 | 12.5 | 1.6707 | 932664 |
| P40 | 30 | 20 | 1.6548 | 906289 |

TABLE 32

Face Thickness Profile 8100

| | x | z | t | Et$^3$ |
|---|---|---|---|---|
| P1 | −22.5 | −12.5 | 1.6582 | 911886 |
| P2 | −22.5 | −5 | 1.6096 | 834034 |
| P3 | −22.5 | 0 | 1.5768 | 784079 |
| P4 | −22.5 | 5 | 1.5507 | 745785 |
| P5 | −15 | −12.5 | 1.9742 | 1538875 |
| P6 | −15 | −5 | 1.8281 | 1221884 |
| P7 | −15 | 0 | 1.7251 | 1026769 |
| P8 | −15 | 5 | 1.6409 | 883642 |
| P9 | −7.5 | −12.5 | 2.3907 | 2732784 |
| P10 | −7.5 | −5 | 2.1749 | 2057538 |
| P11 | −7.5 | 0 | 2.0044 | 1610583 |
| P12 | −7.5 | 5 | 1.8376 | 1241032 |

TABLE 32-continued

| Face Thickness Profile 8100 | | | | |
|---|---|---|---|---|
| | x | z | t | $Et^3$ |
| P13 | −7.5 | 12.5 | 1.6488 | 896466 |
| P14 | 0 | −12.5 | 2.6029 | 3526976 |
| P15 | 0 | −5 | 2.4082 | 2793236 |
| P16 | 0 | 0 | 2.2747 | 2353978 |
| P17 | 0 | 5 | 2.1057 | 1867323 |
| P18 | 0 | 12.5 | 1.8087 | 1183395 |
| P19 | 7.5 | −12.5 | 2.7081 | 3972136 |
| P20 | 7.5 | −5 | 2.5524 | 3325647 |
| P21 | 7.5 | 0 | 2.486 | 3072793 |
| P22 | 7.5 | 5 | 2.37 | 2662411 |
| P23 | 7.5 | 12.5 | 2.0172 | 1641636 |
| P24 | 7.5 | 20 | 1.6916 | 968106 |
| P25 | 15 | −12.5 | 2.7019 | 3944916 |
| P26 | 15 | −5 | 2.7518 | 4167548 |
| P27 | 15 | 0 | 2.7025 | 3947545 |
| P28 | 15 | 5 | 2.582 | 3442696 |
| P29 | 15 | 12.5 | 2.1827 | 2079755 |
| P30 | 15 | 20 | 1.7588 | 1088126 |
| P31 | 22.5 | −12.5 | 2.6541 | 3739227 |
| P32 | 22.5 | −5 | 2.6985 | 3930043 |
| P33 | 22.5 | 0 | 2.6526 | 3732891 |
| P34 | 22.5 | 5 | 2.5536 | 3330340 |
| P35 | 22.5 | 12.5 | 2.179 | 2069196 |
| P36 | 22.5 | 20 | 1.7605 | 1091285 |
| P37 | 30 | 0 | 1.9446 | 1470689 |
| P38 | 30 | 5 | 2.0127 | 1630674 |
| P39 | 30 | 12.5 | 1.8947 | 1360352 |
| P40 | 30 | 20 | 1.6664 | 925482 |

TABLE 33

| Face Thickness Profile 8200 | | | | |
|---|---|---|---|---|
| | x | z | t | $Et^3$ |
| P1 | −22.5 | −12.5 | 1.6316 | 868703 |
| P2 | −22.5 | −5 | 1.6051 | 827059 |
| P3 | −22.5 | 0 | 1.5897 | 803481 |
| P4 | −22.5 | 5 | 1.5798 | 788563 |
| P5 | −15 | −12.5 | 1.9663 | 1520475 |
| P6 | −15 | −5 | 1.7905 | 1148029 |
| P7 | −15 | 0 | 1.6892 | 963992 |
| P8 | −15 | 5 | 1.6256 | 859154 |
| P9 | −7.5 | −12.5 | 2.6963 | 3920438 |
| P10 | −7.5 | −5 | 2.3195 | 2495819 |
| P11 | −7.5 | 0 | 2.0405 | 1699182 |
| P12 | −7.5 | 5 | 1.8124 | 1190672 |
| P13 | −7.5 | 12.5 | 1.6322 | 869661 |
| P14 | 0 | −12.5 | 2.9653 | 5214779 |
| P15 | 0 | −5 | 2.639 | 3675769 |
| P16 | 0 | 0 | 2.4507 | 2943747 |
| P17 | 0 | 5 | 2.1797 | 2071191 |
| P18 | 0 | 12.5 | 1.7439 | 1060705 |
| P19 | 7.5 | −12.5 | 2.9046 | 4901048 |
| P20 | 7.5 | −5 | 2.6846 | 3869624 |
| P21 | 7.5 | 0 | 2.5081 | 3155474 |
| P22 | 7.5 | 5 | 2.2557 | 2295483 |
| P23 | 7.5 | 12.5 | 1.8182 | 1202140 |
| P24 | 7.5 | 20 | 1.6097 | 834190 |
| P25 | 15 | −12.5 | 2.97 | 5239615 |
| P26 | 15 | −5 | 2.4982 | 3118255 |
| P27 | 15 | 0 | 2.0734 | 1782704 |
| P28 | 15 | 5 | 1.9337 | 1446097 |
| P29 | 15 | 12.5 | 1.7461 | 1064725 |
| P30 | 15 | 20 | 1.6047 | 826440 |
| P31 | 22.5 | −12.5 | 3.0046 | 5424878 |
| P32 | 22.5 | −5 | 2.381 | 2699654 |
| P33 | 22.5 | 0 | 1.8727 | 1313514 |
| P34 | 22.5 | 5 | 1.8002 | 1166789 |
| P35 | 22.5 | 12.5 | 1.705 | 991296 |
| P36 | 22.5 | 20 | 1.5999 | 819046 |
| P37 | 30 | 0 | 1.6756 | 940895 |
| P38 | 30 | 5 | 1.6848 | 956478 |

TABLE 33-continued

| Face Thickness Profile 8200 | | | | |
|---|---|---|---|---|
| | x | z | t | $Et^3$ |
| P39 | 30 | 12.5 | 1.6456 | 891257 |
| P40 | 30 | 20 | 1.5874 | 799998 |

TABLE 34

| Face Thickness Profile 8300 | | | | |
|---|---|---|---|---|
| | x | z | t | $Et^3$ |
| P1 | −22.5 | −12.5 | 1.6587 | 912712 |
| P2 | −22.5 | −5 | 1.6666 | 925815 |
| P3 | −22.5 | 0 | 1.7823 | 1132328 |
| P4 | −22.5 | 5 | 1.9474 | 1477051 |
| P5 | −15 | −12.5 | 1.8332 | 1232139 |
| P6 | −15 | −5 | 1.7442 | 1061253 |
| P7 | −15 | 0 | 1.7533 | 1077950 |
| P8 | −15 | 5 | 1.8744 | 1317094 |
| P9 | −7.5 | −12.5 | 2.0697 | 1773177 |
| P10 | −7.5 | −5 | 2.0299 | 1672838 |
| P11 | −7.5 | 0 | 1.9332 | 1444975 |
| P12 | −7.5 | 5 | 1.9068 | 1386582 |
| P13 | −7.5 | 12.5 | 1.9253 | 1427333 |
| P14 | 0 | −12.5 | 2.2147 | 2172575 |
| P15 | 0 | −5 | 2.3111 | 2468802 |
| P16 | 0 | 0 | 2.1932 | 2109914 |
| P17 | 0 | 5 | 2.0362 | 1688462 |
| P18 | 0 | 12.5 | 1.9223 | 1420671 |
| P19 | 7.5 | −12.5 | 2.4014 | 2769641 |
| P20 | 7.5 | −5 | 2.6519 | 3729936 |
| P21 | 7.5 | 0 | 2.56 | 3355443 |
| P22 | 7.5 | 5 | 2.3966 | 2753066 |
| P23 | 7.5 | 12.5 | 2.2501 | 2278429 |
| P24 | 7.5 | 20 | 1.9806 | 1553890 |
| P25 | 15 | −12.5 | 2.2248 | 2202434 |
| P26 | 15 | −5 | 2.4696 | 3012381 |
| P27 | 15 | 0 | 2.5248 | 3218926 |
| P28 | 15 | 5 | 2.5144 | 3179312 |
| P29 | 15 | 12.5 | 2.421 | 2838013 |
| P30 | 15 | 20 | 2.0561 | 1738452 |
| P31 | 22.5 | −12.5 | 1.9393 | 1458697 |
| P32 | 22.5 | −5 | 2.0993 | 1850348 |
| P33 | 22.5 | 0 | 2.1708 | 2045924 |
| P34 | 22.5 | 5 | 2.2039 | 2140946 |
| P35 | 22.5 | 12.5 | 2.1665 | 2033790 |
| P36 | 22.5 | 20 | 1.9524 | 1488457 |
| P37 | 30 | 0 | 1.8596 | 1286141 |
| P38 | 30 | 5 | 1.8797 | 1328298 |
| P39 | 30 | 12.5 | 1.8687 | 1305115 |
| P40 | 30 | 20 | 1.7886 | 1144378 |

Tables 35-39 below provide average thickness and average stiffness ($Et^3$) values for various regions of each of the face thickness profiles 8000, 8100, 8200, 8300. In Tables 35-39, "High" refers to the region of the face having positive low-to-high face axis values, which is also the combination of the two high quadrants HTQ and HHQ; "Low" refers to the region of the face having negative low-to-high face axis values, which is also the combination of the two low quadrants LTQ and LHQ; "Heel" refers to the region of the face having negative heel-to-toe face axis values, which is also the combination of the two heel quadrants HHQ and LHQ; and "Toe" refers to the region of the face having positive heel-to-toe face axis values, which is also the combination of the two toe quadrants HTQ and LTQ. "High Toe" refers to the HTQ, "Low Toe" refers to the LTQ, "High Heel" refers to the HHQ, and "Low Heel" refers to the LHQ. In Tables 35-39, the values in the "Thickness" column are the average of the thickness values for all of the reference points in the respective region. For example, in Table 35 for the face thickness profile 8000, the average thickness value of 2.728 mm for the Low Toe quadrant is the average of the thickness values for reference points P19, P20, P25, P26, P31, and P32, which are all the reference points having a positive heel-to-toe face axis value and a negative low-to-high face axis value. Similarly, in Tables 35-38 the values in the "$Et^3$" column are the average of the $Et^3$ values for all of the reference points in the respective region.

TABLE 35

Profile 8000 Region Averages

| | Thickness | $Et^3$ |
|---|---|---|
| High | 1.780 | 1178698 |
| Low | 2.193 | 2460094 |
| Heel | 1.700 | 988042 |
| Toe | 2.183 | 2411252 |
| High Toe | 1.831 | 1294905 |
| Low Toe | 2.728 | 4181881 |
| High Heel | 1.680 | 948466 |
| Low Heel | 1.733 | 1049137 |

TABLE 36

Profile 8100 Region Averages

| | Thickness | $Et^3$ |
|---|---|---|
| High | 1.959 | 1617095 |
| Low | 2.337 | 2764052 |
| Heel | 1.817 | 1268104 |
| Toe | 2.296 | 2617886 |
| High Toe | 2.056 | 1857505 |
| Low Toe | 2.678 | 3846586 |
| High Heel | 1.670 | 941731 |
| Low Heel | 1.939 | 1549500 |

TABLE 37

Profile 8200 Region Averages

| | Thickness | $Et^3$ |
|---|---|---|
| High | 1.754 | 1118549 |
| Low | 2.433 | 3208868 |
| Heel | 1.845 | 1381171 |
| Toe | 2.071 | 2079073 |
| High Toe | 1.749 | 1107828 |
| Low Toe | 2.741 | 4208846 |
| High Heel | 1.663 | 927013 |
| Low Heel | 2.002 | 1796754 |

TABLE 38

Profile 8300 Region Averages

| | Thickness | $Et^3$ |
|---|---|---|
| High | 2.061 | 1805500 |
| Low | 2.094 | 1945900 |
| Heel | 1.856 | 1295500 |
| Toe | 2.199 | 2214200 |
| High Toe | 2.123 | 1981846 |
| Low Toe | 2.298 | 2503906 |
| High Heel | 1.913 | 1402015 |
| Low Heel | 1.834 | 1262989 |

As illustrated by FIGS. 80-83 and Tables 31-38, optimized face thickness profiles generated by an optimization algorithm such as process 7900 can be thicker and stiffer, on average, in certain regions of the face compared to other regions of the face. As some embodiments, the various regions of the face (e.g., the high region, low region, heel region, toe region, HTQ, LTQ, HHQ, and LHQ) can be further defined by a perimeter boundary of the face (in addition to the ML and the SLmid lines). The perimeter boundary of the face can be defined is different ways. For example, the perimeter boundary of the face can be defined in any of the following ways:

1) the outer perimeter of the "unsupported" portion of a face that is not supported by a rigid portion of the club head behind the face (excluding dampers, foams, fillers, etc., touching the rear surface of the face);
2) the outer perimeter of the region of the face that has a thickness of less than 5 mm, less than 4.5 mm, less than 4 mm, less than 3.5 mm, less than 3.0 mm, and/or less than 2.5 mm;
3) the outer perimeter of the region of the face that has a COR value that is at least 0.790 and/or at least 0.800;
4) the outer perimeter of the region of the face that has a COR drop-off value that is greater than or equal to −0.045 and/or greater than or equal to −0.044; or
5) the outer perimeter of the face thickness profiles 8000/8100/8200/8300 shown in FIGS. 80-83.

In other embodiments, the various regions of the face can be instead defined as a collection of discrete data points (e.g., any subset of the reference points P1-P40) and not defined as a region within a perimeter boundary of the face. For any of the various regions of the face, any or all subset of the reference points within that region can be used to generate average thicknesses and/or average stiffnesses for that region. For example, for the HTQ, all or any subset of the 12 reference points P22, P23, P24, P28, P29, P30, P34, P35, P36, P38, P39, and P40 may be used to calculate an average for the region. An example subset of these points can consist of only P22, P23, P24, P28, P29, P30, P34, P35, and P36 (not including the toeward-most points at x=30 mm). Another example subset of the HTQ reference points can consist of only P22, P23, P28, P29, P34, and P35 (not including the toeward most and the highest points and x=30 or z=20).

In some embodiments, the toe region can be thicker and/or stiffer than the heel region. In some embodiments, the low region can be thicker and/or stiffer than the high region. In some embodiments, the LTQ can be thicker and/or stiffer than any or all of the HTQ, the LHQ, and the HHQ. For example, in all of the face thickness profiles 8000, 8100, 8200, 8300, the low region is, on average, thicker and stiffer than the high region, and the toe region is thicker and stiffer than the heel region. Furthermore, in the face thickness profiles 8000, 8100, 8200, 8300, the LTQ is thicker and stiffer, on average, than all of the HTQ, the LHQ, and the HHQ.

In some embodiments, a ratio of the average stiffness of the high region divided by the average stiffness of the low region is significantly less than 1, such as between 0.15 and 0.95, between 0.15 and 0.90, between 0.15 and 0.85, between 0.15 and 0.80, between 0.15 and 0.75, between 0.15 and 0.70, between 0.15 and 0.65, between 0.15 and 0.60, between 0.15 and 0.55, between 0.15 and 0.50, between 0.15 and 0.45, between 0.15 and 0.40, and/or between 0.15 and 0.35.

In some embodiments, a ratio of the average stiffness of the toe region divided by the average stiffness of the heel region is significantly less than 1, such as between 0.15 and 0.95, between 0.15 and 0.90, between 0.15 and 0.85, between 0.15 and 0.80, between 0.15 and 0.75, between 0.15 and 0.70, between 0.15 and 0.65, between 0.15 and 0.60, between 0.15 and 0.55, between 0.15 and 0.50, and/or between 0.15 and 0.45.

In some embodiments, a ratio of the average stiffness of the HTQ divided by the average stiffness of the LTQ is significantly less than 1, such as between 0.15 and 0.95, between 0.15 and 0.90, between 0.15 and 0.85, between 0.15 and 0.80, between 0.15 and 0.75, between 0.15 and 0.70, between 0.15 and 0.65, between 0.15 and 0.60, between 0.15 and 0.55, between 0.15 and 0.50, between 0.15 and 0.45, between 0.15 and 0.40, between 0.15 and 0.35, and/or between 0.15 and 0.30.

In some embodiments, a ratio of the average stiffness of the HHQ divided by the average stiffness of the LTQ is significantly less than 1, such as between 0.15 and 0.95, between 0.15 and 0.90, between 0.15 and 0.85, between 0.15 and 0.80, between 0.15 and 0.75, between 0.15 and 0.70, between 0.15 and 0.65, between 0.15 and 0.60, between 0.15 and 0.55, between 0.15 and 0.50, between 0.15 and 0.45, between 0.15 and 0.40, between 0.15 and 0.35, between 0.15 and 0.30, and/or between 0.15 and 0.25.

In some embodiments, a ratio of the average stiffness of the LHQ divided by the average stiffness of the LTQ is significantly less than 1, such as between 0.15 and 0.95, between 0.15 and 0.90, between 0.15 and 0.85, between 0.15 and 0.80, between 0.15 and 0.75, between 0.15 and 0.70, between 0.15 and 0.65, between 0.15 and 0.60, between 0.15 and 0.55, between 0.15 and 0.50, between 0.15 and 0.45, between 0.15 and 0.40, between 0.15 and 0.35, and/or between 0.15 and 0.30.

Some exemplary iron-type golf club heads can have a face thickness profile that is thicker and stiffer, on average, in certain regions of the face compared to other regions of the face, including any of the comparative ratios in the preceding several paragraphs. Such golf club heads can also have a face that has a large COR area (such as from 50 $mm^2$ to 300 $mm^2$, from 100 $mm^2$ to 300 $mm^2$, from 150 $mm^2$ to 300 $mm^2$, and/or from 200 $mm^2$-300 $mm^2$) that is defined by locations on the striking surface of the face with a COR that is at least 0.790 and/or at least 0.800. In some embodiments, the all locations on the striking surface within the COR area have a COR that is at least 0.79 and/or at least 0.800, however it is contemplated that some points in the COR area may have a lower COR, such as at or adjacent a scoreline, where a manufacturing imperfection exists, where damage to the face exits, etc. The COR area may or may not include the center point. In some embodiments, the COR area may be offset from the center point, such as toward the LTQ. In some embodiments, the COR area may exclude the center point. In some embodiments, the COR area may be entirely in one quadrant, such as the LTQ, and/or entirely in one region, such as the low region of the face. In some embodiments, the COR area can be centered on the center point. In some embodiments, the COR area can be a symmetrical area, such as a rectangle, and/or can be symmetrical about the center point or some other point on the face.

In some embodiments, a peak face thickness or maximum face thickness of the face is less than 3.50 mm, less than 3.25 mm, less than 3.10 mm, less than 3.05 mm, and/or less than 3.0 mm. The minimum face thickness can be less than 2.0 mm, less than 1.9 mm, less than 1.8 mm, less than 1.75 mm, and/or less than 1.70 mm.

In some embodiments, the region of the face having the peak face thickness can have a non-circular and/or non-symmetrical geometry (as opposed to conventional "inverted cone" or "donut" shaped thickness profiles that have a circular, symmetrical geometry). In some embodiments, the region of the face having the peak face thickness can have an asymmetric, irregular, and/or amorphous geometry, such as those shown in FIGS. 80-83.

Distances between certain points on the ball-striking surface of the face can be defined, such as between different quadrants, and differences between the thicknesses at those points can be calculated. For example, in some embodiments, a distance from a first point in the LTQ to a second point in the HHQ is calculated using the distance formula $d=\text{sqrt}((X_2-X_1)^2+(Y_2-Y_1)^2))$. For example, a distance between P26 (15, −5) in the LTQ to P8 (−15, 5) in the HHQ is $d=\text{sqrt}(((-15-15)^2+(5--5)^2)=\text{sqrt}((30)^2+(10)^2)=\text{sqrt}(1000)=31.62$ mm, and an absolute value of the thickness difference is $\Delta t=\text{abs}(1.6583-3.1002)=1.4419$ mm. For a club head having a Zup value between 10 mm to 20 mm, for example, the distance between the first point and the second point can be greater than 1.3*Zup, greater than 1.5*Zup, greater than 1.75*Zp, greater than 2*Zup, and/or greater than 2.25*Zup, and the thickness difference Δt can be between 0.75 mm and 2.3 mm (e.g., at least 0.75 mm, 0.85 mm, 0.95 mm, 1.05 mm, 1.15 mm, 1.25 mm, 1.35 mm, and/or 1.45 mm). This is just one of many examples and several other examples exist using the data provided in the above tables.

In some embodiments, the club head has a balance point on the face and the balance point is off-center from the center point. The balance point can be located toeward of the center point, such as between 0.25 mm and 3 mm toeward of the center point, or at least 0.5 mm toeward of the center point. The balance point can also be lower on the face than the center point, such as between 0.25 mm and 3 mm below the center point, or at least 0.5 mm below the center point.

Golf club heads that include optimized face thickness profiles generated by optimization processes such as the process 7900 can provide significant performance advantages compared to convention face thickness profiles, such as those that are symmetrical about the center point. For example, such optimized face thickness profiles can increase the launch angle of struck balls, increase backspin, reduce left-right flight deviation angle, increase distance, maximizing a COR area having a minimum COR value, and/or improve other performance parameters compared to conventional face thickness profiles, all while keeping within a set of constraint boundaries, such as stress limitations for durability. The face thickness profiles 8000 and 8200 of FIGS. 80 and 82, for example, can produce a maximized launch angle while keeping stresses below a set limit and having a weighted COR at least as high as current high performance irons. The face thickness profile 8100 of FIG. 81, for example, can produce a minimized right sidespin or maximized left sidespin for reducing rightward fade and increasing leftward draw (assuming a right-handed golf club), while keeping stresses below a set limit, and having a weighted COR and launch angle at least as high as current high performance irons. The face thickness profile 8300 of FIG. 83, as another example, can produce a maximized COR value within a large COR area at the center of the face, while keeping stresses below a set limit, keeping right sidespin less than 0 (negative is left sidespin), and keeping launch angle at least as high as current high performance irons. In another example (not illustrated), the optimized face thickness profile can seek maximize COR values over a large COR area, while keeping stresses below a set limit, generating side spin less than 0 (negative is draw spin) for center point impacts, and keeping left-right ball flight deviation within +/−2 yards from the centerline for all other off-center impact locations. A common feature of optimized face thickness profiles that seek to produce high launch angle and/or draw sidespin is a LTQ that is considerably stiffer on average than other quadrants of the face.

Optimized face thickness profiles described herein and others producible by optimization processes such as process 7900 and the like can be implemented in any loft angle (e.g., any loft angle from a 0 degree loft angle club to a 90 degree loft angle club) and in any type of iron-type club head, such as blade irons, muscle-back irons, cavity-back irons, irons having a hollow interior cavity, irons having slots in the sole, toe, face, or elsewhere, irons having a foam or filler behind the face, irons having a damper behind the face, irons having a weighted damper behind the face (see U.S. patent application Ser. No. 17/558,387 filed Dec. 21, 2021, which is incorporated by reference herein), irons having a rear badge or cap-back, irons having one or more perimeter weights, etc. Optimized face thickness profiles described herein and others producible by optimization processes such as process 7900 and the like can also be implemented in wedges, rescues, hybrids, fairway woods, drivers, putters, and other types of golf clubs. For a particular style of golf clubs, the optimized face thickness profile can vary gradually from one loft angle to the next, such as from a 4 iron to a 5 iron to a 6 iron to a 7 iron, etc, all while maintaining similar overall characteristics, such as a relatively stiffer LTQ, etc.

The disclosure contains a delicate interplay of relationships of the various components, variables within each component as well, as relationships across the components, which impact the performance, sound, feel, durability, and manufacturability of the golf club head. The disclosed relationships are more than mere optimization, maximization, or minimization of a single characteristic or variable, and are often contrary to conventional design thinking, yet have been found to achieve a unique balance of the trade-offs associated with competing criteria such as durability, acoustics, vibration, fatigue resistance, weight, and ease of manufacture. The relationships disclosed do more than maximize or minimize a single characteristic such as characteristic time (CT), coefficient of restitution (COR) at a single point such as face center or offset/distributed COR, moments of inertia, deflection of a single component, frequency of a single components, damping, and/or changes in mode frequencies of the individual components, rather, the relationships achieve a unique balance among these characteristics, which are often conflicting, to produce a club head that has improved feel, sound, and/or performance. After all, the interaction of the numerous components of the present golf club head, particularly when they have such varied material properties, has the potential to adversely impact the sound and feel of the golf club head, as well as its durability, manufacturability, and overall performance. The aforementioned balance requires trade-offs among the competing characteristics recognizing key points of diminishing returns. Further, it is important to recognize that all the associated disclosure and relationships apply equally to all embodiments and should not be interpreted as being limited to the particular embodiment being discussed when a relationship is mentioned. The aforementioned balances require trade-offs among the competing characteristics recognizing key points of diminishing returns, as often disclosed with respect to open and closed ranges for particular variables and relationships. Proper functioning of each component, and the overall club head, on each and every shot, over thousands of impacts during the life of a golf club, is critical. Therefore, this disclosure contains unique combinations of components and relationships that achieve these goals. While the relationships of the various features and dimensions of a single component play an essential role in achieving the goals, the relationships of features and/or characteristics across multiple components are just as critical, if not more critical, to achieving the goals. Further, the relative length, width, thickness, geometry, and material properties of various components, and their relationships to one another and the other design variables disclosed herein, influence the performance, durability, feel, sound, safety, and ease of manufacture.

The above-described embodiments are just examples of possible implementations of the disclosed technologies, and are set forth for a clear understanding of the principles of the present disclosure. Any process descriptions or blocks in flow diagrams should be understood as representing modules, segments, or portions of processes for implementing specific functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure.

Many variations and modifications may be made to the above-described embodiment(s) without departing substantially from the spirit and principles of the present disclosure. Further, the scope of the present disclosure includes any and all combinations and sub-combinations of all elements, features, and aspects disclosed herein and in the documents that are incorporated by reference. All such combinations, modifications, and variations are included herein within the scope of the present disclosure, and all possible claims to individual aspects or combinations of elements or steps are intended to be supported by the present disclosure.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. An iron-type golf club head comprising:

a hosel portion, a toe portion, a topline portion, a sole portion, a rear portion, and a front portion;

wherein the front portion comprises a face portion configured to strike a golf ball;

wherein the face portion comprises horizontal scorelines;

wherein a ball-striking surface of the face portion has a center point that is located horizontally midway between maximum horizontal extents of the scorelines and the center point is located vertically 20 mm above an imaginary ground plane when the sole portion of the club head is resting on the imaginary ground plane and the club head is oriented with the scorelines parallel to the imaginary ground plane and with a plane of the ball-striking surface perpendicular to the imaginary ground plane;

wherein the face portion has a COR area, wherein the COR area is an area of the face portion that is from 50 $mm^2$ to 300 $mm^2$, where locations on the ball-striking surface have a COR of at least 0.790;

wherein a ratio of an average $Et^3$ for a high-toe quadrant (HTQ) of the face portion divided by an average $Et^3$ for a low-toe quadrant (LTQ) of the face portion is between 0.15 and 0.75;

wherein the face portion has a maximum thickness of no more than 3.25 mm; and wherein the club head has a balance point on the face portion and the balance point is off-center from the center point, wherein the balance point is below the center point from 0.25 mm to 3 mm.

2. The club head of claim 1, wherein the ratio of the average $Et^3$ for the HTQ of the face portion divided by the average $Et^3$ for the LTQ of the face portion is between 0.15 and 0.45.

3. The club head of claim 1, wherein a ratio of an average $Et^3$ for a high region of the face portion divided by an average $Et^3$ for a low region of the face portion is between 0.15 and 0.75, and wherein:

the high region comprises the HTQ of the face portion combined with a high-heel quadrant (HHQ) of the face portion, and the low region comprises the LTQ of the face portion combined with a low-heel quadrant (LHQ) of the face portion.

4. The club head of claim 3, wherein the ratio of the average $Et^3$ for the high region of the face portion divided by the average $Et^3$ for the low region of the face portion is between 0.15 and 0.45.

5. The club head of claim 1, wherein a ratio of the average $Et^3$ for a low-heel quadrant (LHQ) of the face portion divided by the average $Et^3$ for the LTQ of the face portion is between 0.15 and 0.75.

6. The club head of claim 5, wherein the ratio of the average $Et^3$ for the LHQ of the face portion divided by the average $Et^3$ for the LTQ of the face portion is between 0.15 and 0.45.

7. The club head of claim 1, wherein a ratio of the average $Et^3$ for a high-heel quadrant (HHQ) of the face portion divided by the average $Et^3$ for the LTQ of the face portion is between 0.15 and 0.75.

8. The club head of claim 7, wherein the ratio of the average $Et^3$ for the HHQ of the face portion divided by the average $Et^3$ for the LTQ of the face portion is between 0.15 and 0.45.

9. An iron-type golf club head comprising:

a hosel portion, a toe portion, a topline portion, a sole portion, a rear portion, and a front portion;

wherein the front portion comprises a face portion configured to strike a golf ball;

wherein the face portion comprises horizontal scorelines;

wherein a ball-striking surface of the face portion has a center point that is located horizontally midway between maximum horizontal extents of the scorelines and the center point is located vertically 20 mm above an imaginary ground plane when the sole portion of the club head is resting on the imaginary ground plane and the club head is oriented with the scorelines parallel to the imaginary ground plane and with a plane of the ball-striking surface perpendicular to the imaginary ground plane;

wherein the club head has a Zup between 10 mm to 20 mm; and wherein an absolute value of a thickness difference between a first point located in a low-toe quadrant (LTQ) of the face portion and a second point located in a high-heel quadrant (HHQ) is between 0.65 mm and 2.3 mm, and a distance between the first point and the second point is at least 1.5*Zup.

10. The club head of claim 9, wherein the absolute value of the thickness difference between the first point and the second point between 1.25 mm and 2.3 mm.

11. The club head of claim 9, wherein the distance between the first point and the second point is at least 2*Zup.

12. The club head of claim 9, wherein the face portion has a COR area, wherein the COR area is an area of the face portion that is from 50 $mm^2$ to 300 $mm^2$, where locations on the ball-striking surface have a COR of at least 0.790; and wherein the COR area includes the center point.

13. The club head of claim 9, wherein a ratio of an average $Et^3$ for the HHQ of the face portion divided by an average $Et^3$ for the LTQ of the face portion is between 0.15 and 0.75.

14. The club head of claim 9, wherein a ratio of an average $Et^3$ for the HHQ of the face portion divided by an average $Et^3$ for the LTQ of the face portion is between 0.15 and 0.45.

15. An iron-type golf club head comprising:

a hosel portion, a toe portion, a topline portion, a sole portion, a rear portion, and a front portion;

wherein the front portion comprises a face portion configured to strike a golf ball;

wherein the face portion comprises horizontal scorelines;

wherein a ball-striking surface of the face portion has a center point that is located horizontally midway between maximum horizontal extents of the scorelines and the center point is located vertically 20 mm above an imaginary ground plane when the sole portion of the club head is resting on the imaginary ground plane and the club head is oriented with the scorelines parallel to the imaginary ground plane and with a plane of the ball-striking surface perpendicular to the imaginary ground plane;

wherein the face portion has a COR area, wherein the COR area is an area of the face portion that is from 50 $mm^2$ to 300 $mm^2$, where locations on the ball-striking surface have a COR of at least 0.790;

wherein a ratio of average $Et^3$ for a high region of the face portion divided by an average $Et^3$ for a low region of the face portion is between 0.15 and 0.75, where the high region comprises a high-toe quadrant (HTQ) of the face portion combined with a high-heel quadrant (HHQ) of the face portion, and the low region comprises a low-toe quadrant (LTQ) of the face portion combined with a low-heel quadrant (LHQ) of the face portion;

wherein an absolute value of a thickness difference between a first point located in the LTQ of the face portion and a second point located in the HHQ is between 0.65 mm and 2.3 mm, and a distance between the first point and the second point is at least 1.5*Zup; and wherein the face portion has a maximum thickness of no more than 3.5 mm.

16. The club head of claim 15, wherein the club head has a balance point on the face portion and the balance point is off-center from the center point;

wherein the balance point is toeward of the center point from 0.25 mm to 3 mm; and wherein the face portion has a maximum thickness of no more than 3.25 mm.

17. The club head of claim 15, wherein the club head has a balance point on the face portion and the balance point is off-center from the center point;

wherein the balance point is below the center point from 0.25 mm to 3 mm; and wherein the face portion has a maximum thickness of no more than 3.25 mm.

18. The club head of claim 15, wherein the absolute value of the thickness difference between the first point and the second point between 1.25 mm and 2.3 mm.

19. The club head of claim 15, wherein the distance between the first point and the second point is at least 2*Zup.

20. The club head of claim 15, wherein a ratio of an average $Et^3$ for the HTQ of the face portion divided by an average $Et^3$ for the LTQ of the face portion is between 0.15 and 0.45.

21. The club head of claim 15, wherein the ratio of the average $Et^3$ for the high region of the face portion divided by the average $Et^3$ for the low region of the face portion is between 0.15 and 0.45.

22. The club head of claim 15, wherein a ratio of an average $Et^3$ for the LHQ of the face portion divided by an average $Et^3$ for the LTQ of the face portion is between 0.15 and 0.75.

23. The club head of claim 15, wherein a ratio of an average $Et^3$ for the LHQ of the face portion divided by an average $Et^3$ for the LTQ of the face portion is between 0.15 and 0.45.

24. The club head of claim 15, wherein a ratio of an average $Et^3$ for the HHQ of the face portion divided by an average $Et^3$ for the LTQ of the face portion is between 0.15 and 0.75.

25. The club head of claim 15, wherein a ratio of an average $Et^3$ for the HHQ of the face portion divided by an average $Et^3$ for the LTQ of the face portion is between 0.15 and 0.45.

* * * * *